US006381442B1

(12) United States Patent
Okitsu et al.

(10) Patent No.: US 6,381,442 B1
(45) Date of Patent: Apr. 30, 2002

(54) IMAGE FORMING APPARATUS WITH PAPER POST-TREATMENT DEVICE

(75) Inventors: Motoaki Okitsu, Nara; Atsushi Saito, Yamatokoriyama; Yasushi Matsutomo, Nara; Shinichiro Hiraoka, Yamatotakada; Tadaaki Kawano, Nara; Kimihide Tsukamoto, Osaka; Susumu Murakami, Kyoto; Takashi Makiura, Nara; Haruyoshi Migita, Yamatokoriyama; Yoshiaki Ibuchi, Nara; Tomohiko Okada, Kyoto; Akira Kohno, Nara; Hideshi Izumi, Ikoma; Minoru Tomiyori, Nara; Kunihiko Sakaguchi, Nara; Kouji Aoki, Nara; Takateru Yamamoto, Uji, all of (JP)

(73) Assignee: Sharp Kabushiki Kaisa, Osaka (JP)

( * ) Notice: Subject to any disclaimer, the term of this patent is extended or adjusted under 35 U.S.C. 154(b) by 0 days.

(21) Appl. No.: 09/695,666

(22) Filed: Oct. 24, 2000

(30) Foreign Application Priority Data

| | | |
|---|---|---|
| Jan. 31, 2000 | (JP) | 12-022998 |
| Jan. 31, 2000 | (JP) | 12-023004 |
| Oct. 2, 2000 | (JP) | 12-302970 |

(51) Int. Cl.[7] ..... G03G 15/00

(52) U.S. Cl. ..... 399/405; 270/58.08; 399/107; 399/407

(58) Field of Search ..... 399/405, 407, 399/410, 401, 107, 110, 124, 21; 270/58.07, 58.08

(56) References Cited

U.S. PATENT DOCUMENTS

| | | | | |
|---|---|---|---|---|
| 5,021,837 A | | 6/1991 | Uto et al. | 399/405 |
| 5,398,918 A | * | 3/1995 | Rizzolo et al. | 270/58.08 |
| 5,926,684 A | * | 7/1999 | Horiuchi et al. | 399/407 X |
| 6,112,047 A | * | 8/2000 | Kato et al. | 399/405 X |
| 6,233,427 B1 | * | 5/2001 | Hirota et al. | 399/407 |

FOREIGN PATENT DOCUMENTS

| | | | |
|---|---|---|---|
| JP | 07-033313 | * | 2/1995 |
| JP | 10-324444 | | 12/1998 |
| JP | 11-157725 | | 6/1999 |
| JP | 2000-214647 | * | 8/2000 |

* cited by examiner

*Primary Examiner*—Sophia S. Chen
(74) *Attorney, Agent, or Firm*—Renner, Otto, Boiselle & Sklar

(57) ABSTRACT

An image-forming apparatus is provided which includes a document reading section for reading image information from a document, and an image-forming section for forming an image on a sheet of paper based upon the image information of the document read by the document reading section. A space section is formed below the document reading section, which accommodates the image-forming section and serves as a discharge section to which the sheet of paper bearing the image formed in the image-forming section is discharged. The space section is surrounded by peripheral walls of an apparatus main body including the image-forming section. The image-forming apparatus further includes a paper post-treatment section that subjects the sheet of paper bearing the image to post-treatments, such as an adjustment process and a stapling process, in a virtually horizontal state, and that is placed between the document reading section and the space section.

58 Claims, 60 Drawing Sheets

IMAGE FORMING APPARATUS WITH PAPER POST-TREATMENT DEVICE

FIELD OF THE INVENTION

The present invention relates to an image-forming apparatus which is a composite apparatus having functions, such as a copying function, a facsimile function and a printing function, in which a paper post-treatment device is installed.

BACKGROUND OF THE INVENTION

As illustrated in FIG. 59, a conventionally-known composite apparatus, which has functions such as a copying function, a facsimile function and a printing function, is provided with a document reading section 1010 for reading a document, an image-forming apparatus main body 1020 serving as a printing means for printing an image on a sheet of paper, and a paper-feed and cassette means 1030 for housing and feeding sheets of paper.

In the composite apparatus having the above-mentioned arrangement, a space is formed below the document reading section 1010 in a manner so as to form a U-letter shape when viewed from the operation face side, an image-forming section 1021 of the image-forming apparatus main body 1020 is formed vertically, and a paper-discharge means 1040 for discharging sheets of paper transported from a paper transport path 1022 of the image-forming apparatus main body 1020 is installed in the above-mentioned space section.

In this manner, since the sheets of printed paper are discharged within the installation plane of the apparatus, it is possible to make the installation area of the apparatus smaller as compared with a case in which the sheets of printed paper are discharged outside of the apparatus main body. In the image-forming apparatus of this type, even when a post-treatment device for carrying out post-treatments such as a stapling process, etc. on sheets of printed paper is attached to the outside of the apparatus main body, it is possible to make the installation area smaller as compared with a case in which the post-treatment device is attached to a conventional image-forming apparatus.

With respect to the image-forming apparatus in which sheets of printed paper are discharged within the installation plane of the apparatus, examples thereof include "image-forming apparatus" disclosed in Japanese Laid-Open Patent Application No. 324444/1998 (Tokukaihei 10-324444 (published on Dec. 8, 1998), hereinafter, referred to as reference 1) and "image-forming apparatus" disclosed in Japanese Laid-Open Patent Application No. 157725/1999 (Tokukaihei 11-157725 (published on Jun. 15, 1999), hereinafter, referred to as reference 2).

As illustrated in FIG. 60, the image-forming apparatus disclosed in reference 1 has an arrangement in which a paper post-treatment device 1050 is placed on the side face of the image-forming apparatus main body 1020. To this paper post-treatment device 1050, sheets of paper from the image-forming apparatus main body 1020 are transported by a relay transporting means 1060 installed in the paper-discharge means 1040 (space section) formed below the document-reading section 1010.

Moreover, as illustrated in FIG. 61, the image-forming apparatus disclosed in reference 2 also has the same arrangement in which to the paper post-treatment device 1050 placed on the side face of the image-forming apparatus main body 1020, sheets of paper from the image-forming apparatus main body 1020 are transported by a relay transporting means 1060 installed in the paper-discharge means 1040 (space section) formed below the document-reading section 1010.

In both of the above-mentioned image-forming apparatuses disclosed by reference 1 and reference 2, in the case when the paper post-treatment device 1050 is not used, sheets of paper are discharged onto the top surface 1060*a* of the relay transport means 1060. Here, in the case of reference 1, as illustrated in FIG. 60, sheets of paper can be discharged not only to the top surface 1060*a* of the relay transport means 1060, but also to a space section formed below the relay transport means 1060, by shifting the relay transport means 1060 in an up and down direction.

However, in the image-forming apparatuses disclosed in reference 1 and reference 2, in the event of a paper jam inside the relay transport means 1060 when the paper post-treatment device 1050 is being used, if there is any sheet of paper on the relay transport means 1060, the sheet of paper is removed, and after opening the top face 1060*a* of the relay transport means 1060, the sheet of paper causing the jam has to be removed.

In this manner, in the image-forming apparatuses disclosed in reference 1 and reference 2, in the event of a paper jam inside the relay transport means 1060, if any sheet of paper has been discharged on the top face 1060*a* of the relay transport means 1060, the sheet of paper needs to be removed so as to clear the top face of the relay transport means 1060, and the surface is then opened, and the sheet of paper causing the jam has to be removed. The resulting problems are that time consuming tasks are required to carry out the jam treatment and that there is subsequent degradation in the maintenance property of the apparatus.

Referring to FIG. 62 showing a cross-sectional structure in the vicinity of a position where a stapling process is carried out, an explanation will be given of an operational example of the paper post-treatment device having the above-mentioned structure, also by reference to a flow chart in FIG. 63. In FIG. 63, first, when a request for printing is given at step S101, a judgment is made as to whether or not the stapling process is selected at step S102. If the. stapling process is not selected, then a printing process is carried out at step S113, and the sheet of paper is discharged through an escape transport path at S114, thereby completing the operation.

In contrast, if the stapling process is selected at step S102, then the sequence proceeds to step S103. In FIG. 62, a stopper 1102 for adjusting the leading edge of a sheet of paper is rotatably attached to the top of an adjustment tray 1101 on the downstream side, and at step S103, a judgment is made as to whether or not the stopper 1102 is in the home position. Here, it is supposed that the home position of the stopper 1102 is set to its up-right state, that is, a state capable of paper-leading edge adjustment. If it is not in the home position, then the sequence proceeds to step S104 where the stopper 1102 is allowed to pivot to the up-right state, that is, to the home position. When the stopper 1102 is in the home position, the sequence proceeds to step S105, thereby carrying out a printing process.

When the sheet of printed paper has been transported to the adjustment tray 1101, the feed roller, not shown, transports the sheet of printed paper until it has come into contact with the stopper 1102 so that the leading edge of the sheet of paper is adjusted. Then, the adjustment of the sheet of paper in the width direction is carried out by using the width adjustment guide, not shown, while the sheet of paper is seized by paper leading-edge seize levers 1106 from above so as to correct the curl of the sheet. The processes of steps S105 and S106 are repeated with respect to sheets of paper corresponding to the number of sheets that has been requested for the stapling process, and upon completion of the adjustment of the predetermined number of sheets at step S107, a staple unit 1103 carries out the stapling process on the set of sheets of paper at step S108.

Next, at step S109, as illustrated in FIG. 62, the transport path is opened by rotating the stopper 1102 so as to fall in the horizontal direction. Then, at step S110, after a driven roller 1105 placed above a semi-circular send-out roller 1104 has been made in contact with the set of sheets of paper, the send-out roller 1104 is driven to rotate at step S111 so that the set of sheets of paper is discharged while being sandwiched between the send-out roller 1104 and the driven roller 1105.

At step S112, a judgment is made as to whether or not the next stapling process is requested, and if it is requested, the processes from step S103 to step S111 are repeated, and if not requested, the operation is completed.

Moreover, with respect to the paper post-treatment device, one example is given by "sheet post-treatment device" disclosed in Japanese Patent Publication No. 2583594 (published on Jun. 4, 1990, hereinafter, referred to as reference 3) In this sheet post-treatment device, sheets of printed paper that have been received are partially discharged diagonally upward from a miniaturized adjustment tray so that the sheets of paper are stored and adjusted in a bridging manner between an adjustment tray and a paper stack section. After having been stapled, the portion of the set of sheets of paper located on the adjustment tray is pushed toward the paper stack section, thereby completing the post-treatment.

In the sheet post-treatment device shown in FIG. 62, however, those members for adjusting the leading edge of sheets of paper, such as the stopper 1102, and those transporting members for transporting the set of sheets of paper after having been stapled, such as the send-out roller 1104 and the driven roller 1105, are installed in a separate manner. The resulting problems are that there are a number of members that have to be controlled individually and that the installation positions of the respective members are closely located, which results in a complex structure.

For example, at the time of a stapling process, in addition to a mechanism for controlling the stopper 1102 so as to shift it to the home position, the following mechanisms are required: a clutch mechanism for controlling the send-out roller 1104 to stop rotating and a mechanism for allowing the driven roller 1105 to retreat so as not to interrupt the adjustment process of the sheets of paper. In particular, since the semi-circular roller is used as the send-out roller 1104, this needs to retreat outside the adjustment tray 1101 with the flat surface facing up, as illustrated in FIG. 62, during the stapling process. Moreover, after the stapling process, the above-mentioned controlling mechanisms are individually used so that the stopper 1102 is allowed to fall, the driven roller 1105 is shifted toward the send-out roller 1104 side, and the send-out roller 1104 is rotatively driven.

In order to reduce one of the independent controlling mechanism in an attempt to simplify the structure, for example, supposing that the driven roller 1105 is omitted, the pressure to the set of sheets of paper from above is only applied by the paper leading-edge seize lever 1106. As described earlier, since the paper leading-edge seize lever 1106 is used so as to correct the curl of sheets of paper at the time of the leading-edge adjusting, it is not possible to apply a great load onto the paper leading-edge seize lever 1106 because of its purpose for correcting the irregularity in the leading edge-of sheets of paper.

In the case when, after the stapling process, a set of several or several tens of sheets of paper is transported toward the paper-discharging side, resistance due to its own gravity is considerably great, with the result that unless the transporting force of the send-out roller 1104 is increased sufficiently, a paper jam tends to occur due to slipping. In other words, it is not possible to omit the driven roller 1105 from this structure, as it is.

Still another problem is that the application of the semi-circular roller as the send-out roller 1104 makes the transport distance of the set of sheets of paper shorter. A paper-discharge roller and a paper-discharge tray are installed right after the downstream side of the staple unit 1103, and the set of sheets of paper needs to reach these members within one rotation of the send-out roller 1104. However, the distance that is provided by the semi-circular roller is only the length of the circular arc portion of the semi-circular roller that is allowed to protrude from the adjustment tray 1101 at the time of rotation.

Therefore, there are only limited positions in which the paper-discharge roller and paper-discharge tray can be placed, causing degradation in the degree of freedom in designing. Moreover, in the case when a long distance is required from the staple unit 1103 to the paper-discharge roller and the paper-discharge tray, a transport roller needs to be added in between, resulting in high costs.

SUMMARY OF THE INVENTION

The present invention relates to an image-forming apparatus which has a paper-discharge device installed on the same installation plane of the apparatus main body, and its objective is to provide an image-forming apparatus which allows the paper-discharge device to be used effectively even when a post-treatment device has been attached, and can reduce the installation area of the apparatus as a whole.

In order to achieve the above-mentioned objective, the image-forming apparatus of the present invention, which is provided with a document reading section for reading image information from a document, an image-forming section for forming an image on a sheet of paper based upon the image information of the document read by the document reading section, and a space section formed below the document reading section, which accommodates the image-forming section and serves as a discharge section to which the sheet of paper bearing the image formed in the image-forming section is discharged, is further provided with a paper post-treatment section that subjects the sheet of paper bearing the image to post-treatments, such as an adjustment process and a stapling process, in a virtually horizontal state, and that is placed between the document reading section and the space section.

In accordance with this invention, the paper post-treatment section is placed between the document reading section and the space section, that is, the space used for paper post-treatments is formed on the installation plane of the image-forming apparatus. Consequently, since the installation area of the image-forming apparatus including the paper post-treatment section is reduced, it becomes possible to provide a greater degree of freedom in installing the image-forming apparatus.

Moreover, in the paper post-treatment section, the post-treatments, such as an adjustment process and a stapling process for sheets of paper bearing images, are carried out in a virtually horizontal state; therefore, it is possible to carry out the post-treatments such as an adjustment process and a stapling process for sheets of paper at the same position.

Thus, it is possible to prevent deformation in the set of sheets of paper and disturbance in the adjustment of the sheets of paper that tend to occur upon transporting the set of adjusted sheets of paper to a stapling position. Consequently, it becomes possible to positively carry out the post-treatment such as the stapling process in a well-adjusted state of the set of sheets of paper.

In order to achieve the above-mentioned objective, the image-forming apparatus of the present invention, which is provided with a document reading section for reading image information from a document, an image-forming section for forming an image on a sheet of paper based upon the image information of the document read by the document reading section, a paper post-treatment section that is attached to the apparatus main body including the image-forming section and that subjects the sheet of paper bearing the image to post-treatments, such as an adjustment process and a stapling process, is further provided with a space section formed below the document reading section, which is surrounded by peripheral walls of the apparatus main body, and serves as a discharge section for discharging the sheet of paper bearing the image formed in the image-forming section, and a relay transport path for transporting the sheet of paper from the image-forming section to the paper post-treatment section, which is installed between the document reading section and the space section.

In this manner, the space section, which is surrounded by peripheral walls of the apparatus main body constituted by the document reading section and the image-forming section, is formed below the document reading section so as to serve as a discharge section for discharging the sheet of paper bearing the image formed in the image-forming section, and a relay transport path for transporting the sheet of paper from the image-forming section to the paper post-treatment section is installed between the document reading section and the space section. In this arrangement, the relay transport path can be used in various ways.

For example, the relay transport path is allowed to accommodate sheets of paper bearing images formed on one side thereof in the image-forming section, and a switch back mechanism, which again transports the sheets of paper to the image-forming section so as to form images on the other side bearing no images, may be installed.

With this arrangement, it is not necessary to install a member having a switch back function for the double-sided printing process in a separated manner.

Moreover, the relay transport path may be installed so as to be openable downward in a direction perpendicular to the paper transporting direction at the end portion serving as a fulcrum on the side opposite to the face of the apparatus to which the operator attends.

With this arrangement, even in the event of a trouble in which a sheet of paper is stuck in the relay transport path, that is, a paper jam, the relay transport path is opened to face the operator on the operation face side so that the jam treatment can be easily carried out.

Furthermore, a jam detection means for detecting a paper jam in the relay transport path may be installed in the relay transport path.

Moreover, the relay transport path may be provided as a unit part that is detachably attached to the apparatus main body.

With this arrangement, in the case when the paper post-treatment section is not used, the relay transport path can be removed, and the maintenance is carried out by removing the relay transport path so that it becomes possible to improve the maintenance efficiency of the entire apparatus.

Another objective of the present invention is to provide a paper post-treatment device in which, among those members constituting the paper leading-edge adjusting mechanism and those members constituting the paper-set transporting mechanism after the post-treatment process, it is possible to reduce the number of those members that need to be controlled independently, and consequently to simplify the mechanism, while maintaining a high transporting force with respect to the sheet of paper after having been subjected to the post-treatment process. Moreover, in addition to the above-mentioned objective, still another objective of the present invention is to provide a paper post-treatment device which can sufficiently maintain the transport distance with respect to the set of sheets of paper having been post-treated.

In order to achieve the above-mentioned objective, the paper post-treatment apparatus, which adjusts a plurality of sheets of paper transported thereto, and sends them out as a set of sheets of paper, is provided with a leading-edge adjusting transport device that is constituted by a leading-edge adjusting section which stops at a predetermined position to block the transport path, thereby arranging the leading edges of a plurality of sheets of paper being transported, and a transport section which also serves as at least one portion of a transport means for transporting a set of sheets of paper toward the downstream side, and is allowed to contact the set of sheets of paper in place of the leading-edge adjusting section when the leading-edge adjusting section has been shifted from the predetermined position so as to open the transport path, thereby allowing the transport means to shift to a state ready for transportation, the reading-edge adjusting section and the transporting section being integrally formed thereon.

In the above-mentioned invention, the leading-edge adjusting section, which exerts the leading-edge adjusting function before the post-treatment such as a stapling process and a punching process with respect to the sheets of paper transported thereto, and the transport section, which exerts at least one of the transporting functions for transporting the set of sheets of paper that have been post-treated toward the downstream side, are integrally formed into one member, that is, the leading-edge adjusting transport device.

When the leading-edge adjusting transport device carries out the leading-edge adjusting process for a plurality of sheets of paper, the leading-edge adjusting section is stopped at the predetermined position so as to block the transport path, thereby allowing the leading-edges of the sheets of paper to come into contact with the leading-edge adjusting section. In this state, an adjusting process in the width direction of sheets of paper is carried out by a certain means so that the sheets of paper are adjusted into a set of sheets of paper. The above-mentioned post treatments are carried out in this state. When the leading-edge adjusting section has been shifted from the predetermined position so as to open the transport path with the sheets of paper being adjusted, the transport section is allowed to contact the set of sheets of paper in place of the leading-edge adjusting section. The transport section also serves as at least one portion of a transport means for transporting a set of sheets of paper toward the downstream side, and upon contacting the set of sheets of paper, allows the transport means to shift to a state ready for transportation.

Therefore, different from conventional methods in which the leading-edge adjusting process and the transition process for getting ready for the transportation are controlled in a separated manner, the two processes can be easily controlled by a sequential controlling operation of one control mechanism.

Moreover, in the case when the transport section is provided as a roller, another roller, etc., may be installed so as to sandwich the set of sheets of paper in a paired state with the transport section upon contacting the face of the set of sheets of paper. In other words, the application of a pair of rollers as the transport means makes it possible to ensure a higher transporting force easily.

Consequently, it is possible to provide a paper post-treatment device in which, among those members constituting the paper leading-edge adjusting mechanism and those members constituting the paper-set transporting mechanism after the post-treatment process, it is possible to reduce the number of those members that need to be controlled independently, and consequently to simplify the mechanism, while maintaining a high transporting force with respect to the sheet of paper after having been post-treated.

For a fuller understanding of the nature and advantages of the invention, reference should be made to the ensuing detailed description taken in conjunction with the accompanying drawings.

BRIEF DESCRIPTION OF THE DRAWINGS

FIG. 20(*b*) is a side view that shows the three concatenation rollers shown in FIG. 19.

FIG. 22(*b*) is a schematic side view that shows the diverging means shown in FIG. 22(*a*).

FIG. 37(*b*) is a schematic side view that shows the paper sensor of FIG. 37(*a*).

FIG. 43(*b*) is a schematic drawing that shows the structure of an image-forming apparatus that serves as a comparative example of the image-forming apparatus of the present invention.

DESCRIPTION OF THE EMBODIMENTS

[Embodiment 1]

The following description will discuss one embodiment of the present invention.

Figure 1:
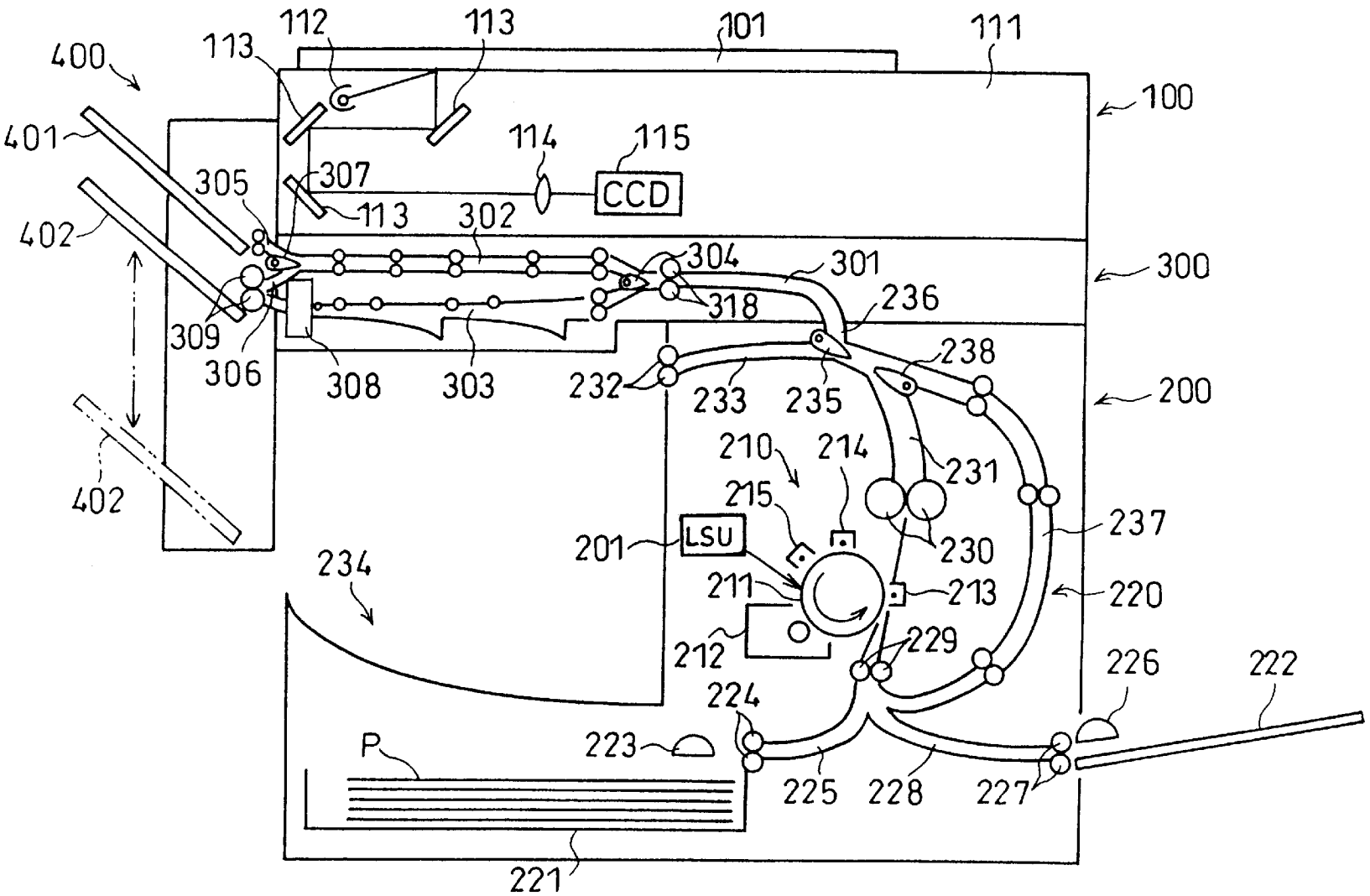
FIG. 1 is a schematic drawing that shows an image-forming apparatus in accordance with one embodiment of the present invention.

As illustrated in FIG. 1, the image-forming apparatus of the present invention is constituted by a document reading section 100, an image-forming apparatus main body 200, a post-treatment device 300, and a paper stack section 400.

The above-mentioned document reading section 100 has a document platen 101 made of transparent glass, etc. on its upper face. A scanner optical system 111 for optically reading a document (not shown) placed on the document platen 101 is installed on the document platen 101.

The scanner optical system 111 is constituted by an exposing light source 112 for irradiating a document (not shown) placed on the document platen 101 with light and a charge coupled device (CCD) 115 for receiving light reflected from the document, and between the exposing light source 112 and the charge coupled device 115 are placed a plurality of reflecting mirrors 113 for directing light reflected by the document to the charge coupled device 115 and an imaging lens 114 for converging light directed by the reflecting mirror 113 onto the charge coupled device 115 to form an image thereon.

In other words, an output signal released from the CCD 115, that is, document image data, is subjected to image processes, and then sent to an LSU (laser scanning unit) 201 installed in the image-forming apparatus main body 200.

The image-forming apparatus main body 200 is mainly classified into an image-forming section 210 for forming an image (printing) on copy paper P, and a paper transport section 220 for housing copy paper P and for transporting the copy paper P to the image-forming section 210.

The image-forming section 210 is provided with the LSU 201 and a photosensitive member 211 on the surface of which laser light from the LSU 201 is directed so that an electrostatic latent image is formed.

The photosensitive member 211 is provided as a drum that is rotatively driven in the direction of arrow, and on the periphery of the photosensitive member 211, from the irradiation point of laser beam from the LSU 201. in the rotation direction of the photosensitive member 211 are placed a developing device 212, a transfer charger 213, a static eliminator 214 and a main charger 215.

The developing device 212 develops an electrostatic latent image formed on the surface of the photosensitive member 211 through the exposure by laser light into a visible image (toner image) by using toner, the transfer charger 213 transfer the toner image on the photosensitive member 211 on copy paper, the static eliminator 214 eliminates residual charge on the photosensitive member 211 after the transferring operation of the toner image, and the main charger 215 charges the surface of the photosensitive member 211 from which the residual charge has been removed, so as to have a predetermined electric potential. Moreover, although not illustrated in the Figure, a cleaning device for cleaning residual toner on the photosensitive member 211 after the transferring operation is installed between the transfer charger 213 and the static eliminator 214.

Based upon not only image data of a document read out by the document reading section 100, but also image information from a peripheral device such as a computer (not shown) that is externally connected as well as FAX information sent thereto through communications, etc., the LSU 201 irradiates the photosensitive member 211 with laser light.

Therefore, the present image-forming apparatus constitutes a composite apparatus having a copying function for reading a document image through the document reading section 100 and for forming an image on paper, a FAX function for forming an image on paper based upon FAX information obtained through communications, etc., and a printing function for printing an image on paper based upon image information from a peripheral device such as a computer, etc.

The paper feeding and transporting section 220 is provided with a paper cassette 221 for storing sheets of copy paper P and for feeding the sheets of copy paper P, and a manually feeding tray 222 used for feeding sheets of copy paper from the side face of the image-forming apparatus main body 200.

At the leading end portion on the copy paper P feeding side of the paper cassette 221 are installed a directing roller 223, which feeds the sheets of copy paper housed in the paper cassette 221, and a paper-sorting section (not shown), which is constituted by a roller and a frictional sheet member or a reversing roller, etc. so as to ensure that the sheets of copy paper thus housed be sent positively sheet by sheet.

On the downstream side of the directing roller 223 in the copy paper P transporting direction are installed a feeding-use pickup roller 224 for guiding the copy paper P to the image-forming position in the image-forming section 210, and a first paper-feeding path 225.

At the leading end portion on the copy paper P feeding side of the manually feeding tray 222 are installed a directing roller 226, which feeds the sheets of copy paper P placed on the manually feeding tray 222, a feeding-use pickup roller 227 for directing the sheets of copy paper P to the image-forming position in the image-forming section 210, and a second feeding-path 228.

Before the image-forming position of the image-forming section 210 is installed a registration roller 229 which transports the sheet of copy paper P fed from the first paper-feeding path 225 or the second paper-feeding path 228 to a transfer position (image-forming position) for a toner image of the photosensitive member 211 at predetermined timing.

Based upon a detection signal indicating that a sheet of copy paper P has passed through either the paper-feeding path 225 or the second paper-feeding path 228, given by registration pre-detection switches (not shown) attached to the first paper-feeding path 225 and the second paper-feeding path 228, the registration roller 229 is driven so as to carry out a positioning operation between a toner image on the photosensitive member 211 and the sheet of copy paper P.

On the downstream side in the copy paper P feeding direction of the transfer position at which the toner image on the photosensitive member 211 is transferred onto the sheet of copy paper P is installed a fixing roller 230 for fixing the toner image transferred on the sheet of copy paper P by applying heat.

On the downstream side in the copy paper P feeding direction of the fixing roller 230 are installed a paper transport path 231 for transporting the sheet of copy paper P that has been fixed and a first paper transport path 233 that directs the sheet of copy paper P transported through the paper transport path 231 to a discharge roller 232 for discharging it outside the image-forming apparatus main body 200.

The sheet of copy paper P, discharged from the discharge roller 232, is put on a first paper-discharge section 234 formed below the document-reading section 100. As illustrated in FIG. 1, the first paper-discharge section 234 is formed in a space that is formed on the upper side of the paper cassette 221 on the side face side of the image-forming section 210 of the image-forming apparatus main body 200, below the document-reading section 100.

Figure 2:
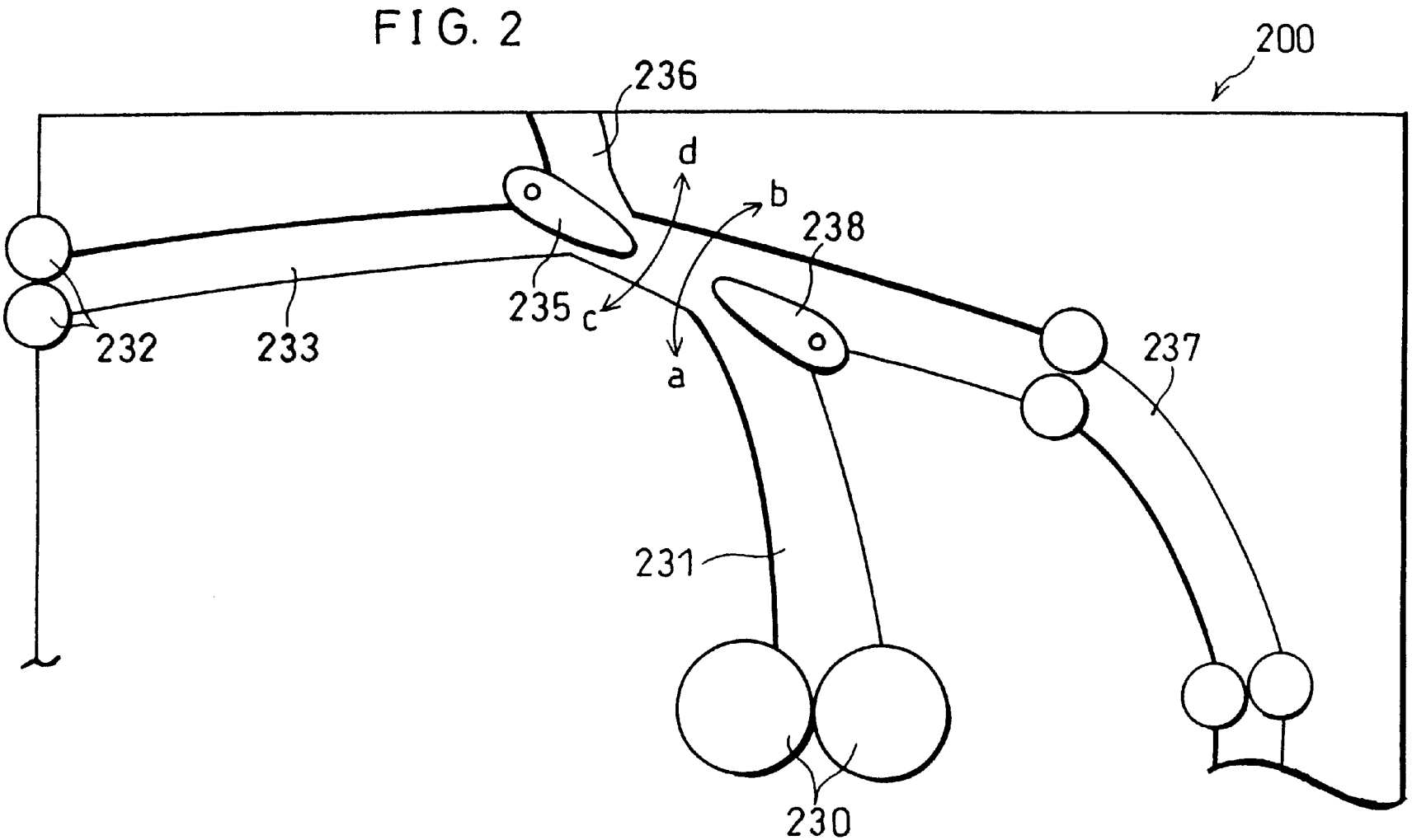
FIG. 2 is an explanatory drawing that schematically shows an essential part of a paper transport system in an image-forming apparatus main body of the image-forming apparatus of FIG. 1.

On the upstream side in the copy paper P transporting direction of the first paper transport path 233 is installed a first switching gate 235 which switches the sheet of copy paper P so as to direct it either to the first paper transport path 233 or to a paper transport path 236 connecting to a post-treatment device 300. As illustrated in FIG. 2, the first switching gate 235 is installed so as to freely pivot in the directions of arrows c and d on the branch point of the first paper transport path 233 and the paper transport path 236, which serves as a fulcrum. In other words, in the case when the sheet of copy paper P is directed to the first paper transport path 233, it is allowed to pivot in the direction of arrow d, thereby blocking the paper transport path 236, and in the case when the sheet of copy paper P is directed to the paper transport path 236, it is allowed to pivot in the direction of arrow c, thereby blocking the first paper transport path 233.

Moreover, as illustrated in FIG. 1, in the paper transport section 220, a reversing transport path 237 is installed in parallel with the paper transport path 231. This reversing transport path 237 is a transport path, used at the time of a double-sided copying process for forming images on both of the sides of a sheet of copy paper P, wherein the sheet of copy paper P is transported in a direction opposite to the transport direction of the paper transport path 231, and sent to the registration roller 229.

Therefore, a sheet of copy paper P to be subjected to the double-sided copying process is first transported to the paper transport path 231 with one of the sides bearing an image, and then temporarily directed to the post-treatment device 300 where it is switched back; thus, it is again transported to the reversing transport path 237 passing through the paper transport path 236. Here, the switching back function of the post-treatment device 300 will be described later.

Here, the sheet of copy paper P, transported to the reversing transport path 237, is further transported to the transfer position of toner image, through the registration roller 229, where a toner image is transferred on the side bearing no image, and this is then thermally fixed by the fixing roller 230, and then transported to the paper transport path 231.

A switching gate 238 is installed at the branch point between the paper transport path 231 and the reversing transport path 237, and in the case when the sheet of copy paper P is transported to the reversing transport path 237, the switching gate 238 is allowed to pivot so as to block the paper transport path 231, thereby preventing the sheet of copy paper P from being transported to the paper transport path 231.

In other words, as illustrated in FIG. 2, the switching gate 238 is installed in a manner so as to pivot in the directions of arrows a and b, and in the case when the sheet of copy paper P is directed to the paper transport pass 231, the switching gate 238 is allowed to pivot in the direction of arrow b so as to block the reversing transport path 237, and in the case when the sheet of copy paper P is directed to the reversing transport path 237, it is allowed to pivot in the direction of arrow a so as to block the paper transport path 231.

Here, in the case when the sheet of copy paper P is directed to the reversing transport path 237, the first switching gate 235 needs to be pivoted in the direction of arrow c.

As illustrated in FIG. 1, the post-treatment device 300 is provided with a paper transport path 301 for directing the sheet of copy paper P transported from the paper transport pass 236 of the image-forming apparatus main body 200 to an escape path 302 that is a second paper transport path, which will be described later, or to a staple tray 303 that is a third paper transport path, and a discharge roller 318 which discharges the sheet of copy paper P, transported through the paper transport path 301, onto the escape path 302 or onto the staple tray 303.

The escape path 302 and the staple tray 303 also serves as a relay transport path which transports copy paper P from the image-forming apparatus main body 200 to the paper stack section 400 that forms a paper post-treatment section.

As illustrated in FIG. 1, the relay transport path is formed between the document reading section 100 and a space section that forms the first paper-discharge section 234. Moreover, when viewed from another angle, it also can be said that the relay transport path is placed on the face (rear face) of the document reading section 100 on the side opposite to the document platen 101. Furthermore, it also can be said that the relay transport path is placed on the top face (ceiling face) of the space section that is the first paper-discharge section 234.

Figure 3:
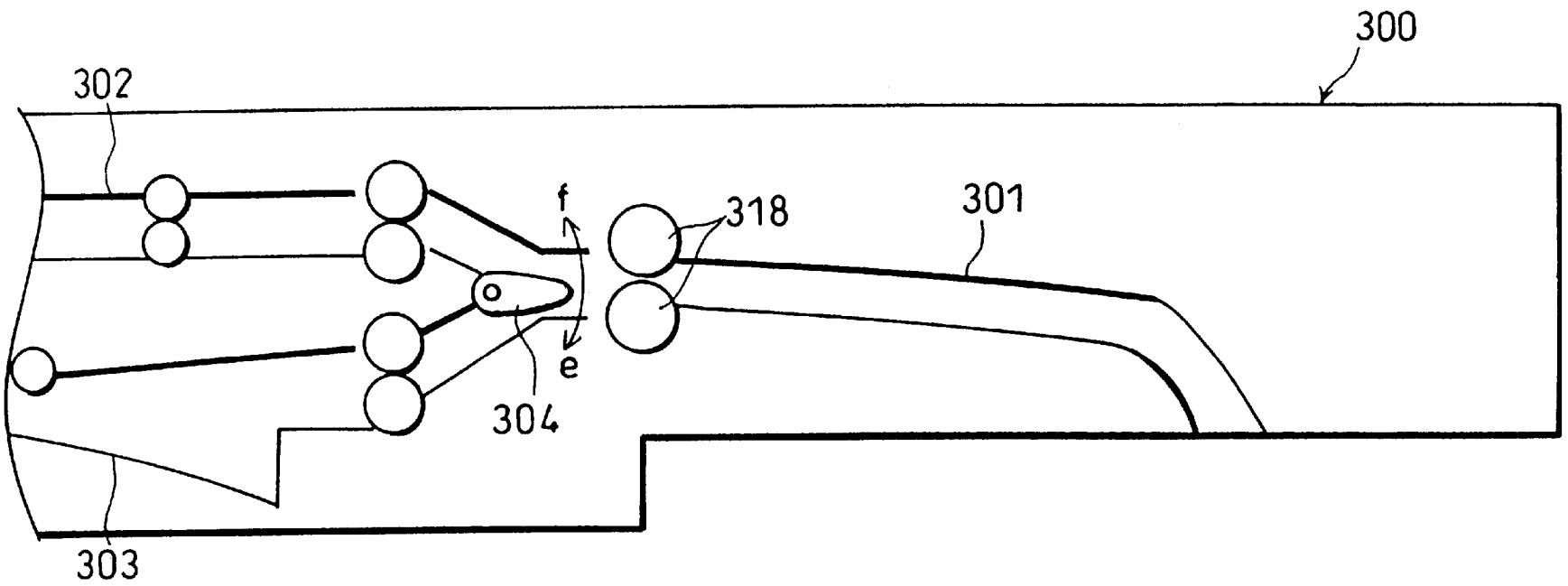
FIG. 3 is an explanatory drawing that schematically shows an essential part of a paper transport system in a paper post-treatment device of the image-forming apparatus of FIG. 1.

On the downstream side in the copy paper P transporting direction of the paper transport path 301, at the junction between the escape path 302 and the staple tray 303 is installed a second switching gate 304. As illustrated in FIG. 3, the second switching gate 304 is installed so as to freely pivot in the directions of arrows e and f with the junction serving as a fulcrum; thus, when copy paper P is directed to the escape path, it is allowed to pivot in the direction of arrow e, and when copy paper P is directed to the staple tray 303, it is allowed to pivot in the direction of arrow f.

The escape path 302 is a path used for transporting copy paper P that is not to be subjected to post-processes such as the stapling process, and as illustrated in FIG. 1, it is designed in such a manner that the transported portion of the copy paper P is maintained virtually in parallel with the document platen 101 of the document reading section 100; thus, the copy paper P is transported to the paper stack section 400, which will be described later, while being maintained virtually horizontally (in a virtually horizontal state).

Figure 4:
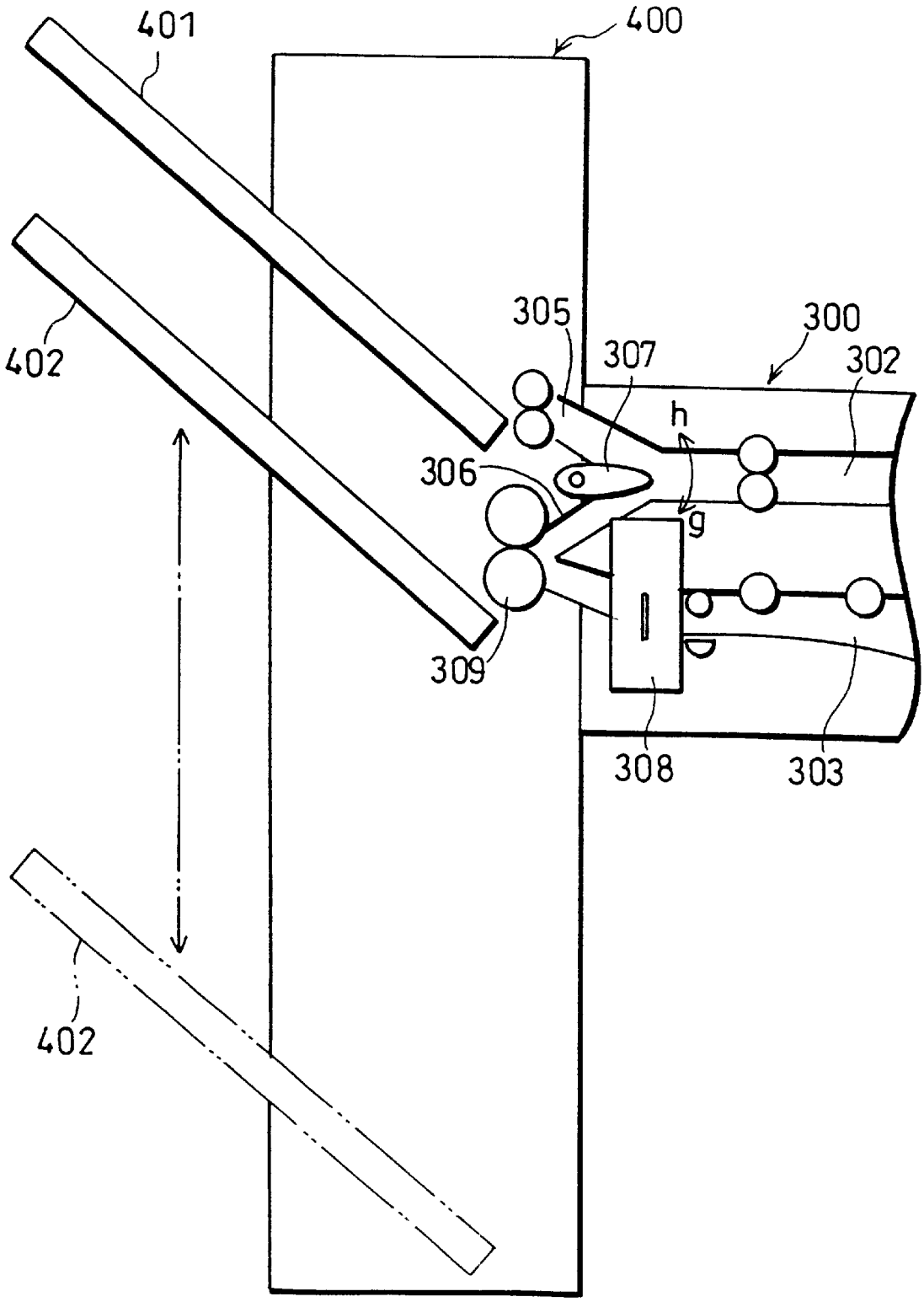
FIG. 4 is an explanatory drawing that schematically shows an essential part of a paper transport system in a paper stack section of the image-forming apparatus of FIG. 1.

On the downstream side in the copy paper P transporting direction of the escape path 302, a first paper-discharge path 305 and a second paper-discharge path 306 are installed in a branched manner. A third switching gate 307 is installed at the junction between the first paper-discharge path 305 and the second paper-discharge path 306 so that copy paper P which is being transported is switched either to the first paper-discharge path 305 or to the second paper-discharge path 306 so as to be transported therein, if necessary. In other words, as illustrated in FIG. 4, the third switching gate 307 is installed so as to freely pivot in the directions of arrows g and h with the junction of the first paper-discharge path 305 and the second paper-discharge path 306 serving as a fulcrum; thus, when copy paper P is directed to the first paper-discharge path 305, it is allowed to pivot in the direction of arrow g, and when copy paper P is directed to the second paper-discharge path 306, it is allowed to pivot in the direction of arrow h.

Here, the staple tray 303 is a transport path for transporting copy paper P that is to be subjected to post-treatments such as a stapling process, and as illustrated in FIG. 1, it is placed below the escape path 302 virtually in parallel with the escape path 302, and designed to transport the copy paper P to the paper stack section 400 while maintaining it virtually in a horizontal state, in the same manner as the escape path 302.

Moreover, in the staple tray 303, sheets of copy paper P are housed and arranged virtually in a horizontal state, and the sheets of copy paper P thus arranged in a horizontal state are subjected to a stapling process by a staple unit 308, which will be described later.

On the downstream side in the copy paper P transporting direction of the staple tray 303 are installed a staple unit 308 for carrying out a stapling process and a paper-discharge roller 309 for discharging sets of copy paper P that have been subjected to the stapling process by the staple unit 308.

The paper-discharge roller 309 is also designed to discharge copy paper P that has been diverged from the escape path 302 through the third switching gate 307, and transported through the second paper-discharge path 306. Here, on the copy paper P import front side of the paper-discharge roller 309 is installed a paper sensor B (FIG. 8) for detecting the passage of copy paper P.

The post-treatment device 300 having the above-mentioned arrangement is placed between the document reading section 100 and a space section formed below it; thus, the space used for paper post-treatment is formed on the installation face of the image-forming apparatus. As a result, it is possible to reduce the installation area of the image-forming apparatus provided with the post-treatment device 300, and consequently to provide a greater degree of freedom in installing the image-forming apparatus.

Moreover, in the post-treatment device 300, the arrangement of sheets of copy paper P bearing images and post-treatments such as the stapling process are carried out virtually in a horizontal state; thus, it is possible to carry out the arrangement of the sheets of copy paper P and the post-treatments such as the stapling process on the same position. Therefore, it becomes possible to prevent deformation and disarrangement of sets of copy paper sheets P that might occur when the sets of copy paper sheets P are transported to a staple position, and consequently to positively carry out post-treatments such as the stapling process in a well-arranged state of the sets of copy paper sheets P.

The paper stack section 400 is used for stacking sheets of copy paper P that have passed through the post-treatment device 300, and as illustrated in FIG. 1, is provided with a first paper stack tray 401 serving as the second paper-discharge section, and a second paper stack tray 402 serving as the third paper-discharge section.

Sheets of copy paper P which have passed through the escape path of the post-treatment device 300 and the first paper-discharge path 305 are discharged and stacked on the first paper stack tray 401. In other words, those sheets of paper P which have passed through the post-treatment device 300 but have not been subjected to the post-treatments such as the stapling process are stacked on the first paper stack tray 401.

On the other hand, sheets of copy paper P which have passed through either the escape path 302 of the post-treatment device 300 or the staple tray 303 are discharged from the paper-discharge roller 309 and stacked on the second paper stack tray 402. In other words, the second paper stack tray 402 mainly stores sheets of copy paper P that have been subjected to the post-treatments such as the stapling process, and also stores those sheets of copy paper P that have not been subjected to the post-treatments such as the stapling process.

Moreover, the second paper stack tray 402 is allowed to shift up and down depending on the amount of the stacked copy paper P. In other words, as the amount of the stacked copy paper P increases, the second paper stack tray 402 shifts downward from a predetermined position. Therefore, in the case when a large number of sheets of copy paper P that have not been subjected to the stapling process, etc. need to be stacked, those sheets of copy paper P are discharged onto the second paper stack tray 402 through the escape path 302 and the second paper-discharge path 306.

Figure 5:
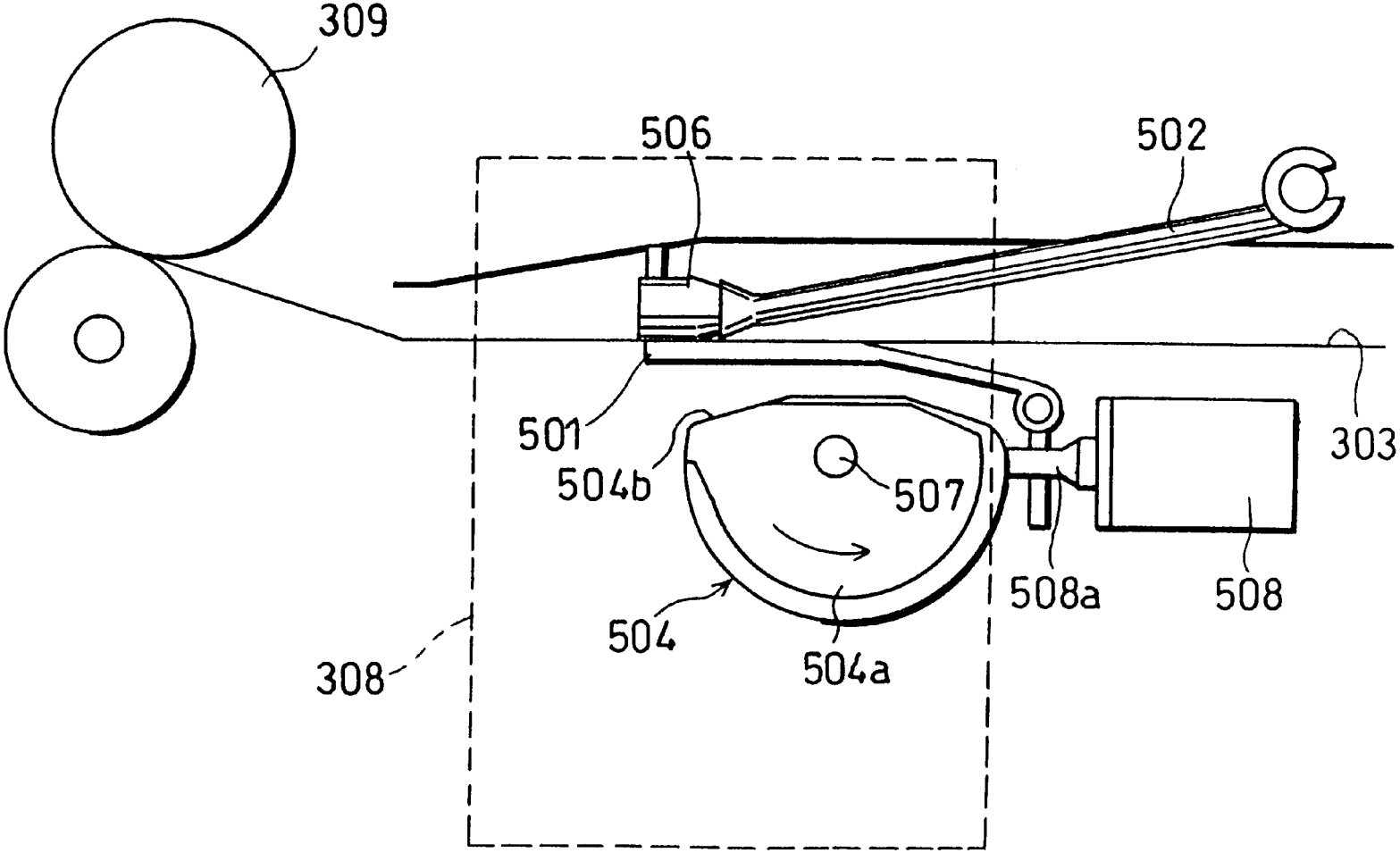
FIG. 5 is an explanatory drawing that shows the vicinity of a staple unit in the paper stack section of FIG. 4.

As illustrated in FIG. 5, the above staple unit 308 is provided with a stopper 501 that is attached to the leading end of the staple tray 303 in the copy paper P transporting direction and that is allowed to contact the leading edge of a sheet of copy paper P transported from the staple tray 303, a paper-leading-edge seize lever 502 that seizes the leading edge of the sheet of copy paper P contacting the stopper 501, a stapler 503 (FIG. 6) for carrying out a staple process on the sheet of copy paper P, and a send-out roller 504 for sending out the sheet of copy paper P subjected to the stapling process to the paper-discharge roller 309.

Figure 6:
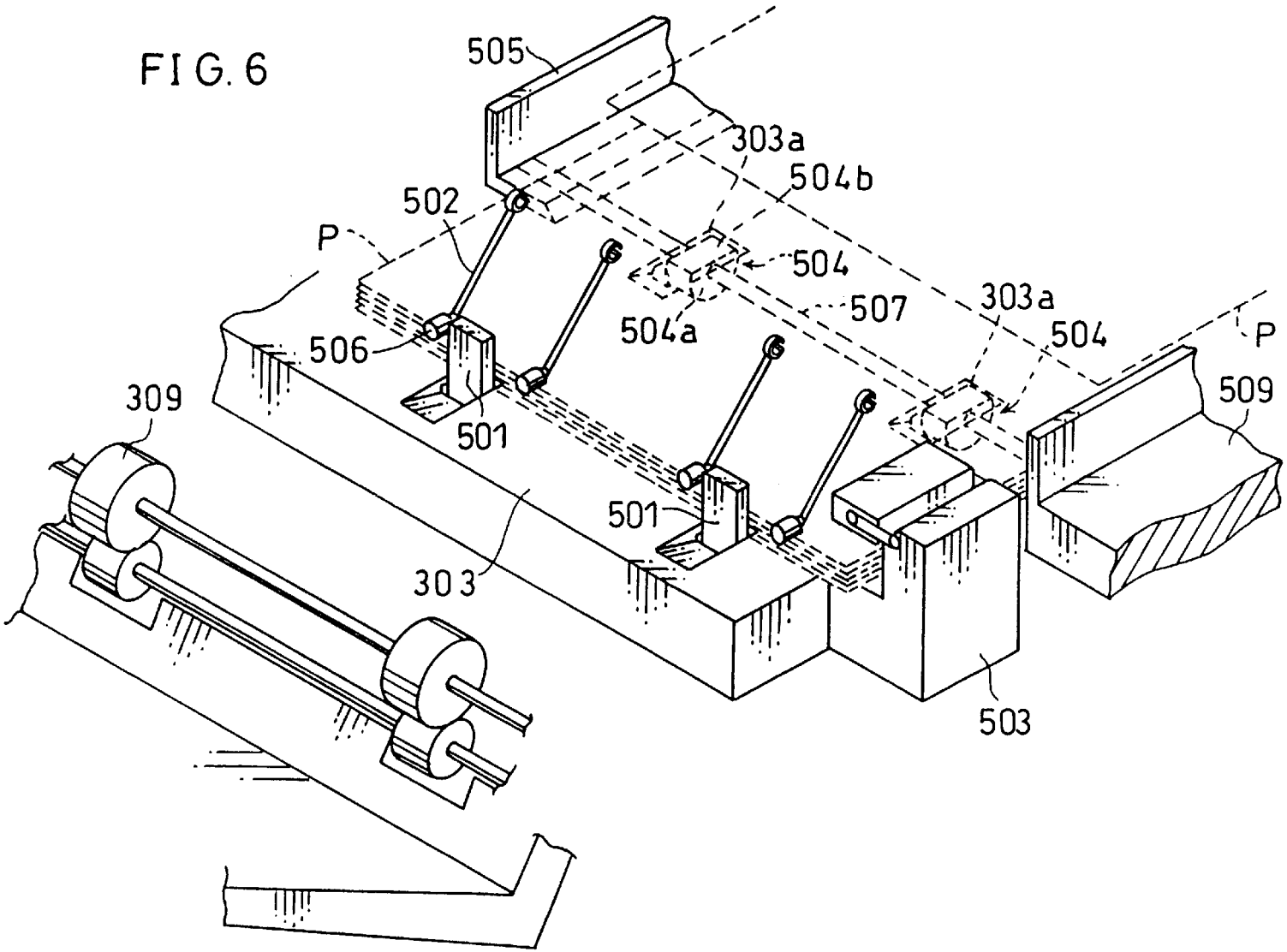
FIG. 6 is a schematic perspective view that shows the vicinity of,the staple unit shown in FIG. 5.

Moreover, as illustrated in FIG. 6, an adjusting member 505 for adjusting the sheets of copy paper P in the width direction is installed in the vicinity of the staple unit 308.

As illustrated in FIG. 5 and FIG. 6, the stopper 501, which is a member having an L-letter shape in its cross-section, is supported on a shaft so as to freely pivot thereon at the end portion opposite to the end portion contacting the sheet of copy paper P, and is allowed to pivot downward when the sheet of copy paper P is sent out.

A pair of the paper-leading-edge seize lever 502 are formed on the respective sides of the stopper 501, and each of them is placed in a manner so as to diagonally hang down toward the downstream side in the transporting direction of the copy paper P with a gentle angle virtually in parallel with the staple tray 303. The paper-leading-edge seize lever 502 is pressed downward by a spring (not shown) so that it guides and seizes a sheet of copy paper P even when its leading edge is curled; thus, since they are placed on the respective sides of the stopper 501, the leading edge of the copy paper P is allowed to have rigidity so that it is possible to prevent deviation in the adjustment due to deformation and damage caused when the edge of the sheet of copy paper P comes into contact with the stopper 501.

Moreover, to the tip of the paper-leading-edge seize lever 502 is attached a roll member 506 that is orthogonal to the stopper 501 and is rotatable with respect to the paper-leading-edge seize lever 502. With this arrangement, upon adjusting the copy paper P in the width direction by the adjusting member 505 with the copy paper P being seized by the paper-leading-edge seize lever 502, resistance between the paper-leading edge seize lever 502 and the copy paper P can be reduced.

As illustrated in FIG. 6, the stapler 503 is placed in such a position that the stapling process is carried out on the left corner of the leading edge in the transporting direction of the copy paper P.

As illustrated in FIGS. 5 and 6, the send-out roller 504 is made of a semicircular member, and is allowed to freely pivot on a support shaft 507 that is placed in an extending manner in the width direction of the copy paper P. In other words, when the send-out roller 504 is rotated in the direction of arrow, the semicircular portion 504*a* sticks out from an opening 303*a* formed in the staple tray 303, and pushes upward the copy paper P on the staple tray 303, and sends it toward the paper-discharge roller 309 side.

Here, the send-out roller 504 is in a stand-by state where the semicircular portion 504*a* is placed on the lower side with the flat portion 504*b* placed on the upper side so as not to protrude from the placing face of the copy paper P of the staple tray 303, virtually in parallel with the placing face of the copy paper P.

Moreover, the send-out roller 504 is driven by a motor 508 serving as a driving means, and the stopper 1 is connected to the driving shaft 508*a* of this motor 508. In other words, as the send-out roller 504 rotates in the direction of arrow, the stopper 501 also rotates downward. Thus, since the same driving source can be used to rotate the stopper 501 and the send-out roller 504, it is possible to provide a small-size apparatus.

Furthermore, upon sending out the copy paper P toward the paper-discharge roller 309, the simple rotation of the send-out roller 504 allows the stopper 501 to automatically rotate downward, thereby making it possible to smoothly send out the copy paper P.

Next, an explanation will be given of an adjustment mechanism of sheets of paper on the staple tray 303.

As illustrated in FIG. 6, the adjusting member 505 is arranged so as to be shiftable in the width direction of the copy paper P, that is, in a direction orthogonal to the transporting direction of the copy paper P; thus, it is adjacent to the stapler 503 of the staple tray 303, and allowed to shift toward a fixed wall 509 installed along the transporting direction of the copy paper P. The operation of the adjusting member 505 may be carried out at any time as long as it is prior to the stapling process by the stapler 503.

Figure 7:
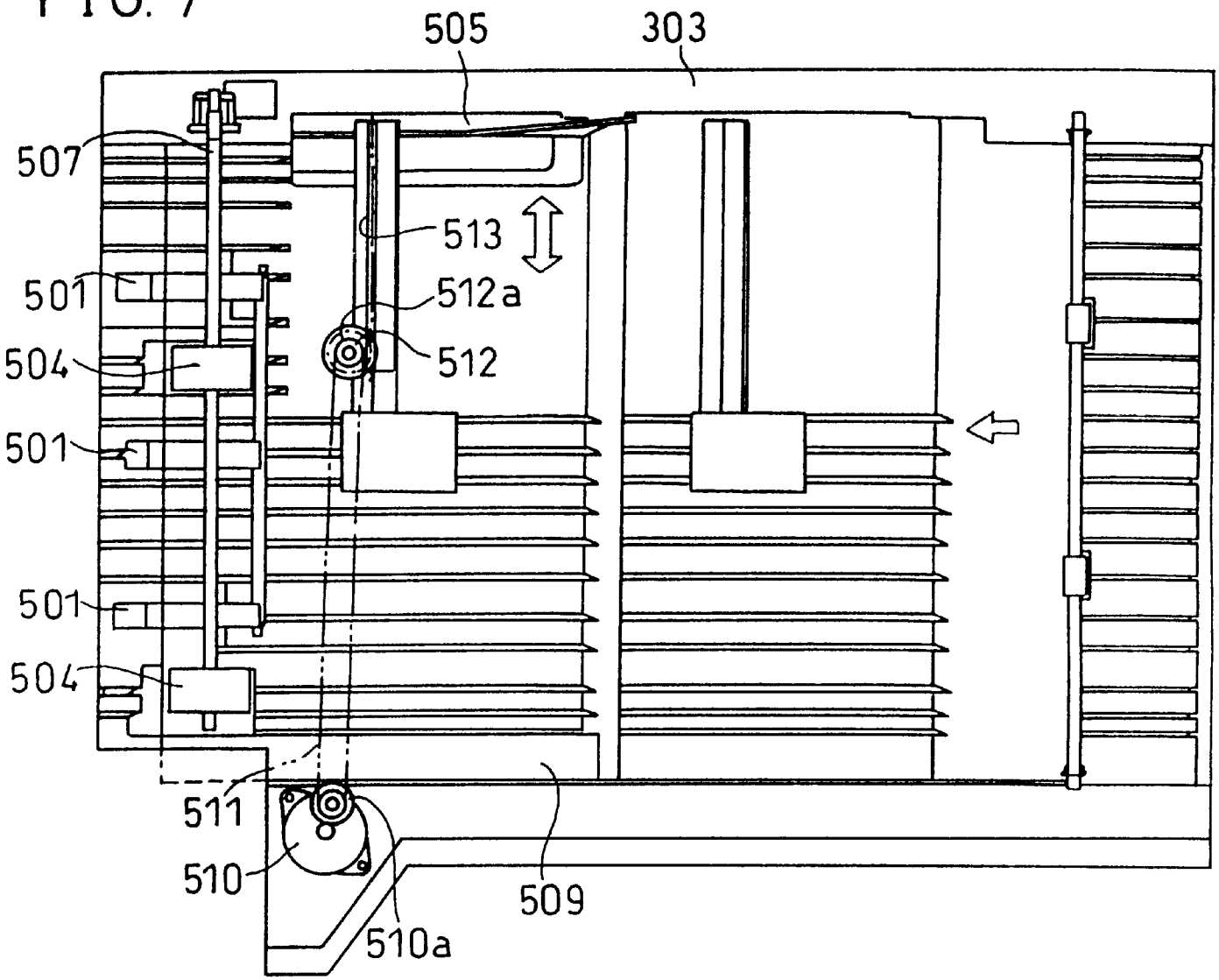
FIG. 7 is a schematic plan view that shows an adjusting member of a staple tray in a post-treatment device in the image-forming apparatus of FIG. 1.

Moreover, as illustrated in FIG. 7, the driving mechanism of the adjusting member 505 is constituted by a driving motor 510 placed on the staple tray 303 as a driving source, a pulley 510*a* for transmitting the torque of the driving motor 510, a driving belt 511 passed over the pulley 510*a*, a pulley 512 on which the driving belt 511 is passed over, a driving gear 512*a* that rotates in cooperation with the pulley 512, and a rack 513 that is engaged with the driving gear 512*a* and connected to the adjusting member 505.

In other words, in the adjusting member 505, the driving force of the driving motor 510 is transmitted to the driving gear 512*a* through the driving belt 511, and connected to the rack 513 engaged with the driving gear 512*a*.

Therefore, as the driving motor 510 rotates, the adjusting member 505 is allowed to shift in the direction of arrow, that is, toward the fixed wall 509 side.

Here, suppose that a state as shown in FIG. 7, that is, a state in which the adjusting member 505 is positioned at an end portion of the staple tray 303 in the width direction of the copy paper P, is a home position (first stand-by position). The adjusting member 505 is controlled in its shifting speed and amount of shift by the number of pulses inputted to the driving motor 510. In other words, upon completion of the adjustment of the copy paper P in the width direction, the driving motor 510 is reversely rotated so that the adjusting member 505 is shifted in a manner so as to depart from the fixed wall 509, and returned to the first stand-by position.

Referring to FIG. 7, an explanation will be given of the operation of the adjusting member 505 more specifically.

The above-mentioned adjusting member 505 is operated in a vertical direction to the transporting direction of the copy paper P; thus, based upon paper-size information sent from the main body, it is maintained at a stand-by position (hereinafter, referred to as a second stand-by position) +3 mm to +5 mm apart from the first stand-by position, taking into account deviations due to diagonal sending and off-centered sending.

Then, upon completion of storage of a sheet of copy paper P to the staple tray 303, that is, after the rear end of the sheet of copy paper P has passed a paper sensor A installed on the paper transport path 301 or a paper sensor C (see FIG. 8) installed on the staple tray 303, the adjusting member 505 starts an adjustment operation, and after the edge of the sheet of copy paper P, which is opposite to the edge of the sheet of copy paper P contacting the adjusting member 505, has come into contact with the fixed wall 509 on the staple tray 303, it further pushes this edge by approximately +1 mm to +3 mm from the width of the sheet of copy paper P, and then returns to the second stand-by position so as to be ready for the next incoming copy paper P. The adjusting member 505 repeats the above-mentioned operation each time a sheet of copy paper P is fed Successively, after sheets of paper as many as the number set by the operator have been fed and arranged, the adjusting member 505 is returned to a stand-by state at the paper size position, and maintains the sheets of copy paper P thus arranged so as not to be offset until the stapling process has been completed, and upon discharging the sheets of copy paper P, it is allowed to retreat to a position where it neither generates resistance, nor causes diagonal transpiration, that is, to the second stand-by position, and maintained at this position until completion of the discharging process.

Figure 8:
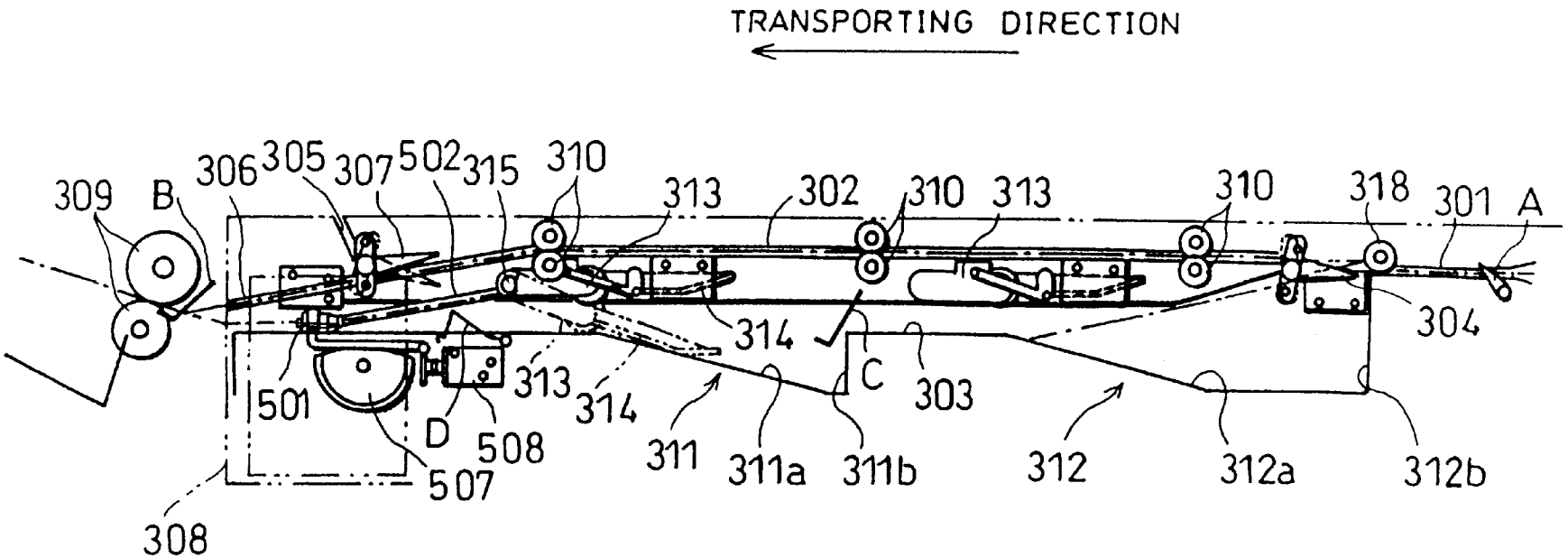
FIG. 8 is a schematic cross-sectional view of the staple tray shown in FIG. 7.
Figure 10:
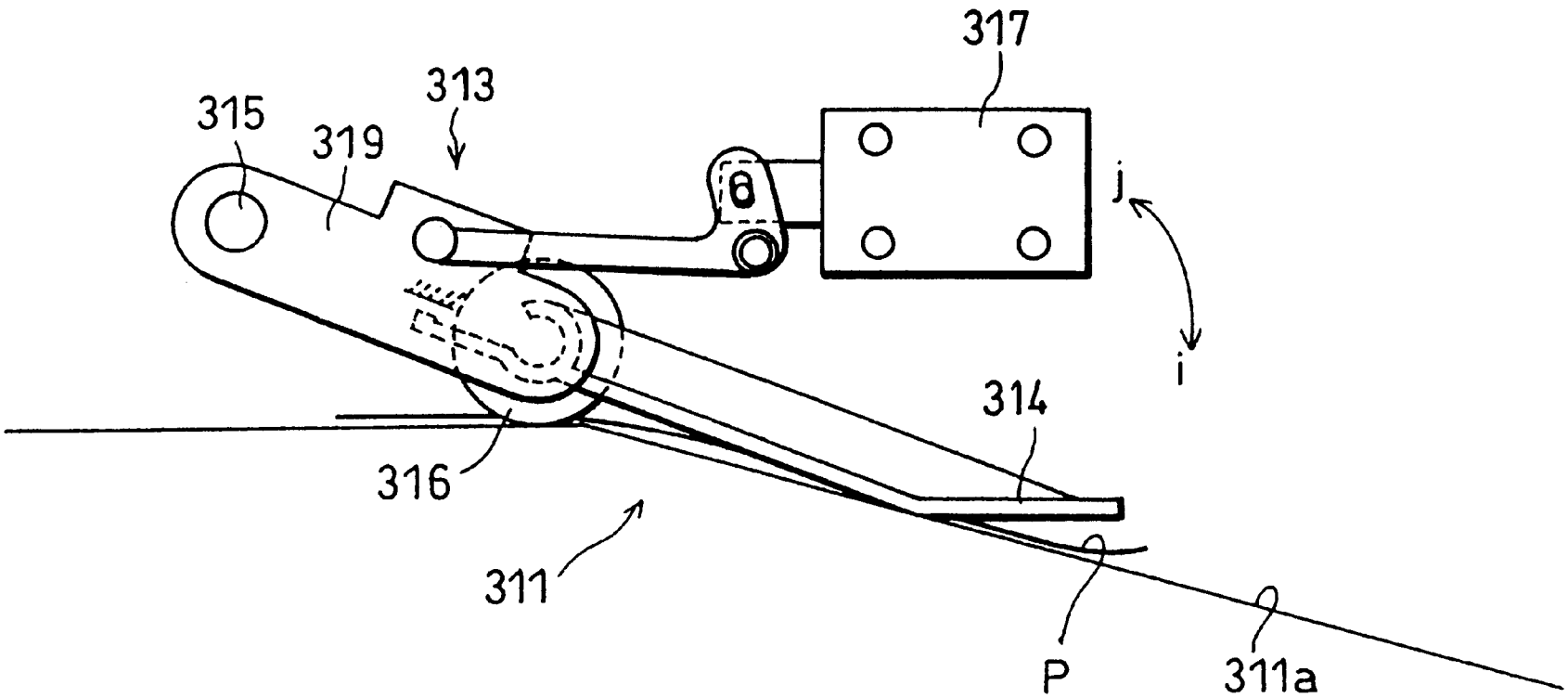
FIG. 10 is an explanatory drawing that shows the operation of the send-out member of the staple tray shown in FIG. 8.

Referring to FIGS. 8 and 10, a detailed explanation will be given of the escape path 302 and the staple tray 303.

As illustrated in FIG. 8, in the escape path 302, a plurality of pairs of transport rollers 310 are installed so as to transport the copy paper P in a sandwiched state. These transport rollers 310 are driven by a driving means, not shown.

In the above-mentioned staple tray 303, there are two adjustment sections (recessed sections) for adjusting sheets of paper, that is, a first adjustment section 311 and a second adjustment section 312.

The first adjustment section 311 is formed on the front side in the transporting direction of copy paper P from the second adjustment section 312, and is constituted by a slope face 311*a* inclined downward in the direction opposite to the transporting direction of copy paper P and a vertical face 311*b* at the lowest portion of the slope face 311*a*.

The second adjustment section 312 is, on the other hand, formed on the rear side in the transporting direction of copy paper P and is constituted by a slope face 312*a* inclined downward in the direction opposite to the transporting direction of copy paper P and a vertical face 312*b* at the lowest portion of the slope face 312*a*.

In the staple tray 303, the first adjustment section 311 and the second adjustment section 312 are used for respectively adjusting sheets of copy papers P of fixed sizes, and for example, the first adjustment section 311, placed on the front side in the transporting direction of the copy paper P, is formed so as to adjust copy paper P of B-5 size and A-4 size, and the second adjustment section 312, placed on the rear side in the transporting direction of the copy paper P, is formed so as to adjust copy paper P of B-4 size and A-3 size.

Moreover, the first adjustment section 311 and the second adjustment section 312 form a concave space against the escape path 302 so that, in the event of a paper jam inside the staple tray 303, this space makes it possible to easily remove the copy paper P from the staple tray 303.

The staple tray 303 is further provided with send-out members 313 which bends the sheets of copy paper P that have been adjusted in the first adjustment section 311 and the second adjustment section 312 over to the staple position of the staple unit 308.

The send-out members 313 are respectively placed above the slope face 311*a* of the first adjustment section 311 and also above the slope face 312*a* of the second adjustment section 312, and the respective send-out member 313 have the same structure. Therefore, the following description will only discuss the send-out member 313 related to the first adjustment section 311.

A detailed explanation will be given of the sendout member 313.

Figure 9:
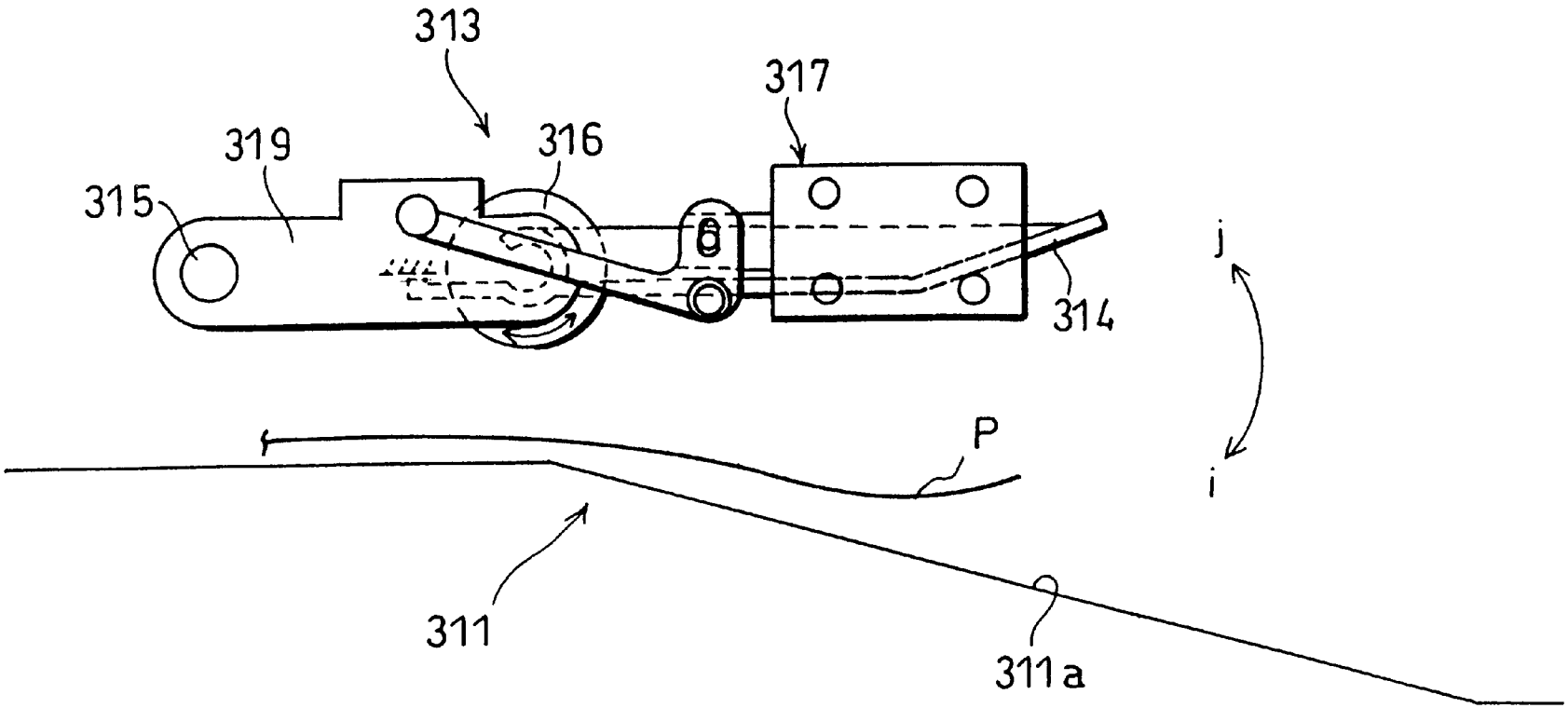
FIG. 9 is an explanatory drawing that shows the operation of a send-out member of the staple tray shown in FIG. 8.

As illustrated in FIGS. 9 and 10, the send-out member 313 sends a sheet of copy paper P on the slope face 311*a* toward the stopper 501 (FIG. 8) of the staple unit 308 (FIG. 8) by using a send-out roller 316 that moves up and down.

The send-out roller 316, which has the same structure as pickup rollers 224 and 227 installed in the image-forming apparatus main body 200, is connected to the roller arm 319 that is supported on the support shaft 315 so as to freely rotate thereon. The rotative driving operation of the send-out roller 316 is ON-OFF controlled by a clutch mechanism and the up and down movements of the roller arm 319 are controlled by a solenoid.

In other words, the send-out roller 316, which is set at a stand-by position in a state where it is recessed toward the slope face 311*a* side (FIG. 10), is raised (in a state shown in FIG. 9) upon turning ON of the solenoid in synchronism with the advance of the sheet of copy paper P, lowered upon passage of the sheet of copy paper P below the send-out roller 316, and allowed to rotate upon turning ON of the clutch mechanism so that it transports the sheet of copy paper P toward the stopper 501 (FIG. 8).

In this case, the rotation operation time of the send-out roller 316, that is, the amount of send-out of the sheet of copy paper P is controlled in the following control method: a timer control based upon the detection signal from the paper sensor A placed on the paper transport path 301 shown in FIG. 8 or the paper sensor C placed on the staple try 303; or detection of the raised state of the paper-leading-edge seize lever 502 caused by warping of the sheet of copy paper P; or detection of the contact of the leading edge of the sheet of copy paper P to the stopper 501; or a controlling mechanism in which the ON timing of the paper sensor C and a tray paper existence sensor D placed on the staple tray 303 upon receipt of a first sheet of copy paper is learned, and from the second sheet of copy paper on, the timer control based upon the ON timing of the paper sensor C is improved in its precision.

In this manner, the sheet of copy paper P is held by the paper-leading-edge seize levers 502 placed on the respective sides of the stopper 501, with the leading edge of the sheet of copy paper P being firmly in contact with the stopper 501.

In the above-mentioned staple tray 303, the following distances measured from the upstream side in the transporting direction of the copy paper P in succession are set to be shorter than the minimum size length permissible for the stapling process: the distance from he paper-discharge roller 318 to the first send-out member 313, the distance from the first send-out member 313 to the second send-out member 313, and the distance from the second feed-out member 313 to the paper-discharge roller 309.

Moreover, seize levers 314 for pressing the curling of the sheet of copy paper P on the slope face 311*a* are placed on the respective sides of the send-out roller 316.

As illustrated in FIG. 9, each of the seize levers 314 is allowed to pivot in the direction of arrow i or j on the rotary shaft of the send-out roller 316 serving as a fulcrum, and when the send-out roller 316 is positioned on the upper side, its shift is regulated by the roller arm 319 so that it is regulated and maintained virtually in parallel with the roller arm 319. In other words, since the roller arm 319 is restricted in its movement by a restriction member 317, the seize lever 314 is restricted so that it is only allowed to pivot to a predetermined position in the direction of arrow j. This predetermined position is defined as a position which prevents the seize lever 314 from entering the escape path 302 formed on the staple tray 303; and is not particularly limited.

Moreover, as illustrated in FIG. 10, when the send-out roller 316 is positioned on the lower side, the seize lever 314 functions so as to seize the sheet of copy paper P on the slope face 311*a*. Here, the pressing force of the seize lever 314 is set so that it allows the seize lever 314 to pivot by a predetermined amount in the direction of arrow j, that is, in the direction in which the seize lever 314 is pushed up by the curling of the sheet of copy paper P; thus, the pressing force is desirably set depending on the length and weight of the lever, and the spring force (pressing force), etc.

The following description will discuss the paper transporting operation in the image-forming apparatus having the above-mentioned arrangement. In the present image-forming process, the explanation exemplifies a one-side printing process for forming an image on one side of copy paper.

In the image-forming apparatus having the above-mentioned arrangement, in the case when the output to the first paper stack tray 401 is selected while the staple function and the off-set function are not selected, or in the case when, although the staple function and the off-set function are selected, a sheet of copy paper P has a paper size in which the output to the second paper stack tray 402 is inhibited or the stapling process is inhibited, the second switching gate 304 is allowed to pivot in the direction of arrow e (FIG. 3) so that the copy paper P is transported to the escape path 302, and the third switching gate 307 is further allowed to pivot in the direction of arrow g (FIG. 4) so that the sheet of copy paper P is discharged onto the first paper stack tray 401.

Moreover, even in the case when the first paper stack tray 401 is selected, if a large amount of copy paper P exceeding the amount of permissible load of the first paper stack tray 401 is outputted, the respective switching gates are switched so that the sheets of copy paper P are automatically discharged onto the first paper-discharge section 234 and the second paper stack tray 402 that are main-body stack sections, and the operator is informed of the fact that the output section (discharge section) has been altered through a display on the operation section (not shown) or the fact that the job in question is not started and that the output operation is not available.

Moreover, in the case when the output to the second paper stack tray 402 is selected and the off-set function is also selected, the sheet of copy paper P is transported to the escape path 302, and the third switching gate 307 is allowed to pivot in the direction of arrow h (FIG. 4) so that the sheet of copy paper P is outputted to the second paper stack tray 402 through the second paper-discharge path 306; thus, normal stacking and off-set stacking processes are carried out.

The above-mentioned switching gate control is carried out based upon paper size information, and the paper size information includes the size detection information of the paper cassettes 221 and size detection information of the manual insertion tray 222.

However, in the manual insertion tray 222, there are some sheets of copy paper P which can not be detected in their size when fed because of their irregular size, etc. In such a case, the paper size is judged by obtaining paper length information based upon the ON time of a sensor before the registration roller, etc. at the time of paper transportation. There are still some sheets of paper which have the same length, but different widths, such as A5 longitudinal feed and A4 transverse feed, etc. In this case, taking into account the switching time of the second switching gate 304, a paper sensor A (FIG. 8) may be placed at a position the corresponding distance apart therefrom so that although the A5 width is not detected, the A4 width is detected.

In the same manner, selection may be carried out before the first switching gate 235 so that those sheets of paper that are not allowed to enter the post-processing device 300 can be selected. In this case, control is made so as to switch the first switching gate 235 so that the sheets of copy paper P are discharged onto the first paper-discharge section 234 on the image-forming apparatus main body 200 side.

An explanation will be given of the sequence of the above-mentioned processes in detail.

Figure 11:
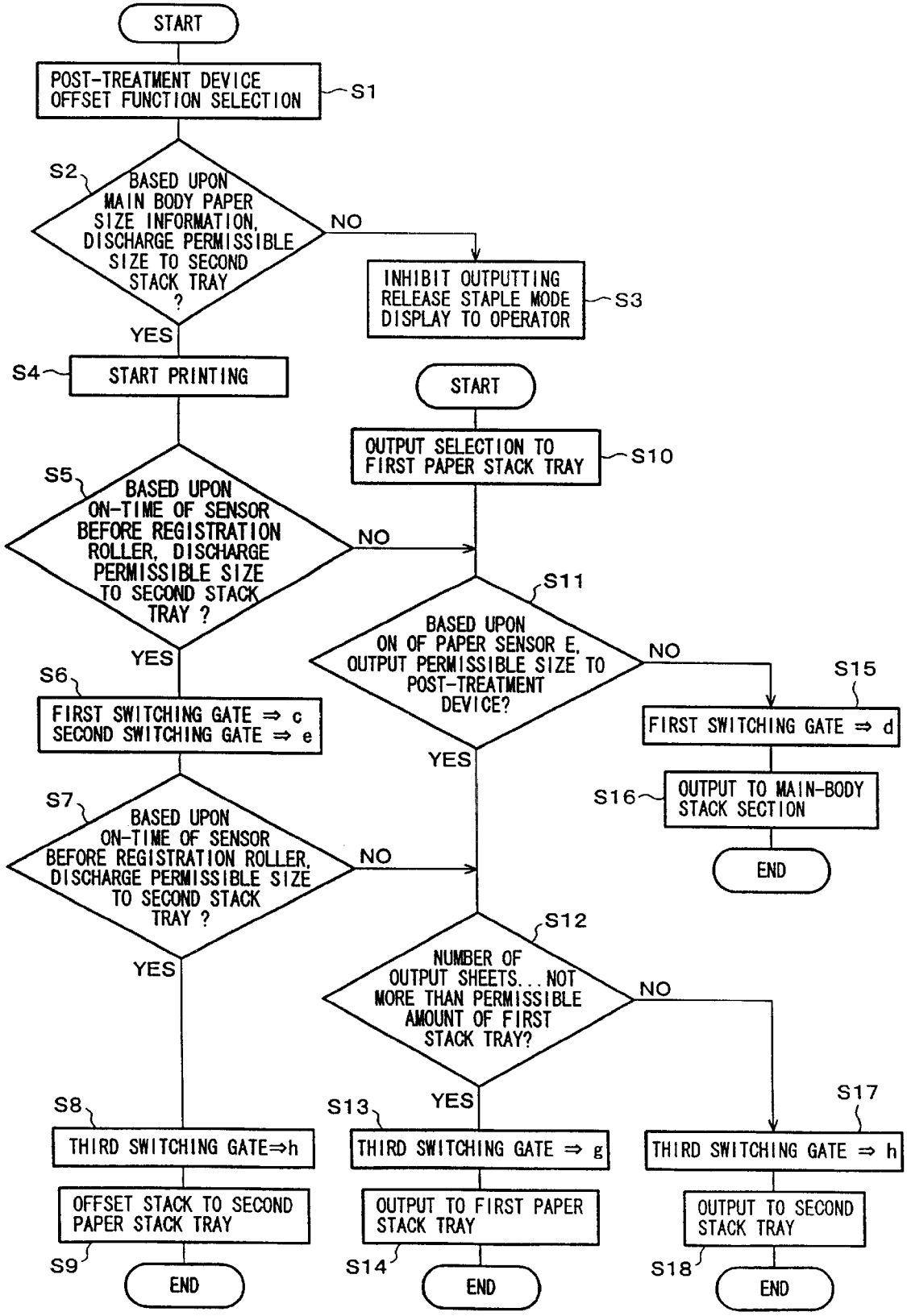
FIG. 11 is a flow chart that shows a sequence of paper-transporting processes in the case when an off-set function is selected in the image-forming apparatus shown in FIG. 1.

First, referring to FIGS. 1 through 4 as well as flow charts shown in FIG. 8 and FIG. 11, the following description will discuss the transporting operation of sheets of copy paper P, in the case when the off-set function of the post-treatment device 300 is selected.

First, the operator selects the off-set function of the post-treatment device 300 (step S1). Here, since this case deals with a one-sided printing process for forming an image on one side of a sheet of copy paper P, the switching gate 238, shown in FIG. 2, is fixed to a state in which it has pivoted in the direction of arrow b.

Next, based upon main-body paper-size information, a judgment is made as to whether or not the size selected by the operator is an output permissible size to the second paper stack tray 2 of the paper stack section 400 (step S2). Here, the paper size indicates the size and number of sheets of copy paper P that are to be discharged on the paper stack section 400.

Here, if the judgment shows that the paper size is not an output permissible size to the second paper stack tray 402, then the output is inhibited, and the off-set mode is cancelled; thus, the operator is informed of the corresponding information through a display on the display panel not shown (step S3).

In contrast, at step S2, if the judgment shows that the paper size is an output permissible size to the second paper stack tray 402, then a printing process is started (step S4).

Next, based upon ON time of the sensor before the registration roller, a judgment is made as to whether or not the paper size, selected by the operator, is an output permissible size to the second paper stack tray 402 of the paper stack section 400 (step S5). Here, the paper size indicates the size and the number of sheets of copy paper P that are to be discharged onto the paper stack section 400.

Here, if the judgment shows that the paper size is an output permissible size to the second paper stack tray 402, then the sequence proceeds to step S6, with the result that the first switching gate 235 is allowed to pivot in the direction of arrow c, while the second switching gate 304 is allowed to pivot in the direction of arrow e. In other words, the sheet of copy paper P is transported to the escape path 302 of the post-treatment device 300 through the paper transport path 301.

Successively, based upon ON time of the sensor before the registration roller, a judgment is made as to whether or not the paper size, selected by the operator, is an output permissible size to the second paper stack tray 402 of the paper stack section 400 (step S7). Here, the paper size indicates the size and the number of sheets of copy paper P that are to be discharged onto the paper stack section 400.

Here, if the judgment shows that the paper size is an output permissible size to the second paper stack tray 402, then the third switching gate is allowed to pivot in the direction of arrow h (step S8). In contrast, if the judgment shows that the paper size is not an output permissible size to the second paper stack tray 402, then the sequence proceeds to step S12. Here, processes after step S12 will be described later.

Then, sheets of copy paper P, which have passed through the escape path 302, are stacked on the second paper stack tray 402 in an off-set manner (step S9). Here, the second paper stack tray 402 is allowed to shift up and down depending on the amount of sheets of paper P thus stacked so that new sheets of copy paper P are always transported onto the uppermost face of the stacked sheets of copy paper P.

At Step S5, if the judgment shows that the paper size is not an output permissible size to the second paper stack tray 402, then the sequence proceeds to step S11. This step S11 is also carried out when the first paper stack tray 401 is selected as the output place of sheets of copy paper P (step S10).

At the above-mentioned step S11, based upon ON signal of a paper sensor E (FIG. 24) installed on the front side of the first switching gate 235 of the image-forming apparatus main body 200, a judgment is made as to whether or not the sheet of copy paper P being transported has an output permissible size. Here, if the judgment shows that the sheet of copy paper P being transported has an output permissible size, then the sequence proceeds to step S12, and if the judgment shows otherwise, then the first switching gate 235 is allowed to pivot in the direction of arrow (step S15) so that the sheet of copy paper P is outputted to the first paper-discharge section 234 that is included in the main body stack section (step S16).

At the above-mentioned step S12, a judgment is made as to whether or not the number of the output sheets is not more than the permissible amount of the first paper stack tray 401. In other words, a judgment is made as to whether or not the number of sheets of copy paper P to be outputted can be sufficiently stored in the first paper stack tray 401.

At the above-mentioned step S12, if the judgment shows that the amount of sheets of copy paper P to be stacked is within the permissible amount of the first paper stack tray 401, the third switching gate 307 is allowed to pivot in the direction of arrow g (step S13) so that the sheets of copy paper P are outputted to the first paper stack tray 401 (step S14).

In contrast, at step S12, if the judgment shows that the amount of sheets of copy paper P is not within the permissible amount of the first paper stack tray 401, the third switching gate 307 is allowed to pivot in the direction of arrow h (step S17), the sheets of copy paper P are outputted to the second paper stack tray 402 (step S18).

As described above, in the case when the offset function is selected at the post-treatment device 300, in accordance with the size and number of the sheets of copy paper P to be outputted, the sheets of copy paper P are outputted to any one of the first paper-discharge section 234, the first paper stack tray 401 and the second paper stack tray 402.

In particular, in the case when a large amount of copy paper P is outputted at once, if the sheet of copy paper is allowed to pass the post-treatment device 300, then the second paper stack tray 402 is used as the output destination of the sheets of copy paper P, and if the sheet of copy paper P is not allowed to pass the post-treatment device 300, then the first paper-discharge section 234 is selected as the output destination of the sheets of copy paper P.

Therefore, in the case when a large amount of copy paper P is outputted at once, since the sheets of copy paper P are controlled so as not to be outputted to the first paper stack tray 401 whose permissible amount of stacked copy paper is small, it is possible to eliminate problems such as a paper jam in the vicinity of the first paper stack tray 401.

Figure 12:
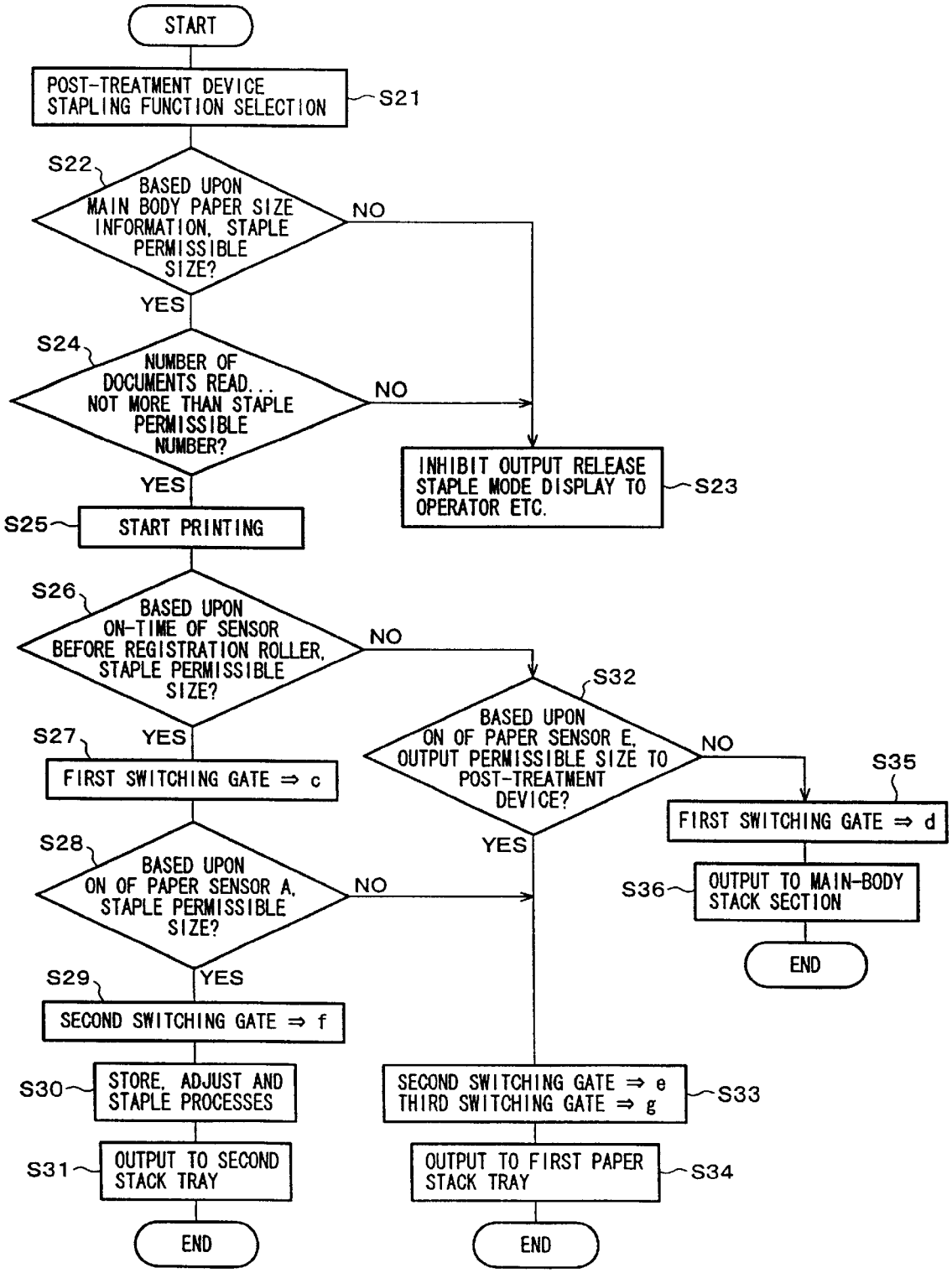
FIG. 12 is a flow chart that shows a sequence of paper-transporting processes in the case when a staple function is selected in the image-forming apparatus shown in FIG. 1.

Referring to FIGS. 1 through 4 and flow charts shown in FIGS. 8 and 12, the following description will discuss the transporting operation of copy paper P in the case when the staple function is selected in the post-treatment device 300.

First, the staple function using the post-treatment device 300 is selected by the operator (step S21). Here, in this case, since the one-sided printing operation for forming an image on one side of a sheet of copy paper P is carried out, the switching gate 238, shown in FIG. 2, is fixed in a state where it has been allowed to pivot in the direction of arrow b.

Next, based upon main-body paper size information, a judgment is made as to whether or not the paper size selected by the operator is a staple permissible size (step S22). The above-mentioned paper size indicates the size and number of sheets of copy paper P to be discharged onto the paper stack section 400.

Here, if the judgment shows that the paper size is not a staple permissible size, then, the output is inhibited, the staple mode is released, and the operator is informed of these facts through a display on a display panel, not shown (step S23).

In contrast, at step S22, if the judgment shows that the paper size is a staple permissible size, then a judgment is made as to whether or not the number of read documents is not more than the staple permissible number (step S24). Here, if the judgment shows that the sheets of copy paper P to be outputted have a staple permissible size, a printing operation is started (step S25). Here, at step S24, if the judgment shows that the paper size is not a permissible size, the sequence returns to step S23.

Successively, based upon ON time of the sensor before the registration roller, a judgement is made as to whether or not the paper size selected by the operator is a permissible size (step S26). Here, if the judgment shows that the paper size is a staple permissible size, the first switching gate 235 is allowed to pivot in the direction of arrow c (step S27), and based upon the time elapsed after the paper detection sensor A was turned on, a judgment is made as to whether or not the paper size selected by the operator is a staple permissible size (step S28).

At the above-mentioned step S28, if the judgment shows that the paper size is a staple permissible size, then the second switching gate 304 is allowed to pivot in the direction of arrow f (step S29), the sheets of copy paper P are housed at a predetermined position in the staple tray 303 corresponding to the paper size, and after having been adjusted, they are subjected to a staple process (step S30), and the resulting sheets of paper P are outputted to the second paper stack tray 402 (step S31).

In contrast, at step S28, if the judgment shows that the paper size is not a staple permissible size, then the sequence proceeds to step S33. An explanation will be given of this step S33 later.

Moreover, at the above-mentioned step S26, based upon the ON time of the sensor before the registration roller, if the judgment indicates that the paper size selected by the operator is not a staple permissible size, a judgment is made as to whether or not the sheet of copy paper P being transported has an output permissible size to the post-treatment device 300 based upon the ON signal of the paper detection sensor E (FIG. 24) (step S32). Here, if the judgment shows that the sheet of copy paper P being transported has an output permissible size to the post-treatment device 300, the second switching gate 304 is allowed to pivot in the direction of arrow e, and the third switching gate 307 is also allowed to pivot in the direction of arrow diagram g (step S33), thereby outputting the sheet of copy paper P to the first paper stack tray 401 (step S34).

In contrast, at step S32, if the judgment shows that the sheet of copy paper P being transported does not have an output permissible size to the post-treatment device 300, the first switching gate 235 is allowed to pivot in the direction of arrow d (step S35), thereby outputting the sheet of copy paper P to the first paper-discharge section 234 that is included in the main body stack section (step S36)

As described above, even in the case when the staple function is selected in the post-treatment device 300, any one of the first paper-discharge section 234, the first paper stack tray 401 and the second paper stack tray 402 is automatically selected, depending on whether or not stapling is available, or whether or not stacking is available, or other conditions; therefore, it is possible to prevent a paper jam, etc. caused by an erroneous operation made by the operator.

Figure 13:
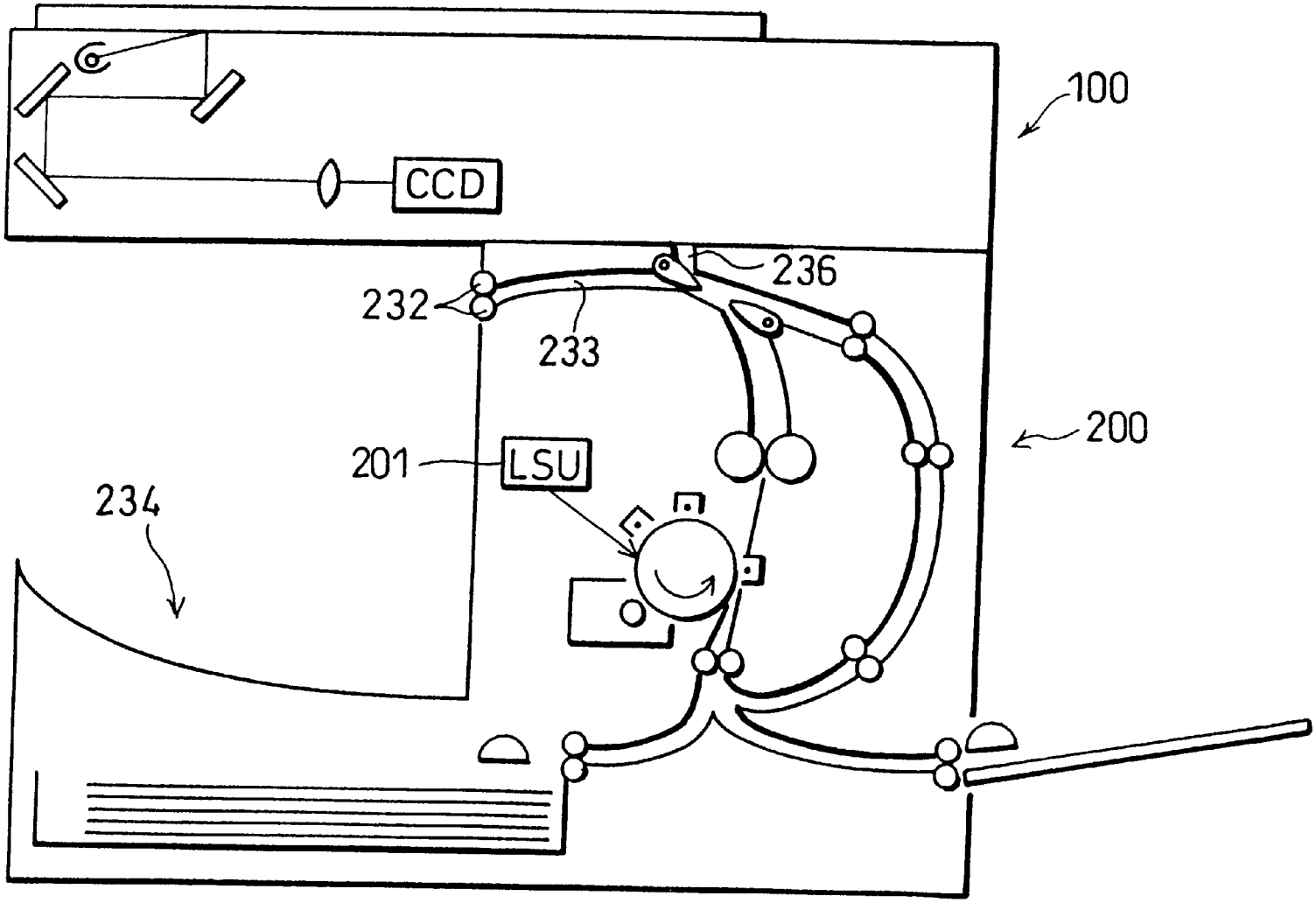
FIG. 13 is a schematic drawing that shows the structure of the image-forming apparatus from which the post-treatment device has been removed in the image-forming apparatus shown in FIG. 1.

In the above-mentioned image-forming apparatus, the post-treatment device 300 and the paper stack section 400 are freely detachable so that the user can attach and detach these devices on demand. In the case when the above-mentioned post-treatment device 300 and the paper stack section 400 has been removed, as illustrated in FIG. 13, the document reading section 100 is directly attached to the upper portion of the image-forming apparatus main body 200. In this case, with respect to the discharge section, only the first paper-discharge section 234, formed in a space below the document reading section 100, is left.

Figure 14:
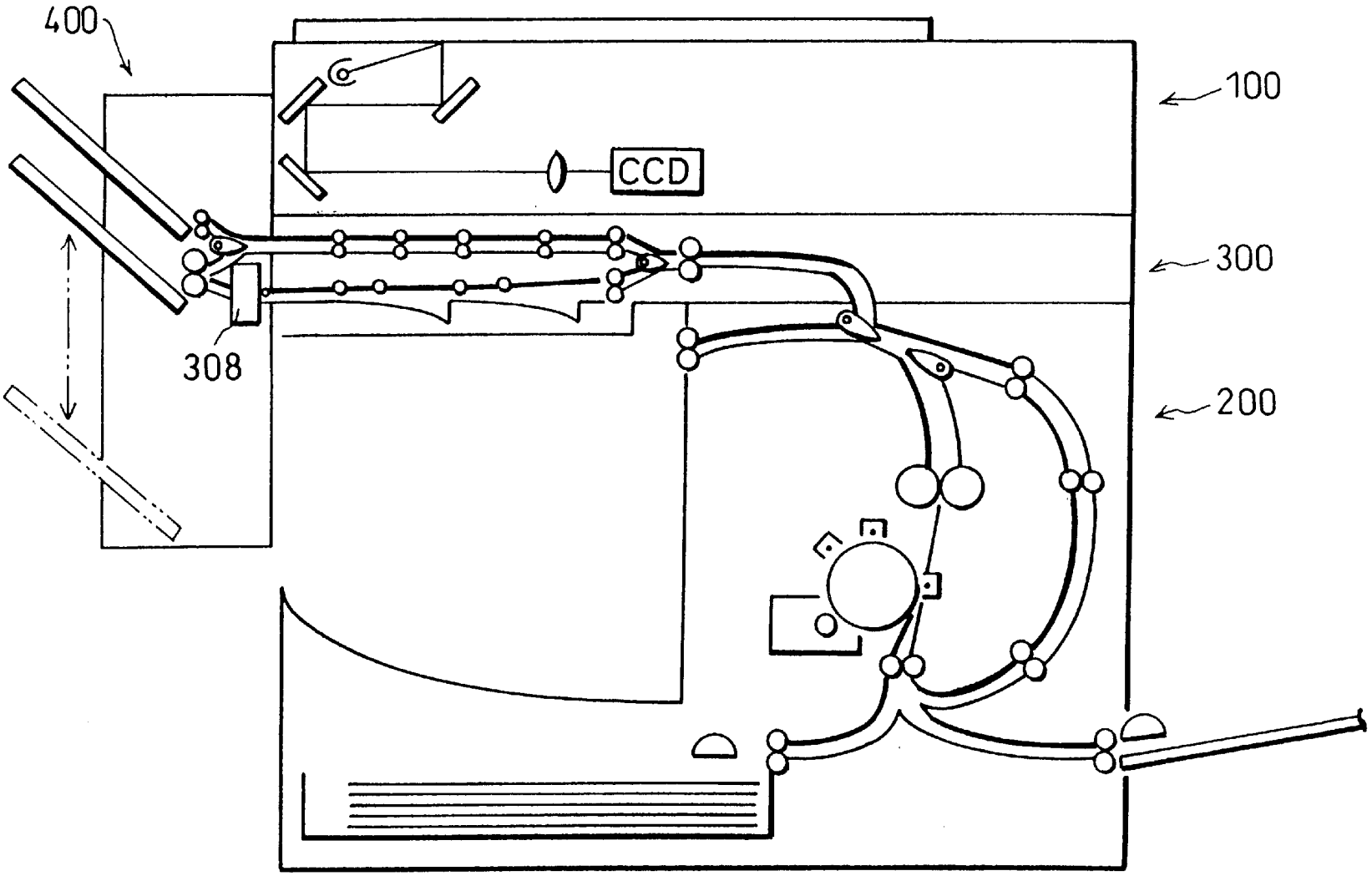
FIG. 14 is a schematic drawing that shows an image-forming apparatus in accordance with another embodiment of the present invention.

Moreover, as illustrated in FIG. 1, in the image-forming apparatus having the above-mentioned arrangement, the staple unit 308 in the post-treatment apparatus 300 is placed in a space below the document reading section 100; however, the present invention is not intended to be limited by this structure, and for example, as illustrated in FIG. 14, the staple unit 308 may be installed inside the paper stack section 400. In this case, the paper stack section 400 has not only a stacking function, but also a paper stapling function.

In the image-forming apparatus having the above-mentioned arrangement, an explanation has been given on the assumption that the escape path 302 and the staple tray 303 are driven by individual driving sources; however, the following description will discuss a case in which the escape path 302 and the staple tray 303 sharedly use the send-out roller 316 that is the driving roller of the transport rollers 310. Here, for convenience of description, those members having the same functions as the members shown in FIGS. 8 to 10 are indicated by the same reference numerals, and the description thereof is omitted.

Figure 15:
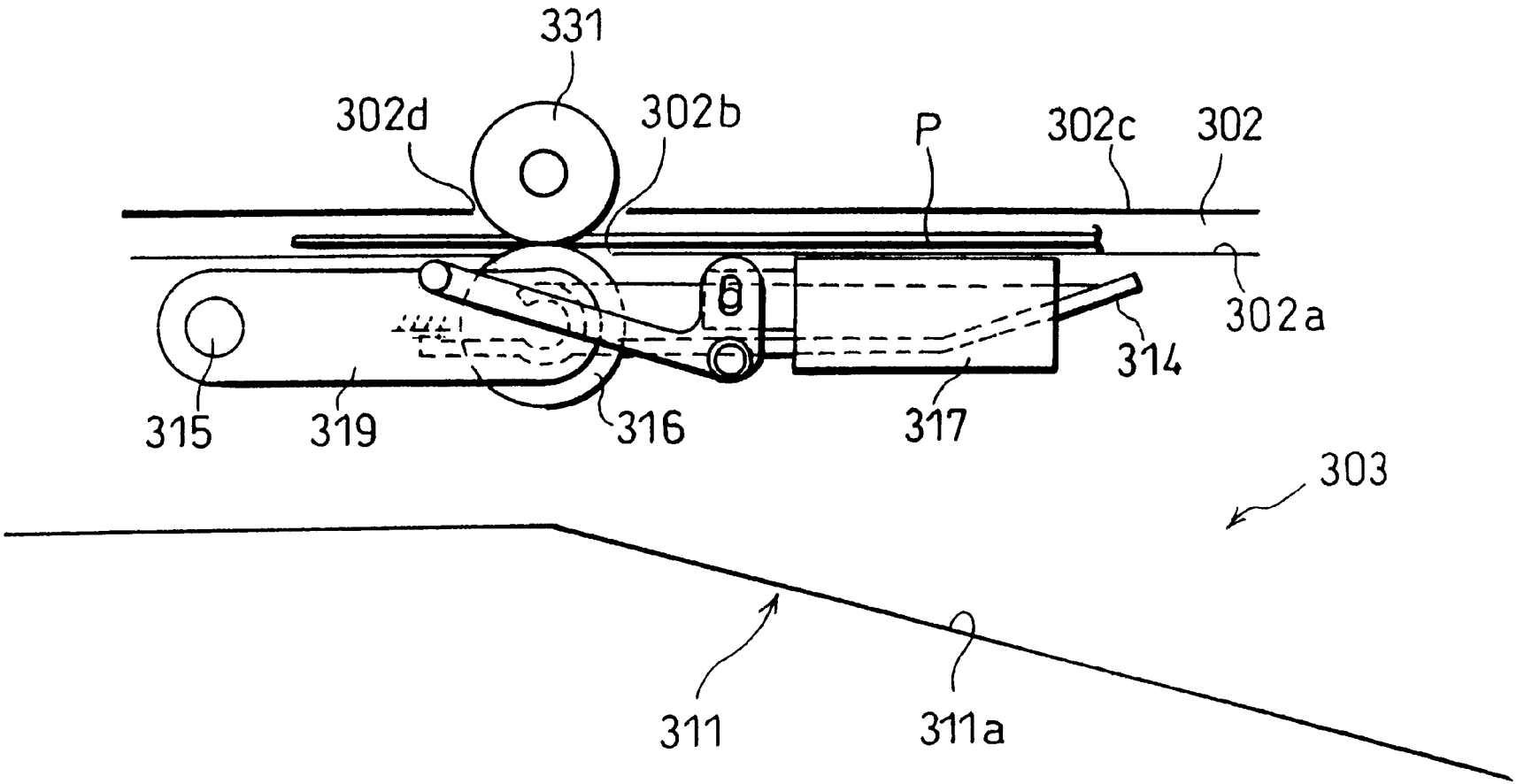
FIG. 15 is an explanatory drawing that shows one example in which a driving roller for transporting sheets of paper is sharedly used in an escape path and the staple tray in the image-forming apparatus of the present invention.

For example, as illustrated in FIG. 15, an opening section 302*b* one portion of which is allowed to protrude when the send-out roller 316 is shifted upward is formed in a central paper guide 302*a* forming the lower surface of the escape path 302. Moreover, to the escape path 302 is attached a pressing roll 331 which presses the send-out roller 316 protruding from the central paper guide 302*a* from above. Here, the opening section 302*b* is set to be smaller than the diameter of the pressing roll 331.

The central paper guide 302*a* is a common member which forms a lower surface member of the escape path 302 and also forms an upper surface member of the staple tray 303.

An opening section 302*d* through which the pressing roll 331 is allowed to penetrate from above is formed in an upper paper guide 302*c* that faces the central paper guide 302*a* of the escape path 302. Thus, the pressing roll 331 is pressed downward by an elastic member such as a spring, and as illustrated in FIG. 16, in the case when the send-out roller 316 is shifted toward an slope face 311*a,* it penetrates through the opening section 302*d* of the upper paper guide 302*c* of the escape path 302, and its movement is then regulated by the opening section 302*b* of the central paper guide 302*a.*

Therefore, in the case when a sheet of copy paper P is transported through the escape path 302, as illustrated in FIG. 15, one portion of the send-out roller 316 is allowed protrude from the opening section 302*b* of the central paper guide 302*a,* and shifted so as to contact the pressing roll 331; thus, the sheet of copy paper P is directed to the nip section formed between the send-out roller 316 and the pressing roll 331 so that the sheet of copy paper P is transported.

Figure 16:
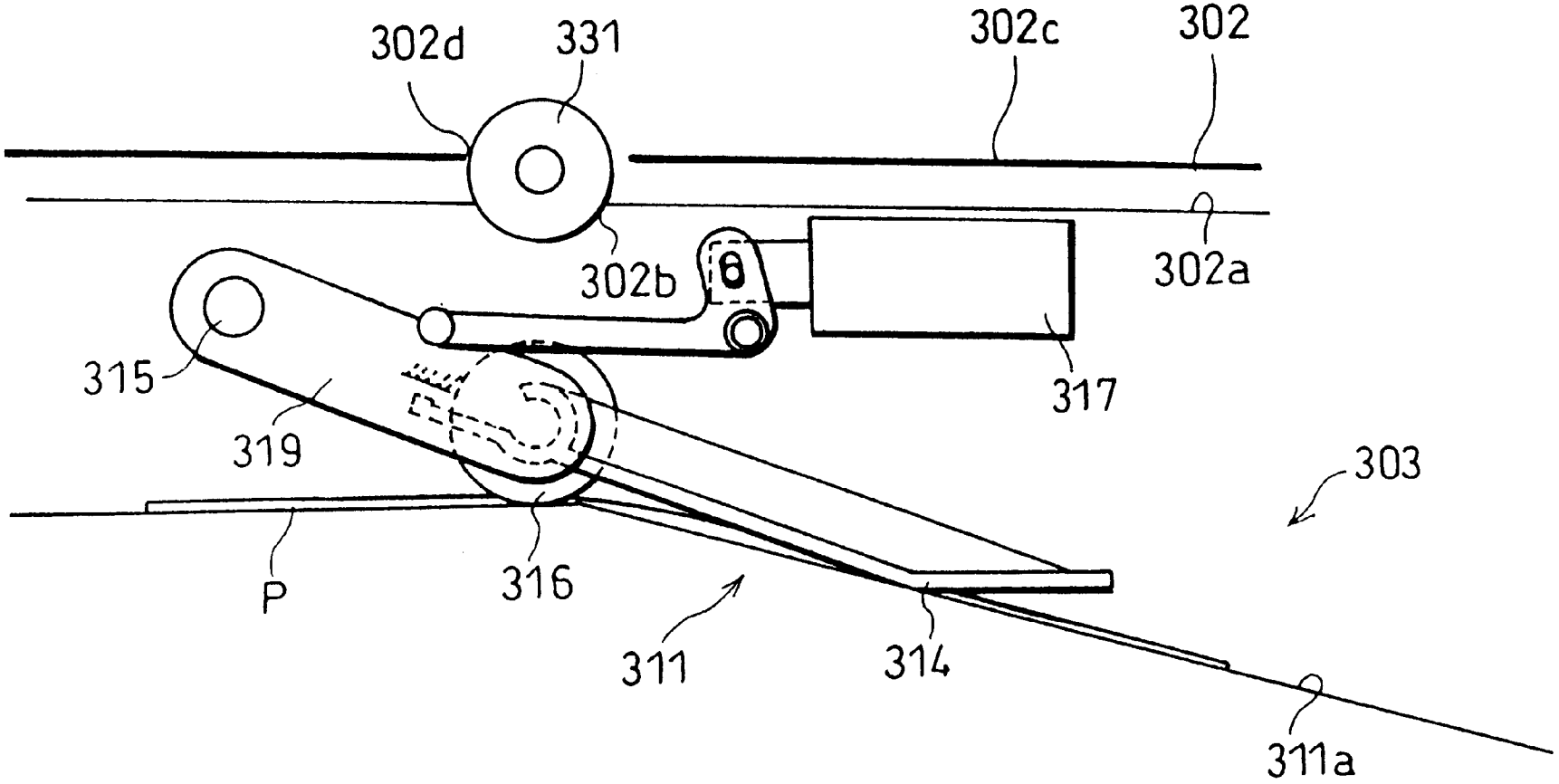
FIG. 16 is an explanatory drawing that shows another example in which a driving roller for transporting sheets of paper is sharedly used in the escape path and the staple tray in the image-forming apparatus of the present invention.

On the other hand, in the case when a sheet of copy paper P is transported through the staple tray 303, as illustrated in FIG. 16, the send-out roller 316 is shifted in a manner so as to contact the slope face 311*a*. At this time, the sheet of copy paper P, placed on the slope face 311*a,* is transported by the torque of the send-out roller while being pressed by the seize lever 314 that has been shifted downward in cooperation with the shift of the send-out roller 316.

In other words, as illustrated in FIG. 16, in a state where the send-out roller 316 is in a low level, the pressing roll 311 is pressed downward by the pressing force, and is stopped by the opening section 302*b* of the central paper guide 302*a* serving as a stopper.

Then, as illustrated in FIG. 15, in the case when a sheet of copy paper P is transported through the escape path 302, the pressing roll 331 is raised by the send-out roller 316 that is shifted upward upon receipt of ON of the solenoid, and driven by the send-out roller 316 that starts to rotate upon turning on the clutch mechanism. At this time, the pressing force of the pressing roll 331 for generating the transporting force for the sheet of copy paper P, derived from the send-out roller 316, is set to a degree of strength so as not to allow the sheet of copy paper P to slip, thereby making it possible to positively carry out the sheet of copy paper P.

Moreover, in the case when a sheet of copy paper is transported through the staple tray 303, as illustrated in FIG. 16, the send-out roller 316 is maintained in contact with the slope face 311*a* at a low level, that is, at a stand-by position. Then, the send-out roller 316 is shifted upward upon receipt of ON of the solenoid in synchronism with the advance of the sheet of copy paper P, and in the synchronized timing with the sheet of copy paper P passing below the send-out roller 316, it is shifted downward, and allowed to rotate upon receipt of ON of the clutch mechanism so that the sheet of copy paper P is transported toward to stopper 501 of the staple unit 308.

In this case, the rotation operation time of the send-out roller 316, that is, the amount of send-out of the sheet of copy paper P is controlled in the following control method: a timer control based upon the detection signal from the paper sensor A placed on the paper transport path 301 shown in FIG. 8 or the paper sensor C placed on the staple tray 303; or detection of the raised state of the paper-leading-edge seize lever 502 caused by warping of the sheet of copy paper P; or detection of the contact of the leading edge of the sheet of copy paper P to the stopper 501; or a controlling mechanism in which the ON timing of the paper sensor C and a tray paper existence sensor D placed on the staple tray 303 upon receipt of a first sheet of copy paper is learned, and from the second sheet of copy paper on, the timer control based upon the ON timing of the paper sensor C is improved in its precision.

In this manner, the sheet of copy paper P is held by the paper-leading-edge seize levers 502 placed on the respective sides of the stopper 501, with the leading edge of the sheet of copy paper P being firmly in contact with the stopper 501.

Moreover, in the case when the send-out roller 316 is sharedly used by the escape path 302 and the staple tray 303, the send-out roller 316 serving as the driving roller is controlled in its rotation so that the transporting force for transporting the sheet of copy paper P along the escape path 302 becomes stronger than the transporting force for transporting the sheet of copy paper P along the staple tray 303.

In other words, with respect to the transporting force of the sheet of copy paper P in the escape path 302, it is preferable to set it as strong as possible so as to positively transport the sheet of copy paper P; in contrast, with respect to the transporting force of the sheet of copy paper P in the staple tray 303, it is preferable to set it as weak as possible. The reason is that, since the leading edge of the sheet of copy paper P is always maintained in contact with the stopper 501 of the staple unit 308, the strong transporting force of the sheet of copy paper P might cause a paper jam.

Therefore, when a sheet of copy paper P is transported through the staple tray 303, the transporting force of the copy paper P by the send-out roller 316 is set at a minimum magnitude required so as to transport the sheet of copy paper P. The transporting force in this case is set, for example, is such a magnitude that the sheet of copy paper P is allowed to move while sliding on sheet of copy paper P stacked on the slope face 311*a* for stapling or the guide plate. Since the sheet of copy paper is transported in this manner, the sheets of copy paper P are free from scratches and damages.

Moreover, even when the control of the amount of send-out of the sheet of copy paper P is disturbed due to noise such as static electricity, etc., causing a load to be applied to a sheet of copy paper P with the leading edge of the sheet of copy paper P contacting the stopper 501 of the staple unit 308, the sheet of copy paper is allowed to slip on the send-out roller 316, therefore, it is possible to prevent paper jam due to excessive feeding of the sheet of copy paper P and damages to the sheet of copy paper P, and consequently to properly adjust the leading edge of the sheet of copy paper P.

Figure 17:
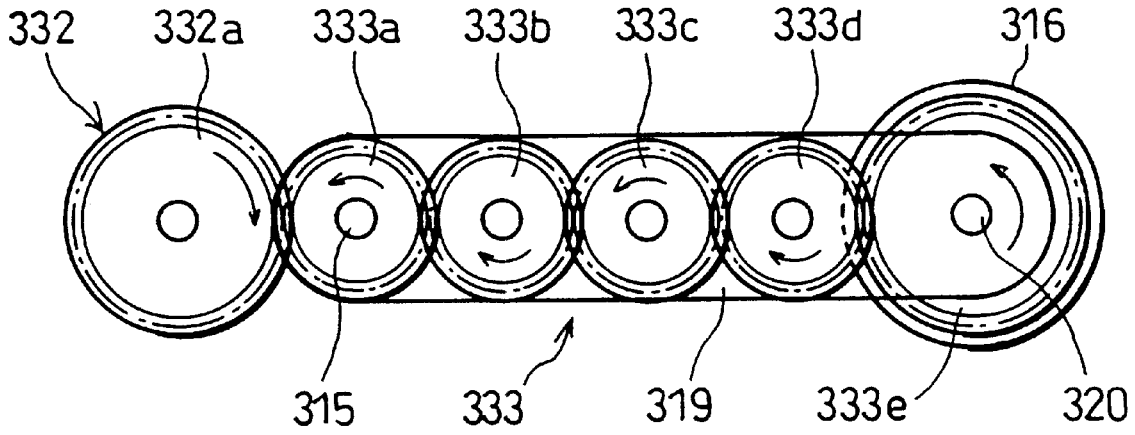
FIG. 17 is an explanatory drawing that shows one example of a transmission means for a driving force from the driving roller to the shared roller.
Figure 18:
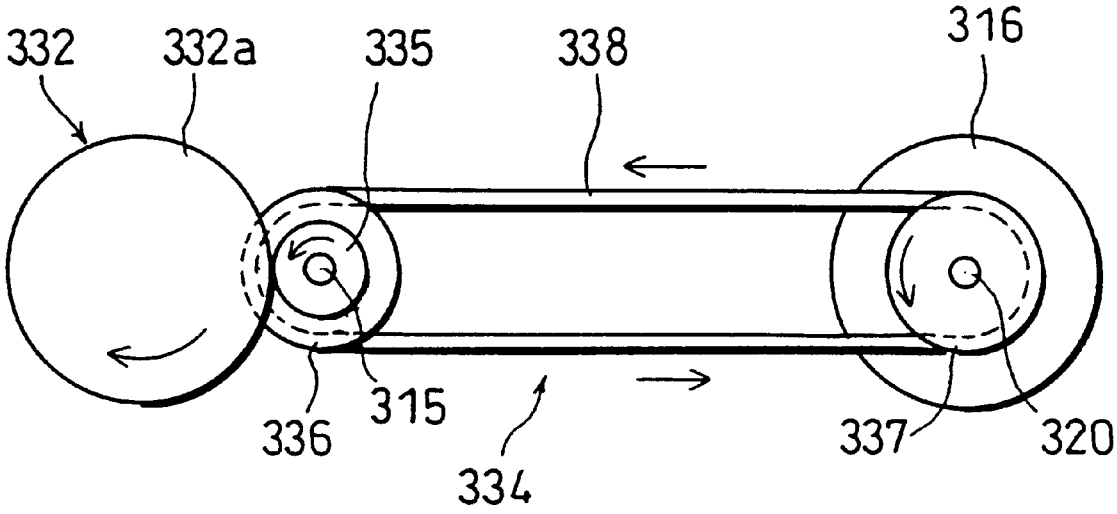
FIG. 18 is an explanatory drawing that shows another example of the transmission means for a driving force from the driving roller to the shared roller.

Referring to FIG. 17 and 18, the following description will discuss the driving mechanism of the send-out roller 316.

As illustrated in FIG. 17, the driving mechanism is constituted by a driving source 332 and a driving transmission section 333 for transmitting the driving force of the driving source 332 to the send-out roller 316.

The driving source 332 has a gear 332*a* that is driven to rotate forwardly as well as reversely. Moreover, the driving transmission section 333 is provided with a first gear 333*a* engaging the above-mentioned gear 332*a,* a second gear 333*b* engaging the first gear 333*a,* a third gear 333*c* engaging the second gear 333*b,* a fourth gear 333*d* engaging the third gear 333*c,* a fifth gear 333*e* engaging the fourth gear 333*d.*

The first gear 333*a* is attached to the support shaft 315 that serves as a rotation fulcrum for the roller arm 319, and the fifth gear 333*e* is designed so as to rotate integrally with the send roller 316 on the support shaft 320 that is the rotation fulcrum of the send-out roller 316. Moreover, the second to fourth gears 333*b* to 333*d* are supported by support members, not shown, that are arranged so as to rotate in cooperation with the roller arm 319.

In other words, the driving force of the driving source 332 is transmitted from the gear 332*a* to the first gear 333*a* of the driving transmission section 333, and is successively transmitted to the second gear 333*b,* the third gear 333*c,* the fourth gear 333*d* and the fifth gear 333*e* so that the send-out roller 316.

Here, a driving transmission section 334 as shown in FIG. 18 may be used in place of the driving transmission section 333 as a driving mechanism. This driving transmission section 334, which is supported by a support shaft 315, is constituted by a gear 335 engaging a gear 332*a* of the driving source 332, a first pulley 336 that is supported by the common support shaft 315 of the gear 335 and that rotates in cooperation with the rotation of the gear 335, a second pulley 337 supported on a support shaft 320 of the send-out roller 316, and a belt 338 that is passed around the first pulley 336 and the second pulley 337.

In other words, the send-out roller 316 is driven to rotate through the following sequence: The driving force of the driving source 332 is transmitted to the gear 335 engaging the gear 332*a,* the first pulley 336 connected to the gear 335 is rotated, and the rotation force of the first pulley 336 is transmitted to the second pulley 337 through the belt 338, thereby allowing the send-out roller 316 to rotate.

In the image-forming apparatus having the above-mentioned arrangement, the claw shaped switching gate is used so as to switch the transport path of the sheet of paper; however, the present invention is not intended to be limited thereby, and, for example, the transport path of the sheet of copy paper P may be switched by using three concatenation rollers as described below.

Figure 19:
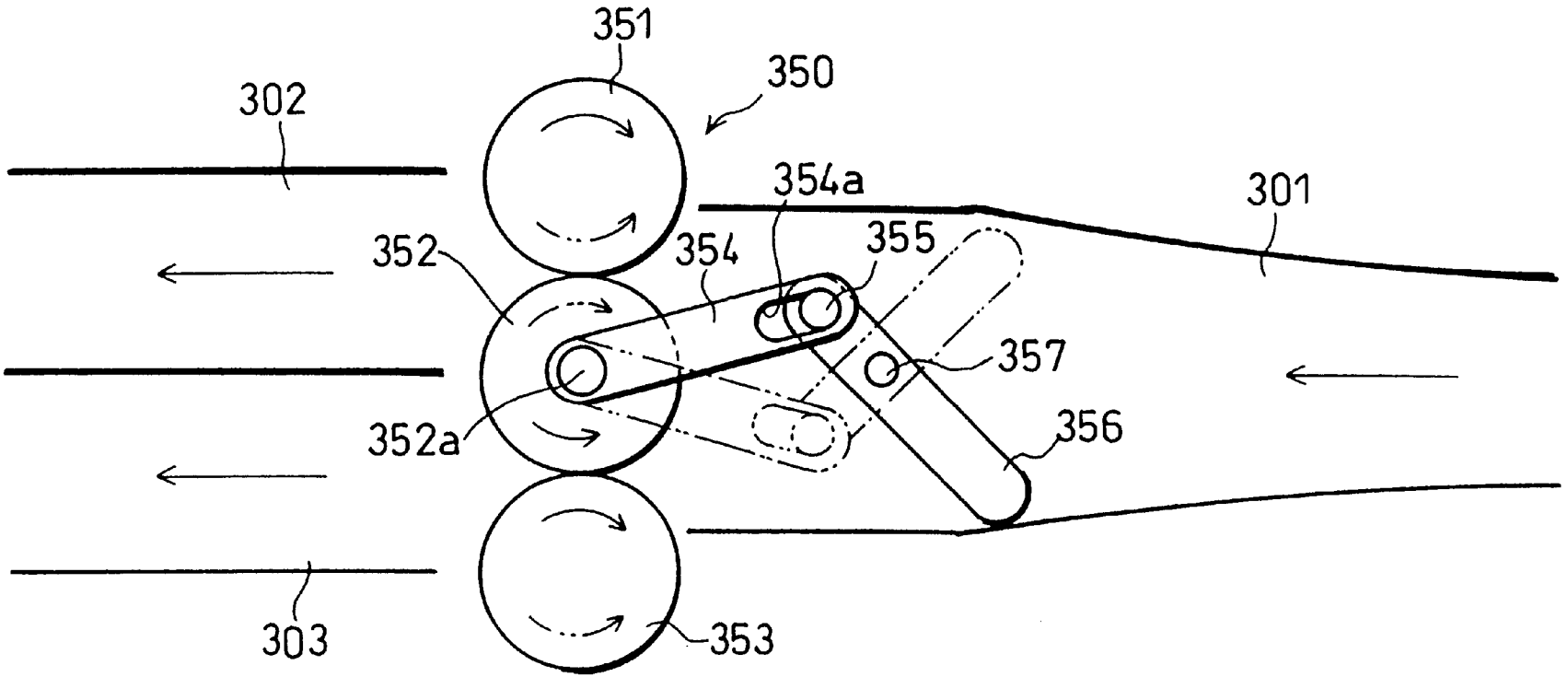
FIG. 19 is an explanatory drawing that shows a case in which three concatenation rollers are used as a diverging means for a sheet of paper within a paper transport path in the image-forming apparatus of the present invention.

Here, an explanation will be given of a case in which, in the post-treatment device 300 shown in FIG. 1, instead of the second switching gate 304 for making switches from the paper transport path 301 to either the escape path 302 or the staple tray 303, a switching means 350 consisting of the three concatenation rollers shown in FIG. 19 is used.

As illustrated in FIG. 19, the switching means 350 is constituted by the three concatenation rollers including a first roller 351, a second roller 352 and a third roller 353 that are placed at the junction between the escape path 302 and the staple tray 303 in a linked manner so as to freely rotate thereon, and has an arrangement in which a sheet of copy paper P ejected from the nip section formed between the first roller 351 and the second roller 352 is discharged onto the escape path 302, and a sheet of copy paper P ejected from the nip section formed between the second roller 352 and the third roller 353 is discharged on the staple tray 303.

Moreover, the second roller 352 is a driving roller and the driving force thereof is transmitted to the first roller 351 and the third roller 353. Moreover, a rod-shaped first gate member 354 is attached to a support shaft 352*a* of the second roller 352 in an extending fashion toward the paper transport path 301 so as to move with the rotation of the second roller 352.

One end of the first gate member 354 is supported on the support shaft 352*a* of the second roller 352, and an opening section 354*a* is formed in the other end. A rod-shaped second gate member 356 is placed in the opening section 354*a* so as to freely pivot therein through the support shaft 355.

The second gate member 356 one end of which is supported on the support shaft 355 in the opening section 354*a* of the first gate member 354 is supported virtually at the center on a fixed shaft 357 secured to the apparatus main body, so as to freely rotate thereon. Here, the opening section 354*a* of the first gate member 354 forms an idle section at the time when the first gate member 354 and the second gate member 356 are driven in association with each other.

Figure 20A:
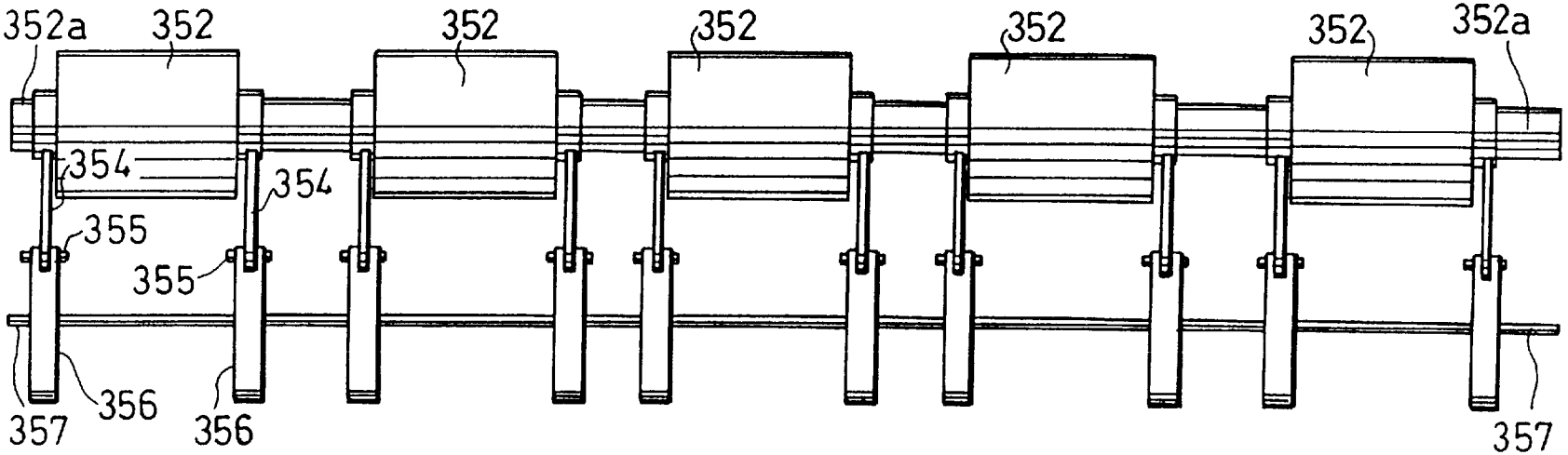
FIG. 20(*a*) is a plan view that shows the three concatenation rollers shown in FIG. 19.
Figure 20B:
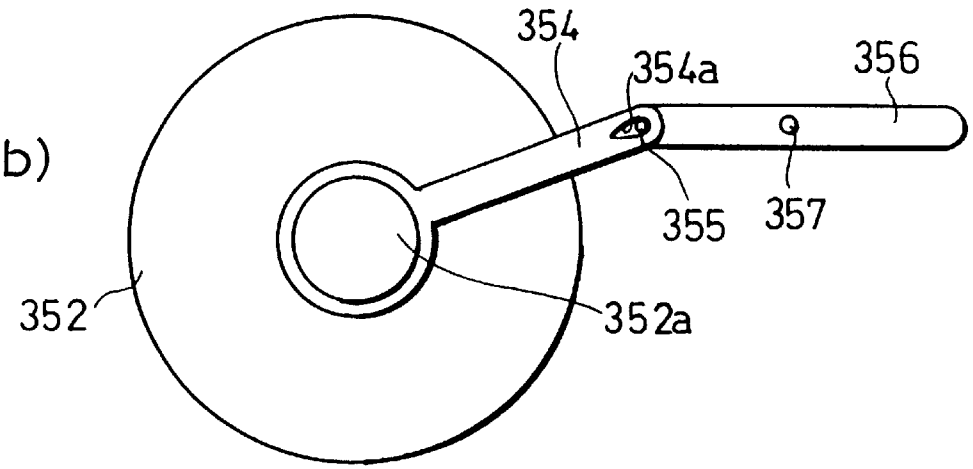

As illustrated in FIGS. 20(*a*) and 20(*b*), the first gate member 354 and the second gate member 356 are placed on both of the side faces of each second roller 352, and the minimum gap between the adjacent second gate members 356 is set smaller than the width of the minimum size of a sheet of copy paper P transported to the post-treatment device 300. Thus, it is possible to positively diverge the sheet of copy paper P.

Moreover, the first gate member 354 is supported on the support shaft 352*a* of the second roller 352 with an appropriate frictional force. Thus, when the second roller 352 rotates, the first gate member 354 is allowed to rotate in the same direction as the second roller 352 by the frictional force exerted between the first gate member 354 and the support shaft 352*a*. Here, with respect to the first gate member 354 and the support shaft 352*a*, when a force exceeding a predetermined value is applied to the first gate member 354, the first gate member 354 is allowed to slip thereon.

Moreover, the fixed shaft 357 is arranged virtually in parallel with the support shaft 352*a* of the second roller 352, and when the second roller 352 is rotated in the direction of the solid line arrow, the first gate member 354 is rotated upward by a frictional force against the support shaft 352*a*. This upward rotation of the first gate member 354 rotates downward the end portion of the second gate member 356 on the upstream side in the transporting direction of the sheet of copy paper P centered on the fixing shaft 357, and allows it to come into contact with the lower face of the paper transport path 301 (in a state indicated by a solid line arrow in FIG. 19). This state is referred to as a first position. This first position is maintained by the first gate member 354 and the support shaft 352*a* when they slip on each other while the second roller 352 is rotating in the direction of the solid line arrow.

In the first position, the end portion of the second gate member 356 on the upstream side in the transporting direction of the sheet of copy paper P is maintained in contact with the lower face of the paper transport path 301 in a low level; therefore, a sheet of copy paper P, transported through the paper transport path 301, is directed by the second gate member 356 and the first gate member 354, and transported between the first roller 351 and the second roller 352. Since these first roller 351 and second roller 352 are rotated in the direction of the solid line arrow, the sheet of copy paper P transported to the nip section formed between the first roller 351 and the second roller 352 is allowed to pass through the nip section and transported to the escape path 302.

In other words, in an attempt to transport a sheet of copy paper P to the escape path 302, control is provided so as to rotate the second roller 352 in the direction of the solid line arrow so that the first gate member 354 and the second gate member 356 are maintained in the first position.

In contrast, when the second roller 352 is rotated in the direction of the broken line arrow, the first gate member 354 is rotated downward by a frictional force against the support shaft 352*a*. This downward rotation of the first gate member 354 rotates upward the end portion of the second gate member 356 on the upstream side in the transporting direction of the sheet of copy paper P centered on the fixing shaft 357, and allows it to come into contact with the upper face of the paper transport path 301 (in a state indicated by a broken line in FIG. 19). This state is referred to as a second position. This second position is maintained by the first gate member 354 and the support shaft 352*a* when they slip on each other while the second roller 352 is rotating in the direction of the broken line arrow.

In the second position, the end portion of the second gate member 356 on the upstream side in the transporting direction of the sheet of copy paper P is maintained in contact with the upper face of the paper transport path 301 in a high level; therefore, a sheet of copy paper P, transported through the paper transport path 301, is directed by the second gate member 356 and the first gate member 354, and transported between the second roller 352 and the third roller 353. Since these second roller 352 and third roller 353 are rotated in the direction of the broken line arrow, the sheet of copy paper P transported to the nip section formed between the second roller 352 and the third roller 353 is allowed to pass through the nip section and transported to the staple tray 303.

In other words, in an attempt to transport a sheet of copy paper P to the staple tray 303, control is provided so as to rotate the second roller 352 in the direction of the broken line arrow so that the first gate member 354 and the second gate member 356 are maintained in the second position.

Figure 21:
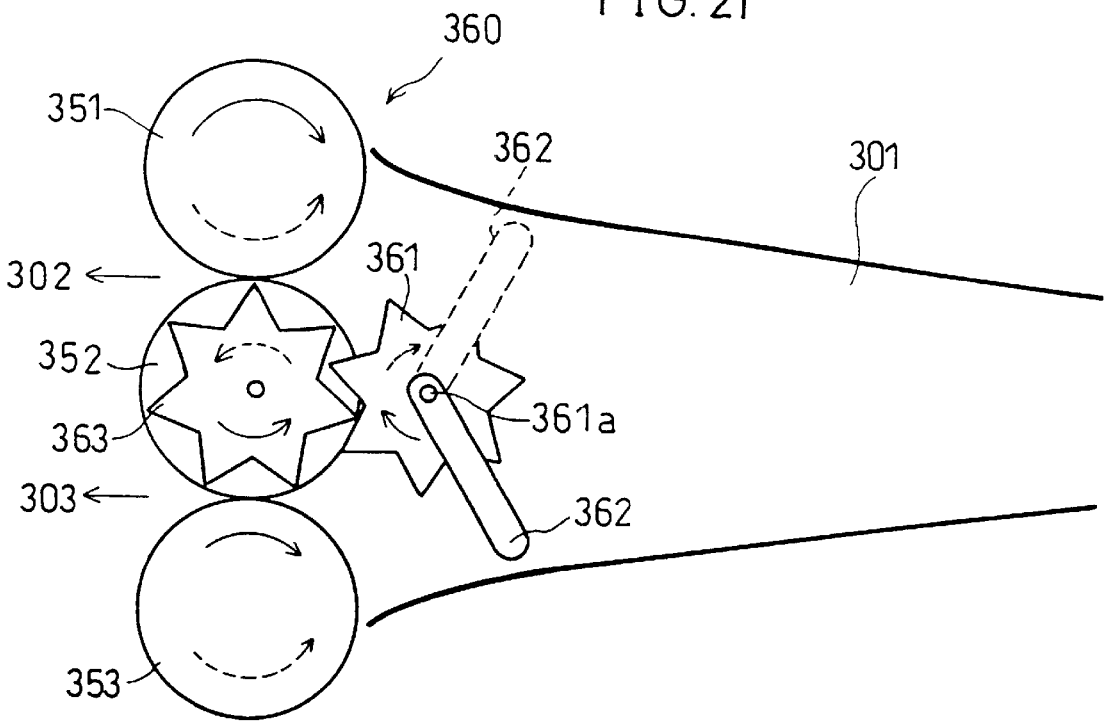
FIG. 21 is an explanatory drawing that shows another case in which three concatenation rollers are used as a diverging means for a sheet of paper within the paper transport path in the image-forming apparatus of the present invention.
Figure 22A:
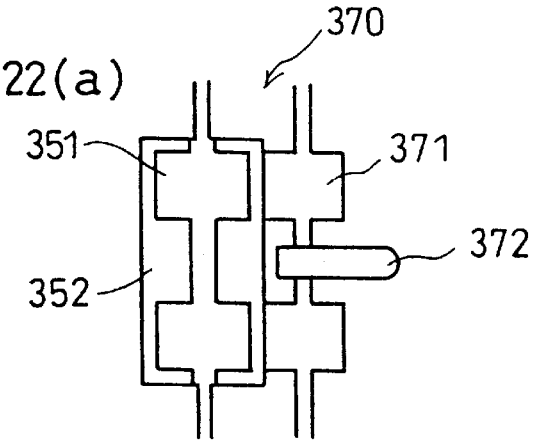
FIG. 22(*a*) is a schematic plan view that shows still another case in which three concatenation rollers are used as a diverging means for a sheet of paper within the paper transport path in the image-forming apparatus of the present invention.
Figure 22B:
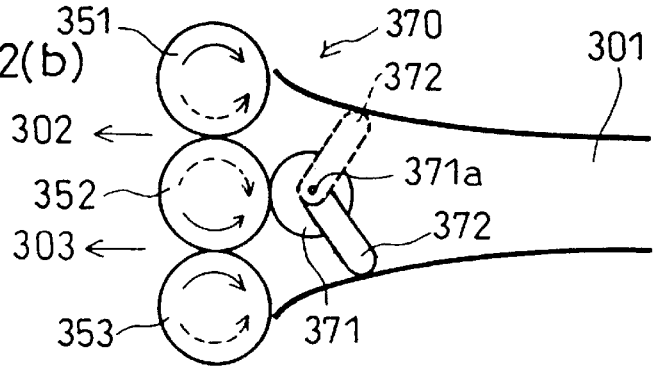

In the above-mentioned switching means 350, the two rod-shaped gate members are used so as to diverge the sheet of copy paper P; however, the present application is not intended to be limited thereby, and a switching means 360 as illustrated in FIG. 21 or a switching means 370 as illustrated in FIG. 22 may be used in the same manner so as to diverge and transport the sheet of copy paper P.

As illustrated in FIG. 21, the switching means 360 is provided with a first gate member 361 which has a turn-free cogwheel shape and a rod-shaped second gate member 362 supported on a rotary shaft 361a of the first gate member 361. The second gate member 362 is supported by the rotary shaft 361*a* with a certain degree of frictional force, and arranged to rotate with the rotation of the first gate member 361. The second gate member 362 is formed with such a length that the top portion on the upstream side in the transporting direction of copy paper P is allowed to contact the upper surface or the lower surface of the paper transport path 301 by the rotation of the second gate member 362.

Moreover, a cogwheel 363 is integrally formed on the second roller 352 in a coaxial manner, and the cogwheel 363 is engaged by the first gate member 361. Thus, the torque of the second roller 352 is transmitted from the cogwheel 363 to the first gate member 361.

In other words, in the case when the second roller 352 is rotated in the direction of the solid line arrow, the first gate member 361 is rotated in the direction of the solid line arrow so that the top portion of the second gate member 362 on the upstream side in the transporting direction of copy paper P is shifted downward to contact the lower surface of the paper transport path 301. This state is referred to as a first position. Therefore, while the second roller 352 is rotated, the second gate member 362 slips on the rotary shaft 361*a* so that the first position is maintained.

In contrast, in the case when the second roller 352 is rotated in the direction of the broken line arrow, the first gate member 361 is rotated in the direction of the broken line arrow so that the top portion of the second gate member 362 on the upstream side in the transporting direction of copy paper P is shifted upward to contact the upper surface of the paper transport path 301. This state is referred to as a second position. Therefore, while the second roller 352 is rotated, the second gate member 362 slips on the rotary shaft 361*a* so that the second position is maintained.

In the above-mentioned arrangement, in the case when a sheet of copy paper P is transported to the escape path 302, the second roller 352 is rotated in the direction of the solid line arrow so that the top portion of the second gate member 362 on the upstream side in the transporting direction of copy paper P is allowed to contact the lower surface of the paper transport path 301, thereby maintaining the first position. Thus, the sheet of copy paper P being transported through the paper transport path 301 is directed between the first roller 351 and the second roller 352 by the second gage member 362, and sent to the escape path 302 through the nip section formed between the first roller 351 and the second roller 352.

On the other hand, in the case when a sheet of copy paper P is transported to the staple tray 303, the second roller 352 is rotated in the direction of the broken line arrow so that the top portion of the second gate member 362 on the upstream side in the transporting direction of copy paper P is allowed to contact the upper surface of the paper transport path 301, thereby maintaining the second position. Thus, the sheet of copy paper P being transported through the paper transport path 301 is directed between the second roller 352 and the third roller 353 by the second gate member 362, and sent to the staple tray 303 through the nip section formed between the second roller 352 and the third roller 353.

In the above-mentioned switching means 360, the cogwheel 363 integrally placed on the second roller 352 is used so as to drive the first gate member 361; however, as exemplified by a switching means 370 shown in FIGS. 22(*a*) and 22(*b*), a direct contact may be made to the second roller 352 so as to transmit the torque of the second roller 352.

As illustrated in FIGS. 22(*a*) and 22(*b*), a first gate member 371, which consists of a roller-shaped member, is allowed to contact the second roller 352 so as to transmit the rotation of the second roller 352. Here, one end of a rod-shaped second gate member 372 is supported on the rotary shaft 371*a* of the first gate member 371.

The second gate member 372 is supported on the rotary shaft 371*a* with a predetermined frictional force against it, and allowed to rotate with the rotation of the first gate member 371. Moreover, the second gate member 372 is formed with such a length that the top portion on the upstream side in the transporting direction of copy paper P is allowed to contact the upper face or the lower face of the paper transport path 301 by the rotation of the second gate member 372.

In the above-mentioned arrangement, in the case when a sheet of copy paper P is transported to the escape path 302, the second roller 352 is rotated in the direction of the solid line arrow so that the top portion of the second gate member 372 on the upstream side in the transporting direction of copy paper P is allowed to contact the lower surface of the paper transport path 301, thereby maintaining the first position. Thus, the sheet of copy paper P being transported through the paper transport path 301 is directed between the first roller 351 and the second roller 352 by the second gate member 372, and sent to the escape path 302 through the nip section formed between the first roller 351 and the second roller 352.

On the other hand, in the case when a sheet of copy paper P is transported to the staple tray 303, the second roller 352 is rotated in the direction of the broken line arrow so that the top portion of the second gate member 372 on the upstream side in the transporting direction of copy paper P is allowed to contact the upper surface of the paper transport path 301, thereby maintaining the second position. Thus, the sheet of copy paper P being transported through the paper transport path 301 is directed between the second roller 352 and the third roller 353 by the second gate member 372, and sent to the staple tray 303 through the nip section formed between the second roller 352 and the third roller 353.

As described above, in the case when the three concatenation rollers are used as a means for diverging the sheet of copy paper P, the means for switching the transport direction of the sheet of copy paper P uses the single driving roller of the three concatenation rollers. In other words, the driving means is sharedly used in the means for diverging the sheet of copy paper P. Thus, it becomes possible to miniaturize the apparatus.

Figure 23:
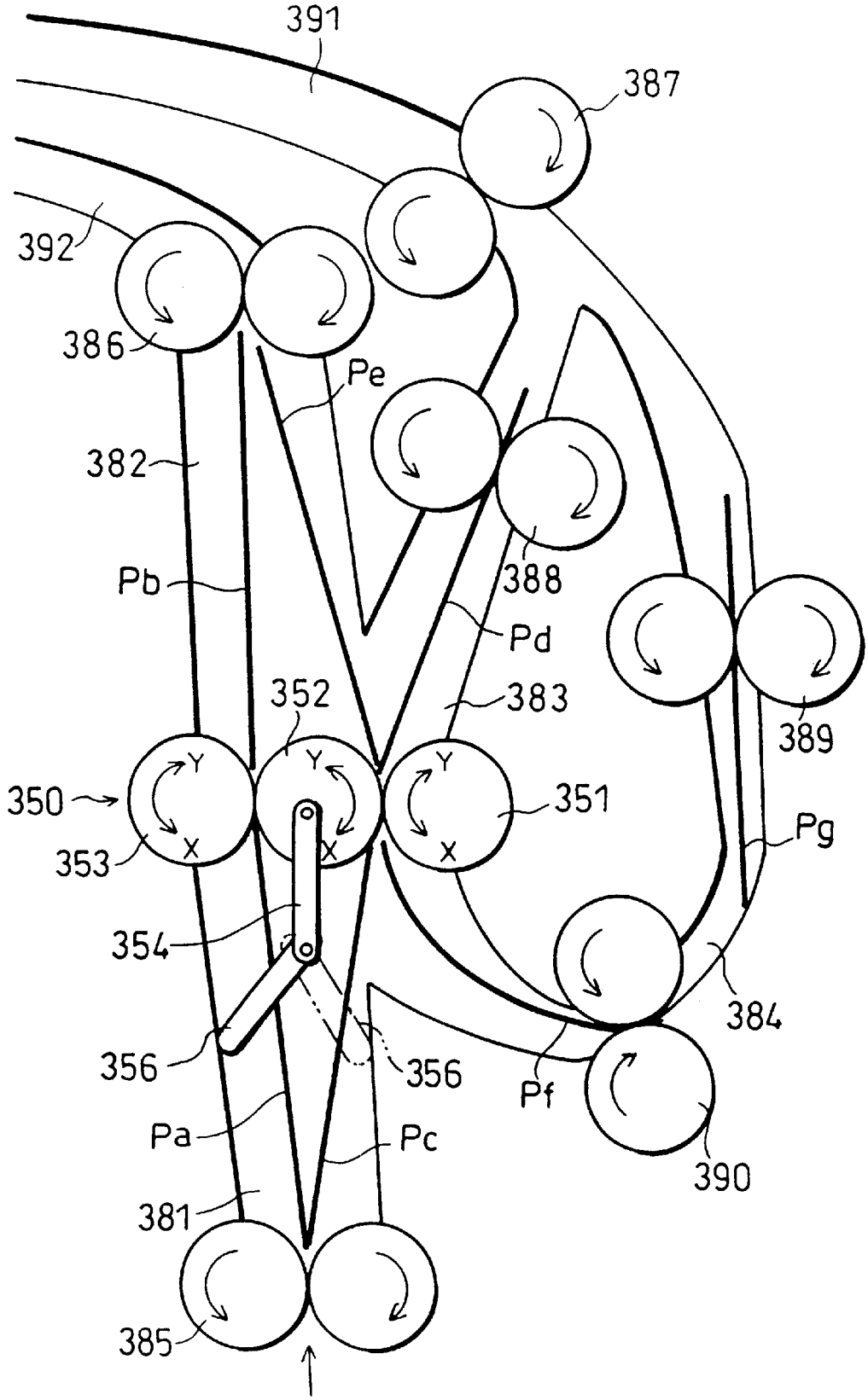
FIG. 23 is an explanatory drawing that shows one example of the paper transporting system in the image-forming forming apparatus of the present invention.

Referring to FIG. 23, an explanation will be given of a paper transporting system in which the three concatenation rollers 351–353 (each rotatable in an x-y direction) are used for switching the transporting direction of copy paper P and an attempt is made so that sheets of copy paper P having a size generally inhibited from being stapled are prevented from being erroneously transported to the staple tray 303.

As illustrated in FIG. 23, the paper transporting system is applied to an image-forming apparatus in which the transportation of the sheets of copy paper P, carried out mainly using the switching means 350 for diverging the sheets of copy paper P, can be performed in a longitudinal direction. For example, immediately after the completion of a sheet of copy paper P, the sheet of copy paper P is diverged to two transport paths (first discharge transport path 391, the second discharge transport path 392) while being transported upward. Here, in FIG. 23, the first discharge transport path 391 is connected to the escape path 302, and the second discharge transport path 392 is connected to the staple tray 303 shown in FIG. 1.

As illustrated in FIG. 23, the above-mentioned paper transporting system is provided with four transport paths (the first transport path 381, the second transport path 382, the third transport path 383, the fourth transport path 384) before reaching the first discharge transport path 391 and the second discharge transport path 392.

The first transport path 381 is placed between the first transport roller 385 for transporting the sheet of copy paper P immediately after the fixing process and the switching means 350. Here, the first transport roller 385 may also serve as a fixing roller. By allowing the first transport roller 385 to have the function of a fixing roller, it is possible to reduce the number of parts in the paper transporting system, and consequently to simplify the structure of the apparatus.

The second transport path 382 is placed between the switching means 350 and second transport roller 386 for transporting copy paper P to the second discharge transport path 392. The second transport path 382 is normally used as a transport path for transporting sheets of copy paper P discharged from the nip section between the second roller 352 and the third roller 353 of the switching means 350 to the staple tray 303.

The third transport path 383 is placed between the switching means 350 and the third transport roller 387 for transporting sheets of copy paper P to the first discharge transport path 391. The fourth transport roller 388 is further placed between the switching means 350 and the third transport roller 387 so as to ensure the transporting process of sheets of copy paper P to the first discharge transport path 391. The third transport path 383 is normally used as a transport path for transporting sheets of copy paper P discharged from the nip section between the first roller 351 and the second roller 352 of the switching means 350 to the escape path 302.

The fourth transport path 384 is formed from the first transport path 381 side of the switching means 350 to the third transport roller 387 in a manner so as to make a detour around the transport path 383. The fifth transport roller 389 and the sixth transport roller 390 are placed in the fourth transport path 384 so as to ensure the transporting process of sheets of copy paper P.

In the paper transporting system having the above-mentioned arrangement, in the second transport path 382, the distance from the nip section between the second roller 352 and the third roller 353 of the switching means 350 to the nip section of the second transport roller 386 is set to a paper size which allows a stapling process in the staple tray 303 (hereinafter, referred to as a staple permissible size).

With this arrangement, any sheet of copy paper P which can be stapled has its leading edge chucked by the second transport roller 386 before having been completely discharged between the second roller 352 and the third roller 353; therefore, it becomes possible to positively send the sheet of copy paper P to the second transport path 392.

Moreover, with the arrangement in which the second transport path 382 is formed vertically to the installation face of the image-forming apparatus, any sheet of copy paper P having a staple permissible size is chucked by the second transport roller 386; however, any sheet of copy paper P having a size smaller than the staple permissible size is not chucked by the second transport roller 386, and falls on the switching means 350 side by gravity. This is because any sheet of copy paper having a size smaller than the staple permissible size has been completely discharged between the second roller 352 and the third roller 353 before its leading edge is chucked by the nip section of the second transport roller 386.

With this arrangement, it is possible to make a judgment as to whether or not a sheet of copy paper P can be stapled, by simply transporting the sheet of copy paper P through the second transport path 382.

Therefore, in the second transport path 382, it is possible to detect sheets of copy paper P that can be stapled by simply adjusting the distance from the nip section between the second roller 352 and the third roller 353 of the switching means 350 to the nip section of the second transport roller 386, without using any paper size sensor, etc.

Consequently, this simple arrangement makes it possible not only to positively send sheets of copy paper P that can be stapled to the staple tray 303, but also to prevent staple-inhibited sheets of copy paper P from being sent to the staple tray 303. As a result, it is possible to prevent various problems (paper jams, etc.) caused by staple-inhibited sheets of copy paper P sent to the staple tray 303.

Moreover, in the case when a sheet of copy paper P that has passed through the nip section of the second roller 352 and the third roller 353 of the switching means 350 is smaller than the staple permissible size, the sheet of copy paper P again falls between the second roller 352 and the third roller 353 by gravity, and in this case, since the second roller 352 and the third roller 353 are respectively rotating in the direction of arrow x, it is shifted along the surface of the second roller 352, and directed between the first roller 351 and the second roller 352, thereby being discharged from this gap.

At this time, the first gate member 354 and the second gate member 356 are driven in a manner so as to discharge the sheet of copy paper P between the second roller 352 and the third roller 353; therefore, the second gate member 356 is located at a position indicated by a broken line in FIG. 23.

With this arrangement, the sheets of copy paper P discharged between the first roller 351 and the second roller 352 are positively transported to the fourth transport path 384 without being returned to the first transport path 381.

Referring to FIG. 23, the following description will discuss the transporting operation of the sheet of copy paper P in the paper-transporting system having the above-mentioned arrangement.

First, a sheet of copy paper P, which has passed through a fixing roller (not shown), is directed to the first transport path 381 by the first transport roller 385, and diverged to either the second transport path 382 or the third transport path 383 in the switching means 350. In this case, if the sheet of copy paper P needs to be stapled, then it is diverged to the second transport path 382, and if the sheet of copy paper P need not be stapled, then it is diverged to the third transport path 383.

The sheet of copy paper P, which needs to be stapled, has its leading edge chucked by the second transport roller 386 located on the downstream side of the second transport path 382 until its rear edge has passed through the nip section between the third roller 353 and the second roller 352. In other words, the sheet of copy paper P, which is to be transported to the staple tray 303 through the discharge transport path 392, is simultaneously chucked by the nip section of the second roller 352 and the third roller 353 and the nip section of the second transport roller 386 in the second transport path 382.

Here, even when the operator erroneously tries to carry out a stapling process on a sheet of staple-inhibited copy paper P such as a post card, etc., the copy paper Pa, discharged from the first transport roller 385, is allowed to pass through the nip section between the second roller 352 and the third roller 353, and discharged onto the second transport path 382, as shown by copy paper Pb.

Here, the distance from the nip section between the second roller 352 and the third roller 353 to the nip section of the second transport roller 386 is set to the minimum value of the staple permissible paper size; therefore, even when copy paper P having a size smaller than this size, such as a post card, is discharged on the second transport path 382 through the gap between the second roller 352 and the third roller 353, the leading edge thereof does not reach the nip section of the second transport 386. Moreover, the second transport path 382 is placed so as to be virtually vertical to the installation plane of the apparatus, the sheet of copy paper Pb drops by gravity, with the result that the rear edge is shifted along the rotation direction (direction of arrow x) of the second roller 352, and maintained in a state as shown by copy paper Pe. Thereafter, the copy paper Pe is directed from the nip section between the first roller 351 and the second roller 352 to the fourth transport path 384, and then transported to the nip section of the third transport rollers 387 and supplied to the first discharge transport path 391. In other words, the sheet of copy paper Pe is allowed to pass through the nip section between the first roller 351 and the second roller 352, and chucked by the nip section of the sixth transport rollers 390 in a state as shown by copy paper Pf. After having been released from the nip section, it is chucked by the nip section of the fifth transport rollers 389 as shown by copy paper Pg, and then released from the nip section, and again chucked by the nip section of the third transport rollers 387, and further directed to the first discharge transport path 391, and supplied to the escape path 302.

In the case when copy paper Pc is supplied to the escape path 302, it is directed to the nip section between the first roller 351 and the second roller 352 by the switching means 350, and from the nip section it is discharged to the third transport path 383, and its leading edge is chucked by the fourth transport rollers 388 (copy paper Pd), and directed to the first discharge transport path 391 through the third transport roller 387.

As described above, in the paper transporting system having the above-mentioned arrangement, even when a sheet of staple-inhibited copy paper P (copy paper having a size smaller than the staple permissible size) is erroneously transported in the second transport path 382, the sheet of copy paper P discharged from the switching means 350 is not chucked by the second transport rollers 386, and automatically transported to the fourth transport path 384, and directed to the first discharge transport path 391 connected to the escape path 302.

With this arrangement, it is possible to prevent staple-inhibited copy paper P from being erroneously directed to the staple tray 303, and consequently to prevent paper jam, etc. caused by unnecessary paper transportation.

Moreover, with the simple setting in which the length (the distance from the nip section between the second roller 352 and the third roller 353 to the second transport roller 386) of the transport path (the second transport path 382) for directing copy paper to the staple tray 303 is set to the staple permissible size, it is possible to make a judgment as to whether or not the sheet of copy paper P is staple-inhibited; therefore, it is not necessary to install a sensor, etc. as a separate member for judging the paper size. Thus, it becomes possible to simplify the structure of the paper transporting system, and consequently to reduce production costs of the entire apparatus.

Here, copying functions include a one-sided printing function for forming an image on one surface of copy paper P and a double-sided printing function for forming images on both of the surfaces of copy paper P. The foregoing description has mainly discussed the one-sided printing function; and the following description will discuss a case in which the double-sided printing function is achieved in the image-forming apparatus having the above-mentioned arrangement. In order to realize the double-sided printing function, it is necessary to provide a means for transporting a sheet of copy paper P in a reversed manner in the image-forming apparatus, that is, a switch-back mechanism.

Figure 24:
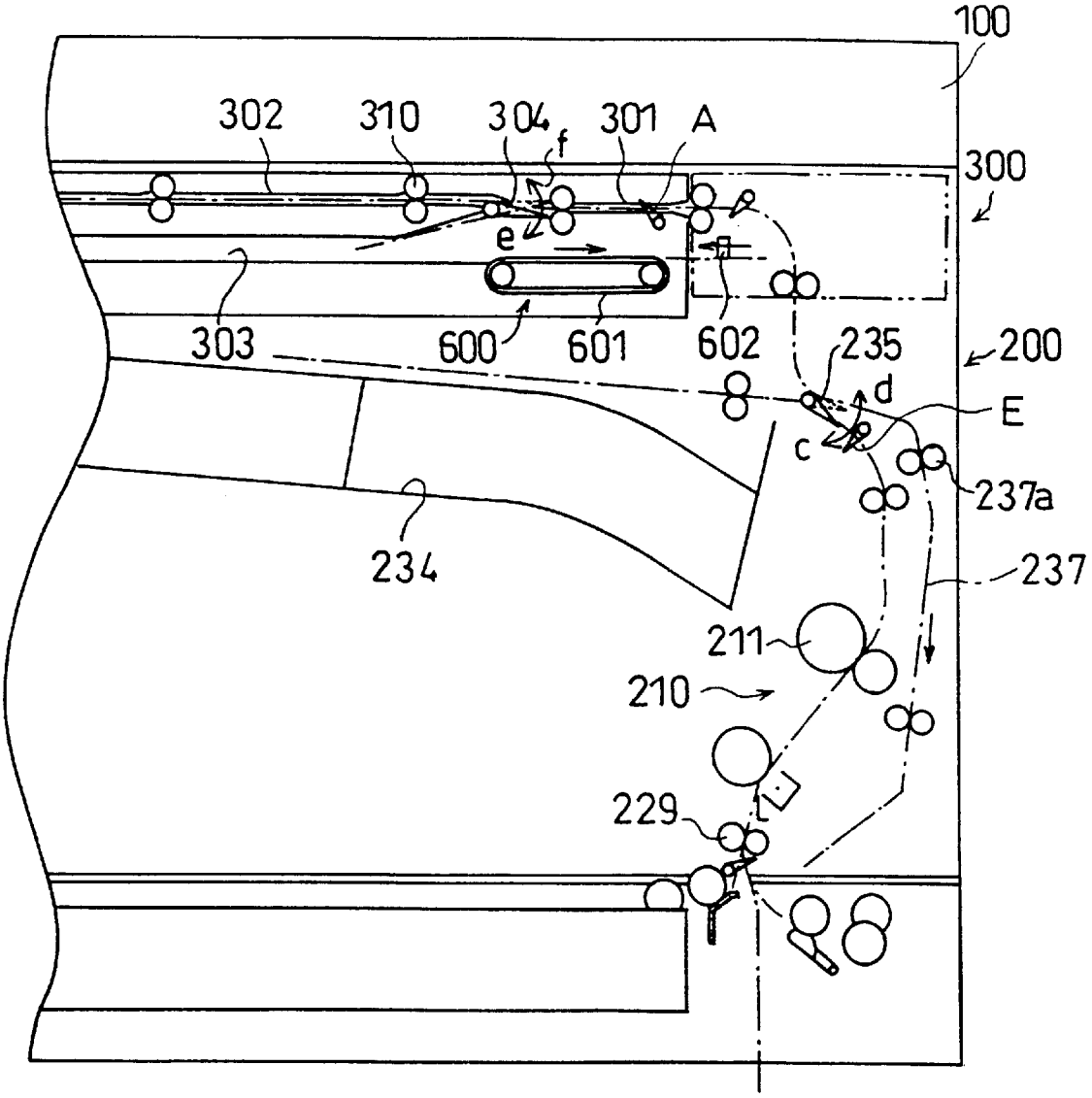
FIG. 24 is an explanatory drawing that shows one example of a case in which the post-treatment device is used as an intermediate tray for a double-sided printing process in the post-treatment device in the image-forming apparatus of the present invention.

For example, it is proposed that, as shown in FIG. 24, an inversion transport means 600 for reversing a sheet of copy paper P is installed in the staple tray 303.

The inversion transport means 600 is provided with a re-paper-feed belt 601 which can be rotated forwardly as well as reversely along the paper-transporting direction in parallel with the installation plane of copy paper P of the staple tray 303, and this re-paper-feed belt 601 is rotated in the direction of arrow so that a sheet of copy paper P, temporarily placed on the staple tray 303, is sent to an inversion transport path 237 inside the image-forming apparatus main body 200. In other words, the re-paper-feed belt 601 is placed in such a position that the rear end of the sheet of copy paper P on the staple tray 303 is slightly bridged thereon.

Figure 25:
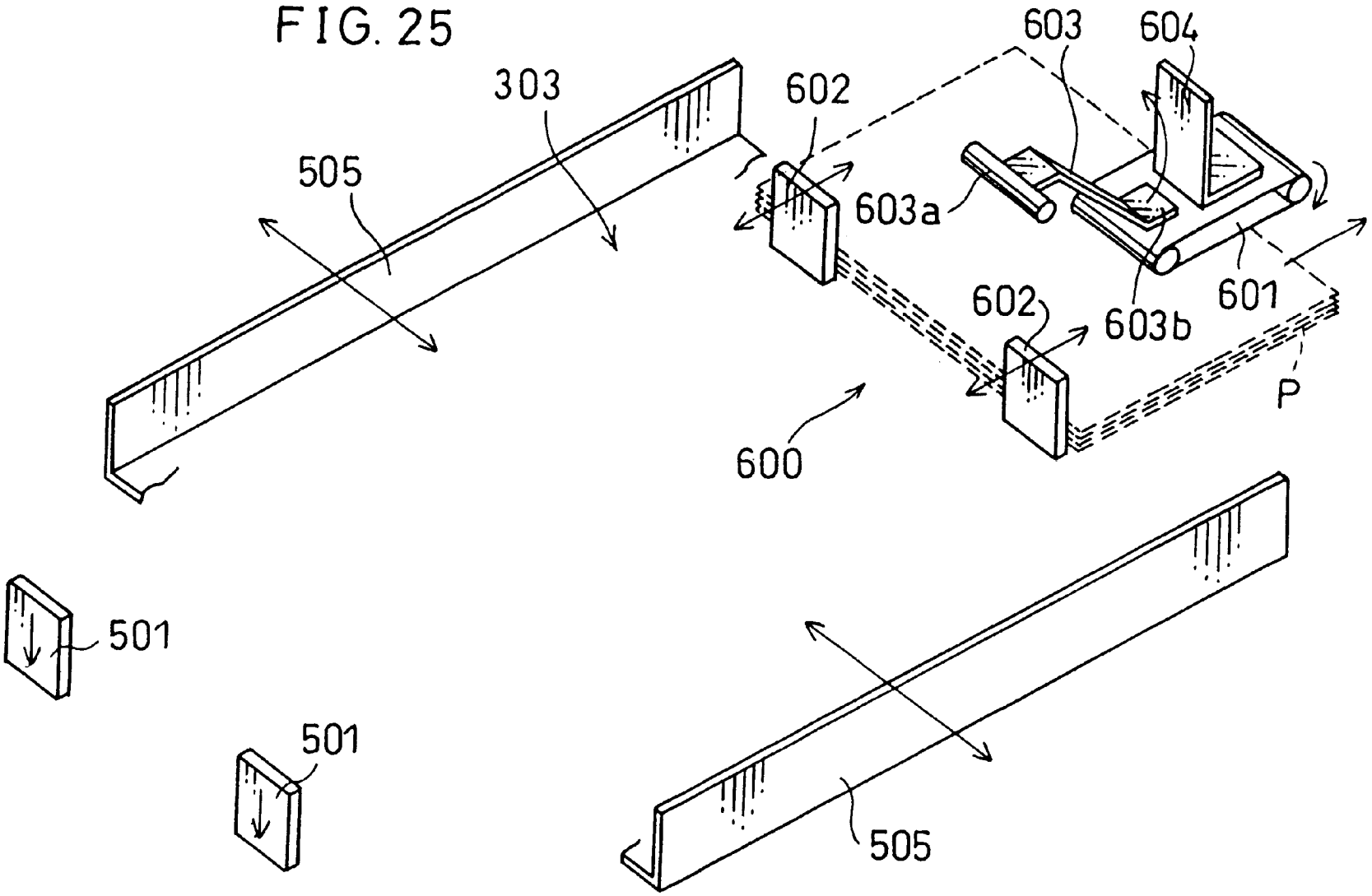
FIG. 25 is a schematic perspective view that shows the vicinity of a staple tray within the post-treatment apparatus shown in FIG. 24.

As illustrated in FIG. 25, the inversion transport means 600 is provided with a transport plate 602 which contacts the end on the staple process direction side of the sheet of copy paper P placed on the staple tray 303, and sends the sheet of copy paper P in the reversed transporting direction, a paper seize lever 603 for pressing the sheet of copy paper P placed on the staple tray 303 from the upper surface side, and an adjusting member 604 which is placed on the end side of the sheet of copy paper P in the reversed transporting direction, and used for sending sheets of stacked copy paper P sheet by sheet to the inversion transport path.

The transport plate 602 is a wall that vertically stands with respect to the plane of the staple tray 303 on which the sheets of copy paper P are stacked, and that is shiftable in the transporting direction of the sheet of copy paper P, and this is allowed to contact the edge of the sheet of copy paper P, and is shifted in the transporting direction so as to send the sheet of copy paper P. In the double-sided printing process, the transport plate 602 also serves as a stopper for sheets of copy paper P that have already been subjected to the one-sided printing process.

Moreover, the transport plate 602 is normally maintained in a stand-by state (shown in FIG. 24) at the end portion on the upstream side in the paper-transporting direction of the staple tray 303 so as not to intervene with the paper transporting process of copy paper P at the time of a one-sided printing process.

The paper seize lever 603, which has one end that is a shaft portion 603*a* supported by a shaft on the lower surface of the escape path 302 (although not shown in the Figure), and the other end that is a member (integrally formed member) consisting of a seize section 603*b* for pressing a sheet of copy paper P placed on the staple tray 303 from above, is installed so as to freely pivot centered on the shaft portion 603*a*.

The paper seize lever 603 is controlled in its driving operation by a solenoid (not shown). In other words, the solenoid is controlled and driven so that at the time when a sheet of copy paper P is transported to the staple tray 303, the seize section 603*b* is shifted upward, and so that at the time when the sheet of copy paper P is placed on the staple tray 303, the seize section 603*b* is shifted downward so as to press the sheet of copy paper P from above.

The adjusting member 604, which is a virtually L-letter shaped member placed on the rear edge side of the staple tray 303, is arranged so that the gap between its lowermost portion and the re-paper-feed belt 601 is virtually equal to the thickness of one sheet of copy paper P; thus, it is possible to prevent double feeding (that is, duplicated transporting process) at the time when a sheet of copy paper P is reversely transported.

Here, referring to FIGS. 24 and 25, the following description will discuss the transporting operation of copy paper P in the image-forming apparatus in which the inversion transport means 600 having the above-mentioned arrangement is installed.

At the time of a double-sided printing process, the first switching gate 235, placed immediately after the fixing section of the apparatus main body, is shifted in the direction of arrow c and the second switching gate 304 is also shifted in the direction of arrow e, so that the sheet of copy paper P after having been subjected to the fixing process, is directed from the paper transport path 301 to the staple tray 303.

At this time, during the stapling process, the transport plate 602, which is maintained at a predetermined stand-by position on the staple tray 303, is shifted toward the downstream side by the paper length plus approximately 2 mm based upon paper-length information, at which it is maintained in a stand-by state.

The transport plate 602 serves as a stopper for the leading edge of a sheet of copy paper P sent to the staple tray 303 during the double-sided printing process, and also carries out a paper-adjusting function in the paper length direction as a double-sided printing intermediate tray.

Here, with respect to the adjustment in the paper width direction, the adjusting member 505 used at the time of the stapling process is also used, and in this case, instead of the fixed wall 509, the adjusting member 505 is used. Thus, the adjusting processes are carried out from both of the sides in the width direction of the sheet of copy paper P. More specifically, from the detection made by the paper sensor A placed before the switching gate 304, timer control is carried out so that the adjusting members 505 are driven in a manner so as to push the sheet of copy paper P from both of the sides in the width direction toward the central reference of the sheet of copy paper P.

The above-mentioned operation is carried out repeatedly on a predetermined number of sheets of copy paper P so that a set of sheets of copy paper that have been subjected to the one-sided printing process are placed on the staple tray 303 in an adjusted state.

After completion of the adjusting process for the last page of the predetermined number of sheets, the rear end of the set of sheets housed on the staple tray 303 is seized from above by the paper seize lever 603 that is controlled and driven by the solenoid.

In this manner, in a state where the set of sheets are seized by the paper seize lever 603, the re-paper-feed belt 601 is driven in the direction of arrow so that only the sheet of copy paper P at the bottom of the set of sheets is transported. At this time, the adjusting member 604 makes it possible to prevent a duplicated feeding process of sheets of copy paper P.

The sheet of copy paper P sent by the re-paper-feed belt 601 is sent to the inversion transport path 237 of the image-forming apparatus main body 200 with its rear end forming a leading edge. Then, the sheet of copy paper P is chucked by the first transport rollers 237a of the inversion transport path 237, the driving operation of the re-paper feed belt 601 is stopped. In other words, timer control is provided until the reversely transported sheet of copy paper P has been chucked by the transport rollers 237*a,* and the driving operation of the re-paper feed belt 601 is stopped, and the paper seize lever 603 is also shifted upward. This re-paper feeding operation is repeated until the preset number of copies have been made in the same synchronized timing as the one-sided printing process with respect to paper-feed intervals.

The re-fed sheet of copy paper P is directed to the registration roller 229 through the inversion transport path 237, and positioning is carried out with respect to a toner image on the photosensitive member 211 of the image-forming section 210 by the registration roller 229. Thereafter, the same sequence as the one-sided printing process is carried out so as to make printing on the surface (rear face) bearing no image, and the resulting sheet of copy paper P is transported to either the first paper-discharge section 234, the escape path 302, or the staple tray 303.

In the above-mentioned arrangement, it is not necessary to install an intermediate tray used at the time of the double-sided printing process in a separate manner; therefore, it is possible to simplify the structure of the transporting system in the apparatus main body, and consequently to miniaturize the apparatus as well as to reduce the costs of the apparatus.

The above-mentioned description has discussed the copying system in which: the staple tray 303 is used as the intermediate tray for the double-sided printing process, and after some sheets of copy paper P bearing an image on one side have been temporarily housed in the staple tray 303, printing is made on the other side; however, the present invention is not intended to be limited by this arrangement, and for example, another copying system in which a sheet of copy paper P is subjected to printing processes on both of the sides sheet by sheet may be used. In this case, immediately after a sheet of copy paper P bearing an image on one side has been sent onto the staple tray 303, this sheet of copy paper P may be reversely transported.

Moreover, in the case when the above-mentioned staple tray 303 is used as the intermediate tray at the time of the double-sided printing process, it is not possible to carry out a double-sided printing process by interrupting an on-going stapling process. Therefore, in order to carry out the double-sided printing process even in such a case, it is proposed that the escape path 302 be used as the intermediate tray at the time of the double-sided printing process.

In other words, in the case when a double-sided printing process is carried out by interrupting an on-going stapling process, the second switching gate 304 is shifted in the direction of arrow e. Thus, the sheet of copy paper P that is to be subjected to a double-sided printing process is transported to the escape path 302. In this case, at the time when, based upon paper-length information, the rear edge of the sheet of copy paper P has passed through the first switching gate 235, the first switching gate is shifted in the direction of arrow d so that the rotation direction of the transport roller 310 is reversed in the vicinity of the escape path 302. Thus, the sheet of copy paper P is sent to the inversion transport path 237 that is a transport path for double-sided printing, and then subjected to a double-sided printing process, and the sheet of copy paper P that has been subjected to the double-sided printing process is discharged through the-escape path 302.

Even in the case when the double-side printing process is carried out by interrupting an on-going stapling process as described above; the escape path 302 is utilized as the intermediate tray so that it becomes possible to carry out the switching back for the double-sided printing process without disturbing the stacking operation for sheets of copy paper P that have been housed in the staple tray 303 so as to be stapled.

In other words, since the escape path 302 and the staple tray 303 are provided with the switching back mechanism, the switching back mechanism of the escape path 302 is utilized when the double-sided printing process is carried out in an interrupting manner while the staple tray 303 is being used. Consequently, it becomes possible to carry out the double-sided printing process without disturbing the stacking operation for sheets of copy paper P on the staple tray 303.

In addition, it is possible to carry out the switching back process without damage to the sheet of copy paper P to be switched back, while maintaining proper positional precision of the sheet of copy paper P.

Moreover, in the case when the switching back mechanism of the staple tray 303 is used, the staple tray 303 is used as the intermediate tray so that a predetermined number of sheets of paper subjected to the one-sided printing process can be stored therein. Then, these sheets of paper subjected to the one-sided printing process are switched back so as to complete the double-sided printing process. Therefore, it is possible to improve the efficiency of the double-sided printing process.

Moreover, as described above, to the staple tray 303 is attached the transport plate 602 serving as an adjusting member for adjusting the end portion of the sheet of copy paper P on the side opposite to the post-treatment direction, in a manner so as to freely shift in the paper-transporting direction; therefore, the adjusting member for aiding the post-treatment function is also used as an adjusting member for used in the intermediate tray at the time of the double-sided printing process. As a result, it is possible to reduce the number of members required for the switching back mechanism, and consequently to achieve miniaturization and low costs in the entire apparatus.

In the image-forming apparatus having the above-mentioned arrangement, as illustrated in FIG. 1, the escape path 302 is provided with a plurality of transport rollers inside the transport path, and a sheet of copy paper P is transported through the transport path by driving these transport rollers. The transport path is made of a paper transport guide plate completely separated from the staple tray 303 so that the sheet of copy paper P supplied to the paper transport guide place is discharged out of the apparatus without being directed to the staple tray 303.

Therefore, independent driving rollers are required for the escape path 302 and the staple tray 303.

Figure 26:
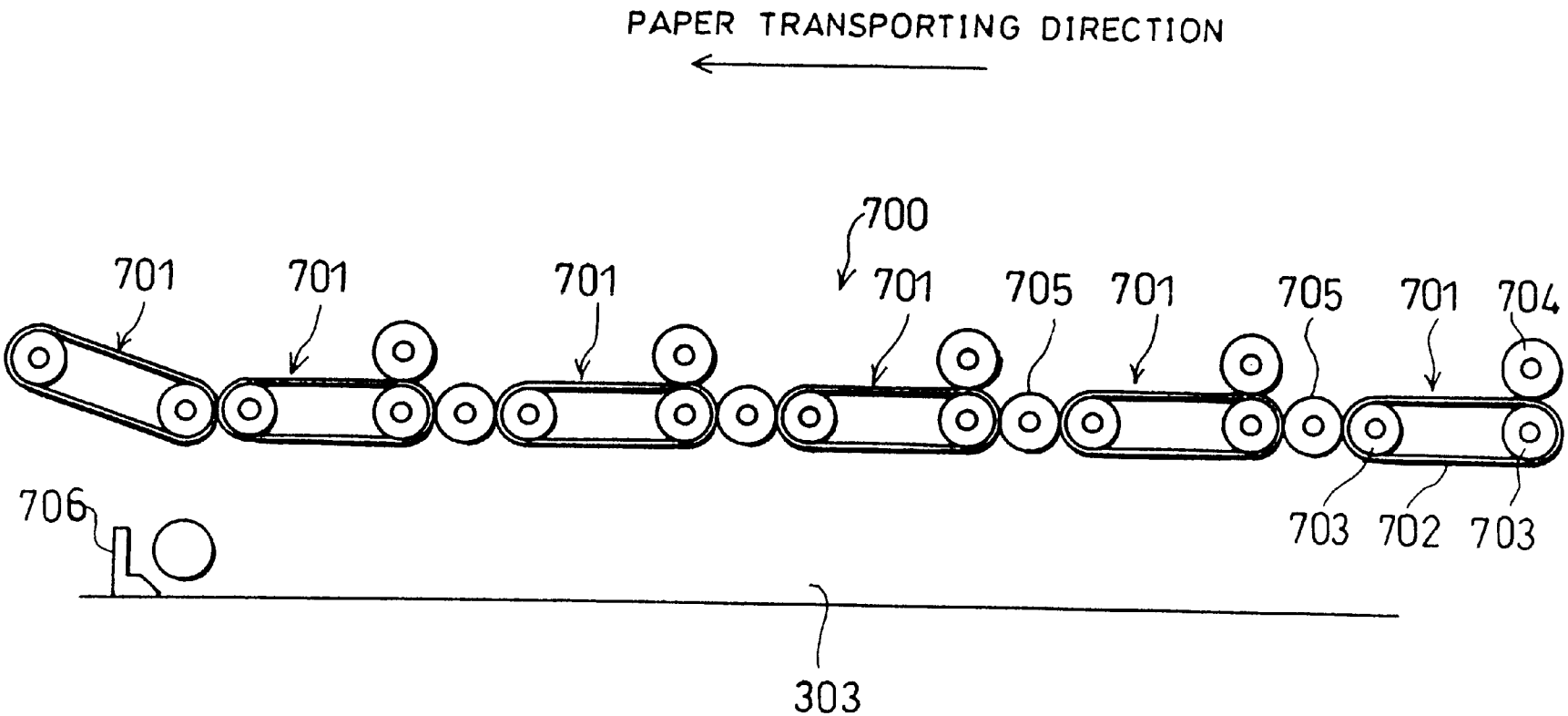
FIG. 26 is an explanatory drawing that shows a modified example of the escape path within the post-treatment device in the image-forming apparatus of the present invention.

Here, it is proposed that an escape path 700 shown in FIG. 26 be used instead of the escape path 302 as a means for allowing the driving rollers to be commonly used.

The escape path 700 has an arrangement in which a plurality of paper-transporting members 701, each of which is driven independently, are placed side by side in the paper transporting direction. The paper-transporting member 701 is constituted by a paper-transporting belt 702 and a pair of rollers 703 over which the paper-transporting belt 702 is passed.

One of the rollers 703, placed on the side opposite to the paper-transporting direction side, is installed in a state so as to contact the driving roller 704 through the paper-transporting belt 702, with its rotation shaft being secured to the apparatus main body. Therefore, as the driving roller 704 rotates, the roller 703 is rotated, and the paper-transporting belt 702 passed over the roller 703 is driven to rotate.

Figure 30:
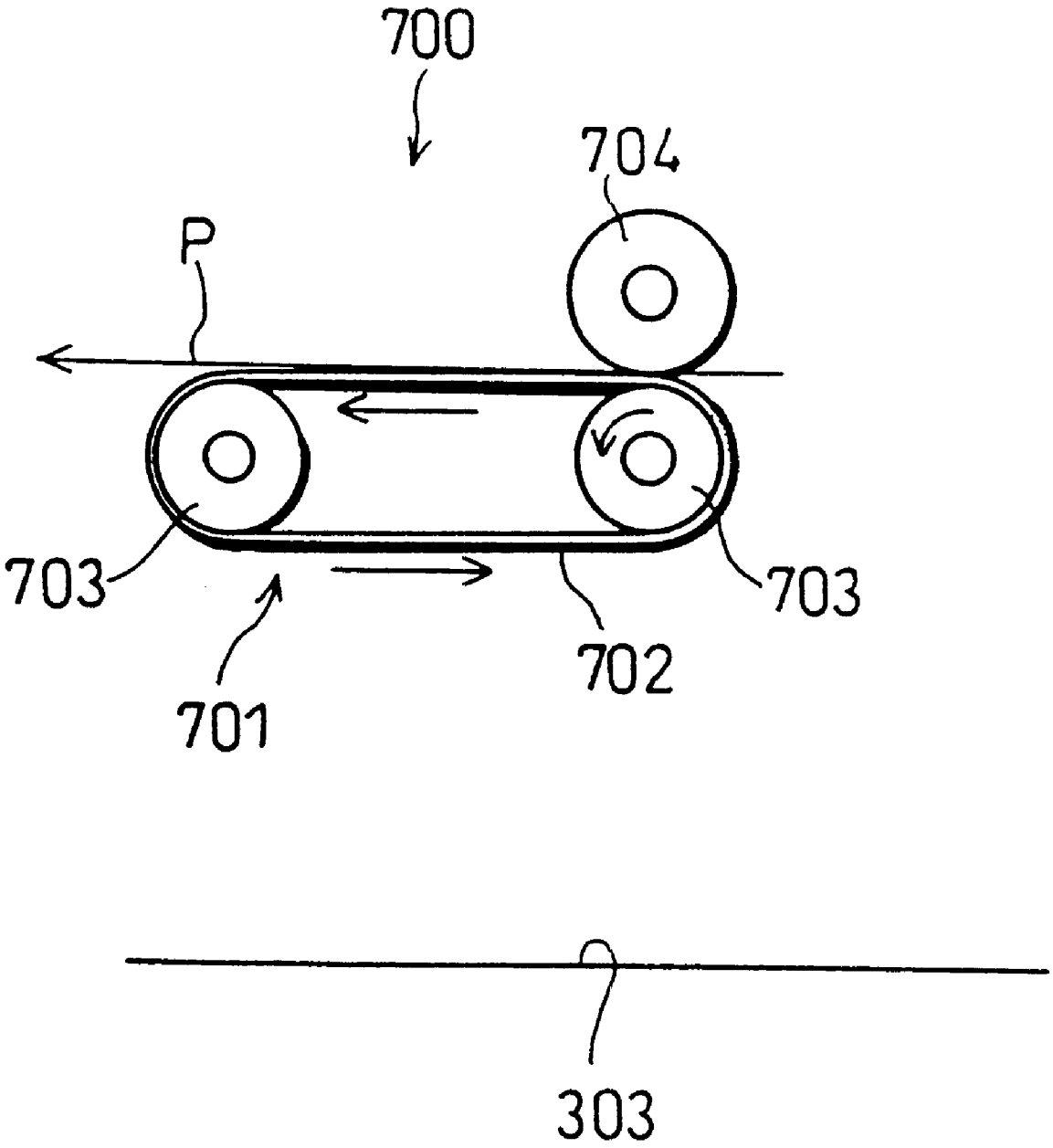
FIG. 30 is an explanatory drawing that shows the operation of a paper transport member that constitutes the escape path shown in FIG. 26.
Figure 31:
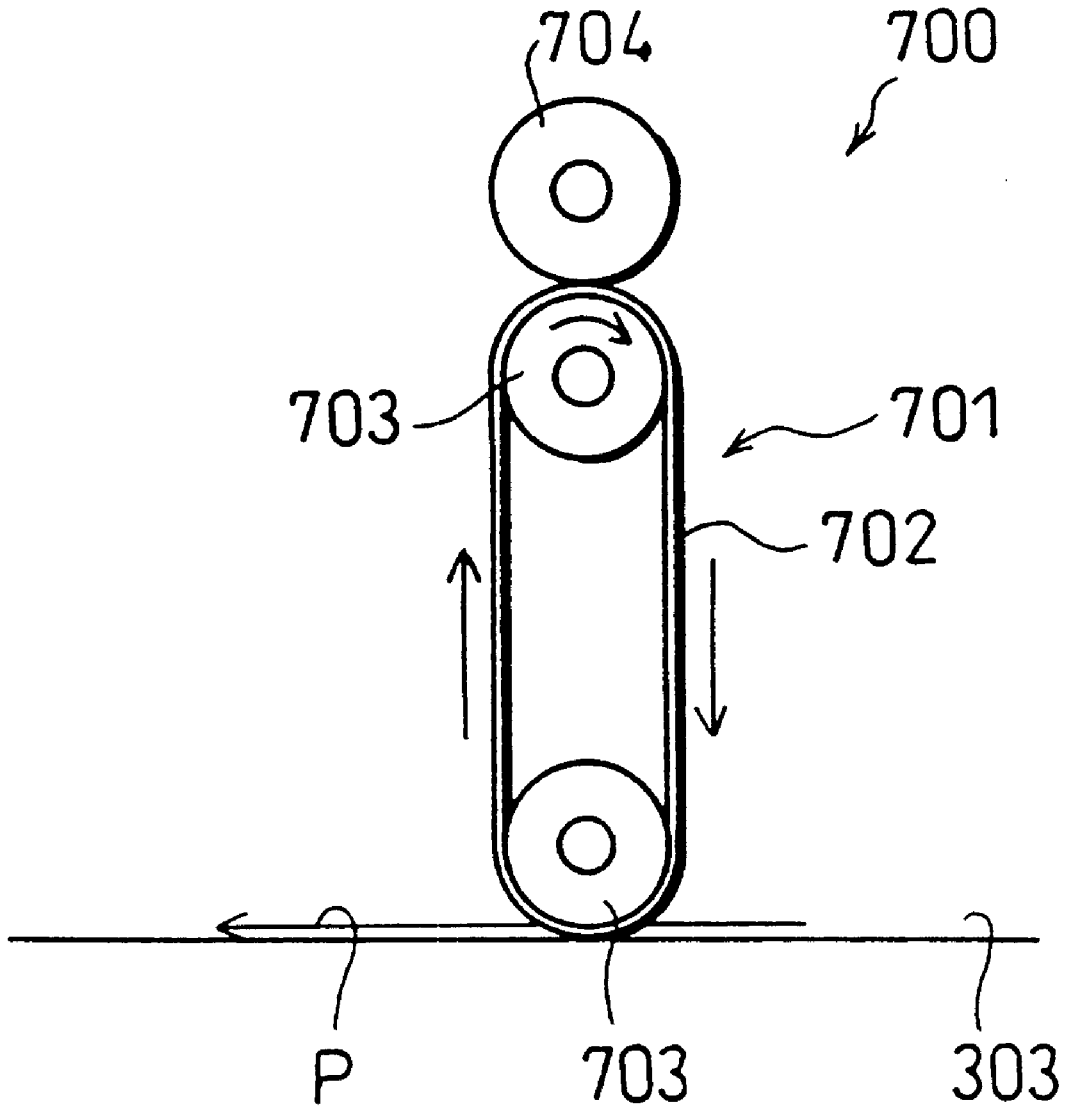
FIG. 31 is an explanatory drawing that shows the operation of the paper transport member that constitutes the escape path shown in FIG. 26.
Figure 32:
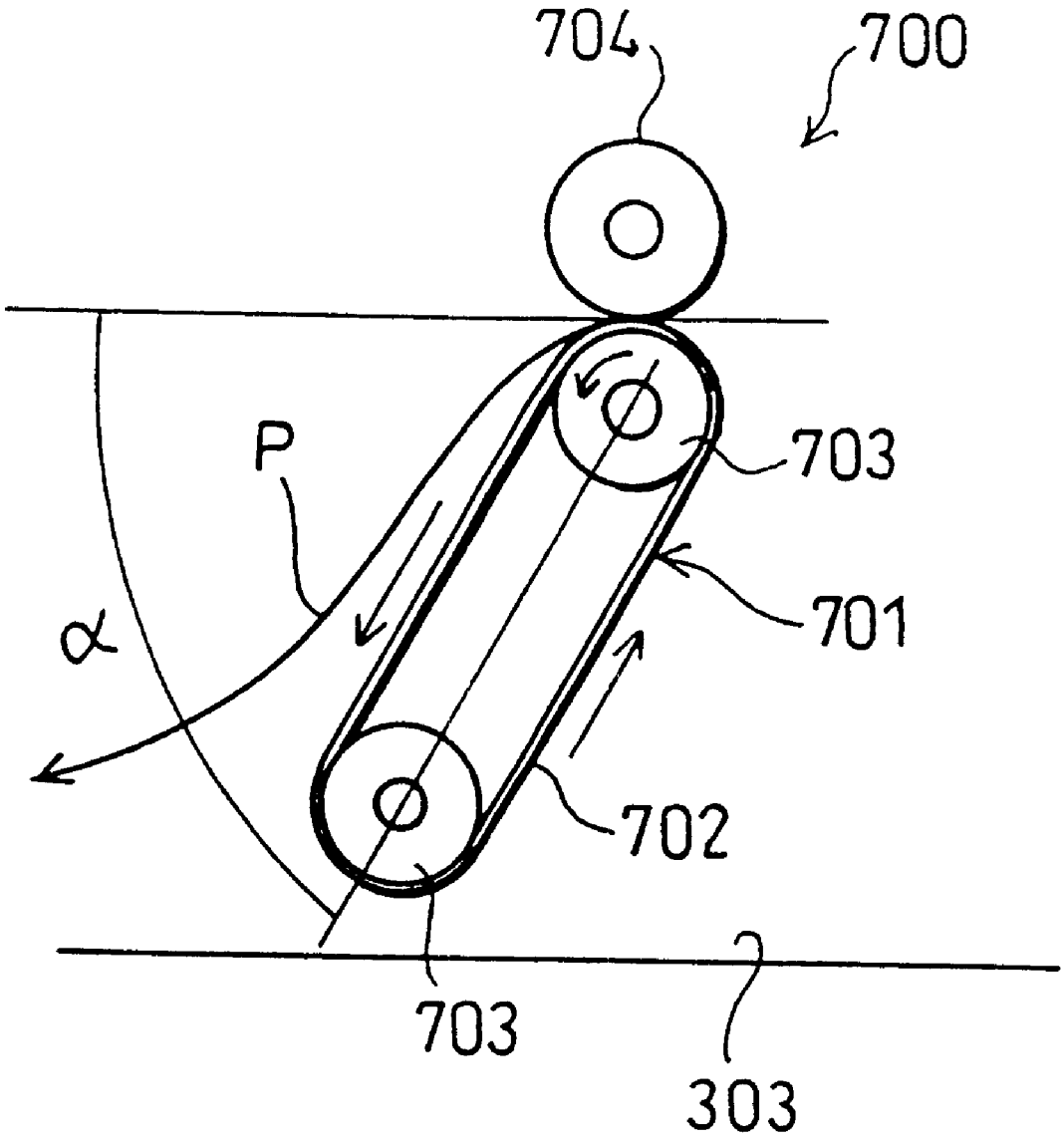
FIG. 32 is an explanatory drawing that shows the operation of the paper transport member that constitutes the escape path shown in FIG. 26.

The other roller 703, placed on the paper-transporting direction side, is installed so as to freely pivot on the rotation shaft of the above-mentioned roller 703 serving as a fulcrum. With this arrangement, the paper-transporting member 701 is allowed to pivot toward the staple tray 303 side as shown in FIGS. 31 and 32, centered on the rotation shaft of the roller 703 on the side opposite to the paper-transporting direction side, from the state shown in FIG. 30.

In the escape path 700 having the above-mentioned arrangement, a sheet of copy paper P is chucked between the paper-transporting belt 702 of the paper-transporting members 701 and the driving rollers 704, and transported.

Moreover, as illustrated in FIG. 26, a driven roller 705, which contacts each paper-transporting belt 702 and is driven with the rotation of the paper-transporting belt 702, is installed between the paper-transporting members 701. Thus, it is possible to rotatively drive the paper-transporting belts 702 of all the paper-transporting members 701 by only rotating the driving roller 704 on the upstream side of the paper transporting direction.

As described above, each of the paper-transporting members 701 is allowed to freely pivot centered on the rotation shaft of one of the rollers 703; therefore, by pivoting the paper-transporting members 701, it is possible to send a sheet of copypaper P transported through the escape path 700 to the staple tray 303 in the middle of the transportation. In this case, as illustrated in FIG. 30, among the paper-transporting members 701 maintained in a home position, some of the paper-transporting members 701 are pivoted in a manner so as to contact the staple tray 303, as illustrated in FIG. 31, and, as illustrated in FIG. 32, some of the paper-transporting members 701 are pivoted so as to have a predetermined angle a with respect to the home position.

In other words, one of the paper-transporting members 701, which is located at a position for starting a transporting process of a sheet of copy paper P from the escape path 700 to the staple tray 303, is allowed to pivot as illustrated in FIG. 32 so that the sheet of copy paper P transported on the escape path 700 is sent to the staple tray 303 by utilizing the slope of the corresponding paper-transporting member 701. On the other hand, one of the paper-transporting members 701, located at a position for transporting a sheet of copy paper P on the staple tray 303, is allowed to pivot as illustrated in FIG. 32 so that the sheet of copy paper P is transported, with the sheet of copy paper P being sandwiched at the contact point between the paper-transporting belt 702 and the staple tray 303. Here, the number of the paper-transporting members 701 to be pivoted is determined depending on the size of a sheet of copy paper.

Figure 27:
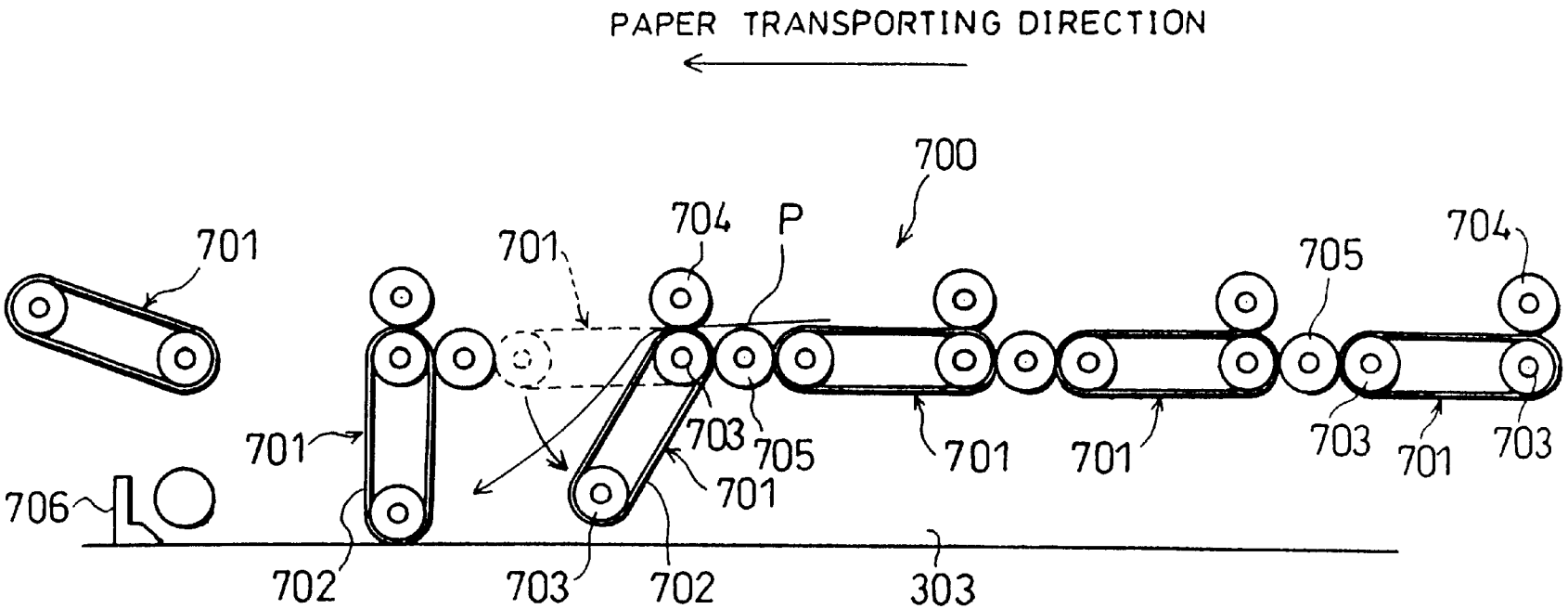
FIG. 27 is an explanatory drawing that shows the operation of the escape path shown in FIG. 26.
Figure 28:
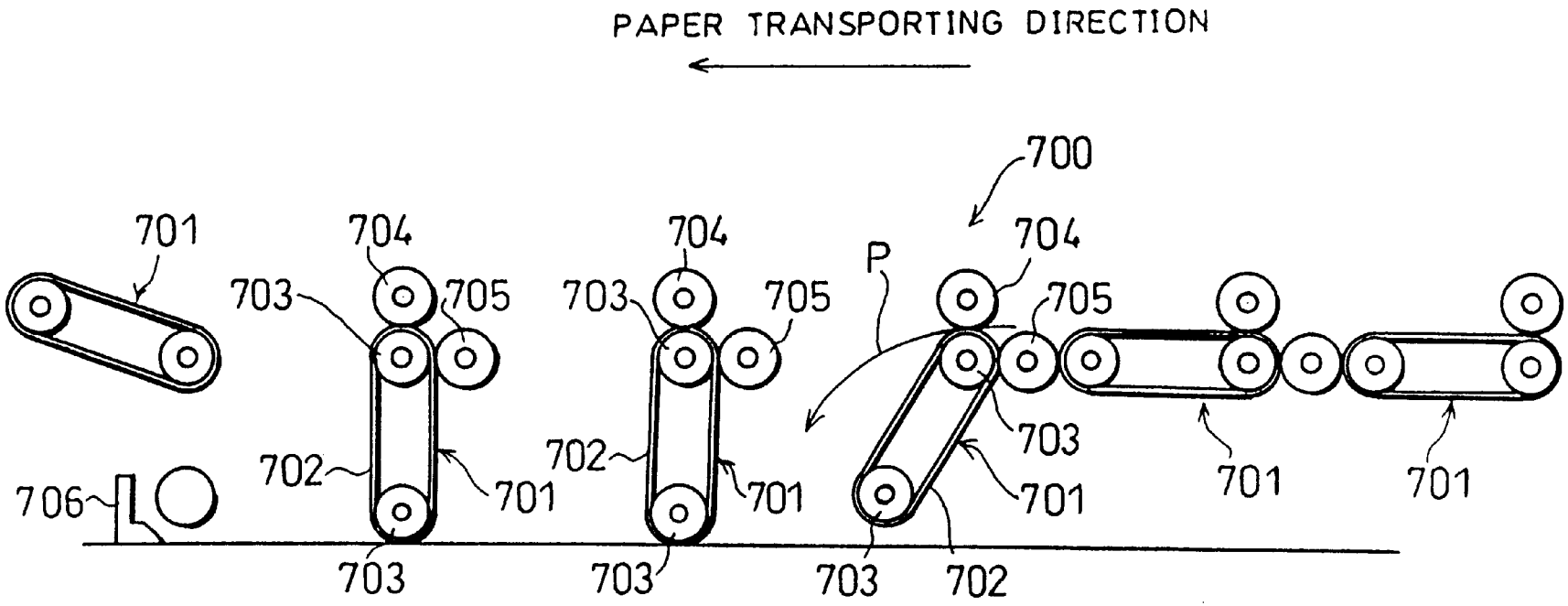
FIG. 28 is an explanatory drawing that shows the operation of the escape path shown in FIG. 26.
Figure 29:
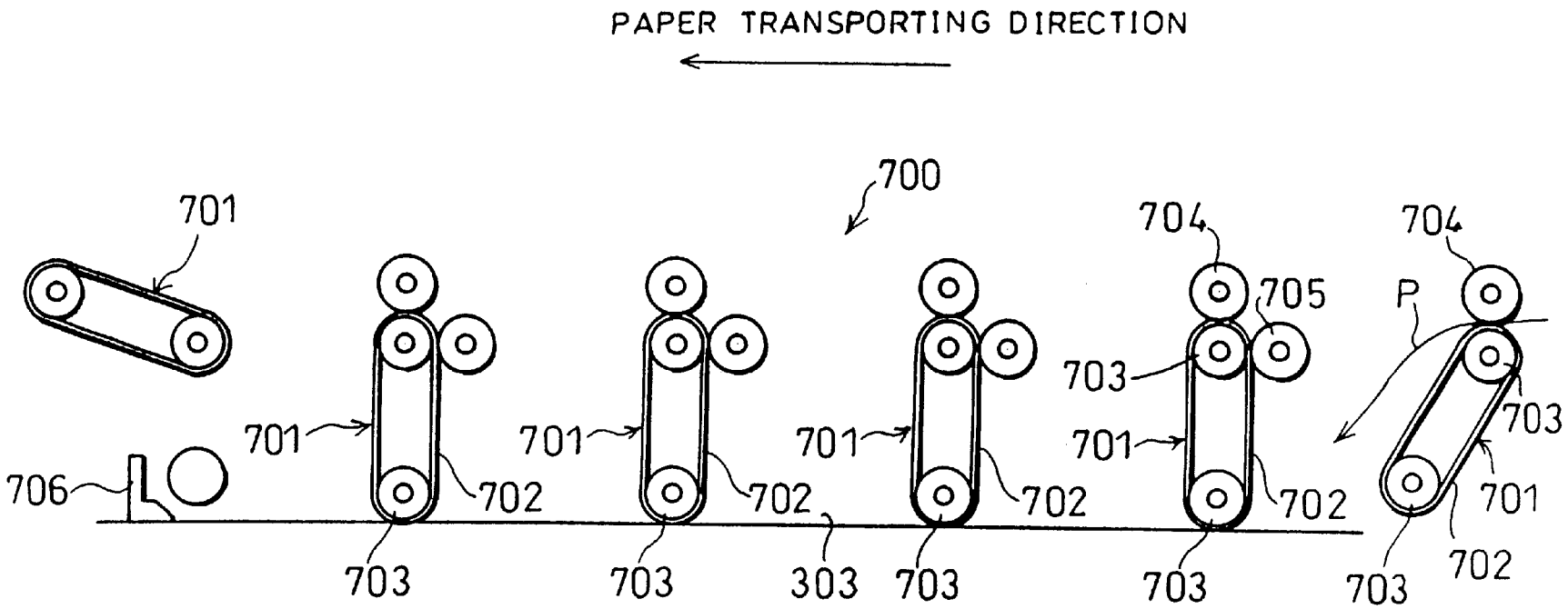
FIG. 29 is an explanatory drawing that shows the operation of the escape path shown in FIG. 26.

In other words, in the case when a sheet of copy paper P of B5-side is sent from the escape path 700 to the staple tray 303, as illustrated in FIG. 27, the farthest end one and the second one of the paper-transporting members 701 in the paper-transporting direction are allowed to pivot. Moreover, in the case when a sheet of copy paper P of A4-size is sent from the escape path 700 to the staple tray 303, as illustrated in FIG. 28, the farthest end one, the second one and the third one of the paper-transporting members 701 are allowed to pivot. In the case when a sheet of copy paper P of A3-size is sent from the escape path 700 to the staple tray 303, as illustrated in FIG. 29, all of the five paper-transporting members 701 are allowed to pivot.

As described above, sheets of copy paper P sent to the staple tray 303 depending on the paper-sizes thereof have their leading edges adjusted by a stopper 706 placed on the downstream side in the paper-transporting direction on the staple tray 303 independent of the sizes thereof. With this arrangement, even when sheets of copy paper P having different paper sizes are sent to the staple tray 303, the next sheet of copy paper P is always sent onto the upper surface of the preceding sheet of copy paper P that has been stacked; therefore, it is possible to smoothly transport sheets of copy paper P.

In accordance with the escape path 700 having the above-mentioned arrangement, the transport means of sheets of copy paper P installed in the escape path 700 is also allowed to serve as the transport means for transporting copy paper P to the staple tray 303; therefore, as compared with an arrangement in which the escape path 302 and the staple tray 303 are completely separated with driving rollers for transporting sheets of copy paper P respectively installed in the escape path 302 and the staple tray 303, it is possible to greatly reduce the number of transport rollers.

Moreover, as illustrated in FIG. 32, among the paper-transporting members 701 that have been allowed to pivot so as to send sheets of copy paper P, the one 701 located at the farthest end on the upstream side in the paper-transporting direction is maintained with a predetermined angle α, that is, an angle not more than 90° in this case, with respect to the transporting plane of the escape path 700. This arrangement makes it possible to smoothly transport sheets of copy paper P transported through the escape path 700 to the staple tray 303.

Additionally, in the above-mentioned paper-transporting members 701, the size and the installation number thereof are determined so as to send sheets of copy paper P from B-5 size to A-3 size from the escape path 700 to the staple tray 303; however, the present invention is not intended to be limited thereby; and any size and installation number of the paper-transporting members 701 may be determined so as to send sheets of copy paper P that can be subjected to a stapling process and that have sizes other than the above-mentioned sizes.

Here, referring to FIGS. 35(*a*) through 35(*c*), an explanation will be given of a jam treatment mechanism inside the post-treatment device 300 in which the staple tray 303 for transporting sheets of copy paper P that are to be subjected to a stapling process and the escape path 302 for transporting sheets of copy paper P that are not to be subjected to a stapling process are installed in a separate manner.

Figure 33:
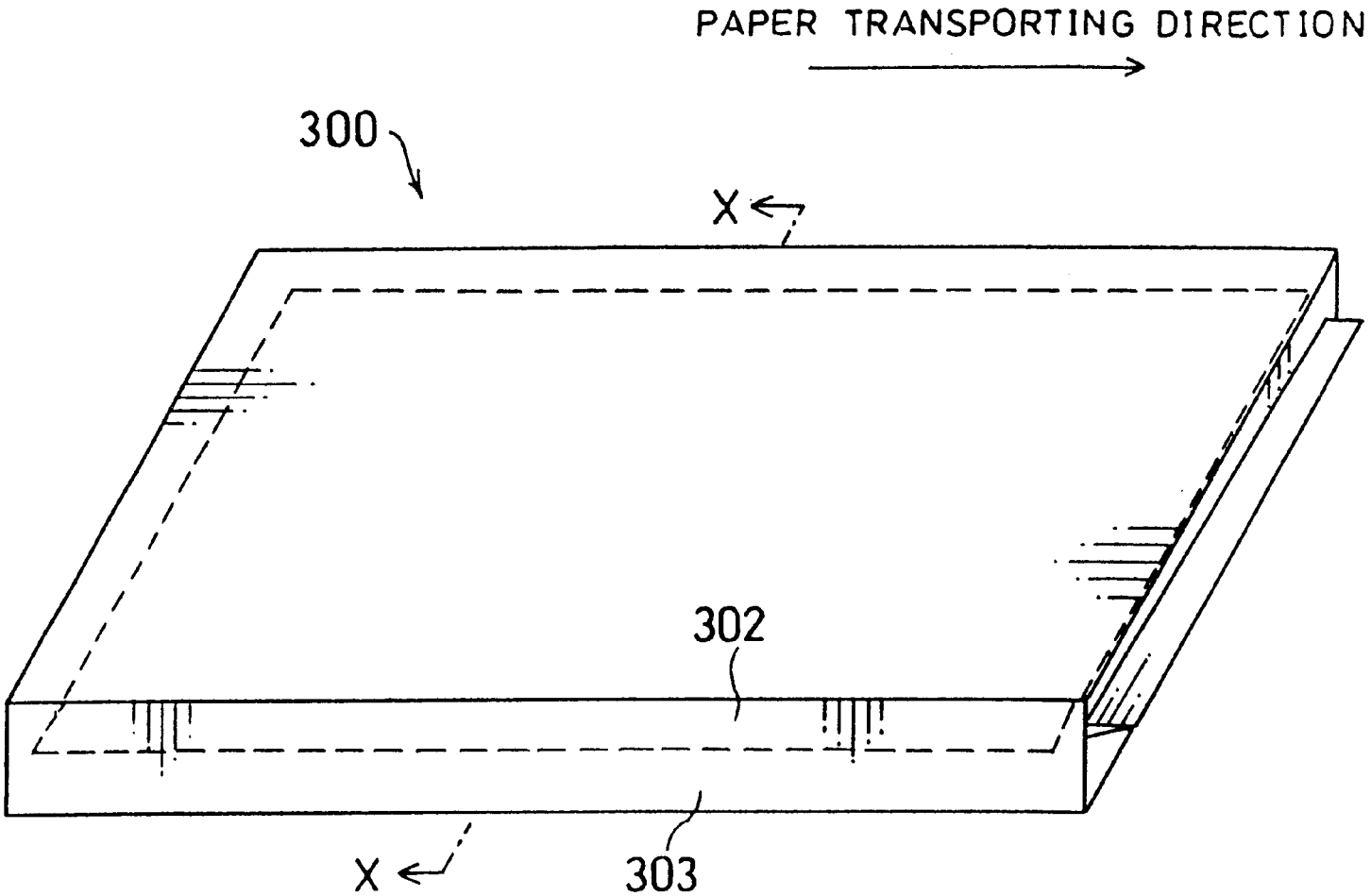
FIG. 33 is a schematic perspective view showing the post-treatment device of the image-forming apparatus of the present invention.
Figure 34:
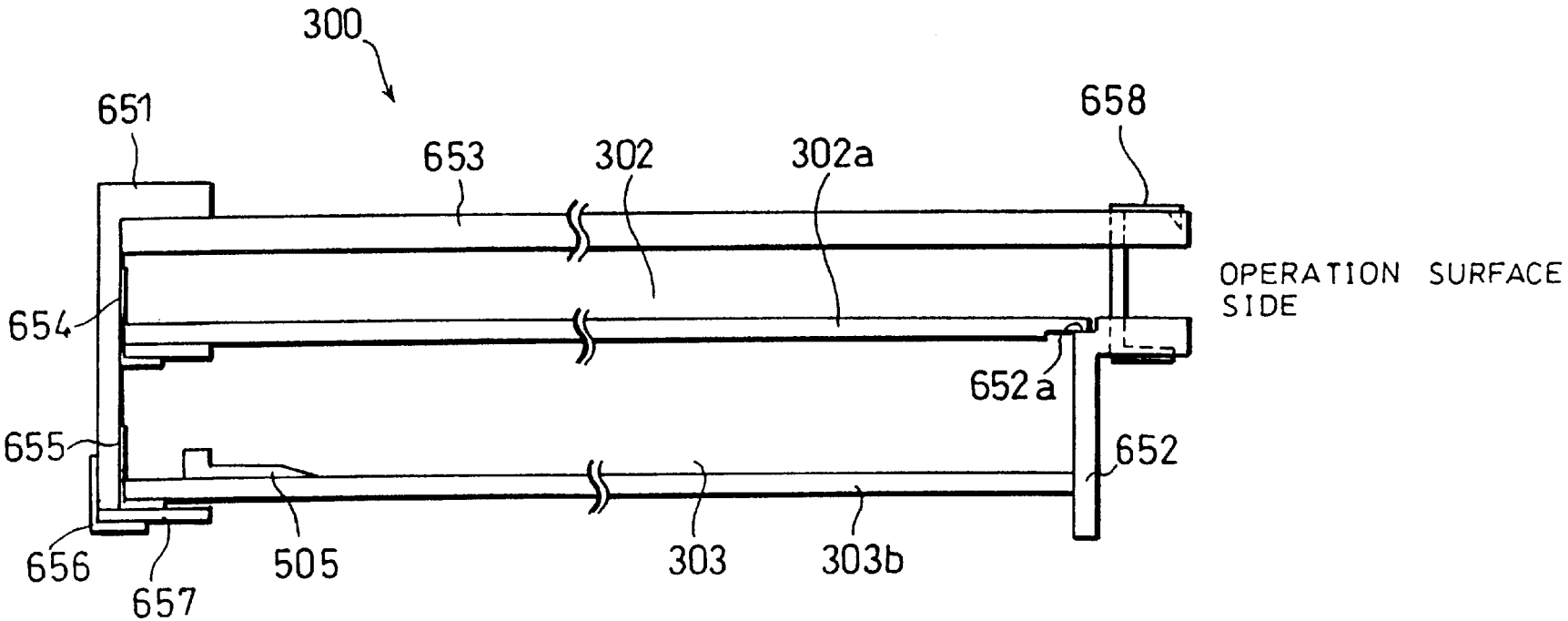
FIG. 34 is a cross-sectional view taken along line X—X of the post-treatment device shown in FIG. 33.

FIG. 33 is a perspective view that only shows the post-treatment device 300, and FIG. 34 is an explanatory drawing that schematically shows a cross-section taken along line X—X of the post-treatment device 300 of FIG. 33. FIGS. 35(*a*) through 35(*c*) are explanatory drawings that show the jam treatment operation.

Figure 35A:
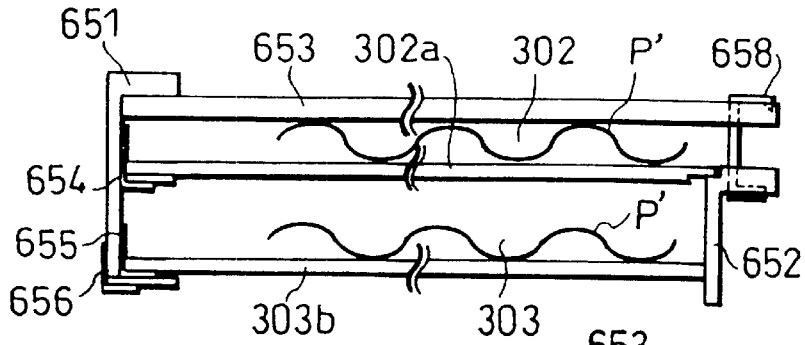
FIGS. 35(*a*) to 35(*c*) are explanatory drawings that show a jam treatment process in the post-treatment device shown in FIG. 33.
Figure 35B:
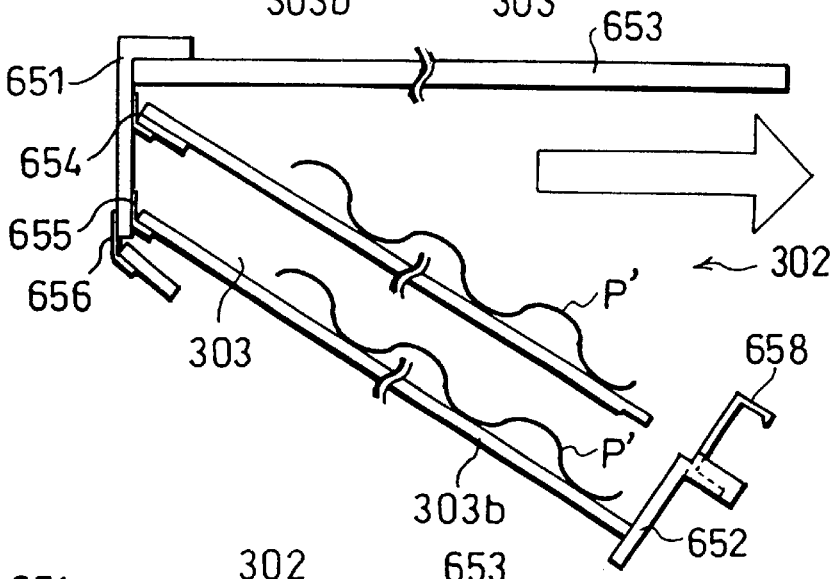
Figure 35C:
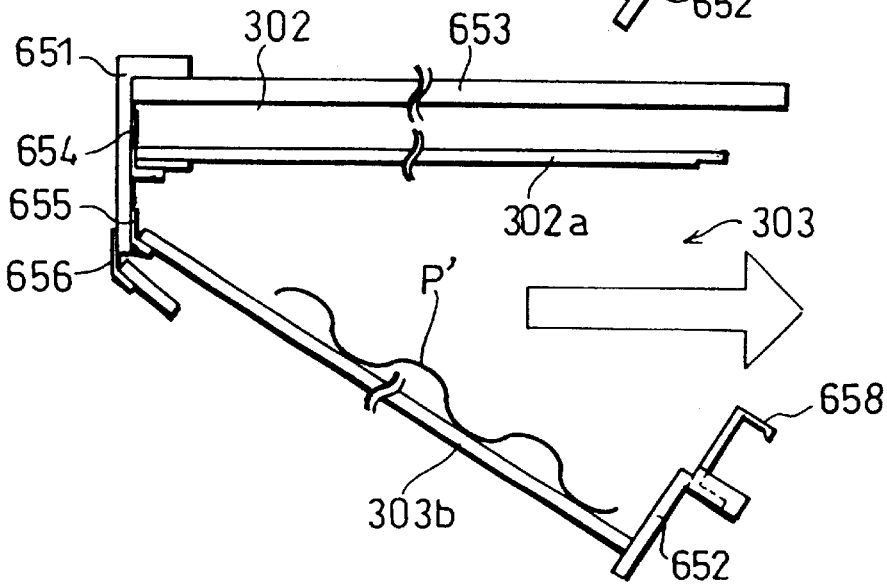

As illustrated in FIGS. 35(*b*) and 35(*c*), the post-treatment device 300 has an arrangement in which a central paper guide 302*a* of the escape path 302 and a transport guide 303*b* of the staple tray 303 respectively have openings in a direction orthogonal to the paper-transporting direction, that is, on the operation face side of the apparatus.

As illustrated in FIG. 34, the central paper guide 302*a* and the transport guide 303*b* are supported by a rear-face frame member 651 and a front-face frame member 652 that constitute the post-treatment device 300 and an upper face plate 653 of the post-treatment device 300. In other words, the central paper guide 302*a* is supported with one end being connected to the rear-face frame member 651 through a movable member 654 and the other end being placed on the upper face portion 652*a* of the front-face frame member 652. Moreover, the transport guide 303*b* has one end connected to the rear-face frame member 651 through a movable member 655 with its rear face also connected to a movable member 656. Furthermore, the other end of the transport guide 303*b* is secured to the front-face frame member 652.

The above-mentioned movable member 654 has one end secured to the rear-face frame member 651 and the other end secured to the central paper guide 302*a,* and the central paper guide 302*a* is arranged so as to pivot downward on the movable member 654 as a fulcrum, when the support by the front-face frame member 652 is removed.

In the same manner, the movable member 655 has its one end secured to the rear-face frame member 651 and the other end secured to the transport guide 303*b* so that the guide 303*b* is allowed to pivot downward together with the front-face frame member 652 on the movable member 655 serving as a fulcrum. Moreover, the movable member 656 has its one end secured to the rear-face frame member 651 and the other end secured to a contact member 657 placed below the transport guide 303*b*. Thus, the contact member 657 is allowed to contact the lower face of the transport guide 303*b* so that it normally supports the transport guide 303*b,* but is separated from the transport guide 303*b* when the transport guide 303*b* is released.

Moreover, a hook-shaped lever 658 is installed on the upper face of the front-face frame member 652, and the top portion thereof engages the upper face plate 653. In other words, when the engaged state of the lever 658 and the upper face plate 653 is released, the central paper guide 302*a* and the transport guide 303*b* are allowed to simultaneously pivot downward so that an open state is formed on the operation face side of the post-treatment device 300.

Referring to FIGS. 35(*a*) through 35(*c*), an explanation will be given of the jam treatment operation in the post-treatment device 300 having the above-mentioned arrangement. Here, the jam treatment operation is carried out based upon the transporting timing of sheets of copy paper P, without the need for installing a jam sensor inside the post-treatment apparatus 300.

First, upon detection of a paper jam in the post-treatment device 300, etc., the operator releases the engaged state between the lever 658 and the upper face plate 653. Thus, as illustrated in FIG. 35(*a*), the post-treatment device 300 becomes an opened state on the operation face side from the state having paper jams (copy paper P') in the escape path 302 and the staple tray 303. Here, for convenience of explanation, it is supposed that paper jams occur in both of the escape path 302 and the staple tray 303.

Then, the copy paper PI on the central paper guide 302*a* is first removed from the post-treatment device 300 in the opened state, and as illustrated in FIG. 35(*c*), the central paper guide 302*a* is raised so that the copy paper P' on the transport guide 303*b* is removed. Lastly, the transport guide 303*b* is raised and the lever 658 is allowed to engage the upper face plate 653, thereby completing the jam treatment operation.

Here, the above explanation has discussed a case in which paper jams occur in both of the escape path 302 and the staple tray 303; however, the jam treatment operation can be carried out in the same manner when a paper jam occurs in either the escape path 302 or the staple tray 303.

As described above, the post-treatment device 300 is arranged so that the escape path 302 and the staple tray 303 are opened in a direction orthogonal to the paper transporting direction. Therefore, even when adjusted sheets of copy paper P are placed on the transport guide 303*b* so as to be stapled, the jam treatment operation can be carried out simply by removing the jammed copy paper P located thereon, without any disturbance to the adjusted sheets of copy paper P. Consequently, immediately after the jam treatment operation, a printing request can be processed continuously.

The above explanation has discussed a case in which the jam treatment operation is carried out based upon the transport timing of the sheet of copy paper P, without installing a jam sensor in the post-treatment device 300; and the following description will discuss a case in which a jam sensor is installed in the post-treatment device 300.

Figure 36:
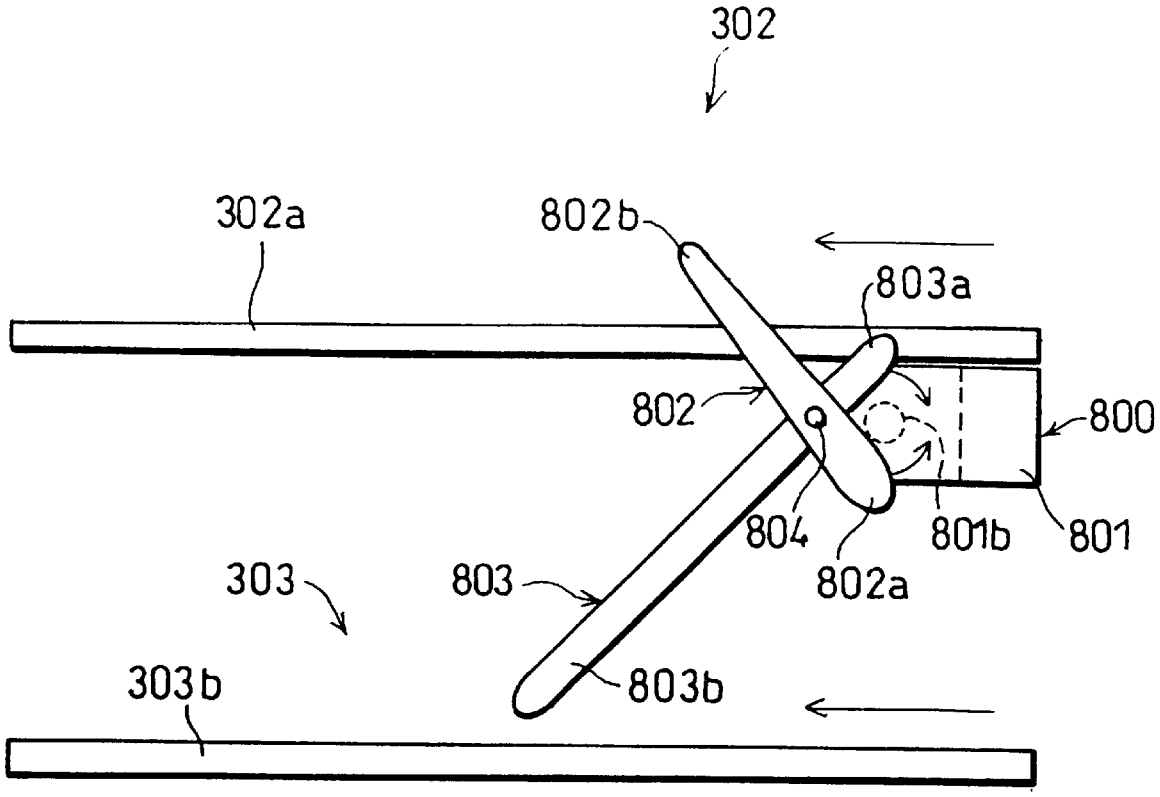
FIG. 36 is a schematic drawing that shows a jam detection mechanism for detecting a sheet of paper in the post-treatment device of the image-forming apparatus of the present invention.

As illustrated in FIG. 36, in the above-mentioned jam detection, a jam detection mechanism is utilized in which a paper sensor 800 is placed between the central paper guide 302*a* of the escape path 302 and the transport guide 303*a* of the staple tray 303.

Figure 37A:
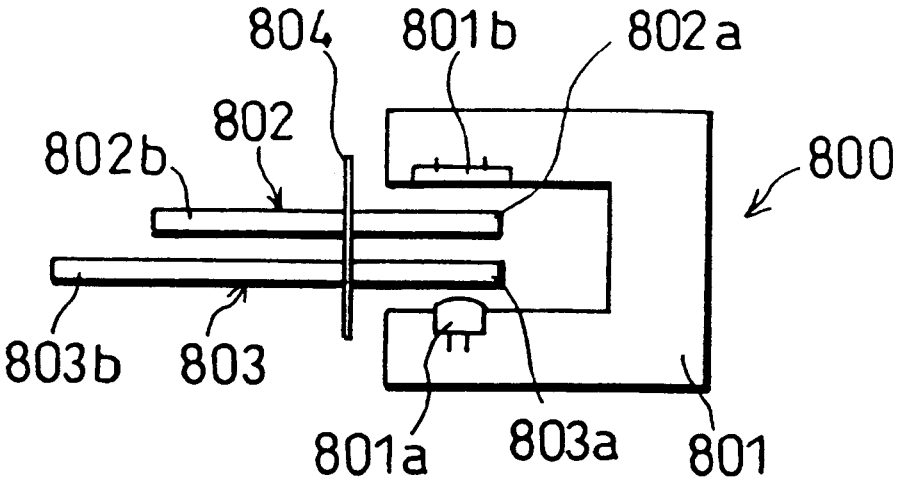
FIG. 37(*a*) is a schematic plan view that shows a paper sensor installed in the jam detection mechanism.
Figure 37B:
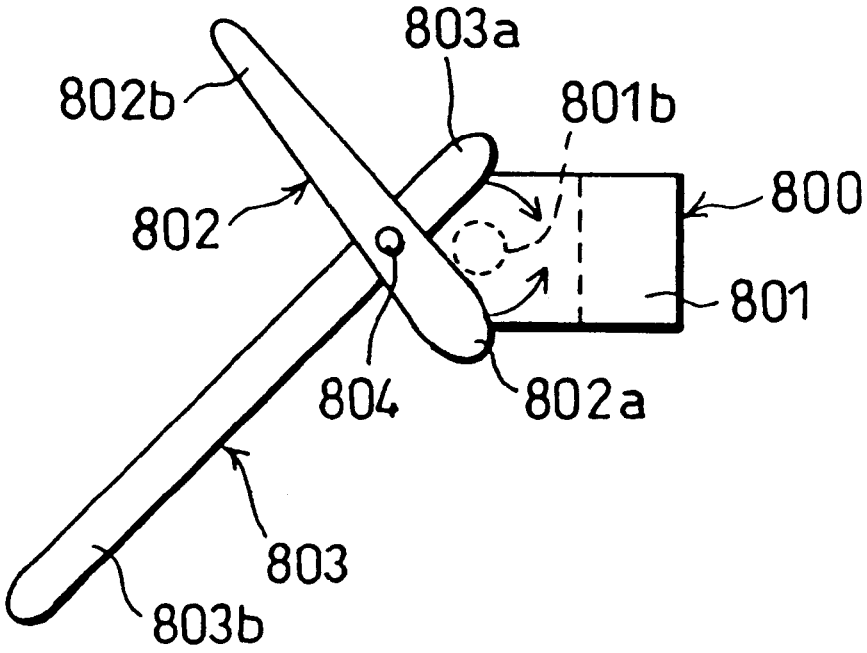

As illustrated in FIGS. 37(*a*) and 37(*b*), the paper sensor 800 is constituted by an optical sensor 801, two large and small arms 802 for blocking the light path of the optical sensor 801 and an arm 803. The arms 802 and the arm 803 are supported on a common support shaft 804 so as to freely pivot thereon.

The optical sensor 801 is provided with a light-emitting section 801*a* and a light-receiving section 801*b*, and the end portion 802*a* of the arm 802 and the end portion 803*a* of the arm 803 are allowed to stay between the light-emitting section 801*a* and the light-receiving section 801*b*. In other words, the arm 802 and the arm 803 are allowed to pivot to block the light path of the optical sensor 801, thereby limiting the quantity of light to be made incident on the light-receiving section 801*b*.

As illustrated in FIG. 36, the end portion 802*b* on the side opposite to the end portion 802*a* of the arms 802 is arranged so as to stick out from the central paper guide 302*a*. Thus, when a sheet of copy paper P is transported through the central paper guide 302*a*, the sheet of copy paper P comes into contact with the end portion 802*b* of the arm 802 to rotate the arm 802 in the direction of the arrow, with the result that the end portion 802*a* of the optical sensor 801 changes the quantity of light to be made incident on the light-receiving section 801*b* of the optical sensor 801.

On the other hand, the end portion 803*b* on the side opposite to the end portion 803*a* of the arms 803 is arranged to come close to the transport guide 303*b*, and when a sheet of copy paper P is transported through the transport guide 302*b*, the sheet of copy paper P comes into contact with the end portion 803*b* to rotate the arm 803 in the direction of the arrow, with the result that the end portion 803*a* changes the quantity of light to be made incident on the light-receiving section 801*b* of the optical sensor 801.

Here, the balance of the center of gravity of the above-mentioned arm 802 and the balance of the center of gravity of the above-mentioned arm 803 are designed so as to be different from each other.

Figure 38:
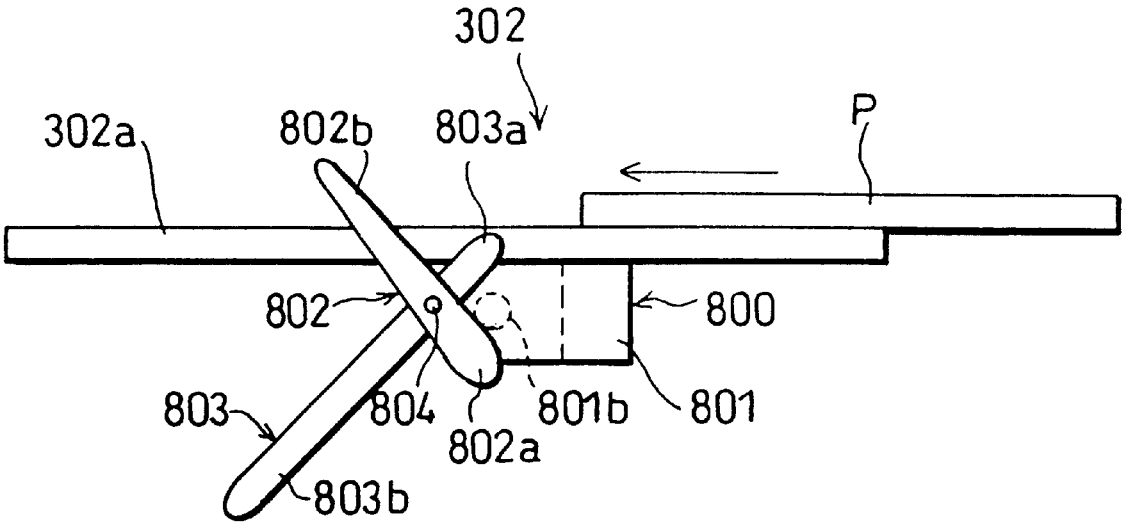
FIG. 38 is an explanatory drawing that shows a detecting operation for a sheet of copy paper in the escape path in the jam detection mechanism of FIG. 36.
Figure 39:
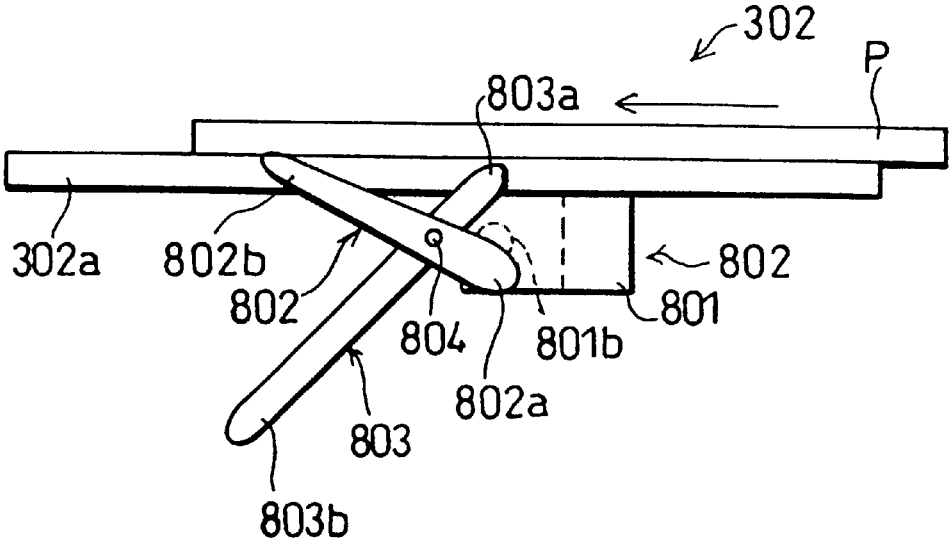
FIG. 39 is an explanatory drawing that shows the detecting operation for a sheet of copy paper in the escape path in the jam detection mechanism of FIG. 36.

In other words, the above-mentioned arm 802 has its center of gravity on the side toward the light path of the optical sensor 801 from the support shaft 804 serving as a fulcrum, and when no copy paper P exists in the escape path 302, it is maintained in a state as shown in FIG. 38 in which the end portion 802*b* sticks out from the central paper guide 302*a* with the end portion 802*a* giving no influence to the quantity of light to be made incident on the light-receiving section 801*b* of the optical sensor 801. In contrast, when a sheet of copy paper P is transported through the escape path 302, or in the event of a jam of copy paper P, it is changed into a state as shown in FIG. 39 in which the end portion 802*b* is pressed downward by the sheet of copy paper P to rotate toward the staple tray 303 side so that the end portion 802*a* is allowed to block the light path of the optical sensor 801.

Figure 40:
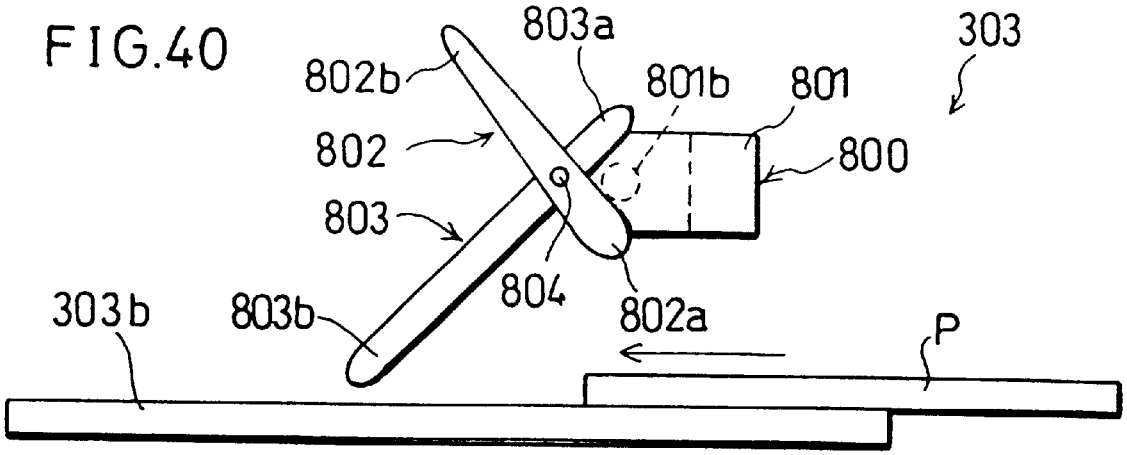
FIG. 40 is an explanatory drawing that shows a detecting operation for a sheet of copy paper in the staple tray in the jam detection mechanism of FIG. 36.
Figure 41:
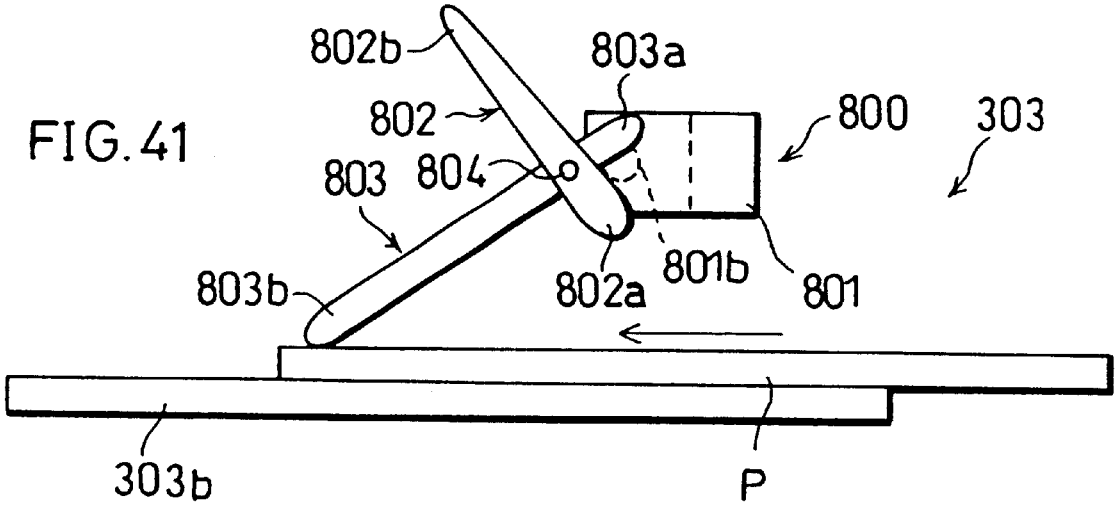
FIG. 41 is an explanatory drawing that shows the detecting operation for a sheet of copy paper in the staple tray in the jam detection mechanism of FIG. 36.

The above-mentioned arm 803 has its center of gravity on the side toward the transport guide 303*b* from the support shaft 804 serving as a fulcrum, and when no copy paper P exists in the staple tray 303, it is maintained in a state as shown in FIG. 40 in which the end portion 803*b* is apart from the transport guide 303*b* with a predetermined distance with the end portion 803*a* giving no influence to the quantity of light to be made incident on the light-receiving section 801*b* of the optical sensor 801. In contrast, when a sheet of copy paper P is transported through the staple tray 303, or in the event of a jam of copy paper P, it is changed into a state as shown in FIG. 41 in which the end portion 803*b* is pressed downward by the sheet of copy paper P to rotate toward the escape path 302 side so that the end portion 803*a* is allowed to block the light path of the optical sensor 801.

As described above, in the case when the end portion 802*a* of the arm 802 has blocked the light path of the optical sensor 801 for not less than a predetermined period of time, the operation panel, etc. are informed of the fact that a paper jam is occurring inside the escape path 302, and if the time during which it has blocked the light path of the optical sensor 801 is not more than the predetermined time, the operation panel, etc. are informed of the fact that a sheet of copy paper P is being transported through the escape path 302. In the case of the arm 803 also, the same operations as those of the arm 802 are carried out.

Here, as described above, the paper sensor 800 is commonly used as a paper sensor both in the escape path 302 and the staple tray 303, and also serves as a jam sensor. With this arrangement, it is possible to properly carry out a jam treatment operation in the post-treatment device 300, and also to eliminate the need for providing a space in which the sensor for the jam treatment operation is installed. Consequently, it becomes possible to further simplify the transport paths of sheets of copy paper P.

The image-forming apparatus of the present invention is applied to the following various modified arrangements.

In other words, the image-forming apparatus of the present invention may have an arrangement in which: in an image-forming apparatus having a main body, provided with a first paper-discharge section below the scanner, to which the paper post-treatment device can be added, a paper transport path reaching the first paper-discharge section is divided into two paths; to the branch path that is not directed to the first paper-discharge section is connected a paper transport path of the paper post-treatment device installed below the scanner, above the main body; the paper transport path of the paper post-treatment device is further divided into two paths, either one of which is used for carrying out the post-treatment; the other transport path that is not used for the post-treatment is directed to a second paper-discharge section, and the paper transport path used for the post-treatment is directed to a third paper-discharge section placed on the side of the main body.

With the above-mentioned arrangement, the paper transport path inside the main body is divided into two paths, and to the branch path that is not directed to the first paper-discharge section is connected the paper transport path of the paper post-treatment device; therefore, the first paper-discharge section can be used without being blocked by the paper post-treatment device. Moreover, the paper transport path of the paper post-treatment device is divided into two paths, and the second paper-discharge path and the third paper-discharge path corresponding to these are installed; thus, the total three paper-discharge sections are installed.

Therefore, in the case when sheets of paper are outputted to the respective paper-discharge sections in a sorted manner for each of the functions possessed by the image-forming apparatus, paper-discharge sections corresponding to the typical three kinds of functions, that is, the copying function, printing function and facsimile function, can be provided without the sacrifice of the first paper-discharge section, thereby making it possible to improve the spatial performance and convenience of the apparatus.

Moreover, of the two paper transport paths branched inside the paper post-treatment device, the one directed to the third paper-discharge section is used for the post-treatment for sheets of copy paper. Therefore, the paper transport paths can be used in a distinct manner depending on the presence or absence of a post treatment; and it is not necessary to carry out complex operation controlling in one paper transport path, which has been required in conventional apparatuses. Moreover, since the transport roller having conditions optimized for the post treatment and the transport roller having conditions optimized for the case without the post treatment are placed in the different paper transport paths; therefore, no trouble is raised in transporting sheets of copy paper.

In another image-forming apparatus of the present invention, the paper transport path that is led to the second paper-discharge section is also branched so as to reach the third paper-discharge path; thus, it is possible for the user to select which of the first, second and third paper-discharge section to be used for discharging sheets of paper.

With the above-mentioned arrangement, any of the paper-discharge sections desired by the user can be selected. Moreover, in the case when sheets of copy paper that are not subjected to the post-treatment are discharged to the third paper-discharge section, those sheets of paper can be discharged to the third paper-discharge section by using the paper transport path that is not related to the post treatment inside the paper post-treatment device.

In still another image-forming apparatus of the present invention, it is possible to select any paper-discharge section depending on functions; and in the case of such a function in which the third paper-discharge section is selected without carrying out the post treatment, sheets of paper are discharged to the third paper-discharge section through the paper transport path that is not related to the post treatment inside the paper post-treatment device.

In the above-mentioned arrangement, the sheets of paper can be classified depending on the respective functions such as the copying function, printing function and the facsimile function, and sorted respectively. Moreover, with respect to the function to which the third paper-discharge section is assigned, no consideration is required as to the presence or absence of the post treatment.

In still another image-forming apparatus of the present invention, the selection of any function is set on the display panel, and the setting is stored in a memory until otherwise changed.

This arrangement makes it possible to easily select the operation, and also to eliminate the need from changing the setting each time the image-forming apparatus is used.

In still another image-forming apparatus of the present invention, in the case when the post-treatment process of sheets of paper is carried out, the sheets of paper are discharged to the third paper-discharge section independent of the setting of the user selection.

With this arrangement, even when the user erroneously selects the paper-discharge section, the post treatment of sheets of copy paper is carried out correctly.

In still another image-forming apparatus of the present invention, even when, upon carrying out the post-treatment of a sheet of paper, a kind of a sheet of paper from which the post-treatment is inhibited is transported, this sheet of paper is discharged through the paper transport path that is not related to the post treatment.

If a kind of a sheet of paper from which the post-treatment is inhibited is subjected to the post-treatment, this might cause a problem in transporting sheets of paper. However, the above-mentioned arrangement makes it possible to prevent this problem.

In still another image-forming apparatus of the present invention, a gate is attached to each of the junctions of the paper transport paths so as to allow selection among the destinations of the paper transport paths.

With the above-mentioned arrangement, it is possible to easily form a path through which a sheet of paper is discharged to the target paper-discharge section.

In still another image-forming apparatus of the present invention which is an image-forming apparatus having a U-letter arrangement that is provided with a document-reading means (scanner), a printing means for printing image information, a paper feeding means for housing and feeding sheets of paper, a cassette means and a paper-discharge means for discharging a printed sheet of paper, the paper-discharge means is located below the document-reading means, above the paper feeding means and the cassette means, and also positioned on the side face of the printing means, a paper post-treatment transport path for virtually transporting a sheet of paper horizontally is placed in the paper-discharge section, and a paper-adjusting member is placed in the post-treatment transport path. In this arrangement, sheets of paper transported are adjusted, and a set of adjusted sheets of paper is subjected to a post-treatment process by a post-treatment (staple) means.

In the above-mentioned arrangement, the paper post-treatment device is placed by utilizing the space section (on the paper-discharge section) of the U-letter shape image forming apparatus effectively; therefore, it is possible to miniaturize the apparatus, and also to reduce the space occupied by the apparatus.

Moreover, the paper-adjusting position and the post-treatment (staple) position are set at the same level so that it is possible to allow the set of adjusted sheets of paper to be subjected to the post-treatment without being deformed. Therefore, it becomes possible to provide the user with a set of well-adjusted sheets of paper that have been printed.

In still another image-forming apparatus of the present invention which is provided with a document-reading means (scanner), a printing means for printing image information, a paper feeding means for housing and feeding sheets of paper, a cassette means and a paper-discharge means for discharging a printed sheet of paper, and a printed-paper post-treatment means that is placed between the paper-discharge means and a housing means for housing printed sheets of paper, the post-treatment means carries out a post-treatment on the printed sheets of paper in a space formed with respect to the image-forming apparatus, that is, in the paper-discharge means.

In the above-mentioned arrangement, it is not necessary to install the post-treatment device on the side face of the image-forming apparatus; therefore, it is possible to effectively use the space in the apparatus, and consequently to provide a compactly designed apparatus.

In still another image-forming apparatus of the present invention which is provided with a document-reading means (scanner), a printing means for printing image information, a paper feeding means for housing and feeding sheets of paper, a cassette means and a paper-discharge means for discharging a printed sheet of paper, and a printed-paper post-treatment means that is placed between the paper-discharge means and a housing means for housing printed sheets of paper, the post-treatment means is placed virtually horizontally with respect to the image-forming apparatus and has two transport paths.

With the above-mentioned arrangement, it is possible to make compact the device attached to the side face of the image-forming apparatus, and consequently to reduce the occupied space of the entire apparatus.

In still another image-forming apparatus of the present invention, of the two transport paths, the first transport path is arranged to transport printed sheets of paper to the first paper stack tray and the second paper stack tray.

With the above-mentioned arrangement, it is possible to fully utilize the functions of the paper stack section, such as outputs for special sheets of paper and small-size sheets of paper, a large amount of output and an off-set function.

In still another image-forming apparatus of the present invention, of the above-mentioned two transport paths, the second transport path is used for transporting printed sheets of paper that have been stapled to the second paper stack tray.

With the above-mentioned arrangement, since the transport path is exclusively-used for stapling, it is possible to easily construct the adjusting member and the driving system used as its driving source.

In still another image-forming apparatus of the present invention, in the staple unit, the stopper and the fixed wall are attached to the same member, and the staple unit is placed outside the width of the main body.

With the above-mentioned arrangement, it is possible to provide better positional precision with respect to the stapling process for sheets of paper, and consequently to improve the appearance and quality of sets of sheets of paper after the stapling process.

In still another image-forming apparatus of the present invention, a printed sheet of paper transported through the second transport path has its rear edge housed in any one of a plurality of recessed sections that are placed in the transport path, depending on kinds of printing; therefore, it is possible to properly adjust the leading edge of a sheet of paper, and also to easily sort pages of printed sheets of paper.

With the above-mentioned arrangement, although it is not necessary to provide an exclusively-used pressing member and controlling operation, the next sheet of paper is always set on the corresponding stacked sheets of paper properly.

In still another image-forming apparatus of the present invention, a width-adjusting mechanism used for the adjusting process in the virtually horizontal post-treatment device is installed.

With the above-mentioned arrangement, it is possible to well-adjust stapled sheets of paper so as to improve the quality of stapled sets of paper, and also to fix the staple unit to a predetermined position by adjusting the width of sheets of paper to the stapling position.

In still another image-forming apparatus of the present invention, the set of printed sheets of paper that have been stapled by the stapling unit is transported and discharged onto the second paper stack tray by a paper-transport member placed in the staple tray section in the post-treatment device and the fourth paper-discharge roller placed between the second paper stack tray and the staple tray section.

With the above-mentioned arrangement, it is possible to discharge sheets of paper without causing damages to the sets of sheets of paper.

In still another image-forming apparatus of the present invention, a gate means for diverging sheets of paper to the first transport path and the second transport path is installed inside the post-treatment device.

With the above-mentioned arrangement, it is possible to properly sort sheets of paper depending on whether the staple function is selected or not.

In still another image-forming apparatus of the present invention, the gate means is switched based upon paper size information given from the main body paper feeding section, the length of a sheet of paper being transported through the main body and the results of detection made by the width detection means.

This arrangement makes it possible to sort sheets of paper by classifying them depending on the respective factors.

In still another image-forming apparatus of the present invention, the pivotal movement or rotation of the driving roller to the staple path is carried out when, after detection of the fact that the leading edge of a sheet of paper has been fed from the paper-discharge section of the apparatus, the leading edge has been transported to the driving roller.

With the above-mentioned arrangement, when the leading edge of a sheet of paper is transported to the driving roller section, the gap between the driving roller and the contact member is maintained sufficiently wide so that, even when the sheet of paper is curled, it is transported smoothly with its leading edge being free from contacting the roller.

In still another image-forming apparatus of the present invention, the rotation angle or rotation time of the driving roller with respect to the staple path is set before the time at which the leading edge of a sheet of paper has reached the stapling paper leading edge stopping mechanism.

With the above-mentioned arrangement, after the leading edge of paper has reached the stapling paper leading edge stopping mechanism, the rotation of the driving roller is stopped or the driving roller is pivoted toward the escape path; thus, it is possible to prevent paper jam and damages to the sheet of paper due to over-feeding of the sheet of paper.

In still another image-forming apparatus of the present invention, with respect to the staple-use driving roller, the transporting force is set so that, when the leading edge of a sheet of paper has reached the stapling paper leading edge stopping mechanism and a load is applied to the sheet of paper, the sheet of paper is allowed to slip on the roller; therefore, it is possible to positively adjust the leading edges of sheets of paper, without causing paper jam and damages to the sheet of paper due to over-feeding of the sheet of paper.

In still another image-forming apparatus of the present invention, the torque is transmitted to the roller to be rotated by allowing the gear attached to the rotation fulcrum to engage a gear that pivots in association with the pivotal arm.

With the above-mentioned arrangement, the roller to be rotated is subjected to the torque by allowing the gear attached to the rotation fulcrum to engage a gear that pivots in association with the pivotal arm; therefore, the arm pivotal movement makes it possible to smoothly transmit the driving force without variations in gear pitches.

In still another image-forming apparatus of the present invention, the torque is transmitted to the roller to be rotated by allowing the gear or pulley attached to the rotation fulcrum to be connected to a belt.

With the above-mentioned arrangement, the roller to be rotated is subjected to the torque by allowing the gear or pulley attached to the rotation fulcrum to be connected to a belt; therefore, the arm pivotal movement makes it possible to smoothly transmit the driving force without variations in gear or pulley pitches. In the case of the gear connection, the number of gears increases or the gear size becomes larger as the pivotal arm is set longer. In contrast, in the case of the belt connection, it is only necessary to change the length of the belt; therefore, it is possible to reduce the number of parts, and also to make the apparatus compact.

In still another image-forming apparatus of the present invention, the transporting force of the roller to be rotated is set greater in the escape path than in the staple path.

When a sheet of paper is transported through the staple path, the sheet is allowed to move while sliding on sheets of paper stocked to be stapled or the guide plate. Here, in the above-mentioned arrangement, the transporting force (a pressing force exerted between the roller and the sheet of paper) of the driving roller at the time of stapling is reduced so that the sheets of paper are free from scratches and damages.

In still another image-forming apparatus of the present invention, with respect to paper jam in the escape path in the printed paper post-treatment means, in the case when, even after a lapse of a predetermined time period since detection of a sheet of paper being transported in the printing means in the image-forming apparatus, the sheet of paper has not reached the paper-discharge section placed on the side face of the apparatus, it is judged that there is a paper jam in the escape path.

With the above-mentioned arrangement, in the case when, upon request for a printing process, a sheet of paper is discharged by using the escape transport path without requesting the post-treatment, it is not necessary to install any detection mechanism for detecting the passage or stack of a sheet of paper being transported in the transport path.

In still another image-forming apparatus of the present invention, with respect to paper jam in the post-treatment transport path in the printed paper post-treatment means, in the case when selection of the post-treatment process for printed sheets of paper is made by request for a printing process and even after one job of the post-treatment process requested has been completed and even after a predetermined time period has elapsed, the sheet of paper has not reached the paper-discharge section placed on the side face of the apparatus, it is judged that there is a paper jam in the escape path.

With the above-mentioned arrangement, in the case when, upon request for a printing process, no sheet is discharged even after one job has been completed and the next job has started, it is judged that there is a jam; therefore, it is possible to prevent sheets of paper from stacking the post-treatment transport path.

[Embodiment 2]

The following description will discuss another embodiment which realizes a paper-post-treatment device of the present invention.

Figure 42:
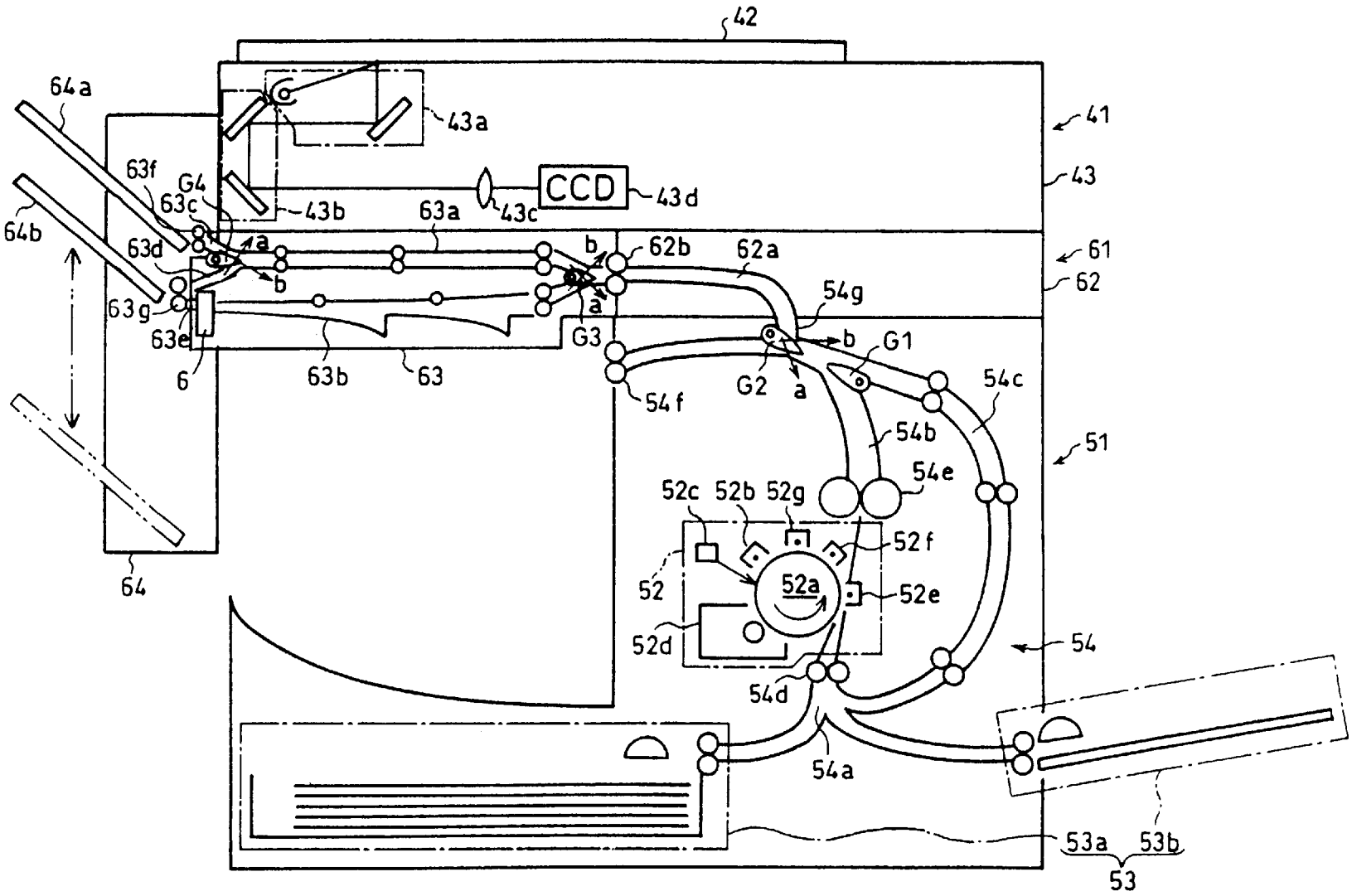
FIG. 42 is a schematic drawing that shows the structure of an image-forming apparatus in accordance with another embodiment of the present invention.

FIG. 42 shows the structure of an image-forming apparatus provided with the paper-post-treatment apparatus in accordance with the present embodiment. The image-forming apparatus of this Figure is constituted by a document reading section 41, an image-forming apparatus main body 51 and a paper-post-treatment device 61; thus, it has almost the same functions as that of Embodiment 1.

The above-mentioned document reading section 41 has a document platen 42 mad of transparent glass, etc. on its upper face. A scanner optical system 43 is placed below the document platen 42. The scanner optical system 43 is constituted by an exposing light source unit 43*a* for irradiating a document placed on the document platen 42 with light while scanning it so as to pick up reflected light, a movable mirror unit 43*b* for directing the reflected light to the succeeding optical system, an imaging lens 43*c* for converging the reflected light thus directed and a charge coupled device (CCD) 43*d* for transferring the converged light to an electric signal.

The image-forming apparatus main body 51 is constituted by an image-forming section 52 for forming an image by using an electrophotographing system, a paper feeding section 53 for supplying sheets of paper to the image-forming section 52 and a transport path 54 for transporting sheets of paper supplied.

In the image-forming section 52, a photosensitive member 52*a,* which is driven to rotate in the direction of the arrow and has a drum shape, is primarily charged by a main charger 52*b*. The photosensitive member 52 *a* thus primarily charged has a surface on which laser light is directed by a laser scanning unit (LSU) 52*c* in accordance with document image data that has been read by the CCD 43*d* and subjected to image processes, so as to form an electrostatic latent image thereon. The electrostatic latent image on the surface of the photosensitive member 52*a* exposed by the laser light is developed by a developing device 52*d* so as to be visualized as a toner image.

Then, the toner image of the photosensitive member 52*a* is transferred on a sheet of paper by a transfer charger 52*e*. After the transferring process, residual toner on the surface of the photosensitive member 52*a* is removed by a cleaning device 52*f* and the electric potential of the surface of the photosensitive member 52*a* is initialized by a static eliminator 52*g*.

The paper feeding section 53 is provided with a paper cassette 53*a* for storing a number of sheets of paper inside the image-forming apparatus main body 51 and a manually feeding tray 53*b* used for feeding sheets of paper from the side face of the image-forming apparatus main body 51. At the leading end portion on the paper feeding side of the paper cassette 53*a* and the manually feeding tray 53*b* are installed a directing roller which feeds the sheets of paper, and a paper-sorting section, which is constituted by a roller and a frictional sheet member or a reversing roller, etc.

The transport path 54 is provided with a transport path 54*a* extending from the paper feeding section 53 to the image-forming section 52, a transport path 54*b* extending from the image-forming section 52 to the outlet and a transport path 54*c* starting from the middle of the transport path 54*b* to reach the transport path 54*a*. For convenience of explanation, the paper feeding section 53 side from which sheets of paper are fed is referred to as the upstream side, and the paper discharging side is referred to as the downstream side. Then, in the transport path 54*a* are installed a pre-registration detection switch (not shown) for detecting the passage of sheets of paper flowing from the upstream side to the downstream side and a pair of registration rollers 54*d* for positioning a sheet of paper with respect to a toner image on the photosensitive member 52*a* based upon the signal of the pre-registration detection switch.

Moreover, in the transport path 54*b* are installed a fixing device 54*e* for fixing a toner image transferred on a sheet of paper by applying heat and pressure, a fixed paper detection switch (not shown) for detecting the passage of a sheet of paper through the fixing device 54*e,* a pair of paper-discharge rollers 54*f* for discharging sheets of paper and a paper-discharge detection switch (not shown) for detecting the passage of a sheet of paper through the paper-discharge rollers 54*f*.

Sheets of paper, which pass through the pair of paper-discharge rollers 54*f,* are discharged to a space beside the image-forming apparatus main body 51, below a paper-post-treatment device 61, which will be described later. The transport path 54*c* is a transport path for switching back a sheet of paper upon carrying out a double-sided printing process on the sheet of paper, and a switching gate G1 for switching transport paths is installed at the junction to the transport path 54*b*. Moreover, from the middle of the transport path 54*b* is branched a transport path 54*g* extending toward a second paper-discharge unit 62, which will be described later, and a switching gate G2 for switching transport paths is installed at its junction.

The paper-post-treatment device 61 is provided with a second paper-discharge unit 62 having a horizontal transport mechanism and a storage adjustment unit 63 that are placed between the document-reading section 41 and the image-forming apparatus main body 51, and a paper stack section 64 installed on the side face of the document-reading section 41 and the image-forming apparatus main body 51.

The paper-post-treatment device 61 is installed so as to carry out post-treatments such as a stapling process, a sorting process using paper offsetting and a high-capacity stacking process. The second paper-discharge unit 62, which is placed right above the transport path 54*b* of the image-forming apparatus main body 51, is provided with a transport path 62*a* that connects the transport path 54*g* to the paper inlet of the storage adjustment unit 63.

Therefore, upon carrying out post-treatments, the switching gate G2 of the image-forming apparatus main body 51 is shifted from orientation b to orientation a so that a sheet of paper is guided to the second paper-discharge unit 62. The sheet of paper thus guided is sent to the storage adjustment unit 63 by the pair of paper-discharge rollers 62*b* through the transport path 62*a*.

The storage adjustment unit 63 is placed in a space to which sheets of paper are discharged from the pair of paper-discharge rollers 54*f* of the image-forming apparatus main body 51, that is, right above the main-body paper-discharge section. The storage adjustment unit 63 is provided with a first transport path 63*a* used when no stapling process is carried out and a second transport path 63*b* used when a stapling process is carried out, and a staple unit 6 is installed on the farthest downstream side of the second transport path 63*b*. The first transport path 63*a* and the second transport path 63*b* are branched immediately after the paper inlet that is connected to the pair of the paper-discharge rollers 62*b* of the second paper-discharge unit 62. A gate G3 is installed at this junction so as to sort sheets of paper by switching them to either of the transport paths.

In the case when a sheet of paper from which a stapling process is inhibited, such as paper of a special kind or paper of a small size, is transported or when a large amount of paper is discharged without carrying out a stapling process thereon, the switching gate G3 is shifted to orientation a so that the first transport path 63*a* is used as an escape transport path. When a stapling process is carried out, the switching gate G3 is shifted to orientation b so that the second transport path 63*b* is used.

Moreover, the first transport path 63*a* is branched to two transport paths 63*c* and 63*d* at the farthest downstream side, and a switching gate G4 is installed at its junction. The operation for switching the switching gate G4 between orientation a and orientation b makes it possible to sort sheets of paper to different stack trays in a paper stack section 64. The paper-discharging process is carried out from the transport path 63*c* to the first stack tray 64*a* by using the pair of paper-discharge rollers 63*f*, and the paper-discharging process is also carried out from the transport path 63*d* or the transport path 63*e* on the downstream side of the staple unit 6 to the second stack tray 64*b* by using the paper-discharge roller 63*g*.

Moreover, the storage adjustment unit 63 is detachably attached to the paper-post-treatment device 61. In other words, in the case when no stapling process is carried out and when the paper stack section 64 is not used, the storage adjustment unit 63 can be removed from the paper-post-treatment device 61. In this manner, in the case when the storage adjustment unit 63 has been removed from the paper-post-treatment device 61, sheets of paper are discharged from the transport path 62*a* in the second paper-discharge unit 62 to a space beside the image-forming apparatus main body 51, below the paper-post-treatment device 61 which will be described later, through the pair of paper-discharge rollers 62*b*.

Figure 43A:
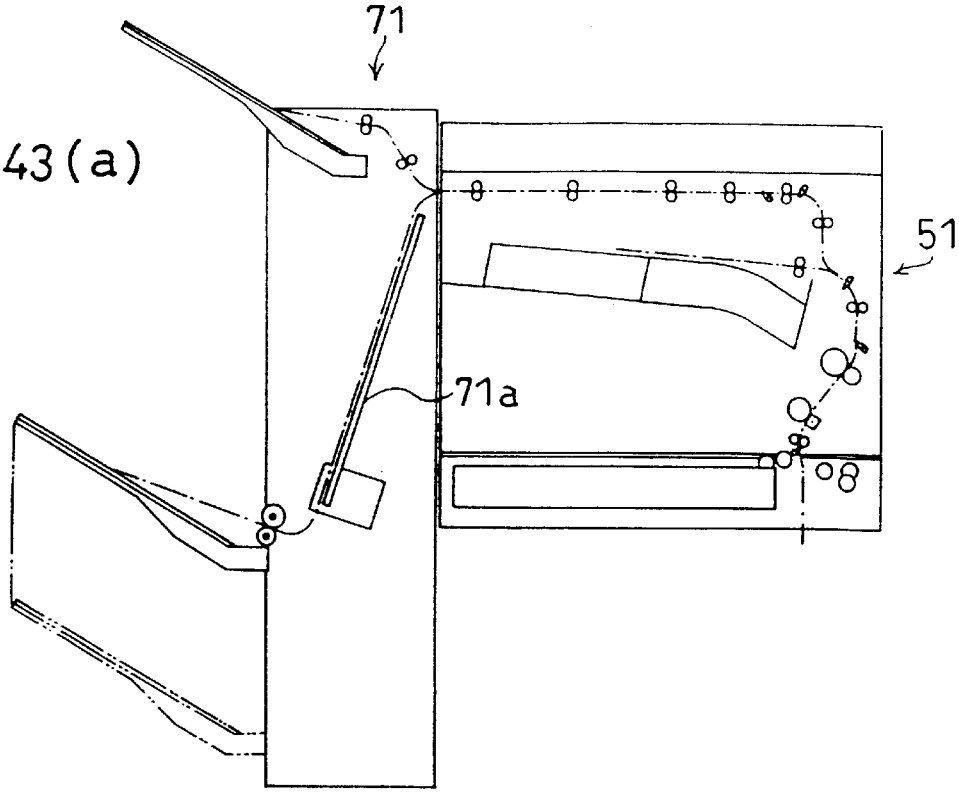
FIG. 43(*a*) is a schematic drawing that shows the structure of an image-forming apparatus that serves as a comparative example of the image-forming apparatus of the present invention.
Figure 43B:
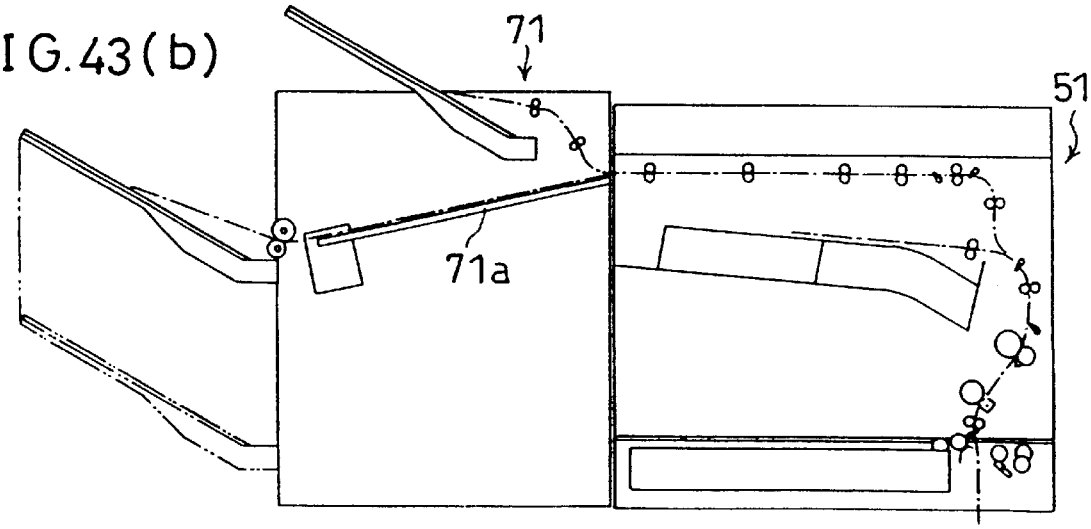

As illustrated in FIGS. 43(*a*) and 43(*b*), in an attempt to carry out the post-treatments inside a paper-post-treatment device 71 placed on the side face of the image-forming apparatus main body 51, a storage adjustment tray 71*a* is installed on the side face of the image-forming apparatus main body 51. In this case, as illustrated in FIG. 43(*a*), as the slant of the storage adjustment tray 71*a* is made closer to the vertical direction, the height increases, and as illustrated in FIG. 43(*b*), as the slant thereof is made closer to the horizontal direction, the width thereof increases. In particular, in an attempt to house and adjust large-size sheets of paper, the length of the storage adjustment tray 71*a* becomes greater. In such a case, even in the recent miniaturization of the image-forming apparatus, the apparatus comes to have a large size that can not be placed without an exclusively-used base plate or a paper-feed cassette mechanism, resulting in a system that requires a large occupied space.

Therefore, in order to avoid the above-mentioned problem, in the paper-post-treatment device 61 in the present embodiment, the post-treatments are carried out in the second transport path 63*b* above the image-forming apparatus main body 51, with respect to sheets of paper discharged from the image-forming apparatus main body 51.

The paper stack section 64 is provided with the first stack tray 64*a* and the second stack tray 64*b*.

The first stack tray 64*a* is used for receiving sheets of paper that are discharged after passing through the first transport path 63*a* of the storage adjustment unit 63 and the transport path 63*c*, and deals with a small amount of paper-discharge including paper of a special kind and paper having a small size.

The second stack tray 64*b* is used for receiving sheets of paper that are discharged after passing through the first transport path 63*a* of the storage adjustment unit 63 and the transport path 63*d* or sheets of paper that are discharged after passing through the second transport path 63*b* of the storage adjustment unit 63 and the transport path 63*e*, and deals with a large amount of paper-discharge or paper-discharge of sets of sheets that have been subjected to a stapling process.

Moreover, the second stack tray 64*b*, which is freely adjustable so as to ascend or descend in accordance with the amount of paper to be discharged, is allowed to always maintain constant the distance between the upper surface of the sheet of paper discharged and the paper-discharge roller, thereby making it possible to improve the paper-discharging function as well as enabling a large amount of paper stack. Moreover, the second stack tray 64*b* also has an offsetting function for sorting sheets of discharged paper into respective sets by making fore and aft reciprocating movements, etc.

Figures 44A, 44B:
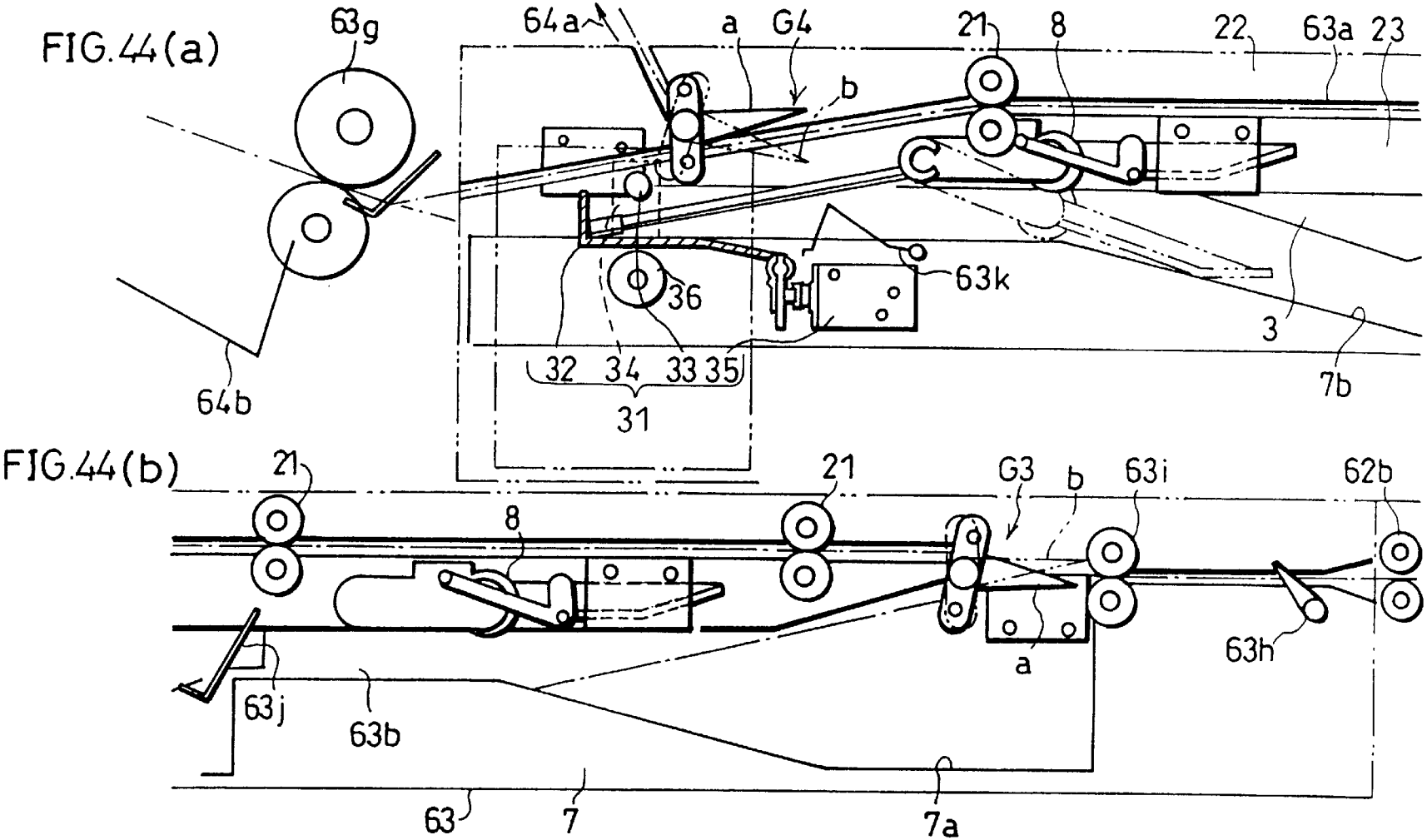
FIGS. 44(*a*) and 44(*b*) are schematic drawings that show the structure of the paper post-treatment device installed in the image-forming apparatus of FIG. 42.

Next, referring to FIGS. 44(*a*) and 44(*b*), the following description will discuss the structure of the above-mentioned storage adjustment unit 63 in detail. FIG. 44(*a*) shows one half of the structure on the downstream side and FIG. 44(*b*) shows the other half of the structure on the upstream side.

On the way from the pair of paper-discharge rollers 62*b* of the second paper-discharge unit 62 to the switching gate G3, a paper width sensor 63*h* and a pair of paper-discharge rollers 63*i* are installed.

The first transport path 63*a* is constituted by pairs of rollers 21, which are arranged with pitches, each shorter than a minimum paper length that can be discharged to the first or second stack tray 64*a* or 64*b* and each of which is formed by pressing a roll onto a generally-used rubber roller, an upper paper guide 22 and a lower paper guide 23; and the lower paper guide 23 is also used as a guide face on the second transport path 63*b*.

The guide face under the second transport path 63*b* is constituted by the upper face of a staple tray (adjustment tray) 7 having two recesses 7*a* and 7*b* on the upstream side and the downstream side. Each of these recesses forms a gentle slope on the downstream side. The arrangement is made so that, upon storing and adjusting, the rear edge of a sheet of paper having a large size is located in the recess 7*a* on the upstream side and the rear edge of a sheet of paper having a small size is located in the recess 7*b* on the downstream side.

The paper sensor 63*j* is installed in the recess 7*b* on the downstream side. Moreover, feed rollers 8 are respectively placed above the recesses 7*a* and 7*b*.

Figures 45A, 45B:
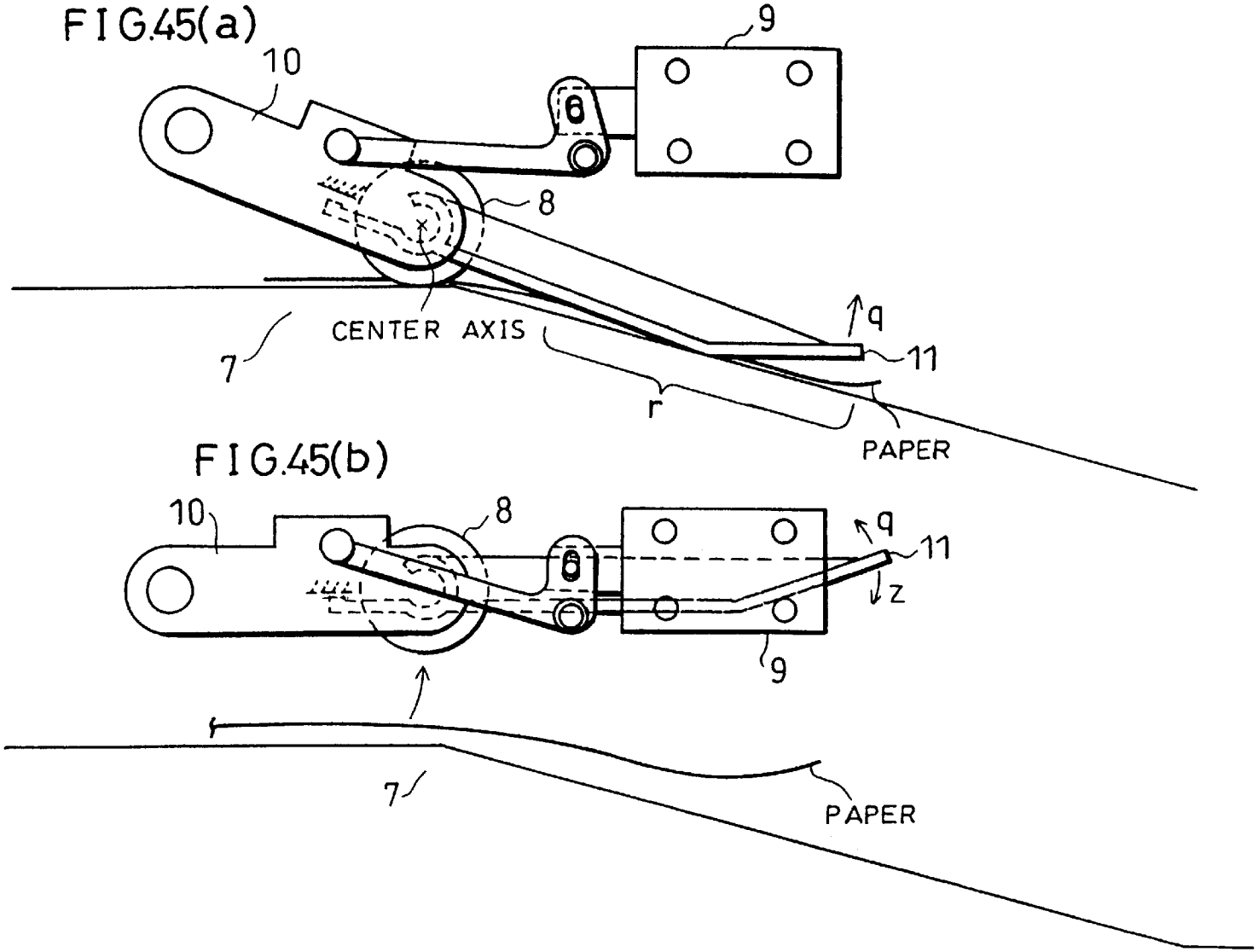
FIGS. 45(*a*) and 45(*b*) are cross-sectional views that show partial structures of the paper post-treatment device shown in FIGS. 44(*a*) and 44(*b*).

FIGS. 45(*a*) and 45(*b*) show the structure on the periphery of the feed roller 8. As illustrated in the Figures, the feed roller 8, which has a structure similar to that of the pickup roller in the main body paper-feed section 53, is ON/OFF controlled by a clutch mechanism so as to rotatively driven, and also controlled by a solenoid 9 in its up and down movements.

The feed roller 8 is in a stand-by position when it is lowered as illustrated in FIG. 45(*a*). Then, as illustrated in FIG. 45(*b*), upon advance of a sheet of paper, the solenoid 9 is turned on so that it is rotated together with the roller arm 10, and raised upward in the direction of arrow. Moreover, the feed roller 8 is lowered in synchronism with the passage of the sheet of paper below it, and it starts to rotate upon turning-on of the clutch mechanism so that the sheet of paper is transported to the adjustment roller 1.

Moreover, paper curling seize levers 11, each having its top bent in a direction slightly departing from the upper face of the staple tray 7, are placed on the respective sides of the feed roller 8, and as illustrated in FIGS. 45(*a*) and 45(*b*), they are allowed to pivot centered on the shaft of the feed roller 8 as a fulcrum.

In other words, when the feed roller 8 is raised, it is restricted by the roller arm 10 to a state in parallel with the roller arm 10, as illustrated in FIG. 45(*b*), and is no longer moved in the direction of arrow z. In contrast, when the feed roller 8 is lowered, it is arranged so that, as illustrated in FIG. 45(*a*), with the portion r thereof functioning so as to press and seize the curled paper, it is allowed to pivot in a direction (direction of arrow q) in which it is pushed up by the curled paper, with a predetermined amount. The pressing force to the curled paper is desirably set by adjusting the length, weight and spring force of the paper curling seize lever 11.

Moreover, as illustrated in FIGS. 44(*a*) and 44(*b*), a paper sensor 63*k* for detecting whether or not any sheet of paper is present on the staple tray 7 is installed on slightly downstream side of the feed roller 8 located on the downstream side.

Figure 46:
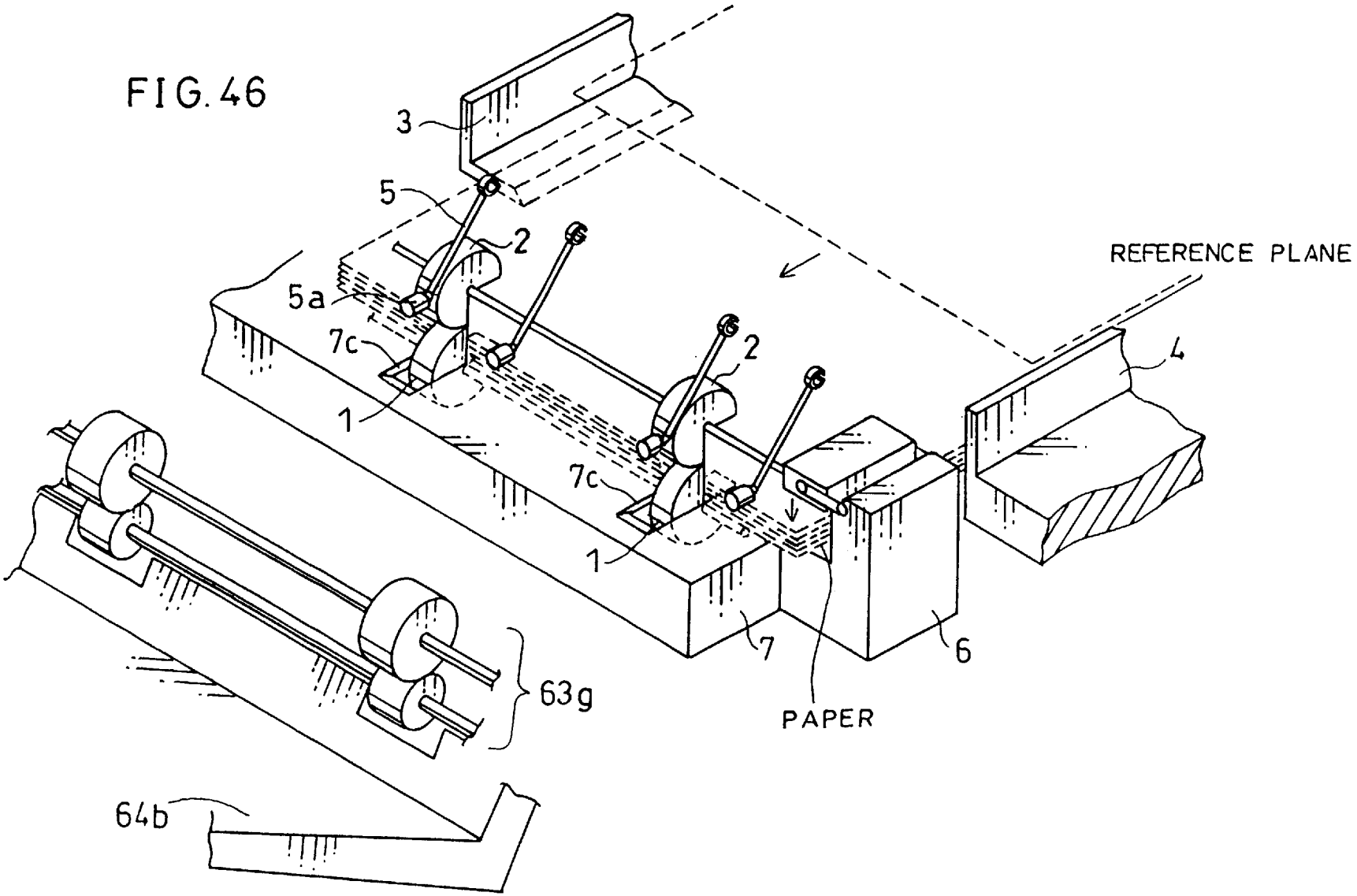
FIG. 46 is a schematic perspective view that shows the vicinity of the staple unit installed in the paper post-treatment device of the image-forming apparatus shown in FIG. 42.
Figure 47:
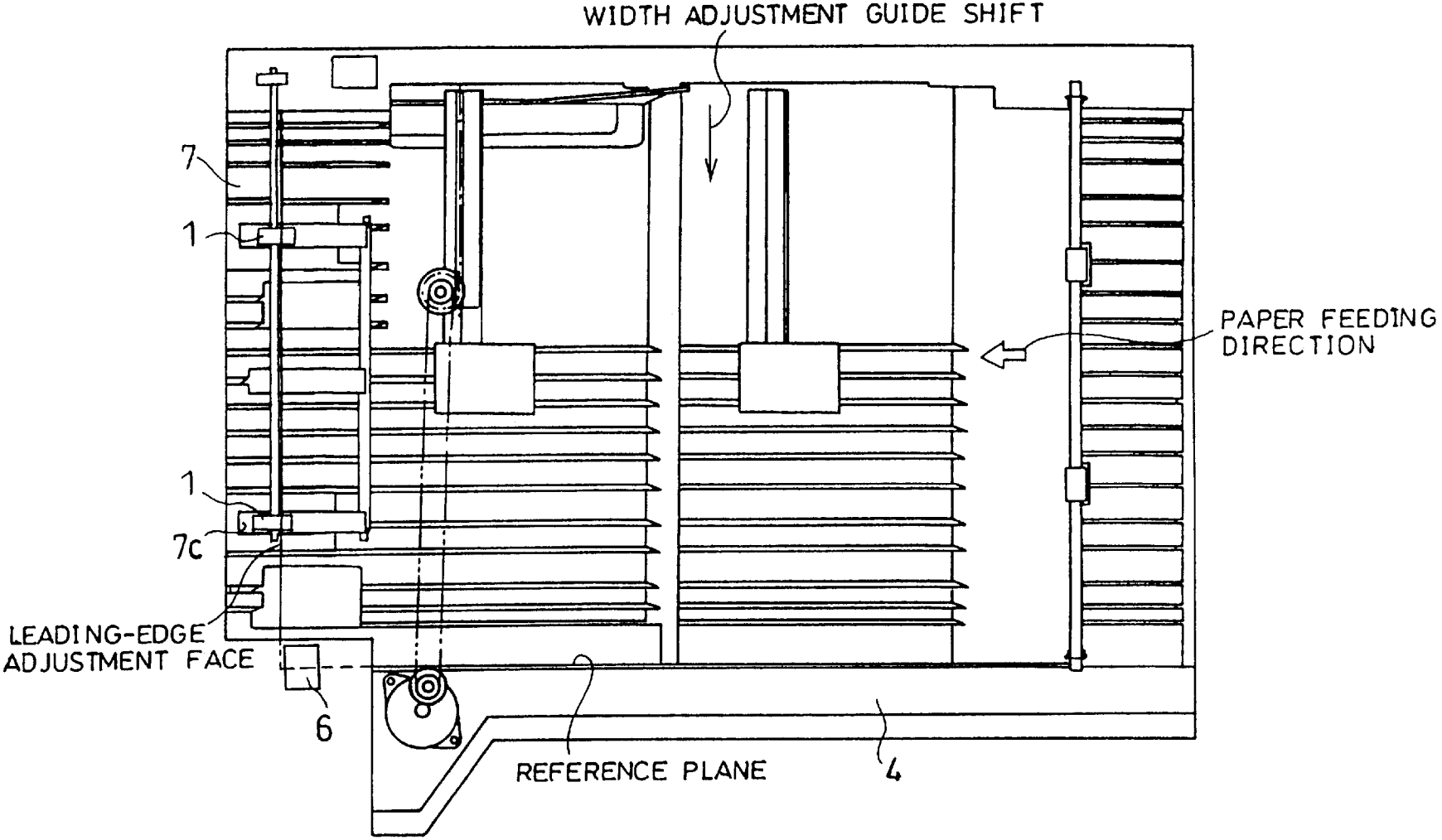
FIG. 47 is a top view that shows the vicinity of the staple unit shown in FIG. 46.

Next, FIG. 46 is a perspective view that shows the structure of the vicinity of the top portion on the downstream side of the staple tray 7 in the second transport path 63*b*, and FIG. 47 shows its upper face. The top portion on the downstream side of the upper face of the staple tray 7 is formed into a flat face, and with respect to post-treatment members used when the staple unit 6, installed on one end of the staple tray 7 in the width direction, carries out a stapling process, there are installed adjustment rollers 1, driven rollers 2, a width adjustment guide 3, a fixing wall 4, and paper leading-edge seize levers 5.

Each of the adjustment rollers 1, serving as a leading-edge adjusting transport means, is a roller that is rotatively driven at a position of a hole 7*c* formed on slightly downstream side from the staple unit 6 on the upper face of the staple tray 7, and has both of the paper leading-edge adjusting function and the transporting function for sets of paper.

Figure 48:
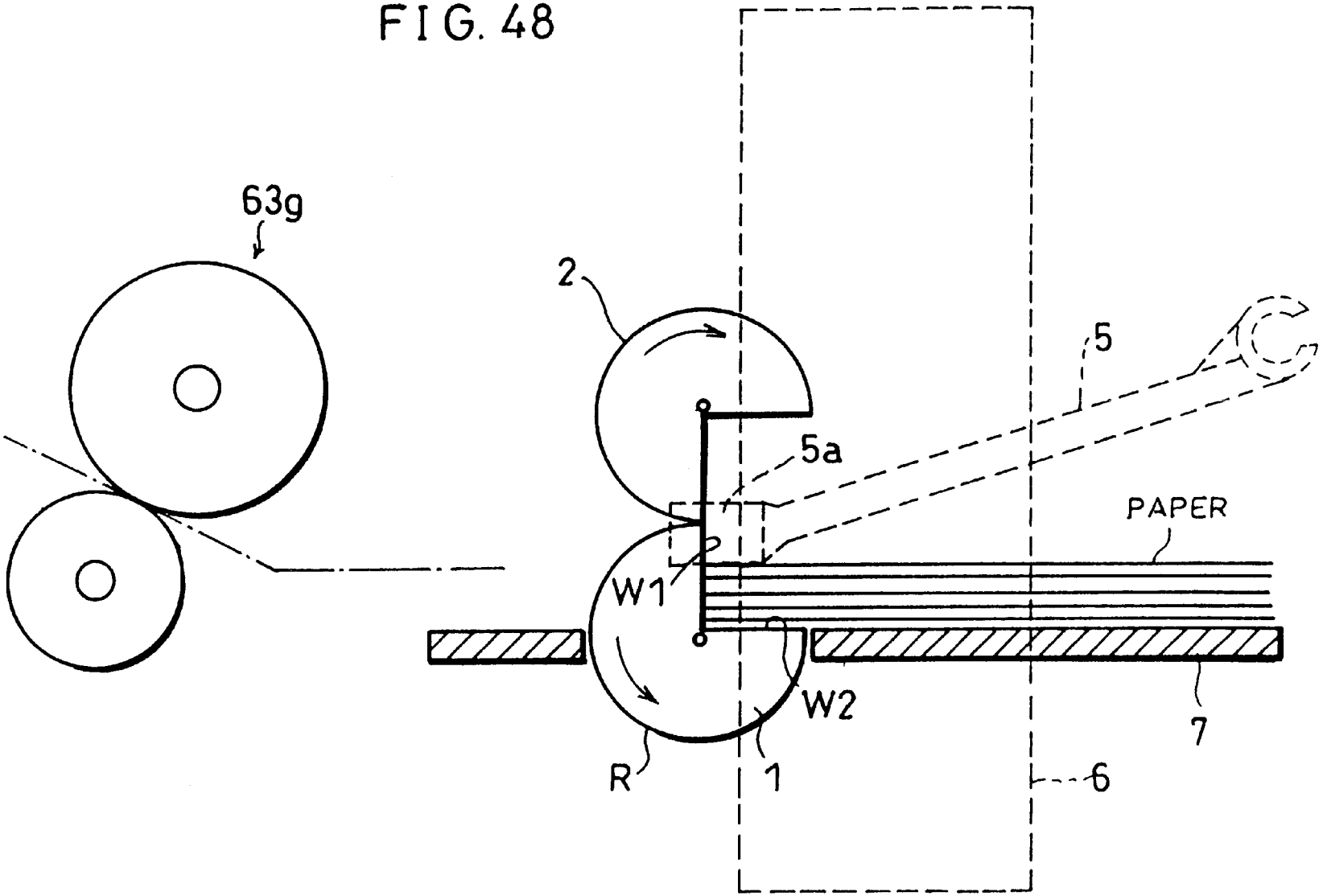
FIG. 48 is a cross-sectional view that shows the structure of a main portion of the paper post-treatment device shown in FIG. 42.
Figure 49A:
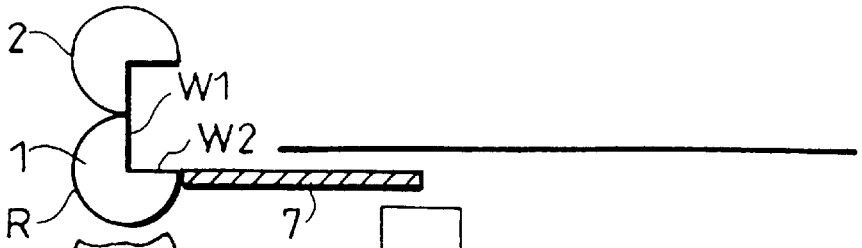
FIGS. 49(*a*) through 49(*f*) show steps that explain processes of sheets of paper in which the main part of the paper post-treatment device shown in FIG. 48 is used.
Figure 49B:
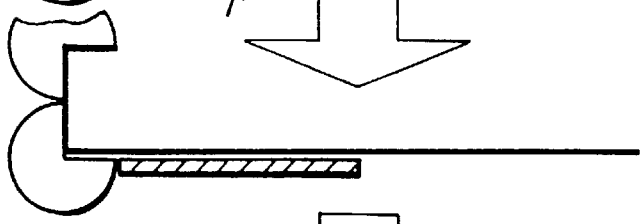
Figure 49C:
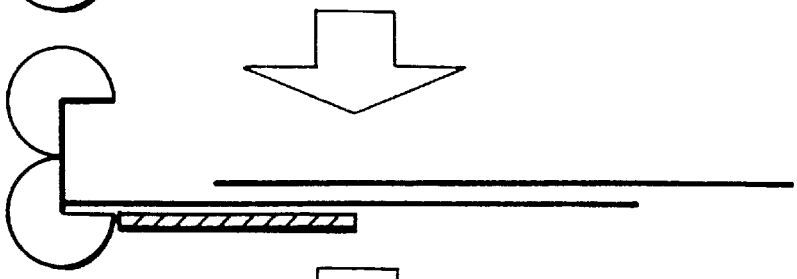
Figure 49D:
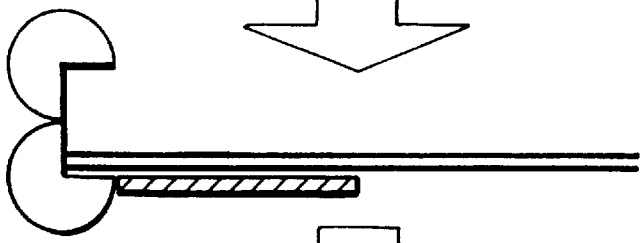
Figure 49E:
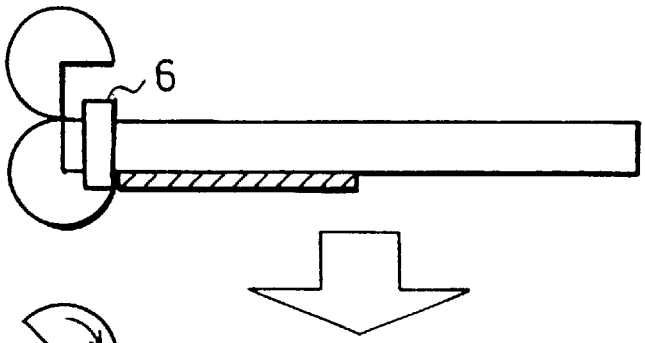
Figure 49F:
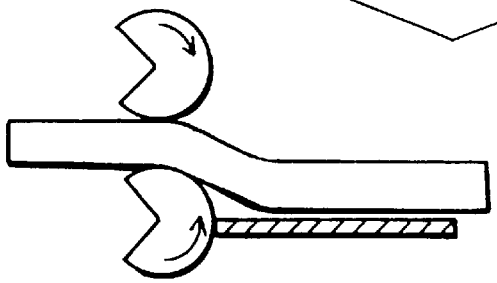

As illustrated in FIG. 48, the adjustment roller 1 has a shape formed by cutting out one-fourth of a circle in its cross-section vertical to the rotation shaft, and the cut-out sections form two wall faces W1 and W2 that are orthogonal to each other. As illustrated in FIG. 48, at the time of stoppage of the adjustment roller 1 in its sequential control processes, the wall face W1 is stopped at a position vertical to the transporting direction so as to block the transport path. The rotation shaft of the adjustment roller 1 is located in the same level as the upper face of the staple tray 7 or slightly lower than the upper face thereof, and in this case, the wall face W2 is located in the same level as the upper face of the staple tray 7 or slightly lower than the upper face thereof. Therefore, when the adjustment roller 1 is stopped in this state, the wall face W2 is not allowed to interrupt the transportation of a sheet of paper so that the cut-out section serves as a leading-edge adjusting section for adjusting the leading edge by allowing a sheet of paper transported to contact the wall face W1.

The driven roller 2 serving as a transport means has the same shape as the adjustment roller 1, and in a state made by reversing the adjustment roller 1 in its up and down and right and left shapes, it is pressed onto the adjustment roller 1 by a pressing force from a spring, etc. from above. When the adjustment roller 1 is driven to rotate in the direction of arrow from the state shown in FIG. 48, the wall face W1 falls toward the downstream side in the transport path so that the transport path is opened, with the result that a set of sheets of paper that has been subjected to adjusting and stapling processes is raised by the wall face W2.

Then, the portion having a curvature of the circumferential face of the adjustment roller 1, that is, the circumferential face R other than the cut-out section comes into contact with the lower face of the set of sheets of paper in place of the cut-out section, so that the set of sheets of paper is transported toward the downstream side through a frictional force. In this case, the driven roller 2 is separated from the adjustment roller 1 in accordance with the thickness of the set of sheets of paper, and sandwiches the set of sheets of paper between it and the adjustment roller 1, and is then driven to rotate in a direction reversed to the direction of the adjustment roller. In this case, on their nip side, the phase of the driven roller 2 is adjusted so that the respective cut-out faces are aligned face to face with each other.

In this manner, although the adjustment roller 1 is a transport roller, its outer circumferential surface R has the cut-out section integrally formed as one part and is also allowed to serve as one portion of the transport means together with the driven roller 2 so that it comes into contact with a set of sheets of paper and gets the transport means ready for the transporting process.

Moreover, when, during the transportation, the wall face W1 has made one rotation and returns to the original position, the adjustment roller 1 as a whole is located on one side face of the set of sheets of paper so that the cut-out section does not interrupt the transportation of the set of sheets of paper. Therefore, the outer circumferential face R serves as the transport section.

Moreover, in FIG. 46, the width adjustment guide 3 directs.,sheets of paper transported thereto to the fixed wall 4 side so as to adjust them based upon the inside face of the fixed wall 4 that serves as a reference face and that is formed on the same side as the staple unit 6 with respect to the staple tray 7. As illustrated in FIG. 48 and FIG. 46, each of the paper leading-edge seize levers 5 is placed in a manner so as to diagonally hang down toward the paper transporting direction and so as to be pushed down by a spring force, with a gentle angle, almost in parallel with the upper face of the staple tray 7 from above the staple tray 7.

Even in the case of a sheet of paper with its leading edge curled, the paper leading-edge seize levers 5 seize the sheet of paper while guiding it toward the wall face W1 of the adjustment roller 1. Moreover, since they are placed on the respective sides of each adjustment roller 1, they impart rigidity to the leading edge of the sheet of paper so as to prevent deformation and damage to the leading edge of a sheet of paper when it collides with the adjustment roller 1, thereby making it possible to avoid offsets at the time of the adjusting process. The roll member 5*a,* which is orthogonal to the wall face W1 of the adjustment roller 1 and is rotatable with respect to the paper leading-edge levers 5, is attached to the top of each paper leading-edge seize lever 5; thus, this arrangement makes it possible to reduce resistance at the time when the adjustment is made in the width direction.

FIGS. 49(*a*) to (*f*) show operation steps of the adjustment roller 1. Assuming that a sheet of printed paper is transported to the storage adjustment unit 63 of the paper post-treatment device 61 from the image-forming apparatus main body 51, the adjustment roller 1 is first maintained still at a position (home position) in which the wall face W1 is made orthogonal to the transporting direction as illustrated in FIG. 49(*a*).

Next, as illustrated in FIG. 49(*b*), the leading-edge of the sheet of paper thus transported is further transported by the feed roller 8 until it comes into contact with the wall face W1. At this time, the other wall face W2 of the adjustment roller 1 is maintained in the same level as that of the staple tray or at a position slightly lower than the level, so as to support the lower face of the sheet of paper. With respect to the next sheet of paper and thereafter, as illustrated in FIG. 49(*c*) and FIG. 49(*d*), the leading edges are allowed to contact the wall face W1 so as to be adjusted, and they are also adjusted in the width direction by the width adjustment guide 3.

Upon completion of the adjustment of a predetermined number of sheets, as illustrated in FIG. 49(*e*), the staple unit 6 carries out a stapling process on the set of sheets of paper on the leading-edge side. Upon completion of the stapling process, the adjustment roller 1 is driven to rotate, as illustrated in FIG. 49(*f*). At this time, the set of sheets of paper is raised by the wall face W2 of the adjustment roller 1, and the outer circumferential face R except the cut-out section is allowed to contact the lower face of the set of sheets of paper so that the set of sheets of paper starts to be transported toward the downstream side. Then, the set of sheets of paper is transported toward the downstream side while being sandwiched between the adjustment roller 1 and the driven roller 2. The driving operation of the rotation is continued until the set of sheets of paper has reached a transporting force applying means for the next process, such as a pair of paper-discharge rollers 63*g,* placed on the downstream side of the adjustment roller 1.

In this manner, different from conventional methods in which the leading-edge adjusting process and the transition process to the transporting state are carried out separately, the application of the adjustment roller 1 makes it possible to easily control the two processes by using a sequential controlling process of a single control mechanism.

Figure 50:
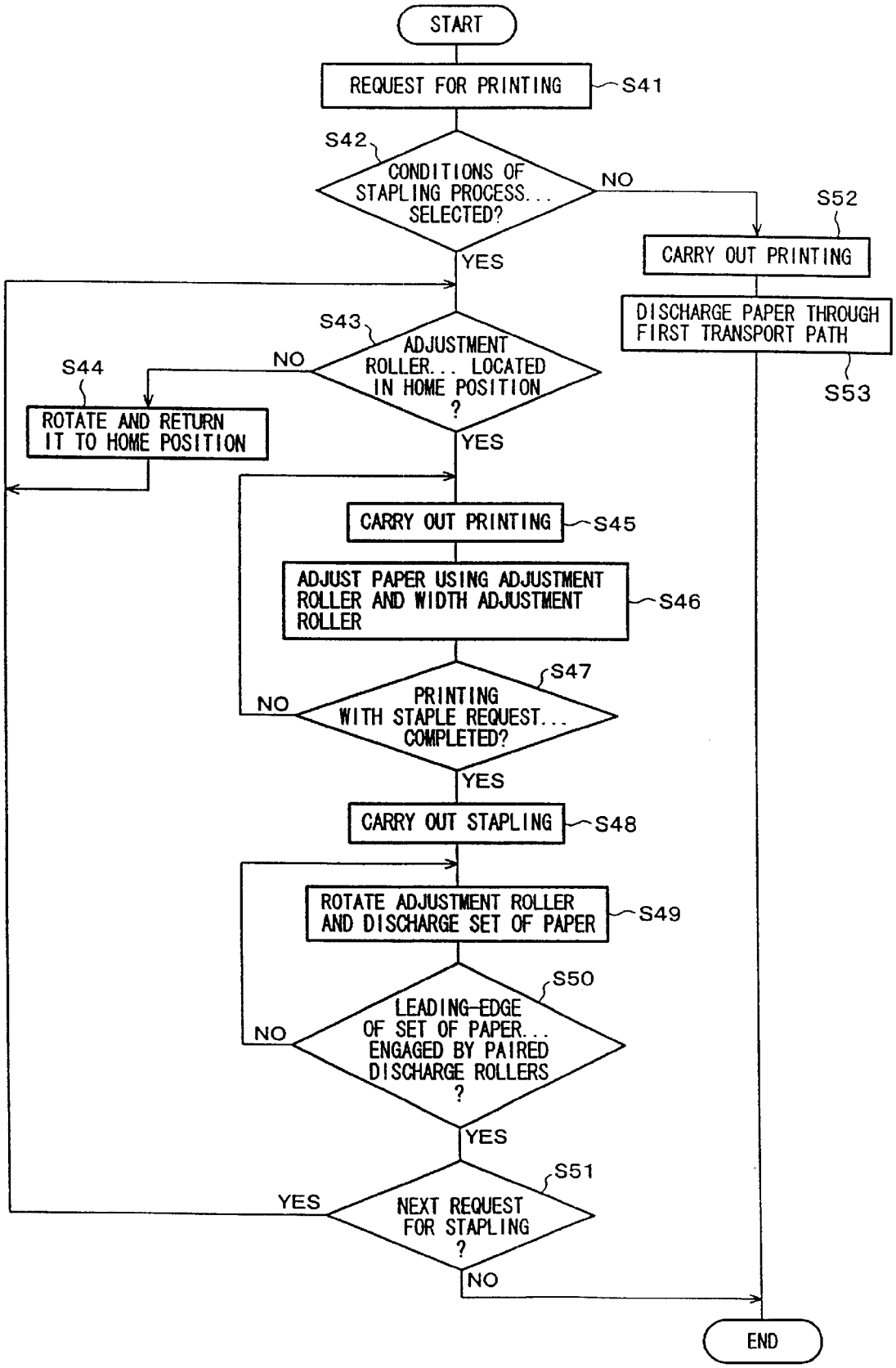
FIG. 50 a flow chart that explains the sequence of processes shown in FIG. 49.

The above-mentioned sequence of operations is shown in the flow chart of FIG. 50. First, when a request for printing is given at step S41, a judgment is made as to whether or not the stapling process is selected at step S42. If the stapling process is not selected, then a printing process is carried out in the image-forming apparatus main body 51 at step S52, and the sheet of paper is discharged through the first transport path 63*a* in the storage adjustment unit 63 at S53, thereby completing the operation.

In contrast, if the stapling process is selected at step S42, then the sequence proceeds to step S43. At step S43, a judgment is made as to whether or not the adjustment roller 1 is in the home position, and if it is not in the home position, then the sequence proceeds to step S44 so that the adjustment roller 1 is rotated to the home position. If the adjustment roller 1 is in the home position, then the sequence proceeds to step S45 where the image-forming apparatus main body 51 carries out a printing process.

When the sheet of printed paper has been transported to the second transport path 63*b* in the storage adjustment unit 63, the feed roller 8 transports the sheet of printed paper until it has come into contact with the wall face W1 of the adjustment roller 1 by the feed roller 8 at step S46 so that the leading edge of the sheet of printed paper is adjusted. Then, the adjustment of the sheet of printed paper in the width direction is carried out by using the width adjustment guide 3, while the sheet of printed paper is seized by the paper leading-edge seize levers 5 from above so as to correct the curl of the sheet.

The processes of steps S45 and S46 are repeated with respect to sheets of paper corresponding to the number of sheets that has been requested for the stapling process, and upon completion of the adjustment of the predetermined number of sheets at step S47, the staple unit 6 carries out the stapling process on the set of sheets of paper at step S48.

Next, at step S49, the transport path is opened by rotating the adjustment roller 1, and the set of sheets is transported while being sandwiched between the adjustment roller 1 and the driven roller 2. At step S50, when the leading edge of the set of sheets is transported to be engaged by the pair of paper-discharge rollers 63*g* on the downstream side, the sequence proceeds to step S51.

At step S51, a judgment is made as to whether or not the next stapling process is requested, and if it is requested, the processes from step S43 to S50 are repeated, and if not requested, the operation is completed. Here, not limited to the stapling process, the operation of this type is effective to carry out post-treatments such as a punching process and a binding process for holes in a plurality of sheets of paper that- have been subjected to a punching process.

In the above-mentioned adjustment roller 1, it is preferable to set the height of the wall face W1 greater than the thickness of sheets of paper at the time of the maximum storage that are to be subjected to a post-treatment on the staple tray; thus, it is possible to always carry out a stable paper leading-edge adjusting process independent of the number of sheets in the set of sheets. Normally, the height of the wall face W1 is set in the range of 3 mm to 5 mm, and to 10 mm at maximum.

Moreover, the length of the outer circumferential face R of the adjustment roller 1 is preferably arranged so that the set of sheets is allowed to reach the pair of paper-discharge rollers 63*g* within one rotation of the adjustment roller 1. This arrangement makes it possible to sufficiently ensure the transport distance with respect to the set of sheets after the post-treatment. However, even in the case when the outer circumferential face R is less than such a length, since the phase is adjusted so that the cut-out section of the adjustment roller 1 and the cutout section of the driven roller 2 are aligned face to face with each other on their nip side, it is possible to avoid raising a problem in which, when the adjustment roller 1 makes not less than one rotation, only one of the rollers comes to contact with the face of the set of sheet, resulting in interruptions in paper transportation.

Moreover, upon completion of the transportation of the set of sheets, the rotative driving operation of the adjustment roller 1 is preferably stopped when the wall face W1 has reached the position for the leading-edge adjusting. It is when the adjustment roller 1 has made rotations the number of which is given by an integer since the start of the transportation of a set of sheets that the wall face W1 reaches the position for the leading-edge adjusting. If the rotative driving operation of the adjustment roller 1 is stopped at the time when, after the rear edge of the set of sheets has passed through the position of the adjustment roller 1, the wall face W1 reaches the position for the leading-edge adjusting, it is possible to ensure a state ready for the next paper leading-edge adjusting simultaneously as the transporting operation is completed. Therefore, it is not necessary to newly carry out the positional control for the adjustment roller 1 so as to arrange the leading-edge for the next post-treatment, and consequently to make the controlling operation easier.

Figure 51:
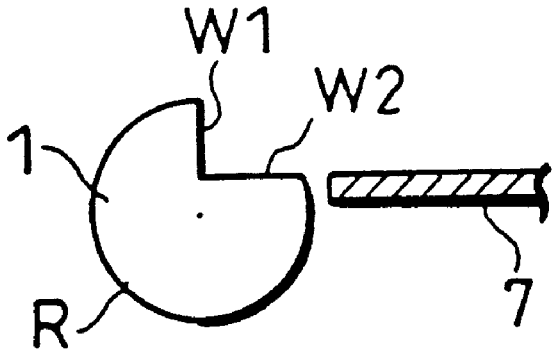
FIGS. 51(*a*) and 51(*b*) are modified examples of an adjusting roller used in the main part shown in FIG. 48.
Figure 51:
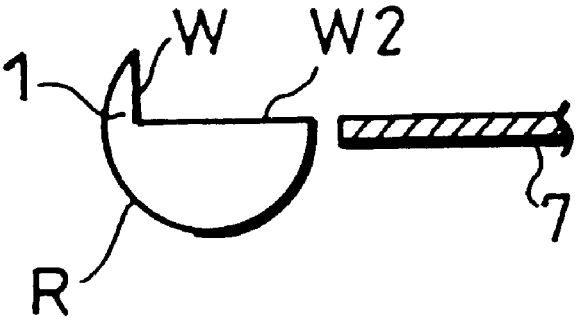

Moreover, in the above-mentioned example, the explanation has been given of a roller having a shape formed by cutting out one-fourth of a circle in its cross-section vertical to the rotation shaft, that is, a shape in which the cross line of the two wall faces is virtually coincident with the rotation shaft; however, the present invention is not intended to be limited by this shape, and for example, as illustrated in FIGS. 51(*a*) and 51(*b*), another shape may be adopted in which the cross line of the two walls is considerably apart from the rotation shaft.

In other words, any roller may be used as long as, in order to provide a cut-out section having two wall faces W1 and W2 that are orthogonal to each other, it has a shape formed by cutting out a cylindrical shape by two planes that are orthogonal to each other from the outer circumferential face to the cross line, with a cross line parallel to the center axis. The angle made by the two wall faces may be set greater than 90 degrees; however, in order to make greater the length of the outer circumferential face R except the cut-out section in the rotation direction and to sufficiently ensure the transport distance of the set of sheets, it is preferable to set the angle to 90 degrees. In any case, the leading-edge adjusting transport means can be realized by providing a structure which is formed by simply cutting out one portion of a generally-used roller.

Moreover, although the driven roller 2 is used in the above-mentioned example, another arrangement using only the adjustment roller 1 so as to transport the set of sheets may be adopted. Nevertheless, it is more preferable to provide the transporting means as a pair of rollers by using the driven roller 2 since this arrangement ensures a higher transporting force more easily.

Another arrangement may be used in which the driven roller 2, which has been placed apart, from the adjustment roller 1 above it prior to the transportation of the set of sheets, is shifted to contact the adjustment roller 1 upon transportation. Even in this arrangement, only two controlling operations for the rotative driving mechanism of the adjustment roller 1 and for the shifting mechanism of the driven roller 2 are required for operations from the leading-edge adjusting process of sheets of paper to the transporting process of the set of sheets; therefore, it is still possible to simplify the controlling mechanism as compared with a conventional mechanism.

Moreover, upon contact with each other, the adjustment roller 1 and the driven roller 2 may be coupled with gears; thus, upon rotation, the gears make it possible to maintain the phases of rotations without deviation. In this case, in order to prevent the change in the thickness of the set of sheets from giving adverse effects to the sandwiched state by the two gears, at least one of the rollers may be made from a material that is easily deformed, such as an elastic member.

Here, in the storage adjustment unit 63 having the leading-edge adjusting transport means and the transport means as described above, each of the respective distances from the pair of paper-discharge rollers 63*i* to the feed roller 8 on the upstream side, from the feed roller 8 on the upstream side to the feed roller 8 on the downstream side, and from the feed roller 8 on the downstream side to the adjustment roller 1 is set to be shorter than the minimum size permissible for the stapling process. Moreover, the distance from the pair of paper-discharge rollers 63*i* to the adjustment roller 1 is set to be longer than the maximum size permissible for the stapling process.

In the paper post-treatment device 61 having the above-mentioned arrangement, an explanation will be given of each of cases in which the respective paper transport paths are used. In the case when the discharge to the first stack tray 64*a* is selected and when neither the stapling process nor the offsetting function is selected, the paper post-treatment device 61 sets the switching gate G3 to orientation a, and also sets the switching gate G4 to orientation b. Upon completion of printing, a sheet of paper is transported through the first transport path 63*a* and the transport path 63*c,* and discharged onto the first stack tray 64*a.* In the case when, although the stapling process or the offsetting function has been selected, the size of the sheet of paper is inhibited from being discharged onto the second stack tray 64*b* or from being-stapled, the corresponding display is given to the operator and depending on the operator's selection, the sheet of paper is discharged onto the first stack tray 64*a.*

Additionally, even when the discharge to the first stack tray 64*a* has been selected, if information indicating that a large amount of sheets of paper exceeding the permissible load of the first stack tray 64*a* is discharged is sent from the image-forming apparatus main body 51, then the destination of discharge is automatically switched to the paper-discharge section of the image-forming apparatus main body 51 or the second stack tray 64*b.* In this case, the operator is informed of the fact that the destination of discharge has been changed through a display on the operation section, etc., or of the fact that the corresponding discharge is not possible without starting the image-forming process.

Next, in the case when the stapling process is not selected and when selection is made so as to discharge sheets of paper to the second stack tray 64*b* after carrying out the offsetting function, as long as the size of sheets of paper is not inhibited from being discharged to the second stack tray 64*b,* the switching gate G3 is set to orientation a and the switching gate G4 is also set to orientation a. The sheets of paper are transported through the first transport path 63*a* and the transport path 63*d,* and discharged onto the second stack tray 64*b* where they are stocked, or stocked in an offset manner.

Moreover, in the case when the stapling process is selected, as long as the size of sheets of paper is not inhibited from being discharged to the second stack tray 64*b,* or is not inhibited from being stapled, the switching gate G3 is set to orientation b. Thus, the sheets of paper are guided to the second transport path 63*b,* and transported by the feed roller 8 until the leading edge of each sheet of paper has come into contact with the inner wall W1 of the adjustment roller 1.

The rotation operation time, that is, the amount of feed of the sheet of paper, can be controlled by using the following methods: a timer control based upon the detection signal from the paper width sensor 63*h* or the paper sensor 63*j* of FIG. 44(*b*); control based upon detection of the raised state of the paper-leading-edge seize lever 5 caused by warping of the sheet of copy paper; control based upon detection of the contact of the leading edge of the sheet of copy paper P to the adjustment roller 1; or a controlling mechanism in which the ON timing of the paper sensors 63*j* or 63*k* upon receipt of a first sheet of copy paper is learned, and from the second sheet of copy paper on, the timer control based upon the ON timing of the paper sensor 63*j* is improved in its precision.

With this arrangement, the sheet of copy paper is held by the paper-leading edge seize levers 5 placed on the respective sides of the adjustment roller 1 as illustrated in FIG. 46, with the leading edge of the sheet of copy paper being firmly in contact with the adjustment roller 1. After a plurality of sheets of paper have been stored and adjusted, these are subjected to a stapling process, and then discharged onto the second stack tray 64*b*.

Here, with respect to paper-size information utilized for controlling the switching gate G3, the results of detection on paper size in the paper feeding cassette 53*a* or the manually feeding tray 53*b* are utilized. However, those sheets of paper, which are fed through the manually feeding tray 53*b*, etc. include sheets of paper having an irregular size or sheets of paper to which no size detection is applied. In these cases, the length information is obtained by detecting the passage time of the sheet of paper using the detection switch before the registration roller so that the length information of the sheet of paper is obtained to make a judgment as to the size of the sheet of recording paper.

Even in these cases, there are some sheets of paper having the same length and different widths, such as a sheet of paper of A-5 size to be longitudinally fed and a sheet of paper of A-4 size to be laterally fed. In such a case, only the length information is insufficient.

Therefore, as described referring to FIG. 44(*b*), taking into account the switching time of the switching gate G3, a paper width sensor 63*h*, which is placed on the upstream side of the switching gate G3 with the corresponding distance therefrom, is preferably used so as to detect the paper width of A-4 size although the paper width of A-5 size is not detected.

By installing the same paper width sensor before the switching gate G2, it becomes possible to select those sheets of paper that are not allowed to enter the paper post-treatment device 61, and consequently to control so that those sheets of paper that are not allowed to enter can be discharged onto the paper-discharge section of the image-forming apparatus main body 51.

Figure 52:
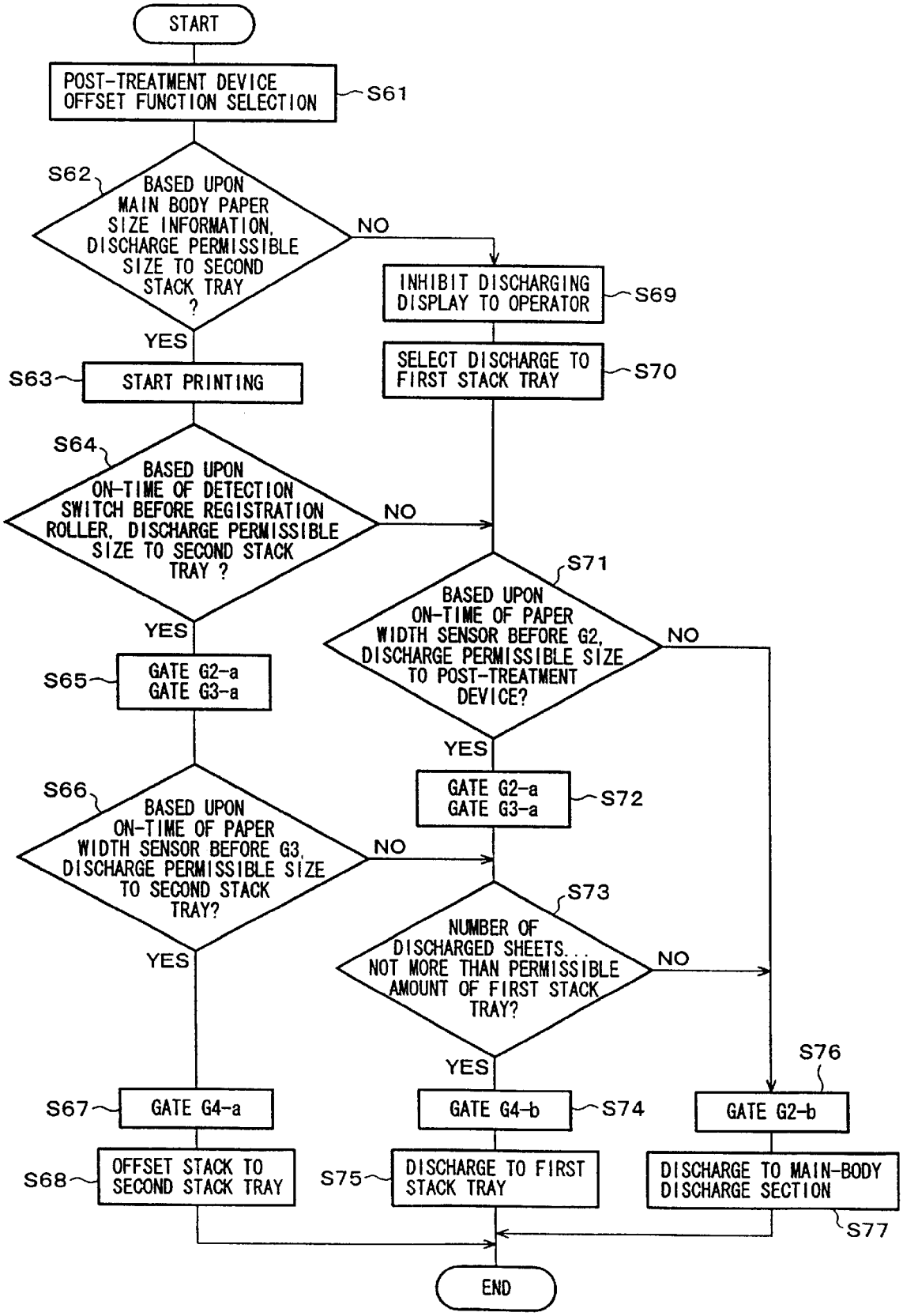
FIG. 52 is a flow chart that explains one example of the sequence of paper transport processes carried out by the image-forming apparatus shown in FIG. 42.
Figure 53:
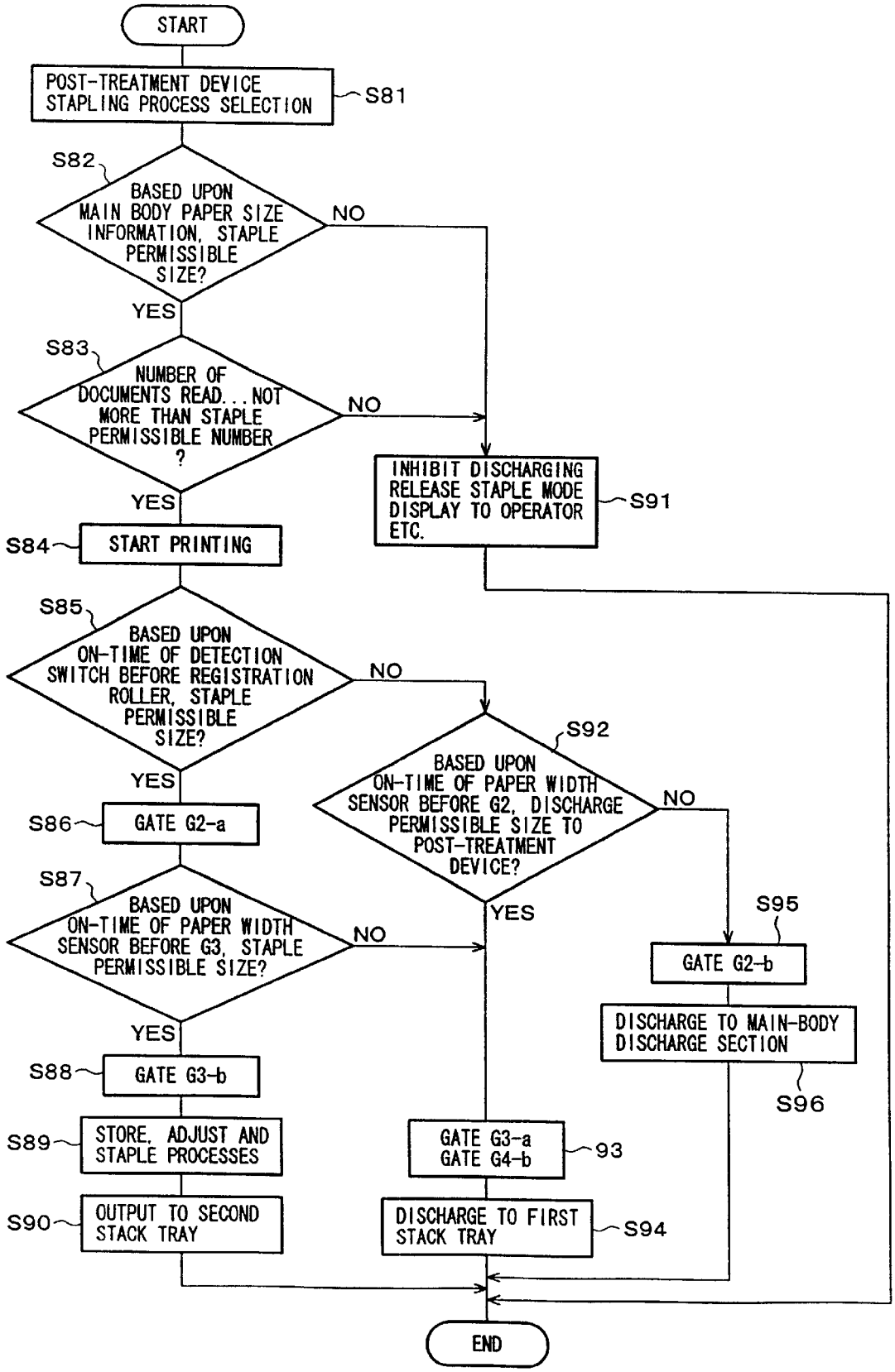
FIG. 53 is a flow chart that explains another example of the sequence of paper transport processes carried out by the image-forming apparatus shown in FIG. 42.

With respect to each of cases in which the respective transport paths are used, one example of a sequence of processes upon selection of the offsetting function is given by reference to the flow chart of FIG. 52, and one example of a sequence of processes upon selection of the stapling process is given by reference to the flow chart of FIG. 53.

First, if the offsetting function is selected at step S61 in FIG. 52, then a judgment is made as to whether or not the size of a sheet of paper to be printed is a discharge permissible size from the setting made by the operator in the image-forming apparatus main body 51. Here, if it is a discharge permissible size to the second stack tray 64*b*, then the sequence proceeds to step S63, thereby carrying out a printing operation. In contrast, if it is not a discharge-permissible size, the sequence proceeds to step S69.

After the printing operation at step S63, a judgment is made as to whether or not the sheet of paper is a discharge permissible size to the second stack tray 64*b* based upon the ON time of the detection switch before the registration roller at step S64. If it is a discharge permissible size, then the sequence proceeds to S65 at which the switching gate G2 is set to orientation a and the switching gate G3 is also set to orientation a. If it is not a discharge permissible size, the step proceeds to S71.

Next, at step S66, paper width information is obtained based upon the ON time of the paper width sensor 63*h* before the switching gate G3, and a judgment is made as to whether or not the sheet of paper is a discharge permissible size to the second stack tray 64*b*. Here, if it is a discharge permissible size, the sequence proceeds to step S67 at which the switching gate G4 is set to orientation a, and at step S68, the sheets of paper are stacked in an offset manner by the second stack tray 64*b*. In contrast, if it is not a discharge permissible size, the sequence proceeds to step S73.

In the above-mentioned step S69 branched from step S62, the discharge to the second stack tray 64*b* is inhibited, and the corresponding display, etc. is given to the operator. Here, if the operator wishes to discharge the sheets of paper, then the sequence proceeds to step S70 where the first stack tray 64*a* is selected.

At step S71, paper width information is obtained based upon the ON time of the paper width sensor before the switching gate G2, and a judgment is made as to whether or not the sheet of paper is a transport/receive permissible size to the paper post-treatment device 61. Here, if it is a transport/receive permissible size, then the sequence proceeds to step S72 at which the switching gate G2 is set to orientation a and the switching gate G3 is also set to orientation a. If it is not a transport/receive permissible size, the sequence proceeds to step S76 where the switching gate G2 is set to orientation b, and at step S77, the sheets of paper are discharged onto the paper-discharge section of the image-forming device main body 51.

At step S73, a judgment is made as to whether or not the number of sheets of paper to be discharged is not more than the permissible amount in the first stack tray 64*a*, and if it is not more than the permissible amount, then the sequence proceeds to step S74 where the gate G4 is set to orientation b, and at step S75, the sheets of paper are discharged onto the first stack tray 64*a*. In contrast, if it exceeds the permissible amount, then the sequence proceeds to step S76 where the switching gate G2 is set to orientation b, and at step S77, the sheets of copy paper are discharged onto the paper-discharge section of the image-forming apparatus main body 51.

Next, as shown in FIG. 53, if the stapling process is selected at step S81, then at step S82, a judgment is made as to whether or not the size of sheets of paper to be printed is a stapling-process permissible size from the setting made by the operator in the image-forming apparatus main body 51. Here, if it is a stapling-process permissible size, then the sequence proceeds to step S83 where a judgment is made as to whether or not the number of documents read out is not more than the permissible number of sheets for the stapling process.

On the other hand, if the size of sheets of paper is not a permissible size at S82, or if the number of documents exceeds the permissible number of sheets at step S83, the sequence proceeds to S91 where the paper discharge is inhibited, the stapling process is released and the corresponding display is given to the operator. If, at step S83, the number of documents is not more than the permissible number of sheets, the sequence proceeds to step S84, thereby carrying out a printing process.

At step S85, based upon the ON time of the detection switch before the registration roller, a judgment is made as to whether or not the size of sheets of paper is a permissible size for the stapling process. If it is a permissible size, the sequence proceeds to step S86 where the switching gate G2 is set to orientation a. If it is not a permissible size, the sequence proceeds to step S92.

At step S87, paper width information is obtained based upon the ON time of the paper width sensor 63*h* before the switching gate G3, and a judgment is made as to whether or not the size of sheets of paper is a permissible size for the stapling process. If it is a permissible size, the sequence proceeds to step S88 where the switching gate G3 is set to orientation b. If it is not a permissible size, the sequence proceeds to step S93.

At step S89, the sheets of paper are stored and adjusted on the staple tray and the set of sheets of paper is subjected to the stapling process, and at step S90, the set of sheets of paper is discharged onto the second stack tray 64*b*. These detailed operations of the storage adjustment unit 63 in steps S81 through S90 correspond to the processes explained in the flow chart of FIG. 50.

At step S92, paper width information is obtained based upon the ON time of the paper width sensor before the switching gate G2, an d a judgment is made as to whether or not the size of sheets of paper is a transport/receive permissible size for the paper post-treatment device 61. If it is a permissible size, the sequence proceeds to step S93 where the switching gate G3 is set to orientation a and the switching gate G4 is set to orientation b, and at step S94, the sheets of paper are discharged onto the first stack tray 64*a*. If it is not a transport/receive permissible size, the sequence proceeds to step S95 where the switching gate G2 is set to orientation b, and at step S96, the sheets of paper are discharged onto the paper-discharge section of the image-forming apparatus main body 51.

As described above, in accordance with the paper post-treatment device 61 of the present embodiment, among members constituting the paper transporting mechanism after the post-treatment process, it is possible to reduce the number of those members, and consequently to simplify the mechanism, while maintaining a high transporting force with respect to the sheet of paper after having been subjected to the post-treatment process.

[Embodiment 3]

The following description will discuss still another embodiment which realizes a paper-post-treatment device of the present invention. Here, those members that have the same functions and that are described in Embodiment 2 indicated by the same reference numerals and the description thereof is omitted.

Figures 54A, 54B:
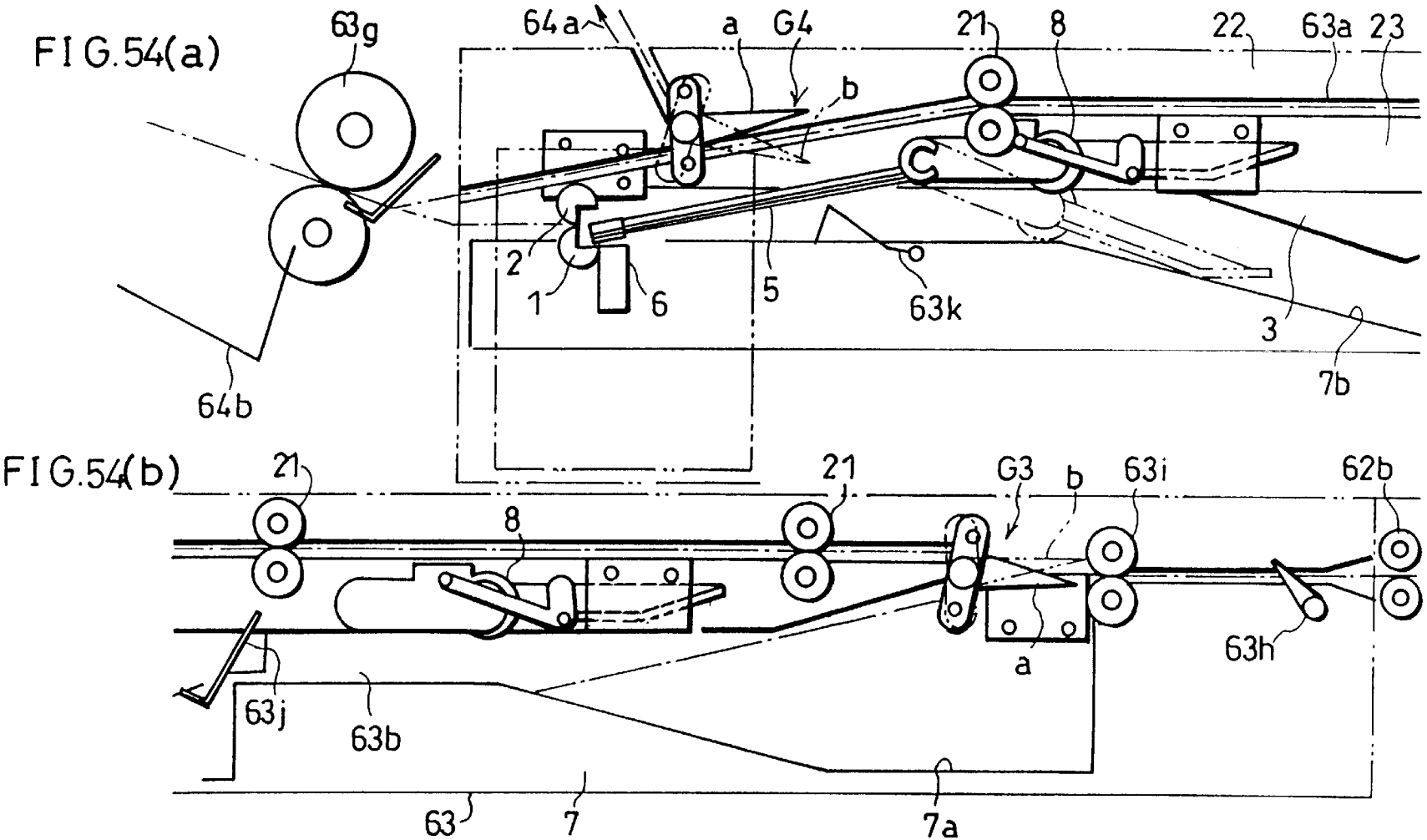
FIGS. 54(*a*) and 54(*b*) are cross-sectional views that show the structure of the paper post-treatment device including the main part and other parts of the paper post-treatment apparatus in another embodiment of the present invention.

As illustrated in FIGS. 54(*a*) and 54(*b*), in the storage adjustment unit 63 of the paper post-treatment device 61, the paper post-treatment device of the present embodiment has a different structure in the vicinity of the front end of the staple tray 7 on the downstream side of the second transport path 63*b*. FIG. 54(*a*) shows one half of the structure on the downstream side, and FIG. 54(*b*) shows the other half of the structure on the upstream side. In this storage adjustment unit 63, instead of the adjustment roller 1 and the driven roller 2, a movable gate unit 31 having a movable gate 32, driven rollers 33, driven roller holders 34 and a solenoid 35, and transport rollers 36. The other structures and operations are the same as those of Embodiment 1.

Figure 55:
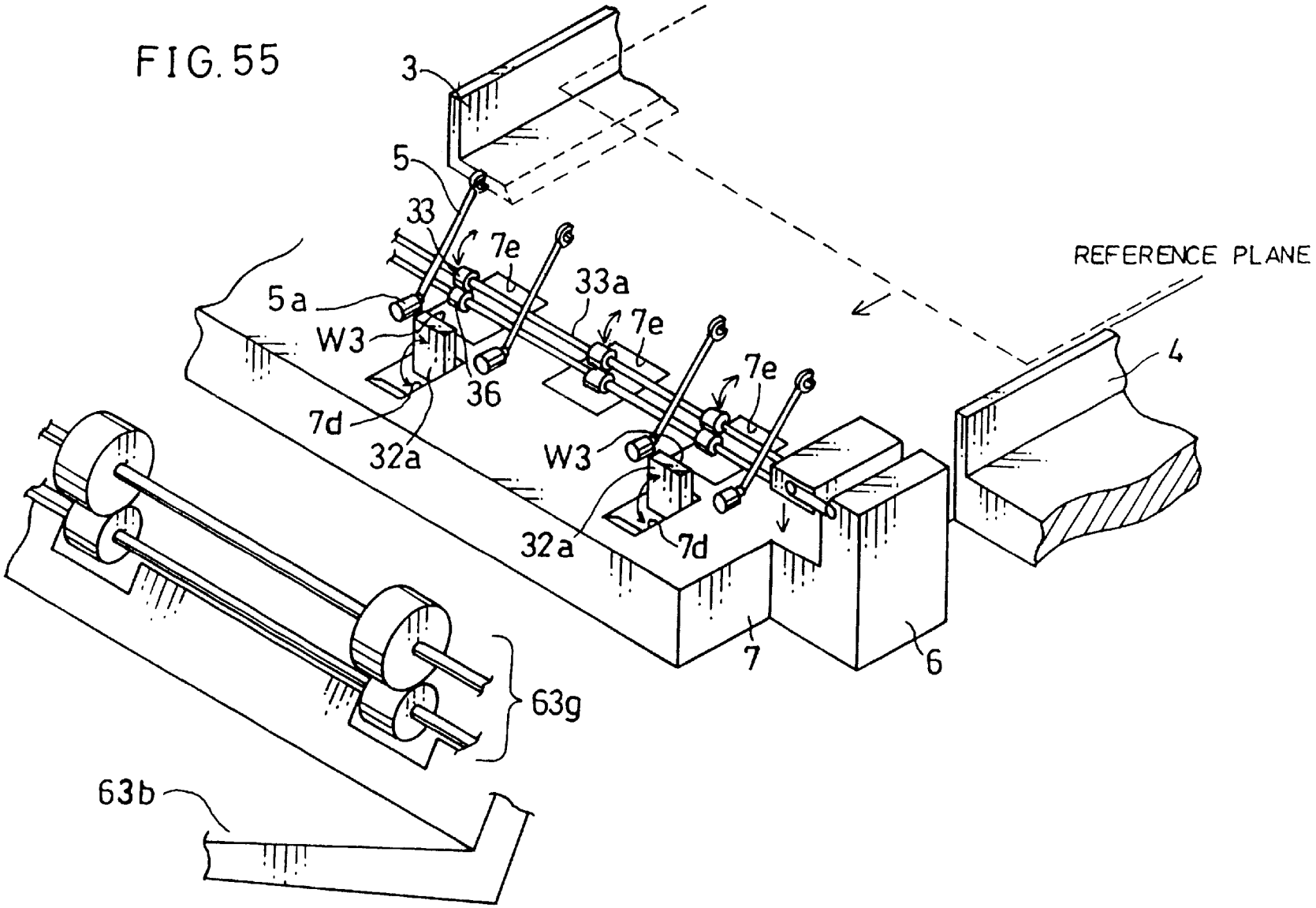
FIG. 55 is a schematic perspective view that shows the vicinity of the staple unit provided in the paper post-treatment device shown in FIGS. 54(*a*) and 54(*b*).

FIG. 55 is a perspective view that shows the construction in the vicinity of the front end on the downstream side. The movable gate unit 31, which serves as the leading-edge adjusting transporting means, also has both of the functions, that is, a leading-edge adjusting function of sheets of paper and a transporting function of a set of sheets. In the movable gate unit 31, the movable gate 32 is provided with stoppers 32*a* that stick out from the upper face on the surface side of the staple tray 7 through holes 7*d* formed in the staple tray 7 on the upper face thereof on slightly the downstream side of the staple tray unit 6. Each stopper 32*a* has a wall face W3 that is orthogonal to the transporting direction of sheets of paper.

Figure 56A:
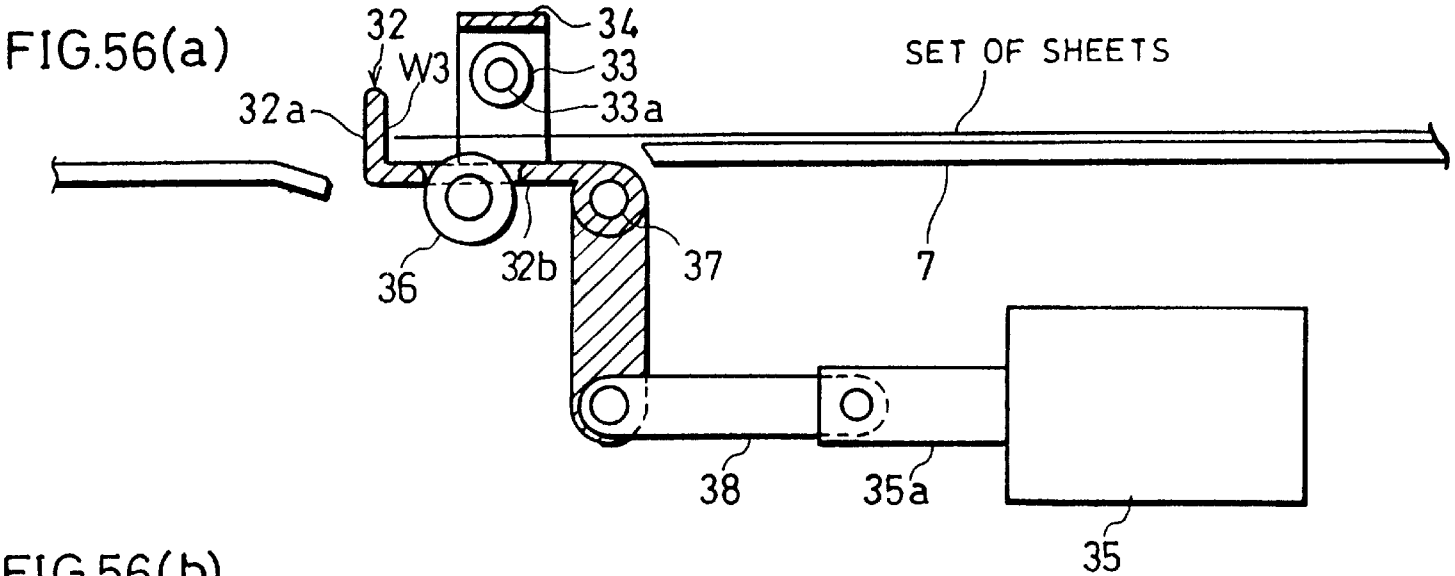
FIGS. 56(*a*) and 56(*b*) are cross-sectional views that show the structure of a main part of a paper post-treatment apparatus in another embodiment of the present invention.
Figure 56B:
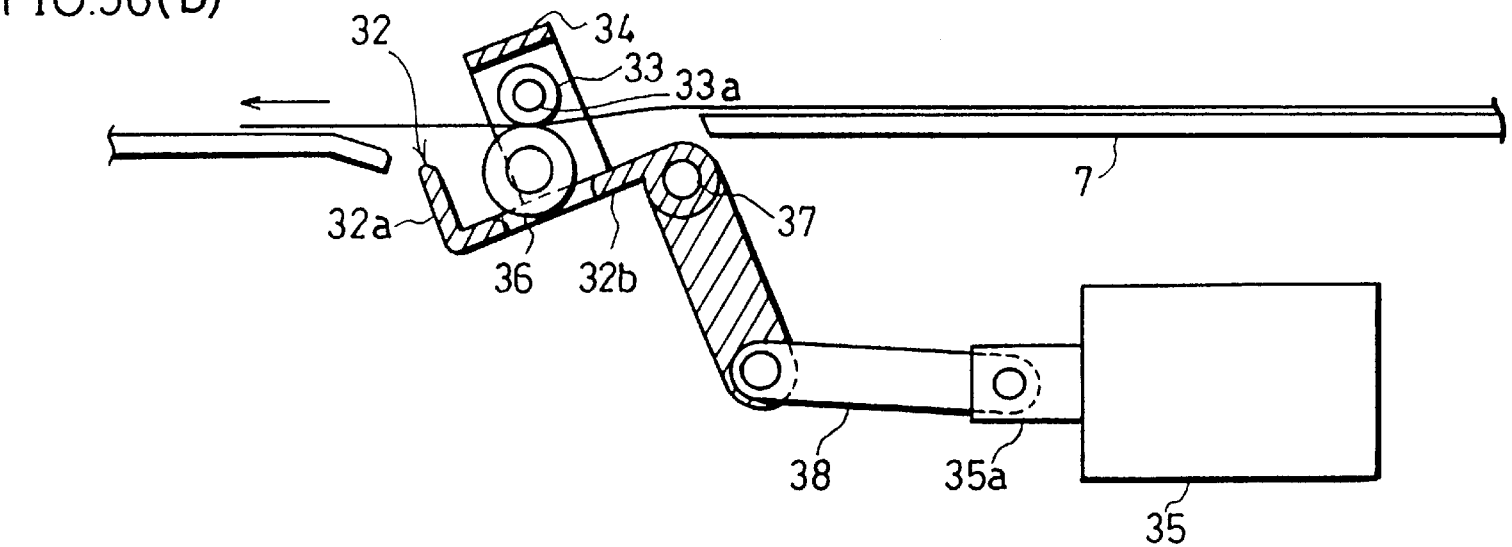

The driven rollers 33 are placed above the upper face of the staple tray 7, below the paper leading-edge seize levers 5, and their rotation shaft 33*a* is held by driven roller holders 34 on both of the ends of the staple tray 7 in the width direction, as illustrated in FIGS. 56(*a*) and 56(*b*) which are cross-sectional views perpendicular to the common rotation shaft 33*a*.

As illustrated in FIGS. 56(*a*) and 56(*b*), the movable gate 32 is provided with an arm portion 32*b* that is integrally connected to the stoppers 32*a*, and has an L-letter shape, and the arm portion 32*b* is placed on the rear side of the upper face of the staple tray 7. The driven roller holders 34 are connected to the arm portion 32*b* of the movable gate 32 on the rear side of the upper face of the staple tray 7, and are allowed to reach the surface side of the staple tray 7 from both of the ends in the width direction. The arm portion 32*b* is supported at its bent portion by a support shaft 37 so as to freely pivot thereon, and one end of the arm portion 32*b* on the side opposite to the stoppers 32*a* is connected to a plunger 35*a* of the solenoid 35 through the movable arm 38. In otherwords, the movable gate 32, the driven rollers 33 and the driven roller holders 34 are integrally formed, and allowed to rotate centered on a fulcrum 37 by the action of the solenoid 35.

Moreover, the transport rollers 36 are placed on the rear side of the upper face of the staple tray 7 in a manner so as to be paired with the driven rollers 33, and driven to rotate at these positions so that the driven rollers 33, which are shifted as the movable gate 32 pivots, are allowed to press the transport rollers 36 through holes 7*e* formed on the upper face of the staple tray 7 as illustrated in FIG. 55.

FIG. 56(*a*) shows a state in which the plunger 35*a* of the solenoid 35 sticks out, and as the movable gate 32 rotates on the fulcrum 37, the wall face W3 of the stopper 32*a* is allowed to shift to a protruding position at which it protrudes on the surface side of the upper face of the staple tray 7, thereby blocking the transport path. As the wall face W3 is shifted to the protruding position, the driven rollers 33 are shifted so as to separate from the sheet of paper transported.

The driven roller holders 34 are allowed to reach the surface side of the staple tray 7 from both of the sides in the width direction thereof so as to hold the rotation shaft 33*a* of the driven rollers 33; therefore, it is possible to prevent them from interrupting the paper transportation. Therefore, the leading edge of a sheet of paper transported is allowed to contact the wall face W3 of the stopper 32*a* so that the leading edge of the sheet of paper is adjusted by the wall face W3 at this position. In this state, the paper adjustment in the width direction is also carried out by the width adjustment guide 3 shown in FIG. 55 so that a plurality of sheets of paper are adjusted and sorted into a set of sheets of paper. The set of sheets of paper in the adjusted state is subjected to the stapling process by the staple unit 6.

Moreover, FIG. 56(*b*) shows a state in which the plunger 35*a* of the solenoid 35 has been sucked after the completion of the stapling process shown in FIG. 56(*a*). The movable gate 32 is allowed to pivot on the fulcrum 37 so that the wall face W3 of the stopper 32*a* is shifted to a shelter position at which it retreats to the rear side of the upper face of the staple tray 7, with the result that the transport path is opened. As the fall face W3 shifts to this shelter position, the driven rollers 33 are moved in a manner so as to press the face of the set of sheets of paper onto the transport rollers 36, and allowed to contact the set of sheets of paper in place of the movable gate 32. In this case, since the set of sheets of paper is sandwiched between the transport rollers 36 and the driven rollers 33, and in this state, both of the rollers are allowed to transport the set of sheets of paper.

In other words, the transport rollers 36 and the driven rollers 33 constitute a transporting means, and the driven rollers 33 constitute one portion of the movable gate unit 31, and also serves as one portion of the transporting means. The driven rollers 33 allow the transport means to shift so as to get ready for the transporting process at the above-mentioned contact position. Moreover, in this case, it is not necessary to allow the transport rollers 36 to protrude on the surface side of the upper face of the staple tray 7; therefore, the transport rollers 36 may be shaped into not a shape having a short transporting distance, such as a semicircular roller, but a normal cylindrical roller.

With this arrangement, the transport distance of the set of sheets of paper is determined by the rotative driving time of the transport rollers 36, and no limitation is imposed thereon. Moreover, the transport rollers 36 are maintained on the rear side of the staple tray 7, and are not allowed to contact the set of sheets of paper until it has been pressed by the driven rollers 33; therefor, it is possible to always maintain them in a rotatable state, and consequently to eliminate the clutch mechanism.

In this manner, the movable gate 32 functions as the leading-edge adjusting section of the leading-edge adjustment transport means, and the driven rollers 33 function as the transporting section of the leading-edge adjusting transport means. Consequently, the leading-edge adjusting transport means is realized by a simple structure in which the rotatable gate 32 and the driven rollers 33 are integrally formed, and this structure sufficiently maintains the transport distance of the set of sheets of paper after having been subjected to the post treatment process.

Therefore, different from conventional methods in which the leading-edge adjusting process and the transition process for getting ready for the transportation are controlled in a separated manner, the two processes can be easily controlled by a sequential controlling operation of one control mechanism. Moreover, although it is a simplified mechanism, it easily maintains a high transporting force since the transportation of the set of sheets of paper is carried out by using the transport rollers 36 and the driven rollers 33.

Figure 57:
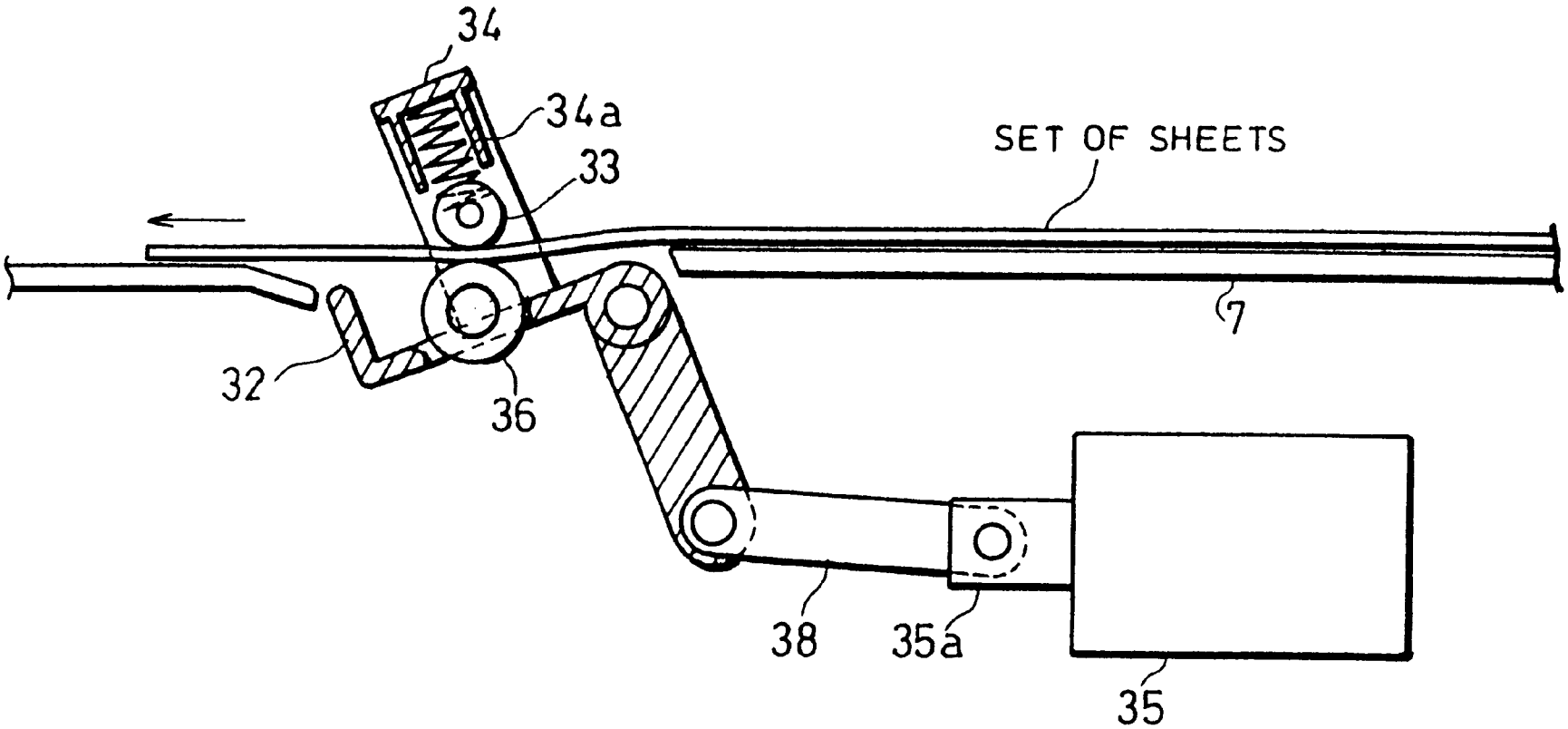
FIG. 57 is a cross-sectional view that shows the structure of a first modified example of the main part shown in FIGS. 56(*a*) and 56(*b*).

Next, FIG. 57 shows a first modified example of the movable gate unit 31. The movable gate unit 31 of FIG. 57 has an arrangement in which each of the driven roller holders 34 is provided with a spring 34*a* (compression spring) for pressing the rotation shaft 33*a* of the driven rollers 33 toward the staple tray 7 side.

Since the number of sheets of paper to be subjected to the stapling process varies from two to the permissible maximum number, the distance between the transport rollers 36 and the driven rollers 33, shown in FIGS. 56(*a*) and 56(*b*) also varies depending on the number of sheets. For this reason, the suction distance of the plunger 35*a* of the solenoid 35 varies depending on the thickness of the set of sheets of paper, sometimes resulting in instability in the suction force of the solenoid 35.

In other words, as illustrated in FIG. 57, in this structure having the spring 34*a,* even when the thickness of the set of sheets of paper varies, the spring 34*a* extends and shrinks correspondingly. Therefore, the variations in the thickness of the set of sheets of paper sandwiched by the transport rollers 36 and the driven rollers 33 can be absorbed, thereby making it possible to transport the set of sheets of paper more stably. Here, it is preferable to set the spring constant to as small a value as possible, since this arrangement can minimize the variations in the pressing force of the driven rollers 33 to the transport rollers 36.

Figure 58:
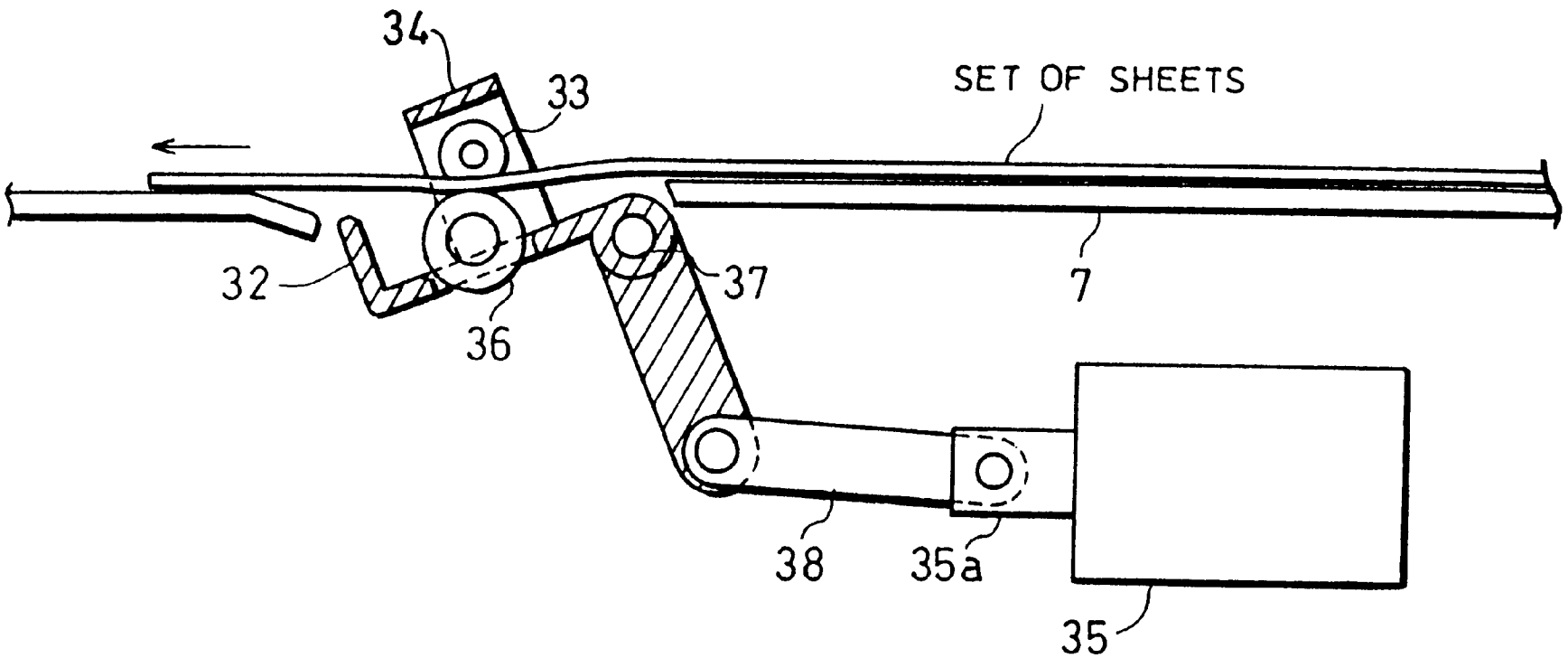
FIG. 58 is a cross-sectional view that shows the structure of a second modified example of the main part shown in FIGS. 56(*a*) and 56(*b*).
Figure 59:
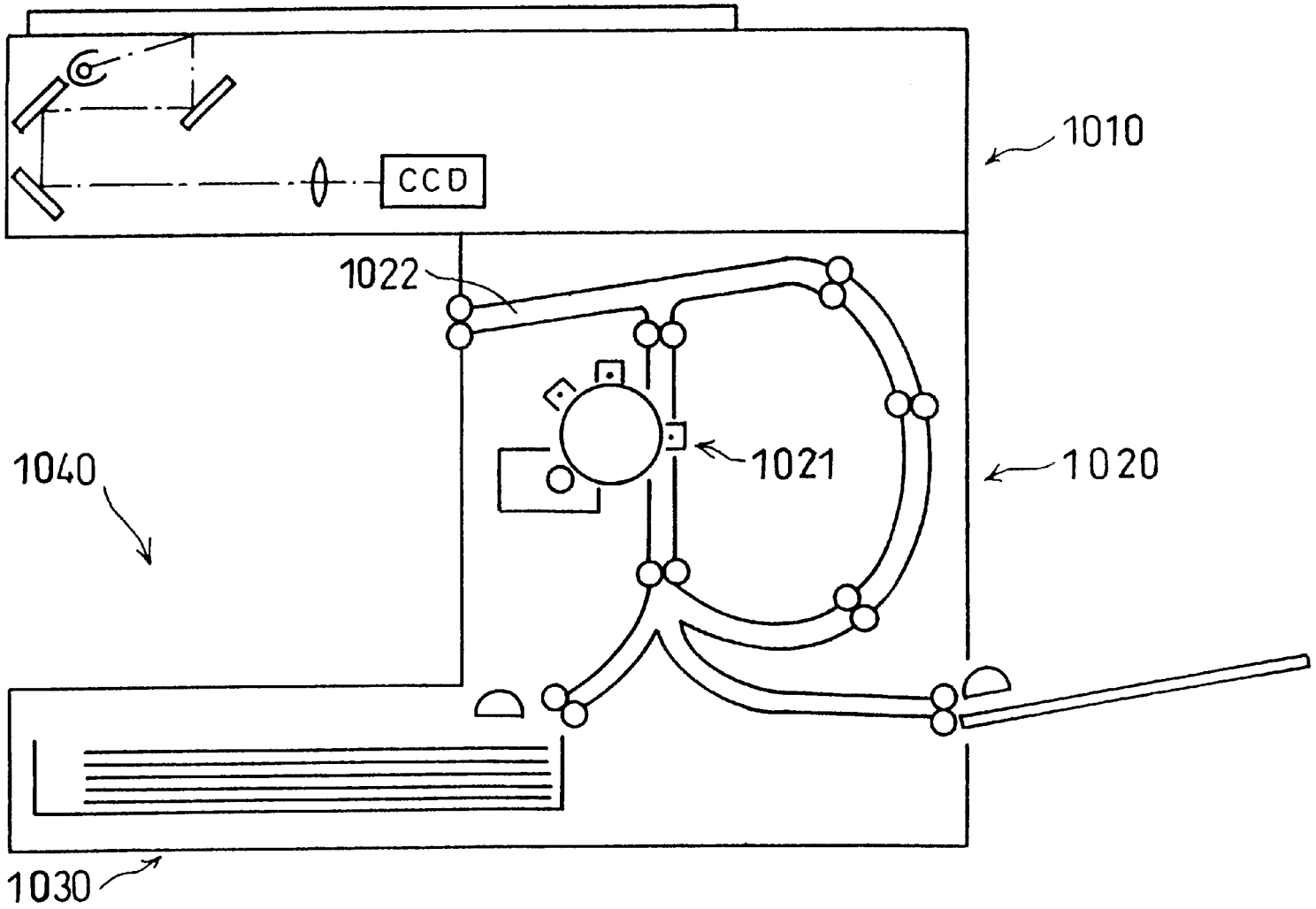
FIG. 59 PRIOR ART
FIG. 59 is a schematic drawing that shows the structure of a generally-used image-forming apparatus.
Figure 60:
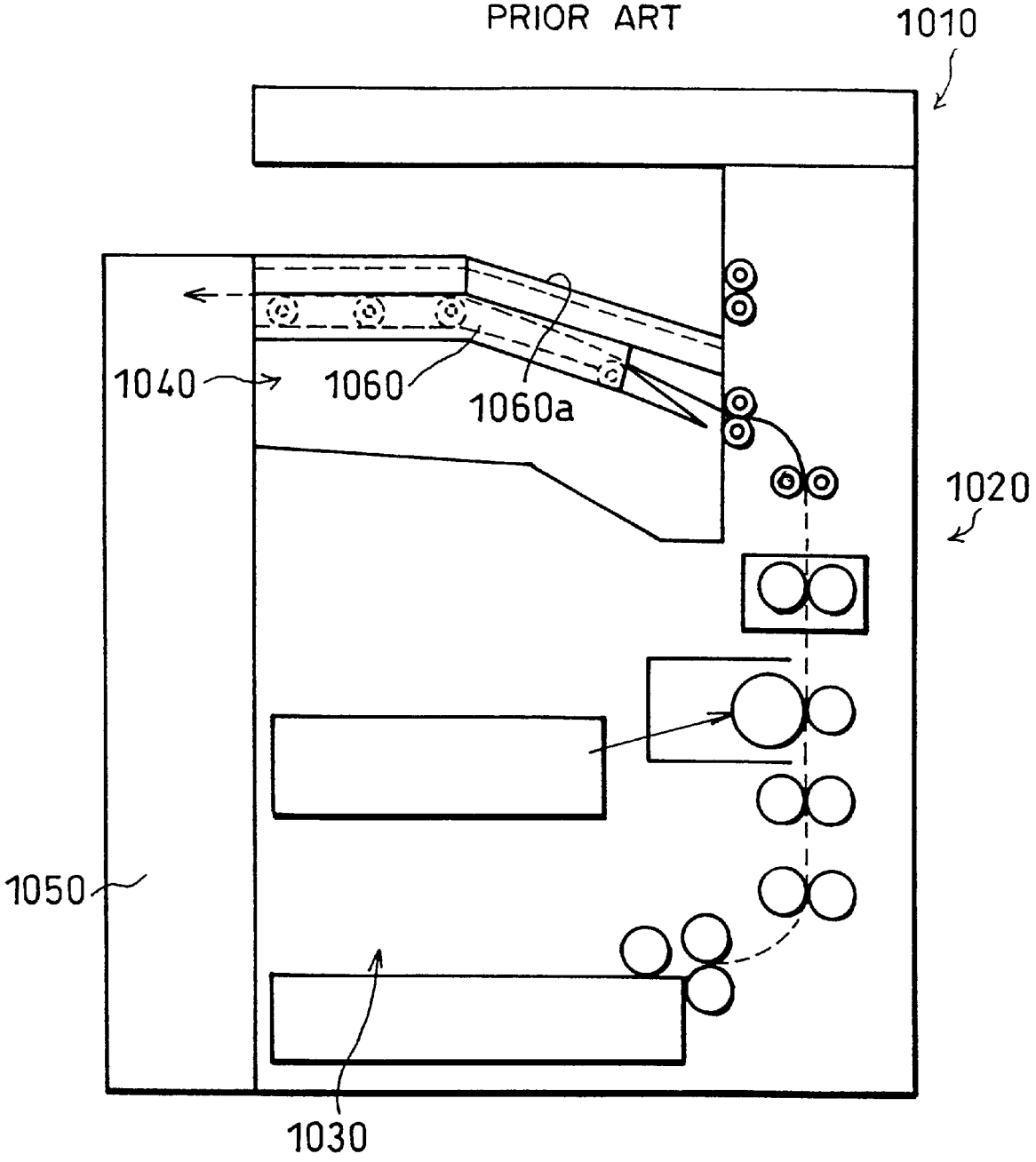
FIG. 60 PRIOR ART
FIG. 60 is a schematic drawing that shows one example of a conventional image-forming apparatus.
Figure 61:
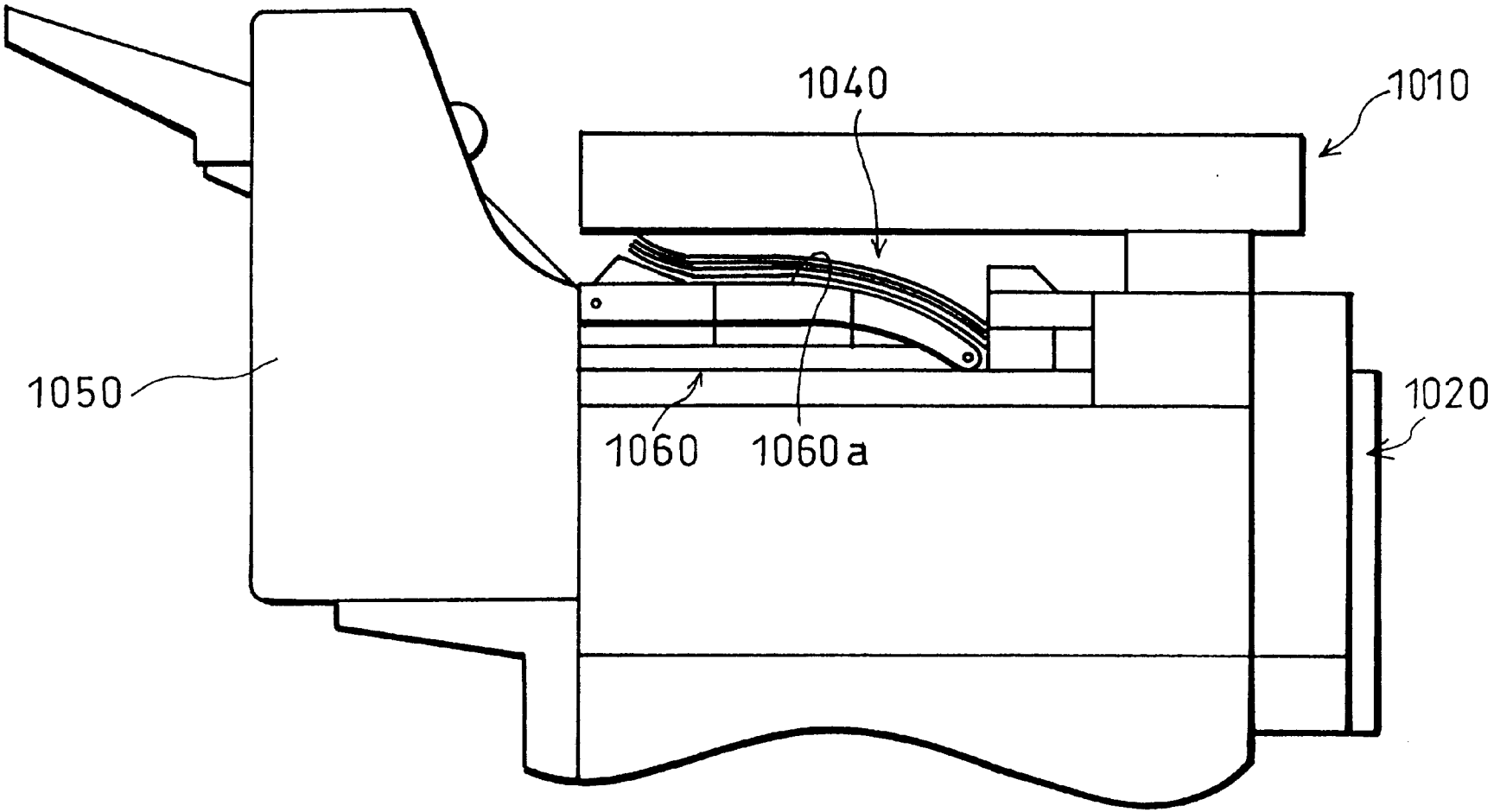
FIG. 61 PRIOR ART
FIG. 61 is a schematic drawing that shows another example of a conventional image-forming apparatus.
Figure 62:
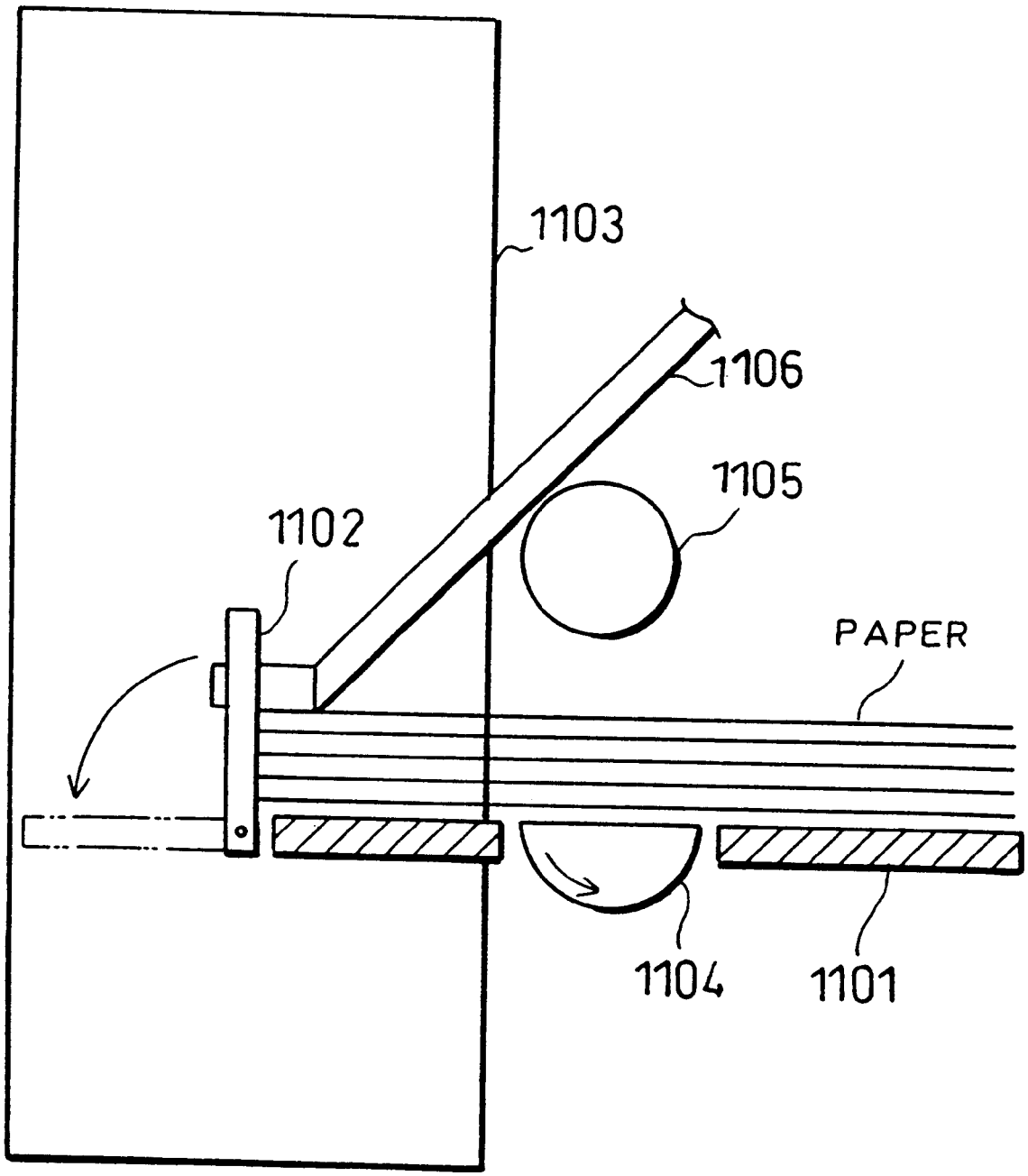
FIG. 62 PRIOR ART
FIG. 62 is a cross-sectional view that shows the structure of a main part of a generally-used paper post-treatment device.
Figure 63:
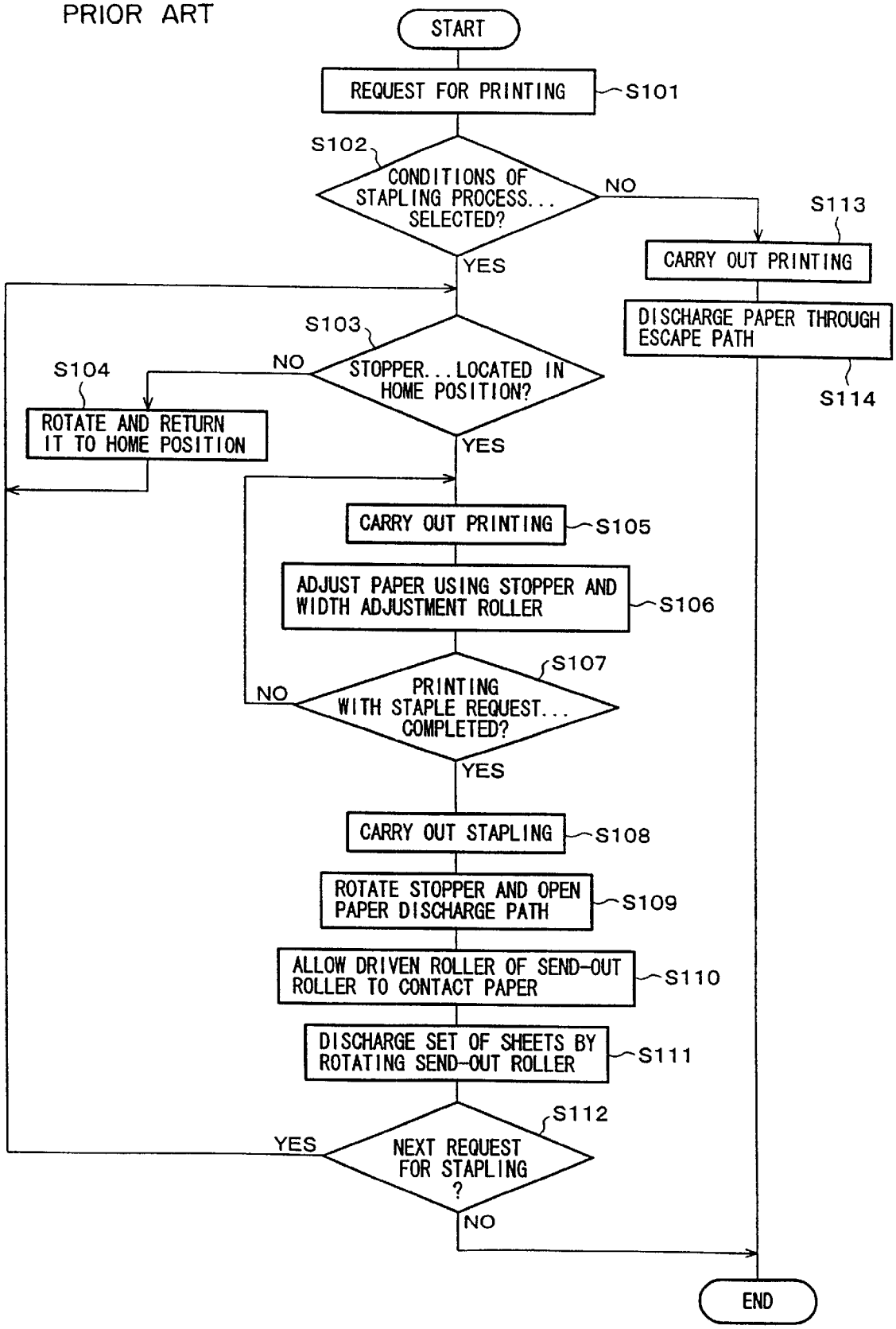
FIG. 63 PRIOR ART
FIG. 63 is a flow chart that explains the sequence of processes for sheets of paper in the paper post-treatment device shown in FIG. 62.

Next, FIG. 58 shows a second modified example of the movable gate unit 31. In the movable gate unit 31 of FIG. 58, the driven rollers 33 are formed by a sponge element. Since the driven rollers 33 are formed by the sponge element, the driven rollers 33 are allowed to deform in accordance with the thickness of the set of sheets of paper when the driven rollers 33 are pressed onto the face of the set of sheets of paper. Therefore, in the same manner as the first modified example, the variations in the thickness of the set of sheets of paper sandwiched by the transport rollers 36 and the driven rollers 33 can be absorbed, thereby making it possible to transport the set of sheets of paper more stably.

Additionally, in all the above-mentioned structures, the movable gate unit 31 is allowed to pivot on the fulcrum 37; however, not limited by this structure, another structure may be used in which the unit 31 is shifted in parallel with a direction orthogonal to the upper face of the staple tray 7.

As described above, in accordance with the paper post-treatment device 61 of the present embodiment, among those members constituting the paper leading-edge adjusting mechanism and those mambas constituting the paper-set transporting mechanism after the post-treatment process, it is possible to reduce the number of those members that need to be controlled independently, and consequently to simplify the mechanism, while maintaining a high transporting force with respect to the sheet of paper after having been subjected to the post-treatment process.

The image-forming apparatus of the present invention is applied to the following various modified arrangements.

In other words, the image-forming apparatus of the present invention may have an arrangement in which: in an image-forming apparatus having a main body, provided with a first paper-discharge section below the scanner, to which the paper post-treatment device can be added, a paper transport path reaching the first paper-discharge section is divided into two paths; to the branch path that is not directed to the first paper-discharge section is connected a paper transport path of the paper post-treatment device installed below the scanner, above the main body; the paper transport path of the paper post-treatment device is further divided into two paths, either one of which is used for carrying out the post-treatment; the other transport path that is not used for the post-treatment is directed to a second paper-discharge section, and the paper transport path used for the post-treatment is directed to a third paper-discharge section placed on the side of the main body.

With the above-mentioned arrangement, the paper transport path inside the main body is divided into two paths, and to the branch path that is not directed to the first paper-discharge section is connected the paper transport path of the paper post-treatment device; therefore, the first paper-discharge section can be used without being blocked by the paper post-treatment device. Moreover, the paper transport path of the paper post-treatment device is divided into two paths, and the second paper-discharge path and the third paper-discharge path corresponding to these are installed; thus, the total three paper-discharge sections are installed.

Therefore, in the case when sheets of paper are outputted to the respective paper-discharge sections in a sorted manner for each of the functions possessed by the image-forming apparatus, paper-discharge sections corresponding to the typical three kinds of functions, that is, the copying function, printing function and facsimile function, can be provided without the sacrifice of the first paper-discharge section, thereby making it possible to improve the spatial performance and convenience of the apparatus.

Moreover, of the two paper transport paths branched inside the paper post-treatment device, the one directed to the third paper-discharge section is used for the post-treatment for sheets of copy paper. Therefore, the paper transport paths can be used in a distinct manner depending on the presence or absence of a post treatment; and it is not necessary to carry out complex operation controlling in one paper transport path, which has been required in conventional apparatuses. Moreover, since the transport roller having conditions optimized for the post treatment and the transport roller having conditions optimized for the case without the post treatment are placed in the different paper transport paths; therefore, no trouble is raised in transporting sheets of copy paper.

In another image-forming apparatus of the present invention, the paper transport path that is led to the second paper-discharge section is also branched so as to reach the third paper-discharge path; thus, it is possible for the user to select which of the first, second and third paper-discharge section to be used for discharging sheets of paper.

With the above-mentioned arrangement, any of the paper-discharge sections desired by the user can be selected. Moreover, in the case when sheets of copy paper that are not subjected to the post-treatment are discharged to the third paper-discharge section, those sheets of paper can be discharged to the third paper-discharge section by using the paper transport path that is not related to the post treatment inside the paper post-treatment device.

In still another image-forming apparatus of the present invention, it is possible to select any paper-discharge section depending on functions; and in the case of such a function in which the third paper-discharge section is selected without carrying out the post treatment, sheets of paper are discharged to the third paper-discharge section through the paper transport path that is not related to the post treatment inside the paper post-treatment device.

In the above-mentioned arrangement, the sheets of paper can be classified depending on the respective functions such as the copying function, printing function and the facsimile function, and sorted respectively. Moreover, with respect to the function to which the third paper-discharge section is assigned, no consideration is required as to the presence or absence of the post treatment.

In still another image-forming apparatus of the present invention, the selection of any function is set on the display panel, and the setting is stored in a memory until otherwise changed.

This arrangement makes it possible to easily select the operation, and also to eliminate the need for changing the setting each time the image-forming apparatus is used.

In still another image-forming apparatus of the present invention, in the case when the post-treatment process of sheets of paper is carried out, the sheets of paper are discharged to the third paper-discharge section independent of the setting of the user selection.

With this arrangement, even when the user erroneously selects the paper-discharge section, the post treatment of sheets of copy paper is carried out correctly.

In still another image-forming apparatus of the present invention, even when, upon carrying out the post-treatment of a sheet of paper, a kind of a sheet of paper from which the post-treatment is inhibited is transported, this sheet of paper is discharged through the paper transport path that is not related to the post treatment.

If a kind of a sheet of paper from which the post-treatment is inhibited is subjected to the post-treatment, this might cause a problem in transporting sheets of paper. However, the above-mentioned arrangement makes it possible to prevent this problem.

In still another image-forming apparatus of the present invention, a gate is attached to each of the junctions of the paper transport paths so as to allow selection among the destinations of the paper transport paths.

With the above-mentioned arrangement, it is possible to easily form a path through which a sheet of paper is discharged to the target paper-discharge section.

In still another image-forming apparatus of the present invention which is an image-forming apparatus having a U-letter arrangement that is provided with a document-reading means (scanner), a printing means for printing image information, a paper feeding means for housing and feeding sheets of paper, a cassette means and a paper-discharge means for discharging a printed sheet of paper, the paper-discharge means is located below the document-reading means, above the paper feeding means and the cassette means, and also positioned on the side face of the printing means, a paper post-treatment transport path for virtually transporting a sheet of paper horizontally is placed in the paper-discharge section, and a paper-adjusting member is placed in the post-treatment transport path. In this arrangement, sheets of paper transported are adjusted, and a set of adjusted sheets of paper is subjected to a post-treatment process by a post-treatment (staple) means.

In the above-mentioned arrangement, the paper post-treatment device is placed by utilizing the space section (on the paper-discharge section) of the U-letter shape image forming apparatus effectively; therefore, it is possible to miniaturize the apparatus, and also to reduce the space occupied by the apparatus.

Moreover, the paper-adjusting position and the post-treatment (staple) position are set at the same level so that it is possible to allow the set of adjusted sheets of paper to be subjected to the post-treatment without being deformed. Therefore, it becomes possible to provide the user with a set of well-adjusted sheets of paper that have been printed.

In still another image-forming apparatus of the present invention which is provided with a document-reading means (scanner), a printing means for printing image information, a paper feeding means for housing and feeding sheets of paper, a cassette means and a paper-discharge means for discharging a printed sheet of paper, and a printed-paper post-treatment means that is placed between the paper-discharge means and a housing means for housing printed sheets of paper, the post-treatment means carries out a post-treatment on the printed sheets of paper in a space formed with respect to the image-forming apparatus, that is, in the paper-discharge means.

In the above-mentioned arrangement, it is not necessary to install the post-treatment device on the side face of the image-forming apparatus; therefore, it is possible to effectively use the space in the apparatus, and consequently to provide a compactly designed apparatus.

In still another image-forming apparatus of the present invention which is provided with a document-reading means (scanner), a printing means for printing image information, a paper feeding means for housing and feeding sheets of paper, a cassette means and a paper-discharge means for discharging a printed sheet of paper, and a printed-paper post-treatment means that is placed between the paper-discharge means and a housing means for housing printed sheets of paper, the post-treatment means is placed virtually horizontally with respect to the image-forming apparatus and has two transport paths.

With the above-mentioned arrangement, it is possible to make compact the device attached to the side face of the image-forming apparatus, and consequently to reduce the occupied space of the entire apparatus.

In still another image-forming apparatus of the present invention, of the two transport paths, the first transport path is arranged to transport printed sheets of paper to the first paper stack tray and the second paper stack tray.

With the above-mentioned arrangement, it is possible to fully utilize the functions of the paper stack section, such as outputs for special sheets of paper and small-size sheets of paper, a large amount of output and an off-set function.

In still another image-forming apparatus of the present invention, of the above-mentioned two transport paths, the second transport path is used for transporting printed sheets of paper that have been stapled to the second paper stack tray.

With the above-mentioned arrangement, since the transport path is exclusively-used for stapling, it is possible to easily construct the adjusting member and the driving system used as its driving source.

In still another image-forming apparatus of the present invention, the staple unit is attached to the same member as the stopper and the fixed wall, and the staple unit is placed outside the width of the main body.

With the above-mentioned arrangement, it is possible to provide better positional precision with respect to the stapling process for sheets of paper, and consequently to improve the appearance and quality of sets of sheets of paper after the stapling process.

In still another image-forming apparatus of the present invention, a printed sheet of paper transported through the second transport path has its rear edge housed in any one of a plurality of recessed sections that are placed in the transport path, depending on kinds of printing; therefore, it is possible to properly adjust the leading edge of a sheet of paper, and also to easily sort pages of printed sheets of paper.

With the above-mentioned arrangement, although it is not necessary to provide an exclusively-used pressing member and controlling operation, the next sheet of paper is always set on the corresponding stacked sheets of paper properly.

In still another image-forming apparatus of the present invention, a width-adjusting mechanism used for the adjusting process in the virtually horizontal post-treatment device is installed.

With the above-mentioned arrangement, it is possible to well-adjust stapled sheets of paper so as to improve the quality of stapled sets of paper, and also to fix the staple unit to a predetermined position by adjusting the width of sheets of paper to the stapling position.

In still another image-forming apparatus of the present invention, the set of printed sheets of paper that have been stapled by the stapling unit is transported and discharged onto the second paper stack tray by a paper-transport member placed in the staple tray section in the post-treatment device and the fourth paper-discharge roller placed between the second paper stack tray and the staple tray section.

With the above-mentioned arrangement, it is possible to discharge sheets of paper without causing damages to the sets of sheets of paper.

In still another image-forming apparatus of the present invention, a gate means for diverging sheets of paper to the first transport path and the second transport path is installed inside the post-treatment device.

With the above-mentioned arrangement, it is possible to properly sort sheets of paper depending on whether the staple function is selected or not.

In still another image-forming apparatus of the present invention, the gate means is switched based upon paper size information given from the main body paper feeding section, the length of a sheet of paper being transported through the main body and the results of detection made by the width detection means.

This-arrangement makes it possible to sort sheets of paper by classifying them depending on the respective factors.

In still another image-forming apparatus of the present invention, the pivotal movement or rotation of the driving roller to the staple path is carried out when, after detection of the fact that the leading edge of a sheet of paper has been fed from the paper-discharge section of the apparatus, the leading edge has been transported to the driving roller.

With the above-mentioned arrangement, when the leading edge of a sheet of paper is transported to the driving roller section, the gap between the driving roller and the contact member is maintained sufficiently wide so that, even when the sheet of paper is curled, it is transported smoothly with its leading edge being free from contacting the roller.

In still another image-forming apparatus of the present invention, the rotation angle or rotation time of the driving roller with respect to the staple path is set before the time at which the leading edge of a sheet of paper has reached the stapling paper leading edge stopping mechanism.

With the above-mentioned arrangement, after the leading edge of paper has reached the stapling paper leading edge stopping mechanism, the rotation of the driving roller is stopped or the driving roller is pivoted toward the escape path; thus, it is possible to prevent paper jam and damages to the sheet of paper due to over-feeding of the sheet of paper.

In still another image-forming apparatus of the present invention, with respect to the staple-use driving roller, the transporting force is set so that, when the leading edge of a sheet of paper has reached the stapling paper leading edge stopping mechanism and a load is applied to the sheet of paper, the sheet of paper is allowed to slip on the roller; therefore, it is possible to positively adjust the leading edges of sheets of paper, without causing paper jam and damages to the sheet of paper due to over-feeding of the sheet of paper.

In still another image-forming apparatus of the present invention, the torque is transmitted to the roller to be rotated by allowing the gear attached to the rotation fulcrum to engage a gear that pivots in association with the pivotal arm.

With the above-mentioned arrangement, the roller to be rotated is subjected to the torque by allowing the gear attached to the rotation fulcrum to engage a gear that pivots in association with the pivotal arm; therefore, the arm pivotal movement makes it possible to smoothly transmit the driving force without variations in gear pitches.

In still another image-forming apparatus of the present invention, the torque is transmitted to the roller to be rotated by allowing the gear or pulley attached to the rotation fulcrum to be connected to a belt.

With the above-mentioned arrangement, the roller to be rotated is subjected to the torque by allowing the gear or pulley attached to the rotation fulcrum to be connected to a belt; therefore, the arm pivotal movement makes it possible to smoothly transmit the driving force without variations in gear or pulley pitches. In the case of the gear connection, the number of gears increases or the gear size becomes larger as the pivotal arm is set longer. In contrast, in the case of the belt connection, it is only necessary to change the length of the belt; therefore, it is possible to reduce the number of parts, and also to make the apparatus compact.

In still another image-forming apparatus of the present invention, the transporting force of the roller to be rotated is set greater in the escape path than in the staple path.

When a sheet of paper is transported through the staple path, the sheet is allowed to move while sliding on sheets of paper stocked to be stapled or the guide plate. Here, in the above-mentioned arrangement, the transporting force (a pressing force exerted between the roller and the sheet of paper) of the driving roller at the time of stapling is reduced so that the sheets of paper are free from scratches and damages.

In still another image-forming apparatus of the present invention, with respect to paper jam in the escape path in the printed paper post-treatment means, in the case when, even after a lapse of a predetermined time period since detection of a sheet of paper being transported in the printing means in the image-forming apparatus, the sheet of paper has not reached the paper-discharge section placed on the side face of the apparatus, it is judged that there is a paper jam in the escape path.

With the above-mentioned arrangement, in the case when, upon request for a printing process, a sheet of paper is discharged by using the escape transport path without requesting the post-treatment, it is not necessary to install any detection mechanism for detecting the passage or stack of a sheet of paper being transported in the transport path.

In still another image-forming apparatus of the present invention, with respect to paper jam in the post-treatment transport path in the printed paper post-treatment means, in the case when selection of the post-treatment process for printed sheets of paper is made by request for a printing process and even after one job of the post-treatment process requested has been completed and even after a predetermined time period has elapsed, the sheet of paper has not reached the paper-discharge section placed on the side face of the apparatus, it is judged that there is a paper jam in the escape path.

With the above-mentioned arrangement, in the case when, upon request for a printing process, no sheet is discharged even after one job has been completed and the next job has started, it is judged that there is a jam; therefore, it is possible to prevent sheets of paper from stacking the post-treatment transport path.

As described above, the first image-forming apparatus of the present invention, which is provided with a document reading section for reading image information from a document, an image-forming section for forming an image on a sheet of paper based upon the image information of the document read by the document reading section, and a space section formed below the document reading section, which accommodates the image-forming section and serves as a discharge section to which the sheet of paper bearing the image formed in the image-forming section is discharged, is further provided with a paper post-treatment section that subjects the sheet of paper bearing the image to post-treatments such as an adjustment process and a stapling process in a virtually horizontal state, and that is placed between the document reading section and-the space section.

In this arrangement, the paper post-treatment section is placed between the document reading section and the space section, that is, the space used for paper post-treatments is formed on the installation plane of the image-forming apparatus. Consequently, since the installation area of the image-forming apparatus including the paper post-treatment section is reduced, it becomes possible to provide a greater degree of freedom in installing the image-forming apparatus.

Moreover, in the paper post-treatment section, the post-treatments such as an adjustment process and a stapling process for sheets of paper bearing images are carried out in a virtually horizontal state; therefore, it is possible to carry out the post-treatments, such as an adjustment process and a stapling process for sheets of paper, at the same position. Thus, it is possible to prevent deformation in the set of sheets of paper and disturbance in the adjustment of the sheets of paper that tend to occur upon transporting the set of adjusted sheets of paper to a stapling position. Consequently, it becomes possible to positively carry out the post-treatment such as the stapling process in a well-adjusted state of the set of sheets of paper.

In the second image-forming apparatus of the present invention, in a separated manner from the above-mentioned space section, a paper-discharge section to which sheets of paper that have been subjected to the post-treatments in the paper post-treatment section are discharged is installed.

Since the sheets of paper which have been subjected to the post-treatments and the sheets of paper which have not been subjected to the post-treatments can be discharged onto respectively different paper-discharge sections, it is possible to completely separate the sheets of paper which have been subjected to the post-treatments and the sheets of paper which have not been subjected to the post-treatments This arrangement makes it possible to eliminate a sorting process that is required when the sheets of paper which have been subjected to the post-treatments and the sheets of paper which have not been subjected to the post-treatments are discharged onto the same paper-discharge section. Thus, it is possible to improve the working efficiency in the image-forming apparatus.

In the third image-forming apparatus of the present invention, the paper post-treatment section is provided with a paper tray on which the sheet of paper bearing an image formed in the image-forming section is stacked, and a staple unit for adjusting and stapling sheets of paper stacked on the paper tray, and in the staple unit, a stopper, which is allowed to contact the edge of the sheet of paper in the transporting direction so as to adjust the sheet of paper upon adjusting the sheet of paper placed on the paper tray, and a fixed wall, which is allowed to contact the sheet of paper in the direction orthogonal to the transporting direction of the sheet of paper so as to adjust the sheet of paper, are attached to the same member.

Therefore, since the stopper which is allowed to contact the edge of the sheet of paper in the transporting direction so as to adjust the sheet of paper upon adjusting the sheet of paper placed on the paper tray and the fixed wall which is allowed to contact the sheet of paper in the direction orthogonal to the transporting direction of the sheet of paper so as to adjust the sheet of paper are attached to the same member, the staple unit can shift the stopper and the fixed fall integrally.

With this arrangement, it is possible to positively carry out the positioning of the stapling process to the sheet of paper and the stapling process quickly and consequently to improve the appearance and quality of sets of sheets of paper after the stapling process.

In the fourth image-forming apparatus of the present invention, the paper post-treatment section is provided with a paper tray on which the sheet of paper bearing an image formed in the image-forming section is stacked, and a staple unit for adjusting and stapling sheets of paper stacked on the paper tray; and the paper tray is provided with a width-adjusting mechanism which allows the sheet of paper to contact the fixed wall in a direction orthogonal to the paper transporting direction and shifts the set of adjusted sheets of paper in the width direction to a stapling position by the staple unit.

Therefore, since the paper tray is provided with a, width-adjusting mechanism which allows the sheet of paper to contact the fixed wall in a direction orthogonal to the paper transporting direction and shifts the set of adjusted sheets of paper to a stapling position, it is possible to positively adjust sheets of paper on the paper tray and to shift the set of the adjusted sheets of paper in the width direction to the stapling position more effectively.

With this arrangement, since the set of sheets of paper is shifted in the width direction to the stapling position, it is not necessary to. shift the staple unit toward the set of adjusted sheets of paper.

Therefore, the stapling process is carried out in a state where the staple unit is fixed at a predetermined position; thus, it is possible to positively carry out the stapling process on the set of sheets of paper quickly, and consequently to improve the appearance and quality of sets of sheets of paper after the stapling process.

In the fifth image-forming apparatus of the present invention, a plurality of recessed sections to which the rear edge of a sheet of paper in the paper transporting direction is allowed to enter are formed in accordance with the sizes of sheets of paper.

In this arrangement, the rear edge of a sheet of paper in the paper transporting direction is allowed to enter the corresponding recessed section in accordance with the size of the sheet of paper so that the paper stacking process is carried out in accordance with the size of the sheet of paper; therefore, it is possible to eliminate exclusively-used seize members and control means that are placed for the respective sizes of sheets of paper transported to the paper tray. This makes it possible to simplify the construction on the paper tray.

In the sixth image-forming apparatus of the present invention, a first paper transport section for transporting a sheet of paper from the image-forming section to the paper post-treatment section is installed, and in the paper post-treatment section are installed a second paper transport path for transporting a sheet of paper that is not to be post-treated, a third transport path for transporting a sheet of paper that is to be post-treated, and a gate means for switching the transporting direction of the sheet of paper passed through the first paper transport path to either the second paper transport path or the third transport path.

Thus, in the paper post-treatment section, the second paper transport path for transporting a sheet of paper that is not to be post-treated and the third paper transport path for transporting a sheet of paper that is to be post-treated are installed; therefore, since the sheet of paper that is not to be post-treated and the sheet of paper that is to be post-treated are transported in a separated manner, it is possible to sort the sheets of paper depending on the presence or absence of a post treatment. For example, discharge sections connecting to the respective transport paths may be installed individually so that it becomes possible to sort the sheets of paper depending on the presence or absence of a post treatment more positively.

In the seventh image-forming apparatus of the present invention, the gate means is switched depending on paper size information and the length and width of a sheet of paper passing through the image-forming apparatus main body.

Thus, the gate means is switched depending on paper-size-information and the length and width of a sheet of paper transported through the image-forming apparatus main body so that the sheet of paper is transported through the second paper transport path or the third paper transport path that has been switched depending on the size of the sheet of paper. For example, even when selection is made so as to carry out a stapling process on sheets of paper smaller than the staple permissible size, that is, even when the operator selects the stapling process in the case of staple-inhibited sheets, the apparatus main body automatically makes a switch to the transport path corresponding to the paper size, and transports the sheet of paper through the path. Therefore, it is possible to prevent staple-inhibited sheets from being erroneously fed to the third paper transport path.

In this manner, since a sheet of paper is positively fed to a transport path that is suitable for the paper size, it becomes possible to prevent a paper jam caused by transporting a transport-inhibited sheet of paper, that is, for example, a staple-inhibited sheet of paper, The eighth image-forming apparatus of the present invention, which is provided with a document reading section for reading image information from a document, an image-forming section for forming an image on a sheet of paper based upon the image information of the document read by the document reading section, a first paper-discharge section, installed below the document reading section, for discharging the sheet of paper bearing an image formed in the image-forming section, a first paper transport path for transporting the sheet of paper from the image-forming section to the first paper-discharge section, a paper post-treatment section for carrying out a post-treatment such as a stapling process on sheets of paper bearing images formed in the image-forming section, a second paper transport path and a third paper transport path that are formed between the document reading section and the first paper-discharge section, and branched from the first paper transport path as two paths so as to respectively direct sheets of paper to a second paper-discharge section and a third paper-discharge section that are formed on the side face side of the apparatus main body in a separated manner from the first paper-discharge section, is arranged so that sheets of paper that are not to be post-treated are discharged onto the second paper-discharge section through the second paper transport path, and sheets of paper that have been post-treated in the paper post-treatment section are discharged onto the third paper-discharge section through the third paper transport path.

For this reason, three discharge destinations, the first to third discharge sections of sheets of paper, are formed so that the respective discharge sections can be classified based upon the respective functions, and used individually.

In the ninth image-forming apparatus of the present invention, the first through third paper-discharge sections can be selected depending on their respective functions.

Therefore, the user can desirably set the respective first through third discharge sections depending on their functions so as to discharge thereto sheets of paper on which images are formed using various functions, such as a copying function, a facsimile function and a printing function. Thus, each of the users can assign desired functions to the respective discharge sections so that it becomes possible to improve the utility of the apparatus.

In the tenth image-forming apparatus of the present invention, in the second paper transport path, a gate means is installed in the second paper transport path so as to switch a sheet of paper transported thereto to the third transport path, and in the case when the third paper-discharge section is selected and when the paper post-treatment is not selected, the gate means is controlled so as to discharge a sheet of paper onto the third paper-discharge section through the second paper transport path.

Here, the gate means is installed in the second paper transport path so as to switch a sheet of paper transported thereto to the third paper transport path; therefore, even in the case when sheets of paper to be housed in the second paper-discharge section connected to the second paper transport path exceeds the permissible amount, the sheets of paper can be housed in the third paper-discharge section connected to the third paper transport path. With this arrangement, since a large amount of paper that is not to be post-treated, for example, not stapled, can be positively discharged, it is possible to improve the utility of the apparatus.

In the eleventh image-forming apparatus of the present invention, in the case when the paper post-treatment is selected, sheets of paper are transported to the third paper-discharge section independent of the paper-discharge section that has been specified.

Thus in this arrangement, every time the paper post-treatment is selected, sheets of paper are transported to the third paper-discharge section independent of the paper-discharge section that has been specified; therefore, even when the user erroneously selects any paper-discharge section other than the third paper-discharge section, the post-treatment is properly carried out on sheets of paper, and the resulting sheets of paper are discharged onto the right paper-discharge section.

In the twelfth image-forming apparatus of the present invention, in the case when, upon selection of the post-treatment of sheets of paper, a sheet of paper of a kind from which the post-treatment is inhibited is transported, either the first paper transport path or the second paper transport path is used so as to discharge the sheet of paper.

Thus, even in the case when, upon selection of the post-treatment of sheets of paper, a sheet of paper of a kind from which the post-treatment is inhibited is transported, the sheet of paper is discharged through the first paper transport path or the second paper transport path; therefore, even when the user erroneously sends a sheet of paper of a kind from which the post-treatment is inhibited, the sheet of paper is transported not through the third paper transport path used for the post-treatment, but through the second paper transport path used for sheets of paper that are not to be post-treated.

With this arrangement, it is possible to prevent problems such as a paper jam caused by erroneously sending a post-treatment inhibited sheet of paper to the third paper transport path used for the post-treatment, and consequently to improve the reliability of the apparatus.

In the thirteenth image-forming apparatus of the present invention, the same driving source is commonly used in the second paper transport path and the third paper transport path so as to transport sheets of paper.

Since the same driving source is commonly used in the second and third paper transport paths so as to transport sheets of paper, it is possible to reduce the number of parts constituting the paper transport path in the paper post-treatment section, and consequently to make the apparatus compact.

In the fourteenth image-forming apparatus of the present invention, the above-mentioned driving source is constituted by a driving roller for transporting sheets of paper that is commonly installed in the second paper transport path and the third paper transport path.

For this reason, since the driving source is constituted by a driving roller for transporting sheets of paper that is commonly installed in the second paper transport path and the third paper transport path, it is possible to reduce the number of parts constituting the paper transport path in the paper post-treatment section, and consequently to make the apparatus compact.

In the fifteenth image-forming apparatus of the present invention, the second paper transport path is placed on the upper side of the third paper transport path, and the driving roller is arranged so as to freely move in an up and down direction. When a sheet of paper is transported through the second transport path, it is allowed to move upward so as to contact the sheet of paper being transported through the second paper transport path, and when a sheet of paper is transported through the third transport path, it is allowed to move downward so as to contact the sheet of paper being transported through the third transport path.

With this arrangement in which: the second paper transport path is placed on the upper side of the third paper transport path, the driving roller is arranged so as to freely move in an up and down direction, when a sheet of paper is transported through the second transport path, it is allowed to move upward so as to contact the sheet of paper being transported through the second paper transport path, and when a sheet of paper is transported through the third transport path, it is allowed to move downward so as to contact the sheet of paper being transported through the third transport path, the driving roller is allowed to separate from the driving roller when a sheet of paper is transported through the second paper transport path.

Consequently, when, upon transporting a sheet of paper to be stapled, a request for an interruption so as send a sheet of paper that is not to be stapled, the driving roller is maintained in a manner so as not to contact a set of sheets of paper to be stapled that are stacked on the third transport path; therefore, it is possible to eliminate insufficient adjustment of the set of sheets of paper, for example, due to reversely fed sheets of paper, and also to readily resume the process upon completion of the request for an interruption.

In the sixteenth image-forming apparatus of the present invention, the rotation control of the driving roller is provided such that the transporting force for transporting sheets of paper through the second paper transport path used for sheets of paper to be post-treated is set to be greater than the transporting force for transporting sheets of paper through the third transport path used for sheets of paper that are not to be post-treated.

In this arrangement, the driving roller is controlled in such a manner that the transporting force for transporting sheets of paper through the second paper transport path used for sheets of paper to be post-treated is set to be greater than the transporting force for transporting sheets of paper through the third transport path used for sheets of paper that are not to be post-treated; therefore, the sheet of paper, sent through the third paper transport path, is transported while smoothly contacting a set of sheets of paper that have stacked on the third paper transport path Consequently, it is possible to prevent the sheet of paper or the set of sheets of paper from being scratched or damaged at the time of discharging it onto the third transport path.

The seventeenth image-forming apparatus of the present invention, which is provided with a document reading section for reading image information from a document, an image-forming section for forming an image on a sheet of paper based upon the image information of the document read by the document reading section, a first paper-discharge section, installed below the document reading section, for discharging the sheet of paper bearing an image formed in the image-forming section, a first paper transport path for transporting the sheet of paper from the image-forming section to the first paper-discharge section, a paper post-treatment section for carrying out a post-treatment such as a stapling process on sheets of paper bearing images formed in the image-forming section, a second paper transport path and a third paper transport path that are formed between the document reading section and the first paper-discharge section, and branched from the first paper transport path as two paths so as to respectively direct sheets of paper to a second paper-discharge section and a third paper-discharge section that are formed on the side face side of the apparatus main body in a separated manner from the first paper-discharge section, is further provided with a diverging means for allowing a sheet of paper transported through the first paper transport path to diverge to either the second or the third transport path is installed, and the diverging means is constituted by three concatenation rollers that are rotatable forwardly as well as reversely, and that selectively transport a sheet of paper from the image-forming section to either the second or third paper transport path depending on their rotation directions.

In this arrangement, the sheet of paper is directed to either of the two nip sections formed by the three concatenation rollers. At this time, since the nips are switched so as to transport a sheet of paper depending on the rotation directions of the center roller, it is possible to positively send the sheet of paper to a desired paper transport path.

In the eighteenth image-forming apparatus of the present invention, a transport member, which transports a sheet of paper by blocking either the second transport path or the third transport path while the other transport path being opened depending on the rotation directions of the three concatenation rollers, is installed.

Therefore, the application of the transport member that transports a sheet of paper by blocking either the second transport path or the third transport path while the other transport path being opened depending on the rotation directions of the three concatenation rollers makes it possible to positively send the sheet of paper to a desired paper transport path.

In the nineteenth image-forming apparatus of the present invention, the transport member is constituted by a first gate member having its one end connected and secured to the rotation shaft of the center roller of the three concatenation rollers and a second gate member that is connected to the other end of the first gate member with its virtually center portion being supported on a fixed shaft so as to freely pivot thereon.

In this arrangement, the transport member is constituted by the first gate member having its one end connected and secured to the rotation shaft of the center roller of the three concatenation rollers and the second gate member that is connected to the other end of the first gate member with its virtually center portion being supported on a fixed shaft so as to freely pivot thereon; therefore, in an attempt to transport a sheet of paper to either one of the transport paths, the three concatenation rollers are rotated in such directions that the sheet of paper is introduced to the nip section facing the corresponding transport path to which it is transported (hereinafter, referred to as a discharging-side transport path).

At this time, the first gate member connected to the center roller is allowed to tilt toward the discharging-side transport path, following the rotation. One end of the second gate member on the side connected to the first gate member is allowed to tilt toward the discharging-side transport path following the shift of the first gate member; however, since the center portion of the second gate member is supported on the fixed shaft so as to freely pivot thereon, the other end on the side not connected to the first gate member is allowed to tilt in a manner so as to open the discharging-side transport path.

Therefore, in the transport path switching mechanism using the three concatenation rollers, the first and second gear members make it possible to positively direct a sheet of paper to the discharging-side transport path. Moreover, this structure is particularly effective when the transport paths are switched in transport paths placed in the horizontal direction.

Moreover, since the driving force is applied to the gate members through the rotation shaft of the three concatenation rollers, it is not necessary to provide a driving source exclusively used for gates. Therefore, it is possible to switch sheets of paper by using a device with a simple structure.

In addition to the application of the first and second gate members, the following structure may be used. In other words, the 20th image-forming apparatus of the present invention may have an arrangement in which: the transport member is constituted by a first gear formed on the rotation shaft of the center roller of the three concatenation rollers, a second gear that engages the first gear, and a paper separation gate that is formed on the second gear and that is allowed to pivot toward the side opposite to the rotation direction of the first gear.

In the 21st image-forming apparatus of the present invention, the transport path from the three concatenation rollers to the paper transport rollers installed in the third paper transport path is formed with an inclination that allows a sheet of paper to drop by gravity, and the distance from the nip sections of the three concatenation rollers to the nip section of the paper transport rollers is set to a paper size that allows post-treatments. Therefore, any sheet of paper having a size that allows post-treatments has its leading edge directed to the nip section of the paper transport rollers before it has been completely released from the nip section of the three concatenation rollers. Moreover, any sheet of paper having a size smaller than the size that allows post-treatments has its leading edge not allowed to reach the nip section of the paper transport rollers even after having been completely released from the nip section of the three concatenation rollers, thereby dropping again on the three concatenation rollers side by gravity.

With this arrangement, only sheets of paper having a size that allows post-treatments are transported through the third paper transport path. In other words, any sheet of paper having a size smaller than the size that allows post-treatments (staple-inhibited paper) is not allowed to pass through the third paper transport path; therefore, it is possible to prevent troubles such as a paper jam in the third paper transport path due to maloperation.

Moreover, it is possible to make a judgment as to whether or not a sheet of paper can be post-treated simply by setting the distance of the transport path; therefore, since no sensors need to be installed separately, the structure of the paper transport path can be simplified.

The 22nd image-forming apparatus of the present invention has an arrangement in which, when a sheet of paper having a size smaller than the size that allows post-treatments is transported between the nip section of the three concatenation rollers and the nip section of the paper transport roller, the sheet of paper is allowed to pass through the other nip section of the three concatenation rollers by the rotation of the center roller, and directed to the second paper transport path.

Therefore, even when a sheet of paper having a size smaller than the size that allows post-treatments is transported between the nip section of the three concatenation rollers and the nip section of the paper transport roller, the sheet of paper is allowed to pass through the other nip section of the three concatenation rollers by the rotation of the center roller, and directed to the second paper transport path. Consequently, it is possible to prevent the occurrence of a paper jam between the nip sections of the three concatenation rollers and the nip section of the paper transport rollers.

The 23rd image-forming apparatus of the present invention, which is provided with a document reading section for reading image information from a document, an image-forming section for forming an image on a sheet of paper based upon the image information of the document read by the document reading section, and a space section formed below the document reading section, which accommodates the image-forming section and serves as a discharge section to which the sheet of paper bearing the image formed in the image-forming section is discharged, is further provided with a paper post-treatment section that subjects the sheet of paper bearing the image to post-treatments such as an adjustment process and a stapling process in a virtually horizontal state, and that is placed between the document reading section and the space section; and in the paper post-treatment section is installed a switch back mechanism which, upon forming images on the two sides of a sheet of paper, again transports the sheet of paper bearing an image on one side thereof to the image-forming section.

Thus, the paper post-treatment section is provided with the switch back mechanism which, upon forming images on the two sides of a sheet of paper, again transports the sheet of paper bearing an image on one side thereof to the image-forming section; therefore, the paper post-treatment section is also used as an intermediate tray used for the double-sided image formation for a sheet of paper (hereinafter, referred to as double-sided printing). Therefore, it is possible to improve the job efficiency of the double-sided printing by reducing the occupied space and achieving the low costs.

In the 24th image-forming apparatus of the present invention, an escape path for transporting sheets of paper that are not to be post-treated and a staple tray that transports sheets of paper to be post-treated, are installed in the paper post-treatment section, and a switch back mechanism, which reverses a sheet of paper bearing an image on one side and transports it again to the image-forming section so as to form an image on the side bearing no image, is installed in each of the escape path and the staple tray.

In this arrangement in which the switch back mechanism, which reverses a sheet of paper bearing an image on one side and transports it again to the image-forming section so as to form an image on the side bearing no image, is installed in each of the escape path and the staple tray even in the case when a double-sided printing process is requested by interrupting a state in which the staple tray is being used, the switch back mechanism of the escape path is used. Thus, it becomes possible to carry out the double-sided printing process without disturbing the stacking property of sheets of paper on the staple tray.

Moreover, it is possible to carry out the switch back process while maintaining the positional precision of sheets of paper without causing damages to the sheets of paper being switched back.

Furthermore, in the case when the switch back mechanism of the staple tray is used, the staple tray is also utilized as an intermediate tray; therefore, a predetermined number of sheets of paper that have been subjected to printing on one side thereof are stored therein. Then, these sheets of paper thus stored can be switched back so as to complete the double-sided printing process. Thus, it becomes possible to improve the efficiency of the double-sided printing process.

More specifically, the following structure is adopted. In other words, in the 25th image-forming apparatus of the present invention, in the case when the switch back mechanism of the above-mentioned escape path is utilized, the rear edge of a sheet of paper bearing an image on one side thereof is chucked by the paper transport rollers installed inside the escape path, and the sheet of paper is switched back sheet by sheet by reversely rotating the paper transport rollers.

Moreover, in the 26th image-forming apparatus of the present invention, in the case when the switch back mechanism of the above-mentioned escape path is utilized, after a predetermined number of sheets of paper bearing images on one side thereof have been stored on the staple tray, the sheets of paper stacked on the staple tray are switched back successively.

In the 27th image-forming apparatus of the present invention, an adjustment member for adjusting the edge of the sheet of paper on the side opposite to the post-treatment direction is placed in the staple tray in a manner so as to shift in the paper transporting direction.

In this arrangement in which the adjustment member for adjusting the edge of the sheet of paper on the side opposite to the post-treatment direction is placed in the staple tray in a manner so as to shift in the paper transporting direction, the adjusting member, which functions as a port-treatment member, is also utilized as an adjusting member in the intermediate tray at the time of a double-sided printing process; therefore, it becomes possible to reduce the number of members required for the switch back mechanism, and consequently to make the entire apparatus compact and reduce the costs of the apparatus.

The 28th image-forming apparatus of the present invention, which is provided with a document reading section for reading image information from a document, an image-forming section for forming an image on a sheet of paper based upon the image information of the document read by the document reading section, and a space section formed below the document reading section, which accommodates the image-forming section and serves as a discharge section to which the sheet of paper bearing the image formed in the image-forming section is discharged, is further provided with a paper post-treatment section that subjects the sheet of paper bearing the image to post-treatments such as an adjustment process and a stapling process in a virtually horizontal state, and that is placed between the document reading section and the space section. In the paper post-treatment section, an escape path for transporting sheets of paper that are not to be post-treated and a staple tray for transporting sheets of paper that are to be post-treated are installed, and the escape path has an arrangement in which a plurality of paper transport members, each consisting of a paper conveyor belt and a pair of rollers, are aligned in the paper transporting direction, and each paper transport member is placed so as to pivot toward the staple tray side on a roller as a fulcrum located on the side opposite to the paper transporting direction.

In this arrangement, the paper transport members serving as the transporting means of the escape path are allowed to pivot so as to send sheets of paper being transported through the escape path to the staple tray side. Thus, it is possible to eliminate the need for installing the diverging means for diverging sheets of paper transported from the image-forming section to the escape path or the staple tray in the vicinity of the paper inlets of the escape path and the staple tray. Consequently, it becomes possible to reduce the number of parts in the apparatus.

In the 29th image-forming apparatus of the present invention, when a sheet of paper is transported through the escape path, each of the paper transport members is maintained at a home position, which allows the paper transport belt to be maintained in a virtually horizontal state. Upon receipt of a request for the stapling process, it is allowed to pivot toward the staple tray side.

Thus, when a sheet of paper is transported through the escape path, the paper transport member is maintained at a home position that allows the paper transport belt to be maintained in a virtually horizontal state, and upon receipt of a request for the stapling process, it is allowed to pivot toward the staple tray side so that a desired position on the escape path can serve as a paper-guiding position by allowing the paper transport member to pivot. Consequently, it is possible to change the paper-guiding position to the staple tray, for example, depending on the size of paper.

More specifically, the following structure is adopted. In other words, in the 30th image-forming apparatus of the present invention, the pivotal positions of the respective paper transport members can be switched depending on the sizes of sheets of paper.

In the 31st image-forming apparatus, in a state where the paper transport member has pivoted toward the staple tray side, the paper conveyor belt is allowed to rotate in the paper transporting direction while it is kept in contact with the staple tray.

Consequently, in the state where the paper transport member has pivoted toward the staple tray side, the paper conveyor belt is allowed to rotate in the paper transporting direction while it is kept in contact with the staple tray so that a sheet of paper, transported to the staple tray, is further transported by the paper transport member. With this arrangement, the same driving means for transporting sheets of paper can be commonly used in the escape path and the staple tray; therefore, it is possible to reduce the number of members in the apparatus, and consequently to reduce the costs of the apparatus.

In the 32nd image-forming apparatus of the present invention, among the paper transport members that have pivoted toward the staple tray side, the paper transport member located on the farthest upstream side is set to have an angle not more than 90 degrees with respect to the paper bearing plane of the staple tray.

Thus, among the paper transport members that have pivoted toward the staple tray side, the paper transport member located on the farthest upstream side is set to have an angle not more than 90 degrees with respect to the paper bearing plane of the staple tray so that it is possible to send sheets of paper smoothly to the staple tray.

More specifically, the above-mentioned paper conveyor belt has the following structure. In other words, in the 33rd image-forming apparatus of the present invention, the paper conveyor belt of the paper transport member is allowed to rotate forwardly as well as reversely.

The 34th image-forming apparatus of the present invention, which is provided with a document reading section for reading image information from a document, an image-forming section for forming an image on a sheet of paper based upon the image information of the document read by the document reading section, and a space section formed below the document reading section, which accommodates the image-forming section and serves as a discharge section to which the sheet of paper bearing the image formed in the image-forming section is discharged, is further provided with a paper post-treatment section that subjects the sheet of paper bearing the image to post-treatments such as an adjustment process and a stapling process in a virtually horizontal state, and that is placed between the document reading section and the space section. In the paper post-treatment section, an escape path for transporting sheets of paper that are not to be post-treated and a staple tray for transporting sheets of paper that are to be post-treated are installed, and the escape path and the staple tray are arranged so as to be opened in a direction perpendicular to the paper transporting direction on the end portion as a fulcrum on the side opposite to the operation face used by the operator.

Consequently, the paper post-treatment section is provided with the escape path for transporting sheets of paper that are not to be post-treated and the staple tray for transporting sheets of paper that are to be post-treated are installed, and the escape path and the staple tray are arranged so as to be opened in a direction perpendicular to the paper transporting direction on the end portion as a fulcrum on the side opposite to the operation face used by the operator; therefore, even in the event of a paper jam at least at either the escape path or the staple tray, the operation face side can be opened so that the paper jam process can be easily carried out.

Moreover, in the case when the escape path and the staple tray are opened by using a single lever, it becomes possible to easily solve problems such as paper jams, etc., without the need for removing machine screws, etc. so as to open the escape path and the staple tray from the apparatus.

In the 35th image-forming apparatus of the present invention, the escape path and the staple tray are opened simultaneously within the space section formed below the document reading section.

Since the escape path and the staple tray are opened simultaneously within the space section formed below the document reading section, it is not necessary to provide another space section that allows the escape path and the staple tray to be opened; thus, it becomes possible to effectively use the installation space of the apparatus.

In the 36th image-forming apparatus of the present invention, the escape path is placed on the upper face side of the staple tray, and the lower face member of the escape path and the upper member of the staple tray are constituted by a common member. Here, the common member is arranged so as to pivot toward the escape path side so that only the staple tray is opened at the time when the escape path and the staple tray are maintained in an openable state.

Therefore, when the escape path and the staple tray are opened, the common member constituting the lower face member of the escape path and the upper face member of the staple tray is pressed downward so that the escape path and the staple tray can be opened with the single action. Moreover, the common member is simply raised so as to open only the staple tray.

In the 37th image-forming apparatus of the present invention, the escape path is placed on the upper face side of the staple tray, and the lower face member of the escape path and the upper member of the staple tray are constituted by a common member. Here, a jam detection mechanism, which carries out jam detection in the staple tray and the escape tray by using a single sensor, is formed on the common member.

Since the jam detection mechanism in the two transport paths (the escape path and the staple tray) is constituted by a single sensor, it is possible to simplify wiring, etc. in the jam detection mechanism. As a result, it becomes possible to make the apparatus compact, and consequently to reduce the production costs of the apparatus.

More specifically, the structure of the sensor is described as follows: That is, in the 38th image-forming apparatus of the present invention, the sensor is constituted by an optical light-emitting section, a light-receiving section for receiving light directed from the light-emitting section, and an arm member which is allowed to block the light-receiving section when a sheet of paper being transported comes into contact therewith.

More specifically, the arm member is formed as follows: That is, the 39th image-forming apparatus of the present invention has a structure in which the arm member is placed in a manner so as to freely pivot on a fulcrum formed on the common member so that one end thereof is allowed to contact a sheet of paper being transported with the other end being allowed to pivot on the fulcrum to block the light-receiving section.

Moreover, the paper post-treatment apparatus is provided with a leading-edge adjusting transport means that is constituted by a leading-edge adjusting section which stops at a predetermined position to block the transport path, thereby arranging the leading edges of a plurality of sheets of paper being transported, and a transport section which also serves as at least one portion of a transport means for transporting a set of sheets of paper toward the downstream side, and is allowed to contact the set of sheets of paper in place of the leading-edge adjusting section when the leading-edge adjusting section has been shifted from the predetermined position so as to open the transport path, thereby allowing the transport means to shift to a state ready for transportation, the reading-edge adjusting section and the transporting section being integrally formed thereon.

In this arrangement, in the case when the leading-edge adjusting transport means adjusts the leading edges of a plurality of sheets of paper, the leading-edge adjusting section is stopped at a predetermined position so as to block the transport path, thereby allowing the leading edges of sheets of paper to contact the leading-edge adjusting section. When the leading-edge adjusting section is moved from the predetermined position so as to open the transport path with the set of sheets of paper being adjusted, the transport section is allowed to come into contact with the set of sheets of paper in place of the leading-edge adjusting section. The transport section also serves as at least one portion of the transport means for transporting a set of sheets of paper toward the downstream side, and allows the transport means to shift to a state ready for transportation, when it comes into contact with the set of sheets of paper. Therefore, different from conventional methods in which the leading-edge adjusting process and the transition process for getting ready for the transportation are controlled in a separated manner, the two processes can be easily controlled by a sequential controlling operation of one control mechanism. Moreover, the application of a pair of rollers as the transport means makes it possible to ensure a higher transporting force easily.

As a result, among those members constituting the paper leading-edge adjusting mechanism and those members constituting the paper-set transporting mechanism after the post-treatment process, it is possible to reduce the number of those members that need to be controlled independently, and consequently to simplify the mechanism, while maintaining a high transporting force with respect to the sheet of paper after having been subjected to the post-treatment process; thus, it becomes possible to provide a paper post-treatment device having a simpler structure.

Moreover, in the paper post-treatment device of the present invention, the leading-edge adjusting transport means is provided as a transport roller having a cut-out section that is formed by cutting out a cylindrical shape by two planes that intersect each other along a cross line parallel to the center axis of the cylindrical shape with an angle of not less than 90 degrees from the outer circumferential face to the cross line.

In this arrangement, when sheets of paper are transported thereto, the cut-out section is allowed to face the paper on-coming side, with one of the wall faces being stopped at a position orthogonal to the transporting direction so that the transport path is closed; thus, the sheets of paper come into contact with the up-right wall face so that the leading edges thereof are adjusted. In this case, since the other wall face has an angle of not less than 90 degrees with respect to the wall face, it is located at a position that gives no interruption to the paper transportation. In this manner, the cut-out section functions as the leading-edge adjusting section 2.

When the transport roller is rotated so that the up-right wall face falls toward the transport-path downstream side, the transport path is opened, and the outer circumferential face other than the cut-out section of the transport roller is allowed to contact the face of the set of sheets of paper, with the result that the transport roller transports the set of sheets of paper toward the downstream side by a frictional force. In this case, a driven roller may be attached to the transport roller so that it is possible to increase the transporting force. Moreover, the driven roller may be placed at such a position that it is allowed to come into contact with the face of the set of sheets of paper on the opposite side as the transport roller is rotated; thus, the contacting action of the transport roller onto the face of the set of sheets of paper serves as an action that gets the transporting means ready for the transporting operation. During the transportation, since the entire transport rollers are positioned on one side face of the set of sheets of paper, even when the cut-out section returns to the original position, it does not interrupt the transportation of the set of sheets of paper. Therefore, the outer circumferential face other than the cut-out section of the transport roller is allowed to function as the transport section.

Thus, the leading-edge adjusting transport means is realized by using a simple structure in which one portion of the normally used roller is cut out.

Moreover, the paper post-treatment device is arranged so that the height of the wall face of the cut-out section with which sheets of paper come into contact with is set to be greater than the thickness of the maximum sheets of paper that are allowed to store at the time of a post treatment process.

Therefore, the permissible range of sheets of paper that can be subjected to the leading-edge adjusting process is set to be greater than the thickness of the maximum sheets of paper that are allowed to store at the time of a post treatment process. Consequently, it is possible to carry out the paper leading-edge adjusting process stably on all range of the thickness of the set of sheets of paper that can be subjected to a post treatment process.

Moreover, the paper post-treatment device of the present invention is arranged so that the length in the rotation direction of the portion having a curvature of the outer circumferential face of the transport roller is set in such a manner that, within one rotation of the transport roller, the set of sheets of paper is allowed to reach the transporting force applying means that is installed on the downstream side of the transport roller and that further transports the set of sheets of paper downstream side.

Consequently, the length of the outer circumferential face other than the cut-out section in the rotation direction is sufficiently provided so that the set of sheets of paper to be transported toward downstream side is taken over by the transporting force applying means that is used in the next process such as the paper-discharge rollers within one rotation of the transport roller. Thus, it becomes possible to sufficiently maintain the transporting distance with respect to the set of sheets of paper having been subjected to the post-treatment process.

In the paper post-treatment device of the present invention, the rotative driving operation of the transport roller is stopped when the paper-contacting wall face of the cut-out section has arrived at the position for the leading-edge adjusting.

For this reason, when, after the rear edge of the set of sheets of paper has passed through the position of the transport roller, the wall face reaches the leading-edge adjusting position, the rotative driving operation of the transport roller is stopped; thus, simultaneously as the transporting operation is completed, it is possible to get the transport roller ready for the next paper leading-edge adjusting process. Consequently, upon carrying out the next post-treatment process, it is not necessary to newly control the position of the transport roller so as to carry out the leading-edge adjusting process; thus, it is possible to make the controlling operation easier.

Furthermore, in the paper post-treatment device of the present invention, the transport means is provided with a transport roller placed on the rear side of the adjustment tray, and a driven roller which transports the set of sheets of paper toward the downstream side while sandwiching the set of sheets of paper between it and the transport roller; the leading-edge adjusting transport means is provided with a movable gate that is movable between a protruding position at which its wall face perpendicular to the transporting direction is allowed to protrude toward the surface side of the upper face of the adjustment tray and a shelter position at which it retreats on the rear side of the upper face of the adjustment tray, and a driven roller holder that is connected to the movable gate on the rear side of the upper face of the adjustment tray and that reaches the surface side from both of the ends in the width direction of the adjustment tray so as to hold the rotation shaft of the driven roller; when the movable gate shifts toward the protruding position, the driven roller holder is shifted so that the driven roller is separated from the set of sheets of paper being transported, and when the movable gate shifts toward the shelter position, the driven roller is shifted to a position where it holds the rotation shaft so as to press the set of sheets of paper to the transport roller.

Thus, in the leading-edge adjusting transport means, the driven roller holder is connected to the movable gate on the rear side of the upper face of the adjustment tray so that the movable gate, the driven roller holder and the driven roller are made integral with each other. When the movable gate is shifted to the protruding position so that its wall face perpendicular to the transporting direction protrudes toward the surface side of the upper face of the adjustment tray, the driven roller is accordingly shifted so as to separate from sheets of paper being transported. Consequently, at this position, the driven roller holder is free from interrupting the paper transportation, and the wall face of the movable gate is allowed to adjust the leading edges of sheets of paper.

Moreover, when the wall face of the movable gate is shifted to the shelter position at which the wall face of the movable gate retreats to the rear side of the upper face of the adjustment tray, the driven roller is accordingly shifted so as to press the set of sheets of paper onto the transport roller installed on the rear side of the upper face of the adjustment tray. Since the wall face of the movable gate is shifted to the shelter position, the transport path is opened, and since the transport roller and the driven roller are allowed to sandwich the set of sheets of paper, the driven roller allows the transport means to get ready for the transporting process at the above-mentioned press-contact position. Moreover, since it is not necessary to make the transport roller protrude toward the surface side of the upper face of the adjustment tray, it is possible to sufficiently maintain the transport distance of the set of sheets of paper by forming the transport roller not into a semi-circular shape having only a short transport distance, but into a normal cylindrical shape, and consequently to maintain the transport distance of the set of sheets of paper sufficiently.

In this manner, the movable gate functions as a leading-edge adjusting section of the leading-edge adjusting transport means, and the driven roller functions as a transport section of the leading-edge adjusting transport means. Thus, the leading-edge adjusting transport means can be realized by a simple structure in which the movable gate and the driven roller are made integral with each other, and it becomes possible to sufficiently maintain the transport distance with respect to the set of sheets of paper after having been post-treated.

Moreover, in the paper post-treatment device of the present invention, the driven roller holder holds the rotation shaft through a spring that presses the driven roller onto the transport roller.

Therefore, it is possible to absorb variations in the thickness of the set of sheets of paper sandwiched between the transport roller and the driven roller, and consequently to transport the set of sheets of paper stably.

Moreover, in the present paper post-treatment apparatus, the driven roller is formed by a sponge material.

Consequently, the variation in the thickness of the set of sheets of paper sandwiched by the transport roller and the driven roller can be absorbed by the deformation of the driven roller, thereby making it possible to carry out a stable transportation of sheets of paper. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image-forming apparatus comprising:

a document reading section for reading image information from a document;

an image-forming section for forming an image on a sheet of paper based upon the image information of the document read by the document reading section;

a space section formed below the document reading section, which accommodates the image-forming section and serves as a discharge section to which the sheet of paper bearing the image formed in the image-forming section is discharged, the space section being surrounded by peripheral walls of an apparatus main body including the image-forming section; and a paper post-treatment section that subjects the sheet of paper bearing the image to post-treatments including an adjustment process and a stapling process, in a virtually horizontal state, and that is placed between the document reading section and the space section, wherein the paper post-treatment section comprises:

a paper tray on which the sheet of paper bearing an image formed in the image-forming section is stacked; and a staple unit for adjusting and stapling sheets of paper stacked on the paper tray, wherein the staple unit includes a stopper which is allowed to contact the edge of the sheet of paper in a transporting direction so as to adjust the sheet of paper upon adjusting the sheet of paper placed on the paper tray, and a fixed wall which is allowed to contact the sheet of paper in the direction orthogonal to the transporting direction of the sheet of paper so as to adjust the sheet of paper, the stopper and the fixed wall being attached to a same member.

2. The image-forming apparatus as defined in claim 1, wherein a paper-discharge section for discharging the sheet of paper that has been post-treated by the paper post-treatment section is installed in a separate manner from the space section.

3. The image-forming apparatus as defined in claim 1, wherein a plurality of recessed sections to which the rear edge of a sheet of paper in the paper transporting direction is allowed to enter are formed in accordance with sizes of sheets of paper.

4. The image-forming apparatus as defined in claim 1, wherein the paper tray comprises a width-adjusting mechanism which allows the sheet of paper to contact a fixed wall in a direction orthogonal to the paper transporting direction and shifts the set of adjusted sheets of paper in the width direction to a stapling position by the staple unit.

5. The image-forming apparatus as defined in claim 1, wherein a first paper transport path for transporting a sheet of paper from the image-forming section to the paper post-treatment section is installed, and in the paper post-treatment section are installed a second paper transport path for transporting a sheet of paper that is not to be post-treated, a third transport path for transporting a sheet of paper that is to be post-treated, and a gate means for switching the transporting direction of the sheet of paper passed through the first paper transport path to either the second paper transport path or the third transport path.

6. The image-forming apparatus as defined in claim 5, wherein the gate means is switched depending on paper size information and the length and width of a sheet of paper passing through the image-forming apparatus main body.

7. An image-forming apparatus comprising:

a document reading section for reading image information from a document;

an image-forming section for forming an image on a sheet of paper based upon the image information of the document read by the document reading section;

a first paper-discharge section, installed below the document reading section, for discharging the sheet of paper bearing an image formed in the image-forming section;

a first paper transport path for transporting the sheet of paper from the image-forming section to the first paper-discharge section;

a paper post-treatment section for carrying out a post-treatment including a stapling process on sheets of paper bearing images formed in the image-forming section; and a second paper transport path and a third paper transport path that are formed between the document reading section and the first paper-discharge section, and branched from the first paper transport path as two paths so as to respectively direct sheets of paper to a second paper-discharge section and a third paper-discharge section that are formed on the side face side of the apparatus main body in a separated manner from the first paper-discharge section, wherein sheets of paper that are not to be post-treated are discharged onto the second paper-discharge section through the second paper transport path, and sheets of paper that have been post-treated in the paper post-treatment section are discharged onto the third paper-discharge section through the third paper transport path, wherein the paper post-treatment section comprises:

a paper tray on which the sheet of paper bearing an image formed in the image-forming section is stacked; and a staple unit for adjusting and stapling sheets of paper stacked on the paper tray, wherein the staple unit includes a stopper which is allowed to contact the edge of the sheet of paper in a transporting direction so as to adjust the sheet of paper upon adjusting the sheet of paper placed on the paper tray, and a fixed wall which is allowed to contact the sheet of paper in the direction orthogonal to the transporting direction of the sheet of paper so as to adjust the sheet of paper, the stopper and the fixed wall being attached to a same member.

8. The image-forming apparatus as defined in claim 7, wherein the first through third paper-discharge sections are selected depending on respective functions thereof.

9. The image-forming apparatus as defined in claim 7, wherein a gate means is installed in the second paper transport path so as to switch a sheet of paper transported thereto to the third transport path, and in the case when the third paper-discharge section is selected and when the paper post-treatment is not selected, the gate means is controlled so as to discharge a sheet of paper onto the third paper-discharge sect ion through the second paper transport path.

10. The image-forming apparatus as defined in claim 7, wherein in the case when the paper post-treatment is selected, sheets of paper are transported to the third paper-discharge section independent of the paper-discharge section that has been specified.

11. The image-forming apparatus as defined in claim 7, wherein in the case when, upon selection of the post-treatment of sheets of paper, a sheet of paper of a kind from which the post-treatment is inhibited is transported, either the first paper transport path or the second paper transport path is used so as to discharge the sheet of paper.

12. The image-forming apparatus as defined in claim 7, Wherein the same driving source is commonly used in the second paper transport path and the third paper transport path so as to transport sheets of paper.

13. The image-forming apparatus as defined in claim 12, wherein the driving source is constituted by a driving roller for transporting sheets of paper that is commonly installed in the second paper transport path and the third paper transport path.

14. The image-forming apparatus as defined in claim 13, wherein: the second paper transport path is placed on the upper side of the third paper transport path, the driving roller is arranged so as to freely move in an up and down direction, and when a sheet of paper is transported through the second transport path, it is allowed to move upward so as to contact the sheet of paper being transported through the second paper transport path, and when a sheet of paper is transported through the third transport path, it is allowed to move downward so as to contact the sheet of paper being transported through the third transport path.

15. The image-forming apparatus as defined in claim 13, wherein a rotation control of the driving roller is provided such that the transporting force for transporting sheets of paper through the second paper transport path used for sheets of paper to be post-treated is set to be greater than the transporting force for transporting sheets of paper through the third transport path used for sheets of paper that are not to be post-treated.

16. An image-forming apparatus comprising:

a document reading section for reading image information from a document;

an image-forming section for forming an image on a sheet of paper based upon the image information of the document read by the document reading section;

a first paper-discharge section, installed below the document reading section, for discharging the sheet of paper bearing an image formed in the image-forming section;

a first paper transport path for transporting the sheet of paper from the image-forming section to the first paper-discharge section;

a paper post-treatment section for carrying out a post-treatment including a stapling process on sheets of paper bearing images formed in the image-forming section; and a second paper transport path and a third paper transport path that are formed between the document reading section and the first paper-discharge section, and branched from the first paper transport path as two paths so as to respectively direct sheets of paper to a second paper-discharge section and a third paper-discharge section that are formed on the side face side of the apparatus main body in a separated manner from the first paper-discharge section, wherein: a diverging means for allowing a sheet of paper transported through the first paper transport path to diverge to either the second or the third transport path is installed, and the diverging means is constituted by three concatenation rollers that are rotatable forwardly as well as reversely, and that selectively transport a sheet of paper from the image-forming section to either the second or third paper transport path depending on their rotation directions.

17. The image-forming apparatus as defined in claim 16, wherein a transport member, which transports a sheet of paper by blocking either the second transport path or the third transport path while the other transport path being opened depending on the rotation directions of the three concatenation rollers, is installed.

18. The image-forming apparatus as defined in claim 17, wherein the transport member is constituted by a first gate member having one end thereof connected and secured to the rotation shaft of the center roller of the three concatenation rollers and a second gate member that is connected to the other end of the first gate member with a virtually center portion thereof being supported on a fixed shaft so as to freely pivot thereon.

19. The image-forming apparatus as defined in claim 17, wherein: the transport member is constituted by a first gear formed on the rotation shaft of the center roller of the three concatenation rollers, a second gear that engages the first gear, and a paper separation gate that is formed on the second gear and that is allowed to pivot toward the side opposite to the rotation direction of the first gear.

20. The image-forming apparatus as defined in claim 16, wherein the transport path from the three concatenation rollers to paper transport rollers installed in the third paper transport path is formed with an inclination that allows a sheet of paper to drop by gravity, and the distance from the nip sections of the three concatenation rollers to a nip section of the paper transport rollers is set to a paper size that allows post-treatments.

21. The image-forming apparatus as defined in claim 20, wherein, when a sheet of paper having a size smaller than the size that allows post-treatments is transported between a nip section of the three concatenation rollers and a nip section of the paper transport rollers, the sheet of paper is allowed to pass through another nip section of the three concatenation rollers by the rotation of the center roller, and directed to the second paper transport path.

22. An image-forming apparatus comprising:

a document reading section for reading image information from a document;

an image-forming section for forming an image on a sheet of paper based upon the image information of the document read by the document reading section;

a space section formed below the document reading section, which accommodates the image-forming section and serves as a discharge section to which the sheet of paper bearing the image formed in the image-forming section is discharged, the space section being surrounded by peripheral walls of an apparatus main body including the image-forming section;

a paper post-treatment section that subjects the sheet of paper bearing the image to post-treatments including an adjustment process and a stapling process in a virtually horizontal state, and that is placed between the document reading section and the space section, wherein in the paper post-treatment section is installed a switch back mechanism which, upon forming images on the two sides of a sheet of paper, again transports the sheet of paper bearing an image on one side thereof to the image-forming section, wherein the paper post-treatment section comprises:

a paper tray on which the sheet of paper bearing an image formed in the image-forming section is stacked; and a staple unit for adjusting and stapling sheets of paper stacked on the paper tray, wherein the staple unit includes a stopper which is allowed to contact the edge of the sheet of paper in a transporting direction so as to adjust the sheet of paper upon adjusting the sheet of paper placed on the paper tray, and a fixed wall which is allowed to contact the sheet of paper in the direction orthogonal to the transporting direction of the sheet of paper so as to adjust the sheet of paper, the stopper and the fixed wall being attached to a same member.

23. The image-forming apparatus as defined in claim 22, wherein an escape path for transporting sheets of paper that are not to be post-treated and a staple tray that transports sheets of paper to be post-treated, are installed in the paper post-treatment section, and a switch back mechanism, which reverses a sheet of paper bearing an image on one side and transports it again to the image-forming section so as to form an image on the side bearing no image, is installed in each of the escape path and the staple tray.

24. The image-forming apparatus as defined in claim 23, wherein, in the case when the switch back mechanism of the escape path is utilized, the rear edge of a sheet of paper bearing an image on one side thereof is chucked by paper transport rollers installed inside the escape path, and the sheet of paper is switched back sheet by sheet by reversely rotating the paper transport rollers.

25. The image-forming apparatus as defined in claim 23, wherein, in the case when the switch back mechanism of the escape path is utilized, after a predetermined number of sheets of paper bearing images on one side thereof have been stored on the staple tray, the sheets of paper stacked on the staple tray are switched back successively.

26. The image-forming apparatus as defined in claim 23, wherein an adjustment member for adjusting an edge of the sheet of paper on the side opposite to a post-treatment direction is placed in the staple tray in a manner so as to shift in the paper transporting direction.

27. An image-forming apparatus comprising:

a document reading section for reading image information from a document;

an image-forming section for forming an image on a sheet of paper based upon the image information of the document read by the document reading section;

a space section formed below the document reading section, which accommodates the image-forming section and serves as a discharge section to which the sheet of paper bearing the image formed in the image-forming section is discharged, the space section being surrounded by peripheral walls of an apparatus main body including the image-forming section;

a paper post-treatment section that subjects the sheet of paper bearing the image to post-treatments including an adjustment process and a stapling process in a virtually horizontal state, and that is placed between the document reading section and the space section, wherein: the paper post-treatment section has an escape path for transporting sheets of paper that are not to be post-treated and a staple tray for transporting sheets of paper that are to be post-treated, and the escape path has an arrangement in which a plurality of paper transport members, each consisting of a paper conveyor belt and a pair of rollers, are aligned in the paper transporting direction, and each paper transport member is placed so as to pivot toward the staple tray side on a roller as a fulcrum located on the side opposite to the paper transporting direction.

28. The image-forming apparatus as defined in claim 27, wherein, when a sheet of paper is transported through the escape path, each of the paper transport members is maintained at a home position, which allows the paper transport belt to be maintained in a virtually horizontal state, and upon receipt of a request for the stapling process, it is allowed to pivot toward the staple tray side.

29. The image-forming apparatus as defined in claim 27, wherein pivotal positions of the respective paper transport members are switched depending on the sizes of sheets of paper.

30. The image-forming apparatus as defined in claim 27, wherein, when the paper transport member has pivoted toward the staple tray side, the paper conveyor belt is allowed to rotate in the paper transporting direction while kept in contact with the staple tray.

31. The image-forming apparatus as defined in claim 30, wherein among the paper transport members that have pivoted toward the staple tray side, the paper transport member located on the farthest upstream side is set to have an angle not more than 90 degrees with respect to a paper bearing plane of the staple tray.

32. The image-forming apparatus as defined in claim 30, wherein the paper conveyor belt of each of the paper transport members is allowed to rotate forwardly as well as reversely.

33. An image-forming apparatus comprising:

a document reading section for reading image information from a document;

an image-forming section for forming an image on a sheet of paper based upon the image information of the document read by the document reading section;

a space section formed below the document reading section, which accommodates the image-forming section and serves as a discharge section to which the sheet of paper bearing the image formed in the image-forming section is discharged, the space section being surrounded by peripheral walls of an apparatus main body including the image-forming section; and a paper post-treatment section that subjects the sheet of paper bearing the image to post-treatments including an adjustment process and a stapling process in a virtually horizontal state, and that is placed between the document reading section and the space section, wherein: the paper post-treatment section has an escape path for transporting sheets of paper that are not to be post-treated and a staple tray for transporting sheets of paper that are to be post-treated, and the escape path and the staple tray are arranged so as to be opened in a direction perpendicular to the paper transporting direction on the end portion as a fulcrum on the side opposite to an operation face used by an operator.

34. The image-forming apparatus as defined in claim 33, wherein the escape path and the staple tray are opened simultaneously within the space section formed below the document reading section.

35. The image-forming apparatus as defined in claim 33, wherein: the escape path is placed on an upper face side of the staple tray, and a lower face member of the escape path and an upper member of the staple tray are constituted by a common member, the common member being arranged so as to pivot toward the escape path side so that only the staple tray is opened at the time when the escape path and the staple tray are maintained in an openable state.

36. The image-forming apparatus as defined in claim 33, wherein: the escape path is placed on an upper face side of the staple tray, and a lower face member of the escape path and an upper member of the staple tray are constituted by a common member, the common member being provided with a jam detection mechanism which carries out jam detection in the staple tray and the escape tray by using a single sensor.

37. The image-forming apparatus as defined in claim 36, wherein the sensor is constituted by an optical light-emitting section, a light-receiving section for receiving light directed from the light-emitting section, and an arm member which is allowed to block the light-receiving section when a sheet of paper being transported comes into contact therewith.

38. The image-forming apparatus as defined in claim 37, wherein the arm member is placed in a manner so as to freely pivot on a fulcrum formed on the common member so that one end thereof is allowed to contact a sheet of paper being transported with the other end being allowed to pivot on the fulcrum to block the light-receiving section.

39. An image-forming apparatus comprising:

a document reading section for reading image information from a document;

an image-forming section for forming an image on a sheet of paper based upon the image information of the document read by the document reading section;

a paper post-treatment section that is attached to the apparatus main body including the image-forming section and that subjects the sheet of paper bearing the image to post-treatments including an adjustment process and a stapling process;

a space section formed below the document reading section, which is surrounded by peripheral walls of the apparatus main body, and serves as a discharge section for discharging the sheet of paper bearing the image formed in the image-forming section; and a relay transport path for transporting the sheet of paper from the image-forming section to the paper post-treatment section, which is installed between the document reading section and the space section, wherein the relay transport path is installed so as to be openable downward in a direction perpendicular to the paper transporting direction at the end portion serving as a fulcrum on the side opposite to the face of the apparatus to which an operator attends.

40. The image-forming apparatus as defined in claim 39, wherein: the relay transport path is allowed to accommodate sheets of paper bearing images formed on one side thereof in the image-forming section, and a switch back mechanism, which again transports the sheets of paper to the image-forming section so as to form images on the other side bearing no images, is installed.

41. The image-forming apparatus as defined in claim 39, wherein a jam detection means for detecting a paper jam in the relay transport path is installed in the relay transport path.

42. The image-forming apparatus as defined in claim 39, wherein the relay transport path is provided as a unit part that is detachably attached to the apparatus main body.

43. An image-forming apparatus comprising:

a document reading section for reading image information from a document;

an image-forming section for forming an image on a sheet of paper based upon the image information of the document read by the document reading section;

a paper post-treatment section that is attached to the apparatus main body including the image-forming section and that subjects the sheet of paper bearing the image to post-treatments including an adjustment process and a stapling process;

a space section formed below the document reading section, which is surrounded by peripheral walls of the apparatus main body, and serves as a discharge section for discharging the sheet of paper bearing the image formed in the image-forming section; and a relay transport path for transporting the sheet of paper from the image-forming section to the paper post-treatment section, which is installed on a rear face of the document reading section, wherein the relay transport path is installed so as to be openable downward in a direction perpendicular to the paper transporting direction at the end portion serving as a fulcrum on the side opposite to the face of the apparatus to which operator attends.

44. The image-forming apparatus as defined in claim 43, wherein: the relay transport path is allowed to accommodate sheets of paper bearing images formed on one side thereof in the image-forming section, and a switch back mechanism, which again transports the sheets of paper to the image-forming section so as to form images on the other side bearing no images, is installed.

45. The image-forming apparatus as defined in claim 43, wherein a jam detection means for detecting a paper jam in the relay transport path is installed in the relay transport path.

46. The image-forming apparatus as defined in claim 43, wherein the relay transport path is provided as a unit part that is detachably attached to the apparatus main body.

47. An image-forming apparatus comprising:

a document reading section for reading image information from a document;

an image-forming section for forming an image on a sheet of paper based upon the image information of the document read by the document reading section;

a paper post-treatment section that is attached to the apparatus main body including the image-forming section and that subjects the sheet of paper bearing the image to post-treatments including an adjustment process and a stapling process;

a space section formed below the document reading section, which is surrounded by peripheral walls of the apparatus main body, and serves as a discharge section for discharging the sheet of paper bearing the image formed in the image-forming section; and a relay transport path for transporting the sheet of paper from the image-forming section to the paper post-treatment section, which is installed on a face of the document reading section on the side opposite to a document platen on which a document is placed, wherein the relay transport path is installed so as to be openable downward in a direction perpendicular to the paper transporting direction at the end portion serving as a fulcrum on the side opposite to the face of the apparatus to which an operator attends.

48. The image-forming apparatus as defined in claim 47, wherein: the relay transport path is allowed to accommodate sheets of paper bearing images formed on one side thereof in the image-forming section, and a switch back mechanism, which again transports the sheets of paper to the image-forming section so as to form images on the other side bearing no images, is installed.

49. The image-forming apparatus as defined in claim 47, wherein a jam detection means for detecting a paper jam in the relay transport path is installed in the relay transport path.

50. The image-forming apparatus as defined in claim 47, wherein the relay transport path is provided as a unit part that is detachably attached to the apparatus main body.

51. A paper post-treatment device, which adjusts a plurality of sheets of paper transported thereto on an adjustment tray, and sends the sheets of paper out as a set of sheets of paper, comprising:

a leading-edge adjusting transport device that is constituted by a leading-edge adjusting section which stops at a predetermined position to block the transport path, thereby arranging the leading edges of a plurality of sheets of paper being transported; and a transport section which also serves as at least one portion of a transport means for transporting a set of sheets of paper toward the downstream side, and is allowed to contact the set of sheets of paper in place of the leading-edge adjusting section when the leading-edge adjusting section has been shifted from the predetermined position so as to open the transport path, thereby allowing the transport means to shift to a state ready for transportation, the leading-edge adjusting section and the transport section being integrally formed thereon.

52. The paper post-treatment device as defined in claim 51, wherein the leading-edge adjusting transport device is provided as a transport roller having a cut-out section that is formed by cutting out a cylindrical shape by two planes that intersect each other along a cross line parallel to the center axis of the cylindrical shape with an angle of not less than 90 degrees from the outer circumferential face to the cross line.

53. The paper post-treatment device as defined in claim 52, wherein a height of the wall face of the cut-out section with which sheets of paper come into contact with is set to be greater than the thickness of a maximum amount of sheets of paper that are allowed to store at the time of a post treatment process.

54. The paper post-treatment device as defined in claim 52, wherein the length in the rotation direction of a portion having a curvature of an outer circumferential face of the transport roller is set in such a manner that, within one rotation of the transport roller, the set of sheets of paper is allowed to reach a transporting force applying means that is installed on the downstream side of the transport roller and that further transports the set of sheets of paper downstream side.

55. The paper post-treatment device as defined in claim 52, wherein a rotative driving operation of the transport roller is stopped when a paper-contacting wall face of the cut-out section has arrived at a leading-edge adjusting position.

56. The paper post-treatment device as defined in claim 51, wherein: the transport means comprises a transport roller placed on the rear side of the adjustment tray and a driven roller which transports the set of sheets of paper toward the downstream side while sandwiching the set of sheets of paper between it and the transport roller and the leading-edge adjusting transport device comprises a movable gate that is movable between a protruding position at which a wall face thereof perpendicular to the transporting direction is allowed to protrude toward the surface side of an upper face of the adjustment tray and a shelter position at which it retreats on the rear side of the upper face of the adjustment tray, and a driven roller holder that is connected to the movable gate on the rear side of the upper face of the adjustment tray and that reaches the surface side from both of the ends in the width direction of the adjustment tray so as to hold the rotation shaft of the driven roller, the driven roller holder being shifted so that the driven roller is separated from the set of sheets of paper being transported when the movable gate shifts toward the protruding position, the driven roller also being shifted to a position where it holds the rotation shaft so as to press the set of sheets of paper to the transport roller when the movable gate shifts toward the shelter position.

57. The paper post-treatment device as defined in claim 56, wherein the driven roller holder holds the rotation shaft through a spring that presses the driven roller onto the transport roller.

58. The paper post-treatment device as defined in claim 56, wherein the driven roller holder is formed by a sponge material.

* * * * *